US008223091B2

(12) United States Patent
Ishihara et al.

(10) Patent No.: US 8,223,091 B2
(45) Date of Patent: Jul. 17, 2012

(54) IMAGE DISPLAY APPARATUS, ELECTRONIC APPARATUS, LIQUID CRYSTAL TV, LIQUID CRYSTAL MONITORING APPARATUS, IMAGE DISPLAY METHOD, DISPLAY CONTROL PROGRAM, AND COMPUTER-READABLE RECORDING MEDIUM

(75) Inventors: Tomoyuki Ishihara, Tenri (JP); Akihiko Inoue, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 1261 days.

(21) Appl. No.: 10/989,583

(22) Filed: Nov. 17, 2004

(65) Prior Publication Data

US 2005/0162360 A1 Jul. 28, 2005

(30) Foreign Application Priority Data

Nov. 17, 2003 (JP) ..... 2003-387269
Nov. 16, 2004 (JP) ..... 2004-332509

(51) Int. Cl.
*G09G 3/28* (2006.01)

(52) U.S. Cl. ..... 345/63; 345/72

(58) Field of Classification Search ..... 345/63, 345/72, 101, 691–693
See application file for complete search history.

(56) References Cited

U.S. PATENT DOCUMENTS 6,088,012 A 7/2000 Shigeta et al.
6,208,467 B1 3/2001 Naka et al.
6,417,835 B1 7/2002 Otobe et al.
7,084,861 B2 * 8/2006 Iisaka ..... 345/204
2002/0003520 A1 1/2002 Aoki
2002/0191008 A1 12/2002 Naka et al.
2003/0006952 A1 1/2003 Hong
2003/0011614 A1 1/2003 Itoh et al.
2004/0196233 A1 * 10/2004 Shimizu ..... 345/89

FOREIGN PATENT DOCUMENTS

JP 2001-296841 10/2001
JP 2002-023707 1/2002
JP 2004-240317 8/2004
JP 2004-302270 10/2004
JP 2005-173573 6/2005

OTHER PUBLICATIONS

Japanese Office Action for corresponding application.
Search Report for corresponding European application dated Feb. 2, 2007.
European Office Action dated Mar. 8, 2010.
Japanese Office Action dated Sep. 21, 2011.

* cited by examiner

*Primary Examiner* — Ke Xiao
(74) *Attorney, Agent, or Firm* — Harness, Dickey & Pierce, P.L.C.

(57) ABSTRACT

An image display apparatus is provided for performing image display by dividing one frame period into a plurality of sub-frame periods, determining a gradation level of each of the sub-frame periods in accordance with a gradation level of an input image signal and supplying the determined gradation level to an image display section. The image display apparatus comprises a display control section, wherein the display control section supplies a relatively largest gradation level in a relatively central sub-frame period which is at a time-wise center or closest to the time-wise center of one frame period, and supplies a sequentially lowered gradation level in a sub-frame period which is sequentially farther from the relatively central sub-frame period.

1 Claim, 70 Drawing Sheets

Sub frame period α is assigned to 1st sub frame period.

Sub frame period β is assigned to 1st sub frame period.

FIG.71

(q)

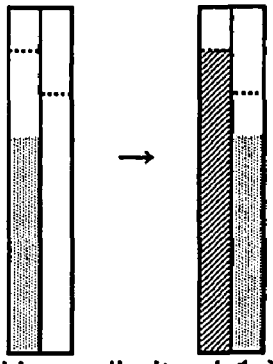

Upper limit L1 > L2

(r)

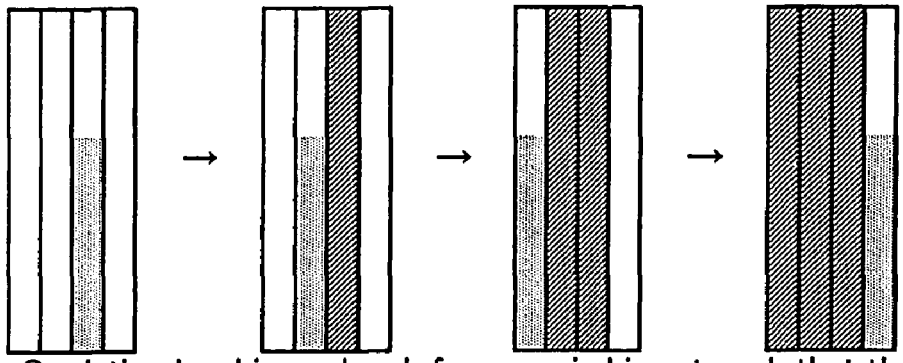

Gradation level in each sub frame period is set such that the relationship between the gradation level of the input image signal and the time-integrated luminance exhibits an appropriate gamma luminance characteristic.

(s)

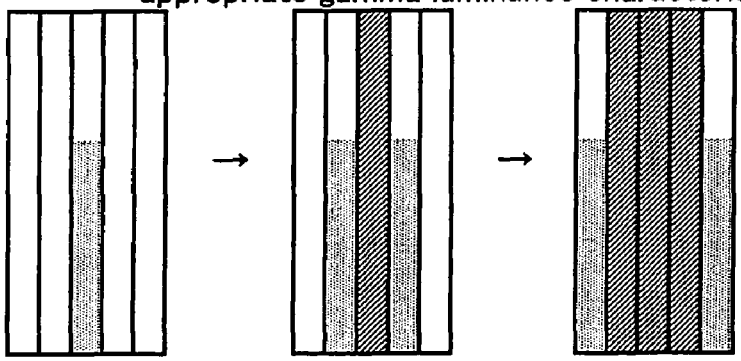

Threshold level < T1 T1 < Threshold level < T2 T2 < Threshold level

Threshold level acting as reference for the gradation level and the gradation level in each sub frame period are set such that the relationship between the gradation level of the input image signal and the time-integrated luminance exhibits an appropriate gamma luminance characteristic.

IMAGE DISPLAY APPARATUS, ELECTRONIC APPARATUS, LIQUID CRYSTAL TV, LIQUID CRYSTAL MONITORING APPARATUS, IMAGE DISPLAY METHOD, DISPLAY CONTROL PROGRAM, AND COMPUTER-READABLE RECORDING MEDIUM

This non-provisional application claims priority under 35 U.S.C., §119(a), on Patent Application No. 2003-387269 filed in Japan on Nov. 17, 2003, and Patent Application No. 2004-332589 filed in Japan on Nov. 16, 2004, the entire contents of which are hereby incorporated by reference.

BACKGROUND OF THE INVENTION

1. Field of the Invention

The present invention relates to an image display apparatus using a hold-type display device such as, for example, a liquid crystal display device or an EL (electroluminescence) display device; an electronic apparatus, a liquid crystal TV, a liquid crystal monitoring apparatus, which use such an image display apparatus for a display section; an image display method performing image display using such an image display apparatus; a display control program for allowing a computer to execute the image display method; and a computer-readable recording medium having the display control program recorded thereon.

2. Description of the Related Art

Conventional image display apparatuses are roughly classified into impulse-type display apparatuses such as CRTs (cathode ray tubes), film projectors and the like; and hold-type display apparatuses using hold-type display devices such as liquid crystal display devices, EL display devices and the like mentioned above.

In impulse-type display apparatuses, a light-on period in which an image is displayed and a light-off period in which no image is displayed are alternately repeated. It is considered that human eyes perceive, as the brightness, a luminance obtained by time integration of a luminance change of an image which is actually displayed on the screen during a period of about several frames. Therefore, human eyes can observe, with no unnatural feeling, an image displayed by an image display apparatus, such an impulse-type image display apparatus, in which the luminance changes within a short period of one frame or less.

FIG. 46 shows a luminance change in accordance with time of one horizontal line in a screen when an object horizontally moves with a still background in a conventional impulse-type image display apparatus. In FIG. 46, the horizontal axis represents the luminance state in the horizontal direction of the screen (the position of the pixel portion in the horizontal direction), and the vertical axis represents the time. FIG. 46 shows images displayed on the screen in three frames.

In FIG. 46, each one-frame period T101 is a cycle by which the image is updated. In the impulse-type image display apparatus shown in FIG. 46, a light-on period T102 is at the beginning of each one-frame period T101. A light-off period T103 follows the light-on period T102 until the image is updated in the next frame. In the light-off period T103, the luminance is minimum.

Regarding the display state of one horizontal line, a display portion A of the moving object is sandwiched between display portions B of the still background. Each time the image is updated frame by frame, the display portion A moves rightward.

The observer's eye paying attention to the display portion A follows the display portion A and thus moves in the direction represented by the oblique thick arrow. A value obtained by time integration of a luminance change in the direction of the movement of the object is perceived as the brightness by the human eye.

FIG. 47 shows the distribution in brightness of the image shown in FIG. 46 which is viewed by the observer's eye paying attention to the moving object.

In the case of the impulse-type image display apparatus, the period from an image update to the next image update is mostly a light-off period T103. The luminance in the light-off period T103, which is sufficiently low, does not contribute to the time-integrated luminance (value of the vertical axis). As a result, the observer's eye clearly views the difference in brightness at the border between the still background and the moving object. Therefore, the observer's eye can clearly distinguish the object from the background.

It is considered that hold-type image display apparatuses are inferior to the impulse-type image display apparatuses in the quality of moving images. This will be described in detail below.

FIG. 48 shows a luminance change in accordance with time of one horizontal line in a screen when an object horizontally moves with a still background in a general conventional hold-type image display apparatus. In FIG. 48, the horizontal axis represents the luminance state in the horizontal direction of the screen (the position of the pixel portion in the horizontal direction), and the vertical axis represents the time. FIG. 48 shows images displayed on the screen in three frames.

In FIG. 48, unlike in FIG. 46, each one-frame period T101 is entirely a light-on period T102. No light-off period is provided.

FIG. 49 shows the distribution in brightness of the image shown in FIG. 48 which is viewed by the observer's eye paying attention to the moving object.

Since the one-frame period T101 is entirely a light-on period T102, the object is displayed as remaining at the same position from an image update until the next image update. As a result, the value obtained by time integration of a luminance change in the direction of the movement of the object does not reflect the difference in brightness at the border between the still background and the moving object. Therefore, the observers eye views the border as a movement blur. This is one cause of the poor image quality of general conventional hold-type image display apparatuses.

One solution to this problem of the hold-type image display apparatuses is to reduce the duration of the light-on period to about half and provide a period in which image display is performed at the minimum luminance level (minimum luminance period). Hereinafter, this system will be referred to as the "minimum (luminance) insertion system".

FIG. 50 shows a luminance change in accordance with time of one horizontal line in a screen when an object horizontally moves with a still background in a conventional hold-type image display apparatus which adopts the minimum (luminance) insertion system. In FIG. 50, the horizontal axis represents the luminance state in the horizontal direction of the screen (the position of the pixel portion in the horizontal direction), and the vertical axis represents the time. FIG. 50 shows images displayed on the screen in three frames.

In FIG. 50, unlike in FIG. 48, each one-frame period T101 includes a ½-frame light-off period (or a minimum luminance period or a minimum (luminance) insertion period) T103.

FIG. 51 shows the distribution in brightness of the image shown in FIG. 50 which is viewed by the observer's eye paying attention to the moving object.

FIG. 51 shows that the movement blur is alleviated, as compared with the general conventional hold-type image display apparatus shown in FIG. 49.

However, in the conventional hold-type image display apparatus which adopts the minimum (luminance) insertion system, each one-frame period includes a minimum luminance period (or a minimum (luminance) insertion period or a light-off period) even when the image display is performed at the maximum gradation level. Therefore, the maximum luminance perceived by the observer's eye is half of that in the general conventional hold-type image display apparatuses which do not adopt the minimum (luminance) insertion system.

Especially when a display device, such as an EL display device, which spontaneously emits light, is used for such a hold-type image display apparatus, the reduction in the maximum luminance is inevitable as compared with the general conventional hold-type image display apparatuses which do not adopt the minimum (luminance) insertion system.

Another solution to the problem of movement blur has been proposed for transmissive display devices such as transmissive liquid crystal display devices and the like. According to the proposed solution, the luminance of the backlight is increased in order to guarantee approximately the same level of maximum luminance as that of the general conventional hold-type image display apparatuses which do not adopt the minimum (luminance) insertion system.

This proposed solution has the following drawbacks. First, the power consumption of the backlight is raised. Second, even while the image display is performed at the minimum luminance (black period), the light from the backlight can be transmitted through the display device. Therefore, the minimum luminance level cannot be approximately the same as that of the hold-type image display apparatuses which do not adopt the minimum (luminance) insertion system. As a result, the contrast is reduced.

Japanese Laid-Open Publication No. 2001-296841 proposes the following image display method by claims 27 through 41 in order to improve the quality of moving images by, for example, solving the problem of movement blur while guaranteeing approximately the same level of maximum luminance as that of the general conventional hold-type image display apparatuses which do not adopt the minimum (luminance) insertion system. A specific method for driving the display device and providing an image signal of a certain gradation level is described in example 7 of Japanese Laid-Open Publication No. 2001-296841 in detail. Japanese Laid-Open Publication No. 2001-296841 is entirely incorporated herein for reference.

According to the image display method proposed by Japanese Laid-Open Publication No. 2001-296841, one frame of image display is performed using two sub frame periods, i.e., the first sub frame period and the second sub frame period. When the gradation level of an input image signal is 0% or greater and less than 50%, an image signal of a gradation level of 0% to 100% is supplied in the first sub frame period, and an image signal of a gradation level of 0% is supplied in the second sub frame period. When the gradation level of the input image signal is 50% or greater and less than 100%, an image signal of a gradation level of 0% to 100% is supplied in the first sub frame period, and an image signal of a gradation level of 100% is supplied in the second sub frame period.

FIG. 52 shows a luminance change in accordance with time of one horizontal line in a screen when an object horizontally moves with a still background in a conventional hold-type image display apparatus disclosed by Japanese Laid-Open Publication No. 2001-296841. In FIG. 52, the horizontal axis represents the luminance state in the horizontal direction of the screen (the position of the pixel portion in the horizontal direction), and the vertical axis represents the time. FIG. 52 shows images displayed on the screen in three frames.

In FIG. 52, unlike in FIG. 48, each one-frame period T101 includes two sub frame periods T201 and T202.

This will be described in more detail. As shown in FIG. 52, for a display portion B of the still background, the gradation level of an input image signal is low. Therefore, the display portion B is in a light-on state only in the first sub frame period T201 and is in a light-off state (0%) in the second sub frame period T202. For a display portion A of the moving object, the gradation level of the input image signal is sufficiently high. Therefore, the display portion A is in a light-on state at the maximum luminance (100%) in the second sub frame period T202, and is in a light-on state at the luminance of 20% with an image signal of a gradation signal of 0% to 100% in the first sub frame period T201. The numerals with "%" represent the luminance level of the image with respect to the maximum display ability of 100%. For example, the numeral surrounded by the dotted line for B1 represents the luminance of 40%.

Such an image display method can guarantee approximately the same level of maximum luminance and contrast as those of the conventional hold-type image display apparatuses which do not adopt the minimum (luminance) insertion system, and also can improve the quality of moving images where the gradation level of the input image signal is sufficiently low.

Japanese Laid-Open Publication No. 2002-23707 discloses another method for suppressing the reduction in luminance of the hold-type image display apparatuses which adopt the minimum (luminance) insertion system. According to the method disclosed by Japanese Laid-Open Publication No. 2002-23707, a one-frame period includes a plurality of sub frame periods, and the luminance of one of the latter frames is attenuated at a prescribed ratio in accordance with the luminance of an input image signal. Therefore, the movement blur which is visually perceived in the general conventional hold-type image display apparatuses can be prevented. Since the luminance of one of the latter sub frame periods is attenuated as described above and thus is not 0%, the reduction in luminance can be suppressed as compared with the conventional hold-type image display apparatuses which adopt the minimum (luminance) insertion system as shown in FIGS. 50 and 51.

For displaying an image of an object moving horizontally with a still background, the conventional image display apparatus disclosed by Japanese Laid-Open Publication No. 2001-296841 can provide substantially the same effect as that of the conventional hold-type image display apparatus which adopts the minimum (luminance) insertion system shown in FIGS. 50 and 51, as long as the gradation level of the input image signal is sufficiently low. However, when the gradation level of the input image signal is high, the following problems occur.

FIG. 53 shows the distribution in brightness of the image shown in FIG. 52 which is viewed by the observer's eye paying attention to the moving object.

As shown in FIG. 53, a portion of the image is brighter than the original image and another portion of the image is darker than the original image. As a result, the observer's eye views abnormally bright and abnormally dark portions at the leading end or the trailing end of the moving object, which are not viewed in a still image. This lowers the quality of moving images.

The reason why such abnormally bright and abnormally dark portions are viewed is that the time-wise center of gravity of the light-on period is significantly different between when the gradation level of the input image signal is less than 50% and when the gradation level of the input image signal is 50% or greater. For example, when the gradation level of the input image signal is less than 50%, the time-wise center of gravity of luminance in the light-on period is the first sub frame period T201 since an image signal of a gradation level of 0% is supplied in the second sub frame period T202. When the gradation level of the input image signal is 50% or greater, the time-wise center of gravity of the light-on period (display luminance) is the second sub frame period T202 since an image signal of a gradation level of 100% is supplied in the second sub frame period T202. For this reason, abnormally bright and abnormally dark portions are viewed at the leading end or the trailing end of the moving object, in terms of the value obtained by time integration of a luminance change in the direction of the movement of the object.

Current general image signals, for example, TV broadcast signals, video reproduction signals, and PC (personal computer) image signals, are mostly generated and output in consideration of the gamma luminance characteristic of CRTs (cathode ray tubes). Display panels which use the hold-type display devices such as, for example, liquid crystal display devices and EL display devices generally have substantially the same gamma luminance characteristic as that of CRTs in order to be compatible with the general image signals.

FIG. 54 is a graph illustrating the relationship between the gradation level of an input image signal and the display luminance of a display panel having such a gamma luminance characteristic. As shown in FIG. 54, the relationship is represented by a curve which is generally concaved toward lower luminance. From this, it is understood that the point of luminance of 50% and the point of gradation level of 50% do not match each other.

FIG. 55 shows the relationship between the gradation level of an input signal and the time-integrated luminance corresponding to the brightness perceived by the observer's eye, when the display control as described in example 7 of Japanese Laid-Open Publication No. 2001-296841 is performed using a hold-type image display device having the gamma luminance characteristic.

In example 7 of Japanese Laid-Open Publication No. 2001-296841, when the gradation level of the input image signal is 50% or greater, an image signal is supplied in two sub frame periods (the first and second sub frame periods). By contrast, when the gradation level of the input image signal is less than 50%, an image signal is supplied in only one sub frame period (only in the first sub frame period). Therefore, the luminance characteristic curve has two concaves at the point of luminance of 50% in the center thereof. With such a luminance characteristic curve, an appropriate color reproducibility to a general input image signal cannot be realized.

The method disclosed by Japanese Laid-Open Publication 2002-23707 places the image into a light-on state in one of the latter sub frame periods of each one-frame period, and thus can suppress the reduction in luminance and contrast as compared with the general hold-type image display apparatus which adopt the minimum (luminance) insertion type shown in FIGS. 50 and 51. However, this method does not provide a significant effect for preventing the movement blur. In addition, the contrast obtained by this method is lower than that of the general conventional hold-type image display apparatuses.

SUMMARY OF THE INVENTION

According to a first aspect of the present invention, an image display apparatus is provided for performing image display by dividing one frame period into a plurality of sub-frame periods, determining a gradation level of each of the sub-frame periods in accordance with a gradation level of an input image signal and supplying the determined gradation level to an image display section. The image display apparatus comprises:

a display control section, wherein the display control section supplies a relatively largest gradation level in a relatively central sub-frame period which is at a time-wise center or closest to the time-wise center of one frame period, and supplies a sequentially lowered gradation level in a sub-frame period which is sequentially farther from the relatively central sub-frame period.

In one embodiment of the first aspect of the present invention, when the gradation of the input image signal is relatively smallest, the display control section supplies a relatively smallest gradation level to all the sub-frame periods; and when the gradation of the input image signal is relatively largest, the display control section supplies a relatively largest gradation level to all the sub-frame periods.

In one embodiment of the first aspect of the present invention, the display control section performs image display by the image display section by controlling the gradation level supplied in each sub-frame period, such that a time-integrated value of luminance corresponding to the input image signal represents a prescribed luminance characteristic.

According to a second aspect of the present invention, an image display apparatus is provided for performing one frame of image display by a sum of time-integrated values of luminance displayed in an image display section inn sub-frame periods (where n is an integer of 2 or greater). The image display apparatus comprises:

a display control section for performing the n sub-frame periods of image display control on the image display section in each one-frame period, wherein:

in a relatively central sub-frame period which is at a time-wise center, or closest to the time-wise center, of one frame period for image display, the display control section supplies, to the image display section, an image signal of a relatively largest gradation level within the range in which a sum of time-integrated value of luminance in the n sub-frame periods does not exceed the luminance level corresponding to the gradation level of an input image signal;

when the sum of time-integrated values of luminance in the relatively central sub-frame period does not reach the luminance level corresponding to the gradation level of the input image signal, the display control section supplies, to the image display section, an image signal of the relatively largest gradation level within the range in which the sum of time-integrated values of luminance in the n sub-frame periods does not exceed the luminance level corresponding to the gradation level of the input image signal, in each of a preceding sub-frame period before the central sub-frame period and a subsequent sub-frame period after the central sub-frame period;

when the sum of time-integrated values of luminance in the relatively central sub-frame period, the preceding sub-frame period and the subsequent sub-frame period still do not reach the luminance level corresponding to the gradation level of the input image signal, the display control section supplies, to the image display section, an image signal of the relatively largest gradation level within the range in which the sum of time-integrated values of luminance in the n sub-frame periods does not exceed the luminance level corresponding to the gradation level of the input image signal, in each of a sub-frame period before the preceding sub-frame period and a sub-frame period after the subsequent sub-frame period;

the display control section repeats the operation until the sum of time-integrated values of luminance in all the sub-frame periods in which the image signals have been supplied reaches the luminance level corresponding to the gradation level of the input image signal; and when the sum reaches the luminance level corresponding to the gradation level of the input image signal, the display control section supplies, to the image display section, an image signal of a relatively smallest gradation level or an image signal of a gradation level lower than a prescribed value in the remaining sub-frame periods.

According to a third aspect of the present invention, an image display apparatus is provided for performing one frame of image display by a sum of time-integrated values of luminance displayed in an image display section in n sub-frame periods (where n is an odd number of 3 or greater). The image display apparatus comprises:

a display control section for performing the n sub-frame periods of image display control on the image display section in each one-frame period, wherein:

the sub-frame periods are referred to as a first sub-frame period, a second sub-frame period, . . . the n'th sub-frame period from the sub-frame period which is earliest in terms of time or from the sub-frame period which is latest in terms of time; and the sub-frame period which is at a time-wise center of one frame period for image display is referred to as the m'th sub-frame period, where m=(n+1)/2;

(n+1)/2-number of threshold levels are provided for the gradation level of an input image signal, and the threshold levels are referred to as T1, T2, . . . T[(n+1)/2] from the smallest threshold level;

when the gradation level of the input image signal is equal to or less than T1, the display control section supplies, to the image display section, an image signal of a gradation level which is increased or decreased in accordance with the gradation level of the input image signal in the m'th sub-frame period, and an image signal of a relatively smallest gradation level or an image signal lower than a prescribed value in the other sub-frame periods;

when the gradation level of the input image signal is greater than T1 and equal to or less than T2, the display control section supplies, to the image display section, an image signal of a relatively largest gradation level or an image signal of a gradation level greater than the prescribed value in the m'th sub-frame period, an image signal of a gradation level which is increased or decreased in accordance with the gradation level of the input image signal in each of the (m−1)'th sub-frame periods and the (m+1)'th sub-frame periods, and an image signal of the relatively smallest gradation level or an image signal of a gradation level lower then the prescribed value in the other sub-frame periods;

when the gradation level of the input image signal is greater than T2 and equal to or less than T3, the display control section supplies, to the image display section, an image signal of the relatively largest gradation level or an image signal of a gradation level greater than the prescribed value in each of the m'th sub-frame periods, the (m−1)'th sub-frame periods and the (m+1)'th sub-frame periods, an image signal of a gradation level which is increased or decreased in accordance with the gradation level of the input image signal in each of the (m−2)'th sub-frame periods and the (m+2)'th sub-frame periods, and an image signal of the relatively smallest gradation level or an image signal of a gradation level lower than the prescribed value in the other sub-frame periods; and in this manner, when the gradation level of the input image signal is greater than Tx−1 (x is an integer of 4 or greater) and equal to or less than Tx, the display control section supplies, to the image display section, an image signal of the relatively largest gradation level or an image of a gradation level greater than the prescribed value in each of the [m−(x−2)]'th sub-frame periods through the [m+(x−2)]'th sub-frame period, an image signal of a gradation level which is increased or decreased in accordance with the gradation level of the input image signal in each of the [m−(x−1)]'th sub-frame periods through the [m+(x−1)]'th sub-frame period, and an image signal of the relatively smallest gradation level or an image signal of a gradation level lower than the prescribed value in the other sub-frame periods.

According to a fourth aspect of the present invention, an image display apparatus is provided for performing one frame of image display by a sum of time-integrated values of luminance displayed in an image display section in n sub-frame periods (where n is an even number of 2 or greater). The image display apparatus comprises:

a display control section for performing the n sub-frame periods of image display control on the image display section in each one-frame period, wherein:

the sub-frame periods are referred to as a first sub-frame period, a second sub-frame period, . . . the n'th sub-frame period from the sub-frame period which is earliest in terms of time or from the sub-frame period which is latest in terms of time; and two sub-frame periods which are closest to a time-wise center of one frame period for image display are referred to as the mist sub-frame period and the m2nd sub-frame period, where m1=n/2 and m2=n/2+1;

n/2-number of threshold levels are provided for the gradation level of an input image signal, and the threshold levels are referred to as T1, T2, . . . T[n/2] from the smallest threshold level;

when the gradation level of the input image signal is equal to or less than T1, the display control section supplies, to the image display section, an image signal of a gradation level which is increased or decreased in accordance with the gradation level of the input image signal in each of the m1st sub-frame period and the m2nd sub-frame period, and an image signal of a relatively smallest gradation level or an image signal of a gradation level lower than a prescribed value in the other sub-frame periods;

when the gradation level of the input image signal is greater than T1 and equal to or less than T2, the display control section supplies, to the image display section, an image signal of a relatively largest gradation level or an image signal of a gradation level greater than the prescribed value in each of the mist sub-frame period and the m2nd sub-frame period, an image signal of a gradation level which is increased or decreased in accordance with the gradation level of the input image signal in each of the (m1−1)'th sub-frame period and the (m2+1)'th sub-frame period, and an image signal of the relatively smallest gradation level or an image signal of a gradation level lower than the prescribed value in the other sub-frame periods;

when the gradation level of the input image signal is greater than T2 and equal to or less than T3, the display control section supplies, to the image display section, an image signal of the relatively largest gradation level or an image signal of a gradation level greater than the prescribed value in each of the m1st sub-frame period, the m2nd sub-frame period, the (m1−1)'th sub-frame period and the (m2+1)'th sub-frame period, an image signal of a gradation level which is increased or decreased in accordance with the gradation level of the input image signal in each of the (m1−2)'th sub-frame period and the (m2+2)'th sub-frame period, and an image signal of the relatively smallest gradation level or an image signal of a gradation level lower than the prescribed value in the other sub-frame periods; and in this manner, when the gradation level of the input image signal is greater than Tx−1 (x is an integer of 4 or greater) and equal to or less than Tx, the display control section supplies, to the image display section, an image signal of the relatively largest gradation level or an image signal of a gradation level greater than the prescribed value in each of the [m1−(x−2)]'th sub-frame periods through the [m2+(x−2)]'th sub-frame period, an image signal of a gradation level which is increased or decreased in accordance with the gradation level of the input image signal in each of the [m1−(x−1)]'th sub-frame periods through the [m2+(x−1)]'th sub-frame period, and an image signal of the relatively smallest gradation level or an image signal of a gradation level lower than the prescribed value in the other sub-frame periods.

According to a fifth aspect of the present invention, an image display apparatus is provided for performing one frame of image display by a sum of time-integrated values of luminance displayed in an image display section in two sub-frame periods. The image display apparatus comprises:

a display control section for performing the two sub-frame periods of image display control on the image display section in each one-frame period, wherein:

one of the sub-frame periods is referred to as a sub-frame period α, and the other sub-frame period is referred to as a sub-frame period β;

when the gradation level of an input image signal is equal to or less than a threshold level uniquely determined, the display control section supplies, to the image display section, an image signal of a gradation level which is increased or decreased by the gradation level of the input image signal in the sub-frame period α, and an image signal of a relatively smallest gradation level or an image signal of a gradation level lower than a prescribed value in the sub-frame period β; and when the gradation level of the input image signal is greater than the threshold level, the display control section supplies, to the image display section, an image signal of a relatively largest gradation level or an image signal of a gradation level greater than the prescribed value in the sub-frame period α; and an image signal of a gradation level which is increased or decreased by the gradation level of the input image signal in the sub-frame period β.

According to a sixth aspect of the present invention, an image display apparatus is provided for performing one frame of image display by a sum of time-integrated values of luminance displayed in an image display section in two sub-frame periods. The image display apparatus comprises:

a display control section for performing the two sub-frame periods of image display control on the image display section in each one-frame period, wherein:

one of the sub-frame periods is referred to as a sub-frame period α, and the other sub-frame period is referred to as a sub-frame period β; and threshold levels, T1 and T2, of the gradation levels in the two sub-frame periods are defined, and the threshold level T2 is greater than the threshold level T1;

when the gradation level of an input image signal is equal to or less than the threshold level T1, the display control section supplies, to the image display section, an image signal of a gradation level which is increased or decreased in accordance with the gradation level of the input image signal in the sub-frame period α, and an image signal of a relatively smallest gradation level or an image signal of a gradation level lower than a prescribed value in the sub-frame period β;

when the gradation level of the input image signal is greater than the threshold level T1 and equal to or less than the threshold level T2, the display control section supplies, to the image display section, an image signal of a gradation level which is increased or decreased in accordance with the gradation level of the input image signal in the sub-frame period α, and an image signal of a gradation level which is lower than the gradation level supplied in the sub-frame period α and which is increased or decreased in accordance with the gradation level of the input image signal in the sub-frame period β; and when the gradation level of the input image signal is greater than the threshold level T2, the display control section supplies, to the image display section, an image signal of a relatively largest gradation level or an image signal of a gradation level which is greater than the prescribed value in the sub-frame period α, and an image signal of a gradation level which is increased or decreased in accordance with the gradation level of the input image signal in the sub-frame period β.

According to a seventh aspect of the present invention, an image display apparatus is provided for performing one frame of image display by a sum of time-integrated values of luminance displayed in an image display section in two sub-frame periods. The image display apparatus comprises:

a display control section for performing the two sub-frame periods of image display control on the image display section in each one-frame period, wherein:

one of the sub-frame periods is referred to as a sub-frame period α, and the other sub-frame period is referred to as a sub-frame period β; threshold levels, T1 and T2, of the gradation levels in the two sub-frame periods are defined, and the threshold level T2 is greater than the threshold level T1; and a gradation level L is uniquely determined;

when the gradation level of an input image signal is equal to or less than the threshold level T1, the display control section supplies, to the image display section, an image signal of a gradation level which is increased or decreased in accordance with the gradation level of the input image signal in the sub-frame period α, and an image signal of a relatively smallest gradation level or an image signal of a gradation level lower than a prescribed level in the sub-frame period β;

when the gradation level of the input image signal is greater than the threshold level T1 and equal to or less than the threshold level T2, the display control section supplies, to the image display section, an image signal of the gradation level L in the sub-frame period α, and an image signal of a gradation level which is increased or decreased in accordance with the gradation level of the input image signal in the sub-frame period β; and when the gradation level of the input image signal is greater than the threshold level T2, the display control section supplies, to the image display section, an image signal of a gradation level which is increased or decreased in accordance with the gradation level of the input image signal in the sub-frame period α, and an image signal of a relatively largest gradation level or an image signal of a gradation level greater than the prescribed value in the sub-frame period β.

According to an eighth aspect of the present invention, an image display apparatus is provided for performing one frame of image display by a sum of time-integrated values of luminance displayed in an image display section in two sub-frame periods. The image display apparatus comprises:

a display control section for performing the two sub-frame periods of image display control on the image display section in each one-frame period, wherein:

the display control section generates an image in an intermediate state in terms of time through estimation based on two frames of images continuously input;

one of the sub-frame periods is referred to as a sub-frame period α, and the other sub-frame period is referred to as a sub-frame period β;

in the sub-frame period α, when the gradation level of an input image signal is equal to or less than a threshold level uniquely determined, the display control section supplies, to the image display section, an image signal of a gradation level which is increased or decreased in accordance with the gradation level of the input image signal; and when the gradation level of the input image signal is greater than the threshold level, the display control section supplies, to the image display section, an image signal of a relatively largest gradation level or an image signal of a gradation level greater than a prescribed value; and in the sub-frame period β, when the gradation level of the image signal in the intermediate state is equal to or less than the threshold level, the display control section supplies, to the image display section, an image signal of a relatively smallest gradation level or an image signal of a gradation level lower than the prescribed value; and when the gradation level of the image signal in the intermediate state is greater than the threshold level, the display control section supplies, to the image display section, an image signal of a gradation level which is increased or decreased in accordance with the gradation level of the image signal in the intermediate state.

According to a ninth aspect of the present invention, an image display apparatus is provided for performing one frame of image display by a sum of time-integrated values of luminance displayed in an image display section in two sub-frame periods. The image display apparatus comprises:

a display control section for performing the two sub-frame periods of image display control on the image display section in each one-frame period, wherein:

one of the sub-frame periods is referred to as a sub-frame period α, and the other sub-frame period is referred to as a sub-frame period β;

in the sub-frame period α, when the gradation level of an input image signal is equal to or less than a threshold level uniquely determined, the display control section supplies, to the image display section, an image signal of a gradation level which is increased or decreased in accordance with the gradation level of the input image signal; and when the gradation level of the input image signal is greater than the threshold level, the display control section supplies, to the image display section, an image signal of a relatively largest gradation level or an image signal of a gradation level greater than a prescribed value; and in the sub-frame period β, when an average value of the gradation level of the image signal in the current frame period and the gradation level of an image signal input one frame before or one frame after is equal to or less than the threshold level, the display control section supplies, to the image display section, an image signal of a relatively smallest gradation level or an image signal of a gradation level lower than the prescribed value; and when the average value is greater than the threshold level, the display control section supplies, to the image display section, an image signal of a gradation level which is increased or decreased in accordance with the average value.

In one embodiment of the first aspect of the present invention, the sub-frame periods have an identical length to each other or different lengths from each other.

In one embodiment of the first aspect of the present invention, the display control section sets an upper limit of the gradation level of the image signal supplied in each sub-frame period.

In one embodiment of the first aspect of the present invention, where upper limits of the gradation levels of the image signals supplied in the first, second, . . . n'th sub-frame periods are respectively referred to as L1, L2, . . . Ln; and the sub-frame period which is at the time-wise the center, or closest to the time-wise center, of one frame period is referred to as the j'th sub-frame period, the display control section sets the upper limits so as to fulfill:

$$L[j-i] \geqq L[j-(i+1)];$$

$$L[j+i] \geqq L[j+(i+1)]$$

where i is an integer of 0 or greater and less than j.

In one embodiment of the first aspect of the present invention, the image display section sets the gradation level of the image signal supplied in each sub-frame period after being increased or decreased in accordance with the gradation level of the input image signal, such that the relationship between the gradation level of the input image signal and the time-integrated values of luminance during one frame period exhibits an appropriate gamma luminance characteristic.

In one embodiment of the first aspect of the present invention, the image display apparatus further comprises a gamma luminance characteristic setting section for externally setting the gamma luminance characteristic, wherein:

the display control section is capable of changing the gamma luminance characteristic which is externally set by the gamma luminance characteristic setting section.

In one embodiment of the first aspect of the present invention, the image display apparatus further comprises a temperature detection section for detecting a temperature of a display panel or the vicinity thereof, wherein:

in accordance with the temperature detected by the temperature detection section, the display control section sets the gradation level of the image signal supplied in each sub-frame period after being increased or decreased in accordance with the gradation level of the input image signal.

In one embodiment of the first aspect of the present invention, where the input image signal has a plurality of color components, the display control section sets the gradation level of the image signal supplied in each sub-frame period, such that the ratio between the luminance level displayed in each sub-frame period of a color other than a color having a highest gradation level of input image signal, is equal to the ratio between the luminance level displayed in each sub-frame period of the color having the highest gradation level of input image signal.

In one embodiment of the first aspect of the present invention, where the plurality of sub-frame periods are three or more sub-frame periods, the gradation level allocated to the central sub-frame period in one frame period is higher than the gradation levels allocated to the other sub-frame periods at ends of one frame period.

In one embodiment of the first aspect of the present invention, where the plurality of sub-frame periods are three or more sub-frame periods, the luminance level of the image signal allocated to the central sub-frame period in one frame period is higher than the luminance levels of the image signal allocated to the other sub-frame periods at ends of one frame period.

In one embodiment of the first aspect of the present invention, a time-wise center of gravity of time-integrated values of luminance in the plurality of sub-frame periods moves within one sub-frame period.

In one embodiment of the first aspect of the present invention, the display control section performs display control on each of a plurality of pixel portions on a display screen.

In one embodiment of this invention, each pixel portion includes one pixel or a prescribed number of pixels.

In one embodiment of the first aspect of the present invention, the gradation level of the image signal allocated in an earlier sub-frame period is half or less of the gradation level of the image signal allocated in a later sub-frame period.

In one embodiment of the second aspect of the present invention, the sub-frame periods have an identical length to each other or different lengths from each other.

In one embodiment of the second aspect of the present invention, the display control section sets an upper limit of the gradation level of the image signal supplied in each sub-frame period.

In one embodiment of the second aspect of the present invention, where upper limits of the gradation levels of the image signals supplied in the first, second, . . . n'th sub-frame periods are respectively referred to as L1, L2, . . . Ln; and the sub-frame period which is at the time-wise the center, or closest to the time-wise center, of one frame period is referred to as the j'th sub-frame period, the display control section sets the upper limits so as to fulfill:

$$L[j-i] \geqq L[j-(i+1)];$$

$$L[j+i] \geqq L[j+(i+1)]$$

where i is an integer of 0 or greater and less than j.

In one embodiment of the second aspect of the present invention, the image display section sets the gradation level of the image signal supplied in each sub-frame period after being increased or decreased in accordance with the gradation level of the input image signal, such that the relationship between the gradation level of the input image signal and the time-integrated values of luminance during one frame period exhibits an appropriate gamma luminance characteristic.

In one embodiment of the second aspect of the present invention, the image display apparatus further comprises a gamma luminance characteristic setting section for externally setting the gamma luminance characteristic, wherein:

the display control section is capable of changing the gamma luminance characteristic which is externally set by the gamma luminance characteristic setting section.

In one embodiment of the second aspect of the present invention, the image display apparatus further comprises a temperature detection section for detecting a temperature of a display panel or the vicinity thereof, wherein:

in accordance with the temperature detected by the temperature detection section, the display control section sets the gradation level of the image signal supplied in each sub-frame period after being increased or decreased in accordance with the gradation level of the input image signal.

In one embodiment of the second aspect of the present invention, the input image signal has a plurality of color components, the display control section sets the gradation level of the image signal supplied in each sub-frame period, such that the ratio between the luminance level displayed in each sub-frame period of a color other than a color having a highest gradation level of input image signal, is equal to the ratio between the luminance level displayed in each sub-frame period of the color having the highest gradation level of input image signal.

In one embodiment of the second aspect of the present invention, the gradation level which is greater than the prescribed value is a gradation level of greater than 90% where the relatively largest gradation level is 100%, and the gradation level which is lower than the prescribed value is a gradation level lower than 10% where the relatively smallest gradation level is 0%.

In one embodiment of the second aspect of the present invention, the gradation level which is greater than the prescribed value is a gradation level corresponding to a luminance level greater than 90% where the relatively largest luminance level is 100%, and the gradation level which is lower than the prescribed value is a gradation level corresponding to a luminance level lower than 10% where the relatively smallest luminance level is 0%.

In one embodiment of the second aspect of the present invention, the gradation level which is greater than the prescribed value is a gradation level greater than 98% where the relatively largest gradation level is 100%, and the gradation level which is lower than the prescribed value is a gradation level lower than 2% where the relatively smallest gradation level is 0%.

In one embodiment of the second aspect of the present invention, the gradation level which is greater than the prescribed value is a gradation level corresponding to a luminance level greater than 98% where the relatively largest luminance level is 100%, and the gradation level which is lower than the prescribed value is a gradation level corresponding to a luminance level lower than 2% where the relatively smallest luminance level is 0%.

In one embodiment of the second aspect of the present invention, where the plurality of sub-frame periods are three or more sub-frame periods, the gradation level allocated to the central sub-frame period in one frame period is higher than the gradation levels allocated to the other sub-frame periods at ends of one frame period.

In one embodiment of the second aspect of the present invention, where the plurality of sub-frame periods are three or more sub-frame periods, the luminance level of the image signal allocated to the central sub-frame period in one frame period is higher than the luminance levels of the image signal allocated to the other sub-frame periods at ends of one frame period.

In one embodiment of the second aspect of the present invention, a time-wise center of gravity of time-integrated values of luminance in the plurality of sub-frame periods moves within one sub-frame period.

In one embodiment of the second aspect of the present invention, the display control section performs display control on each of a plurality of pixel portions on a display screen.

In one embodiment of this invention, each pixel portion includes one pixel or a prescribed number of pixels.

In one embodiment of the third aspect of the present invention, the sub-frame periods have an identical length to each other or different lengths from each other.

In one embodiment of the third aspect of the present invention, the m'th sub-frame period has a longer length than the other sub-frame periods.

In one embodiment of the third aspect of the present invention, the display control section sets an upper limit of the gradation level of the image signal supplied in each sub-frame period.

In one embodiment of the third aspect of the present invention, where upper limits of the gradation levels of the image signals supplied in the first, second, . . . n'th sub-frame periods are respectively referred to as L1, L2, . . . Ln; and the sub-frame period which is at the time-wise the center, or closest to the time-wise center, of one frame period is referred to as the j'th sub-frame period, the display control section sets the upper limits so as to fulfill:

$$L[j-i] \geqq L[j-(i+1)];$$

$$L[j+i] \geqq L[j+(i+1)]$$

where i is an integer of 0 or greater and less than j.

In one embodiment of the third aspect of the present invention, the display control section sets the threshold level acting as a reference for the gradation level of the image signal supplied in each sub-frame period, and also sets the gradation level of the image signal supplied in each sub-frame period, such that the relationship between the gradation level of the input image signal and the time-integrated values of luminance during one frame period exhibits an appropriate gamma luminance characteristic.

In one embodiment of the third aspect of the present invention, the image display apparatus further comprises a gamma luminance characteristic setting section for externally setting the gamma luminance characteristic, wherein:

the display control section is capable of changing the gamma luminance characteristic which is externally set by the gamma luminance characteristic setting section.

In one embodiment of the third aspect of the present invention, the image display apparatus further comprises a temperature detection section for detecting a temperature of a display panel or the vicinity thereof wherein:

in accordance with the temperature detected by the temperature detection section, the display control section sets the threshold level acting as reference for the gradation level of the image signal supplied in each sub-frame period, and also sets the gradation level of the image signal supplied in each sub-frame period after being increased or decreased in accordance with the gradation level of the input image signal.

In one embodiment of the third aspect of the present invention, where the input image signal has a plurality of color components, the display control section sets the gradation level of the image signal supplied in each sub-frame period, such that the ratio between the luminance level displayed in each sub-frame period of a color other than a color having a highest gradation level of input image signal, is equal to the ratio between the luminance level displayed in each sub-frame period of the color having the highest gradation level of input image signal.

In one embodiment of the third aspect of the present invention, when n is 3, the display control section includes:

a timing control section;

a line data memory section for receiving and temporarily storing one horizontal line of image signal;

a frame memory data selection section, controlled by the timing control section, to select (i) transferring data from the line data memory section to a frame data memory section, or (ii) outputting data which was input ¼ frame before and is read from the frame data memory section and outputting data which was input ¾ frame before and is read from the frame data memory section;

a gradation conversion source selection section, controlled by the timing control section, to select (i) outputting the data from the line data memory section, or (ii) outputting the data which was input ¾ frame before and is supplied from the frame memory data selection section;

a first gradation conversion section for converting the gradation level of the image signal from the frame memory data selection section to the relatively largest level or a gradation level greater than a prescribed value or to a gradation level which is increased or decreased by the gradation level of the input image signal;

a second gradation conversion section for converting the gradation level of the image signal from the gradation conversion source selection section to the relatively smallest level or a gradation level lower than the prescribed value or to a gradation level which is increased or decreased by the gradation level of the input image signal; and an output data selection section, controlled by the timing control section, for selecting the image signal from the first gradation conversion section or the image signal from the second gradation conversion section, and supplying the selected image signal to the image display section.

In one embodiment of the third aspect of the present invention, the gradation level which is greater than the prescribed value is a gradation level of greater than 90% where the relatively largest gradation level is 100%, and the gradation level which is lower than the prescribed value is a gradation level lower than 10% where the relatively smallest gradation level is 0%.

In one embodiment of the third aspect of the present invention, the gradation level which is greater than the prescribed value is a gradation level corresponding to a luminance level greater than 90% where the relatively largest luminance level is 100%, and the gradation level which is lower than the prescribed value is a gradation level corresponding to a luminance level lower than 10% where the relatively smallest luminance level is 0%.

In one embodiment of the third aspect of the present invention, the gradation level which is greater than the prescribed value is a gradation level greater than 98% where the relatively largest gradation level is 100%, and the gradation level which is lower than the prescribed value is a gradation level lower than 2% where the relatively smallest gradation level is 0%.

In one embodiment of the third aspect of the present invention, the gradation level which is greater than the prescribed value is a gradation level corresponding to a luminance level greater than 98% where the relatively largest luminance level is 100%, and the gradation level which is lower than the prescribed value is a gradation level corresponding to a luminance level lower than 2% where the relatively smallest luminance level is 0%.

In one embodiment of the third aspect of the present invention, where the plurality of sub-frame periods are three or more sub-frame periods, the gradation level allocated to the central sub-frame period in one frame period is higher than the gradation levels allocated to the other sub-frame periods at ends of one frame period.

In one embodiment of the third aspect of the present invention, where the plurality of sub-frame periods are three or more sub-frame periods, the luminance level of the image signal allocated to the central sub-frame period in one frame period is higher than the luminance levels of the image signal allocated to the other sub-frame periods at ends of one frame period.

In one embodiment of the third aspect of the present invention, a time-wise center of gravity of time-integrated values of luminance in the plurality of sub-frame periods moves within one sub-frame period.

In one embodiment of the third aspect of the present invention, the display control section performs display control on each of a plurality of pixel portions on a display screen.

In one embodiment of this invention, each pixel portion includes one pixel or a prescribed number of pixels.

In one embodiment of the fourth aspect of the present invention, the sub-frame periods have an identical length to each other or different lengths from each other.

In one embodiment of the fourth aspect of the present invention, the display control section sets an upper limit of the gradation level of the image signal supplied in each sub-frame period.

In one embodiment of the fourth aspect of the present invention, where upper limits of the gradation levels of the image signals supplied in the first, second, . . . n'th sub-frame periods are respectively referred to as L1, L2, . . . Ln; and the sub-frame period which is at the time-wise the center, or closest to the time-wise center, of one frame period is referred to as the j'th sub-frame period, the display control section sets the upper limits so as to fulfill:

$$L[j-i] \geqq L[j-(i+1)];$$

$$L[j+i] \geqq L[j+(i+1)]$$

where i is an integer of 0 or greater and less than j.

In one embodiment of the fourth aspect of the present invention, the display control section sets the threshold level acting as reference for the gradation level of the image signal supplied in each sub-frame period, and also sets the gradation level of the image signal supplied in each sub-frame period, such that the relationship between the gradation level of the input image signal and the time-integrated values of luminance during one frame period exhibits an appropriate gamma luminance characteristic.

In one embodiment of the fourth aspect of the present invention, the image display apparatus further comprises a gamma luminance characteristic setting section for externally setting the gamma luminance characteristic, wherein:

the display control section is capable of changing the gamma luminance characteristic which is externally set by the gamma luminance characteristic setting section.

In one embodiment of the fourth aspect of the present invention, the image display apparatus further comprises a temperature detection section for detecting a temperature of a display panel or the vicinity thereof, wherein:

in accordance with the temperature detected by the temperature detection section, the display control section sets the threshold level acting as reference for the gradation level of the image signal supplied in each sub-frame period, and also sets the gradation level of the image signal supplied in each sub-frame period after being increased or decreased in accordance with the gradation level of the input image signal.

In one embodiment of the fourth aspect of the present invention, where the input image signal has a plurality of color components, the display control section sets the gradation level of the image signal supplied in each sub-frame period, such that the ratio between the luminance level displayed in each sub-frame period of a color other than a color having a highest gradation level of input image signal, is equal to the ratio between the luminance level displayed in each sub-frame period of the color having the highest gradation level of input image signal.

In one embodiment of the fourth aspect of the present invention, the gradation level which is greater than the prescribed value is a gradation level of greater than 90% where the relatively largest gradation level is 100%, and the gradation level which is lower than the prescribed value is a gradation level lower than 10% where the relatively smallest gradation level is 0%.

In one embodiment of the fourth aspect of the present invention, the gradation level which is greater than the prescribed value is a gradation level corresponding to a luminance level greater than 90% where the relatively largest luminance level is 100%, and the gradation level which is lower than the prescribed value is a gradation level corresponding to a luminance level lower than 10% where the relatively smallest luminance level is 0%.

In one embodiment of the fourth aspect of the present invention, the gradation level which is greater than the prescribed value is a gradation level greater than 98% where the relatively largest gradation level is 100%, and the gradation level which is lower than the prescribed value is a gradation level lower than 2% where the relatively smallest gradation level is 0%.

In one embodiment of the fourth aspect of the present invention, the gradation level which is greater than the prescribed value is a gradation level corresponding to a luminance level greater than 98% where the relatively largest luminance level is 100%, and the gradation level which is lower than the prescribed value is a gradation level corresponding to a luminance level lower than 2% where the relatively smallest luminance level is 0%.

In one embodiment of the fourth aspect of the present invention, where the plurality of sub-frame periods are three or more sub-frame periods, the gradation level allocated to the central sub-frame period in one frame period is higher than the gradation levels allocated to the other sub-frame periods at ends of one frame period.

In one embodiment of the fourth aspect of the present invention, where the plurality of sub-frame periods are three or more sub-frame periods, the luminance level of the image signal allocated to the central sub-frame period in one frame period is higher than the luminance levels of the image signal allocated to the other sub-frame periods at ends of one frame period.

In one embodiment of the fourth aspect of the present invention, a time-wise center of gravity of time-integrated values of luminance in the plurality of sub-frame periods moves within one sub-frame period.

In one embodiment of the fourth aspect of the present invention, the display control section performs display control on each of a plurality of pixel portions on a display screen.

In one embodiment of this invention, each pixel portion includes one pixel or a prescribed number of pixels.

In one embodiment of the fifth aspect of the present invention, the sub-frame periods have an identical length to each other or different lengths from each other.

In one embodiment of the fifth aspect of the present invention, when a response time of the image display section to a decrease in the luminance level is shorter than a response time of the image display section to an increase in the luminance level, the sub-frame period $\alpha$ is assigned to a second sub-frame period among the two sub-frame periods; and when the response time of the image display section to the decrease in the luminance level is longer than the response time of the image display section to the increase in the luminance level, the sub-frame period $\alpha$ is assigned to a first sub-frame period among the two sub-frame periods.

In one embodiment of the fifth aspect of the present invention, where a relatively largest luminance level of the image display section is Lmax and a relatively smallest luminance level of the image display section is Lmin, when a response time of the image display section to a luminance switch from the relatively largest luminance level of Lmax to the relatively smallest luminance level of Lmin is shorter than a response time of the image display section to a luminance switch from the relatively smallest luminance level of Lmin to the relatively largest luminance level of Lmax, the sub-frame period $\alpha$ is assigned to a second sub-frame period among the two sub-frame periods; and when the response time of the image display section to the luminance switch from the relatively largest luminance level of Lmax to the relatively smallest luminance level of Lmin is longer than the response time of the image display section to the luminance switch from the relatively smallest luminance level of Lmin to the relatively largest luminance level of Lmax, the sub-frame period $\alpha$ is assigned to a first sub-frame period among the two sub-frame periods.

In one embodiment of the fifth aspect of the present invention, the display control section sets an upper limit of the gradation level of the image signal supplied in each sub-frame period.

In one embodiment of the fifth aspect of the present invention, where an upper limit L1 is the gradation level of the image signal supplied in one of the sub-frame periods and an upper limit L2 is the gradation level of the image signal supplied in the other sub-frame period, the display control section sets L1 and L2 so as to fulfill the relationship of L1≧L2.

In one embodiment of the fifth aspect of the present invention, the display control section sets the threshold level acting as reference for the gradation level of the image signal supplied in each sub-frame period, and also sets the gradation level of the image signal supplied in each sub-frame period, such that the relationship between the gradation level of the input image signal and the time-integrated values of luminance during one frame period exhibits an appropriate gamma luminance characteristic.

In one embodiment of the fifth aspect of the present invention, the image display apparatus further comprises a gamma luminance characteristic setting section for externally setting the gamma luminance characteristic, wherein:

the display control section is capable of changing the gamma luminance characteristic which is externally set by the gamma luminance characteristic setting section.

In one embodiment of the fifth aspect of the present invention, the image display apparatus further comprises a temperature detection section for detecting a temperature of a display panel or the vicinity thereof, wherein:

in accordance with the temperature detected by the temperature detection section, the display control section sets the threshold level acting as reference for the gradation level of the image signal supplied in each sub-frame period, and also sets the gradation level of the image signal supplied in each sub-frame period after being increased or decreased in accordance with the gradation level of the input image signal.

In one embodiment of the fifth aspect of the present invention, where the input image signal has a plurality of color components, the display control section sets the gradation level of the image signal supplied in each sub-frame period, such that the ratio between the luminance level displayed in each sub-frame period of a color other than a color having a highest gradation level of input image signal, is equal to the ratio between the luminance level displayed in each sub-frame period of the color having the highest gradation level of input image signal.

In one embodiment of the fifth aspect of the present invention, the display control section includes:

a timing control section;

a line data memory section for receiving and temporarily storing one horizontal line of image signal;

a frame memory data selection section, controlled by the timing control section, to select data transfer from the data line memory section to a frame data memory section or data output of data which was input one frame before and is read from the frame data memory section;

a first gradation conversion section for converting the gradation level of the image signal from the line data memory section to the relatively largest level or a gradation level greater than a prescribed value or to a gradation level which is increased or decreased by the gradation level of the input image signal;

a second gradation conversion section for converting the gradation level of the image signal from the frame memory data selection section to the relatively smallest level or a gradation level lower than the prescribed value or to a gradation level which is increased or decreased by the gradation level of the input image signal; and an output data selection section, controlled by the timing control section, for selecting the image signal from the first gradation conversion section or the image signal from the second gradation conversion section, and supplying the selected image signal to the image display section.

In one embodiment of the fifth aspect of the present invention, the gradation level which is greater than the prescribed value is a gradation level of greater than 90% where the relatively largest gradation level is 100%, and the gradation level which is lower than the prescribed value is a gradation level lower than 10% where the relatively smallest gradation level is 0%.

In one embodiment of the fifth aspect of the present invention, the gradation level which is greater than the prescribed value is a gradation level corresponding to a luminance level greater than 90% where the relatively largest luminance level is 100%, and the gradation level which is lower than the prescribed value is a gradation level corresponding to a luminance level lower than 10% where the relatively smallest luminance level is 0%.

In one embodiment of the fifth aspect of the present invention, the gradation level which is greater than the prescribed value is a gradation level greater than 98% where the relatively largest gradation level is 100%, and the gradation level which is lower than the prescribed value is a gradation level lower than 2% where the relatively smallest gradation level is 0%.

In one embodiment of the fifth aspect of the present invention, the gradation level which is greater than the prescribed value is a gradation level corresponding to a luminance level greater than 98% where the relatively largest luminance level is 100%, and the gradation level which is lower than the prescribed value is a gradation level corresponding to a luminance level lower than 2% where the relatively smallest luminance level is 0%.

In one embodiment of the fifth aspect of the present invention, the display control section performs display control on each of a plurality of pixel portions on a display screen.

In one embodiment of this present invention, each pixel portion includes one pixel or a prescribed number of pixels.

In one embodiment of the sixth aspect of the present invention, the sub-frame periods have an identical length to each other or different lengths from each other.

In one embodiment of the sixth aspect of the present invention, when the gradation level of the input image signal is greater than the threshold level T1 and equal to or less than the threshold level T2, the gradation level of the image signal supplied in the sub-frame period $\alpha$ and the gradation level of the image signal supplied in the sub-frame period $\beta$ are set, such that the difference between the gradation levels is constant, or such that the difference between the luminance level in the sub-frame period $\alpha$ and the luminance level in the sub-frame period $\beta$ is constant.

In one embodiment of the sixth aspect of the present invention, the gradation level of the image signal allocated in an earlier sub-frame period is half or less of the gradation level of the image signal allocated in a later sub-frame period.

In one embodiment of the sixth aspect of the present invention, when the gradation level of the input image signal is greater than the threshold level T1 and equal to or less than the threshold level T2, the gradation level of the image signal supplied in the sub-frame period $\alpha$ and the gradation level of the image signal supplied in the sub-frame period $\beta$ are set, such that the relationship between the gradation levels is set by a function, or such that the relationship between the luminance level in the sub-frame period $\alpha$ and the luminance level in the sub-frame period $\beta$ is set by a function.

In one embodiment of the sixth aspect of the present invention, when a response time of the image display section to a decrease in the luminance level is shorter than a response time of the image display section to an increase in the luminance level, the sub-frame period $\alpha$ is assigned to a second sub-frame period among the two sub-frame periods; and when the response time of the image display section to the decrease in the luminance level is longer than the response time of the image display section to the increase in the luminance level, the sub-frame period $\alpha$ is assigned to a first sub-frame period among the two sub-frame periods.

In one embodiment of the sixth aspect of the present invention, where a relatively largest luminance level of the image display section is Lmax and a relatively smallest luminance level of the image display section is Lmin, when a response time of the image display section to a luminance switch from the relatively largest luminance level of Lmax to the relatively smallest luminance level of Lmin is shorter than a response time of the image display section to a luminance switch from the relatively smallest luminance level of Lmin to the relatively largest luminance level of Lmax, the sub-frame period $\alpha$ is assigned to a second sub-frame period among the two sub-frame periods; and when the response time of the image display section to the luminance switch from the relatively largest luminance level of Lmax to the relatively smallest luminance level of Lmin is longer than the response time of the image display section to the luminance switch from the relatively smallest luminance level of Lmin to the relatively largest luminance level of Lmax, the sub-frame period $\alpha$ is assigned to a first sub-frame period among the two sub-frame periods.

In one embodiment of the sixth aspect of the present invention, the display control section sets an upper limit of the gradation level of the image signal supplied in each sub-frame period.

In one embodiment of the sixth aspect of the present invention, where an upper limit L1 is the gradation level of the image signal supplied in one of the sub-frame periods and an upper limit L2 is the gradation level of the image signal supplied in the other sub-frame period, the display control section sets L1 and L2 so as to fulfill the relationship of $L1 \geqq L2$.

In one embodiment of the sixth aspect of the present invention, the display control section sets the threshold level acting as a reference for the gradation level of the image signal supplied in each sub-frame period, and also sets the gradation level of the image signal supplied in each sub-frame period, such that the relationship between the gradation level of the input image signal and the time-integrated values of luminance during one frame period exhibits an appropriate gamma luminance characteristic.

In one embodiment of this invention, the image display apparatus further comprises a gamma luminance characteristic setting section for externally setting the gamma luminance characteristic, wherein:

the display control section is capable of changing the gamma luminance characteristic which is externally set by the gamma luminance characteristic setting section.

In one embodiment of the sixth aspect of the present invention, the image display apparatus further comprises a temperature detection section for detecting a temperature of a display panel or the vicinity thereof, wherein:

in accordance with the temperature detected by the temperature detection section, the display control section sets the threshold level acting as a reference for the gradation level of the image signal supplied in each sub-frame period, and also sets the gradation level of the image signal supplied in each sub-frame period after being increased or decreased in accordance with the gradation level of the input image signal.

In one embodiment of the sixth aspect of the present invention, where the input image signal has a plurality of color components, the display control section sets the gradation level of the image signal supplied in each sub-frame period, such that the ratio between the luminance level displayed in each sub-frame period of a color other than a color having a highest gradation level of input image signal, is equal to the ratio between the luminance level displayed in each sub-frame period of the color having the highest gradation level of input image signal.

In one embodiment of the sixth aspect of the present invention, the display control section includes:

a timing control section;

a line data memory section for receiving and temporarily storing one horizontal line of image signal;

a frame memory data selection section, controlled by the timing control section, to select data transfer from the data line memory section to a frame data memory section or data output of data which was input one frame before and is read from the frame data memory section;

a first gradation conversion section for converting the gradation level of the image signal from the line data memory section to the relatively largest level or a gradation level greater than a prescribed value or to a gradation level which is increased or decreased by the gradation level of the input image signal;

a second gradation conversion section for converting the gradation level of the image signal from the frame memory data selection section to the relatively smallest level or a gradation level lower than the prescribed value or to a gradation level which is increased or decreased by the gradation level of the input image signal; and an output data selection section, controlled by the timing control section, for selecting the image signal from the first gradation conversion section or the image signal from the second gradation conversion section, and supplying the selected image signal to the image display section.

In one embodiment of this invention, the display control section performs display control on each of a plurality of pixel portions on a display screen.

In one embodiment of the sixth aspect of the present invention, the gradation level which is greater than the prescribed value is a gradation level of greater than 90% where the relatively largest gradation level is 100%, and the gradation level which is lower than the prescribed value is a gradation level lower than 10% where the relatively smallest gradation level is 0%.

In one embodiment of this invention, the display control section performs display control on each of a plurality of pixel portions on a display screen.

In one embodiment of the sixth aspect of the present invention, the gradation level which is greater than the prescribed value is a gradation level corresponding to a luminance level greater than 90% where the relatively largest luminance level is 100%, and the gradation level which is lower than the prescribed value is a gradation level corresponding to a luminance level lower than 10% where the relatively smallest luminance level is 0%.

In one embodiment of the sixth aspect of the present invention, the gradation level which is greater than the prescribed value is a gradation level greater than 98% where the relatively largest gradation level is 100%, and the gradation level which is lower than the prescribed value is a gradation level lower than 2% where the relatively smallest gradation level is 0%.

In one embodiment of the sixth aspect of the present invention, the gradation level which is greater than the prescribed value is a gradation level corresponding to a luminance level greater than 98% where the relatively largest luminance level is 100%, and the gradation level which is lower than the prescribed value is a gradation level corresponding to a luminance level lower than 2% where the relatively smallest luminance level is 0%.

In one embodiment of the sixth aspect of the present invention, the display control section performs display control on each of a plurality of pixel portions on a display screen.

In one embodiment of this invention, each pixel portion includes one pixel or a prescribed number of pixels.

In one embodiment of the seventh aspect of the present invention, the sub-frame periods have an identical length to each other or different lengths from each other.

In one embodiment of the seventh aspect of the present invention, when the gradation level of the input image signal is greater than the threshold level T1 and equal to or less than the threshold level T2, the gradation level of the image signal supplied in the sub-frame period $\alpha$ and the gradation level of the image signal supplied in the sub-frame period $\beta$ are set, such that the difference between the gradation levels is constant, or such that the difference between the luminance level in the sub-frame period $\alpha$ and the luminance level in the sub-frame period $\beta$ is constant.

In one embodiment of this invention, the gradation level of the image signal allocated in an earlier sub-frame period is half or less of the gradation level of the image signal allocated in a later sub-frame period.

In one embodiment of the seventh aspect of the present invention, when the gradation level of the input image signal is greater than the threshold level T1 and equal to or less than the threshold level T2, the gradation level of the image signal supplied in the sub-frame period $\alpha$ and the gradation level of the image signal supplied in the sub-frame period are set, such that the relationship between the gradation levels is set by a function, or such that the relationship between the luminance level in the sub-frame period $\alpha$ and the luminance level in the sub-frame period $\beta$ is set by a function.

In one embodiment of the seventh aspect of the present invention, when a response time of the image display section to a decrease in the luminance level is shorter than a response time of the image display section to an increase in the luminance level, the sub-frame period $\alpha$ is assigned to a second sub-frame period among the two sub-frame periods; and when the response time of the image display section to the decrease in the luminance level is longer than the response time of the image display section to the increase in the luminance level, the sub-frame period $\alpha$ is assigned to a first sub-frame period among the two sub-frame periods.

In one embodiment of the seventh aspect of the present invention, where a relatively largest luminance level of the image display section is Lmax and a relatively smallest luminance level of the image display section is Lmin, when a response time of the image display section to a luminance switch from the relatively largest luminance level of Lmax to the relatively smallest luminance level of Lmin is shorter than a response time of the image display section to a luminance switch from the relatively smallest luminance level of Lmin to the relatively largest luminance level of Lmax, the sub-frame period $\alpha$ is assigned to a second sub-frame period among the two sub-frame periods; and when the response time of the image display section to the luminance switch from the relatively largest luminance level of Lmax to the relatively smallest luminance level of Lmin is longer than the response time of the image display section to the luminance switch from the relatively smallest luminance level of Lmin to the relatively largest luminance level of Lmax, the sub-frame period α is assigned to a first sub-frame period among the two sub-frame periods.

In one embodiment of the seventh aspect of the present invention, the display control section sets an upper limit of the gradation level of the image signal supplied in each sub-frame period.

In one embodiment of the seventh aspect of the present invention, where an upper limit L1 is the gradation level of the image signal supplied in one of the sub-frame periods and an upper limit L2 is the gradation level of the image signal supplied in the other sub-frame period, the display control section sets L1 and L2 so as to fulfill the relationship of L1≧L2.

In one embodiment of the seventh aspect of the present invention, the display control section sets the threshold level acting as reference for the gradation level of the image signal supplied in each sub-frame period, and also sets the gradation level of the image signal supplied in each sub-frame period, such that the relationship between the gradation level of the input image signal and the time-integrated values of luminance during one frame period exhibits an appropriate gamma luminance characteristic.

In one embodiment of this invention, the image display apparatus further comprises a gamma luminance characteristic setting section for externally setting the gamma luminance characteristic, wherein:

the display control section is capable of changing the gamma luminance characteristic which is externally set by the gamma luminance characteristic setting section.

In one embodiment of the seventh aspect of the present invention, the image display apparatus further comprises a temperature detection section for detecting a temperature of a display panel or the vicinity thereof, wherein:

in accordance with the temperature detected by the temperature detection section, the display control section sets the threshold level acting as reference for the gradation level of the image signal supplied in each sub-frame period, and also sets the gradation level of the image signal supplied in each sub-frame period after being increased or decreased in accordance with the gradation level of the input image signal.

In one embodiment of the seventh aspect of the present invention, where the input image signal has a plurality of color components, the display control section sets the gradation level of the image signal supplied in each sub-frame period, such that the ratio between the luminance level displayed in each sub-frame period of a color other than a color having a highest gradation level of the input image signal, is equal to the ratio between the luminance level displayed in each sub-frame period of the color having the highest gradation level of the input image signal.

In one embodiment of the seventh aspect of the present invention, the display control section includes:

a timing control section;

a line data memory section for receiving and temporarily storing one horizontal line of image signal;

a frame memory data selection section, controlled by the timing control section, to select data transfer from the data line memory section to a frame data memory section or data output of data which was input one frame before and is read from the frame data memory section;

a first gradation conversion section for converting the gradation level of the image signal from the line data memory section to the relatively largest level or a gradation level greater than a prescribed value or to a gradation level which is increased or decreased by the gradation level of the input image signal;

a second gradation conversion section for converting the gradation level of the image signal from the frame memory data selection section to the relatively smallest level or a gradation level lower than the prescribed value or to a gradation level which is increased or decreased by the gradation level of the input image signal; and an output data selection section, controlled by the timing control section, for selecting the image signal from the first gradation conversion section or the image signal from the second gradation conversion section, and supplying the selected image signal to the image display section.

In one embodiment of the seventh aspect of the present invention, the gradation level which is greater than the prescribed value is a gradation level of greater than 90% where the relatively largest gradation level is 100%, and the gradation level which is lower than the prescribed value is a gradation level lower than 10% where the relatively smallest gradation level is 0%.

In one embodiment of the seventh aspect of the present invention, the gradation level which is greater than the prescribed value is a gradation level corresponding to a luminance level greater than 90% where the relatively largest luminance level is 100%, and the gradation level which is lower than the prescribed value is a gradation level corresponding to a luminance level lower than 10% where the relatively smallest luminance level is 0%.

In one embodiment of the seventh aspect of the present invention, the gradation level which is greater than the prescribed value is a gradation level greater than 98% where the relatively largest gradation level is 100%, and the gradation level which is lower than the prescribed value is a gradation level lower than 2% where the relatively smallest gradation level is 0%.

In one embodiment of the seventh aspect of the present invention, the gradation level which is greater than the prescribed value is a gradation level corresponding to a luminance level greater than 98% where the relatively largest luminance level is 100%, and the gradation level which is lower than the prescribed value is a gradation level corresponding to a luminance level lower than 2% where the relatively smallest luminance level is 0%.

In one embodiment of the seventh aspect of the present invention, the display control section performs display control on each of a plurality of pixel portions on a display screen.

In one embodiment of the seventh aspect of the present invention, each pixel portion includes one pixel or a prescribed number of pixels.

In one embodiment of the eighth aspect of the present invention, the sub-frame periods have an identical length to each other or different lengths from each other.

In one embodiment of the eighth aspect of the present invention, when a response time of the image display section to a decrease in the luminance level is shorter than a response time of the image display section to an increase in the luminance level, the sub-frame period α is assigned to a second sub-frame period among the two sub-frame periods; and when the response time of the image display section to the decrease in the luminance level is longer than the response time of the image display section to the increase in the luminance level, the sub-frame period α is assigned to a first sub-frame period among the two sub-frame periods.

In one embodiment of the eighth aspect of the present invention, where a relatively largest luminance level of the image display section is Lmax and a relatively smallest luminance level of the image display section is Lmin, when a response time of the image display section to a luminance switch from the relatively largest luminance level of Lmax to the relatively smallest luminance level of Lmin is shorter than a response time of the image display section to a luminance switch from the relatively smallest luminance level of Lmin to the relatively largest luminance level of Lmax, the sub-frame period $\alpha$ is assigned to a second sub-frame period among the two sub-frame periods; and when the response time of the image display section to the luminance switch from the relatively largest luminance level of Lmax to the relatively smallest luminance level of Lmin is longer than the response time of the image display Section to the luminance switch from the relatively smallest luminance level of Lmin to the relatively largest luminance level of Lmax, the sub-frame period $\alpha$ is assigned to a first sub-frame period among the two sub-frame periods.

In one embodiment of the eighth aspect of the present invention, the display control section sets an upper limit of the gradation level of the image signal supplied in each sub-frame period.

In one embodiment of the eighth aspect of the present invention, where an upper limit L1 is the gradation level of the image signal supplied in one of the sub-frame periods and an upper limit L2 is the gradation level of the image signal supplied in the other sub-frame period, the display control section sets L1 and L2 so as to fulfill the relationship of L1≧L2.

In one embodiment of the eighth aspect of the present invention, the display control section sets the threshold level acting as reference for the gradation level of the image signal supplied in each sub-frame period, and also sets the gradation level of the image signal supplied in each sub-frame period, such that the relationship between the gradation level of the input image signal and the time-integrated values of luminance during one frame period exhibit an appropriate gamma luminance characteristic.

In one embodiment of the eighth aspect of the present invention, the image display apparatus further comprises a gamma luminance characteristic setting section for externally setting the gamma luminance characteristic, wherein:

the display control section is capable of changing the gamma luminance characteristic which is externally set by the gamma luminance characteristic setting section.

In one embodiment of the eighth aspect of the present invention, the image display apparatus further comprises a temperature detection section for detecting a temperature of a display panel or the vicinity thereof, wherein:

in accordance with the temperature detected by the temperature detection section, the display control section sets the threshold level acting as reference for the gradation level of the image signal supplied in each sub-frame period, and also sets the gradation level of the image signal supplied in each sub-frame period after being increased or decreased in accordance with the gradation level of the input image signal.

In one embodiment of the eighth aspect of the present invention, where the input image signal has a plurality of color components, the display control section sets the gradation level of the image signal supplied in each sub-frame period, such that the ratio between the luminance level displayed in each sub-frame period of a color other than a color having a highest gradation level of input image signal, is equal to the ratio between the luminance level displayed in each sub-frame period of the color having the highest gradation level of input image signal.

In one embodiment of the eighth aspect of the present invention, the display control section includes:

a timing control section;

a line data memory section for receiving and temporarily storing one horizontal line of image signal;

a frame memory data selection section, controlled by the timing control section, to select data transfer from the data line memory section to a frame data memory section or data output of data which was input one frame before and is read from the frame data memory section;

a first gradation conversion section for converting the gradation level of the image signal from the line data memory section to the relatively largest level or a gradation level greater than a prescribed value or to a gradation level which is increased or decreased by the gradation level of the input image signal;

a second gradation conversion section for converting the gradation level of the image signal from the frame memory data selection section to the relatively smallest level or a gradation level lower than the prescribed value or to a gradation level which is increased or decreased by the gradation level of the input image signal; and an output data selection section, controlled by the timing control section, for selecting the image signal from the first gradation conversion section or the image signal from the second gradation conversion section, and supplying the selected image signal to the image display section.

In one embodiment of the eighth aspect of the present invention, the display control section includes:

a timing control section;

a line data memory section for receiving and temporarily storing one horizontal line of image signal;

a first multiple line data memory section and a second multiple line data memory section for temporarily storing a plurality of horizontal lines of image signals;

a frame memory data selection section, controlled by the timing control section, to select (i) transferring data from the line data memory section to a frame data memory section, or (ii) transferring data which was input one frame before and is read from the frame data memory section to the first multiple line data memory section and transferring data which was input two frames before and is read from the frame data memory section to the second multiple line data memory section;

an intermediate image generation section for estimating and generating an image in an intermediate state in terms of time between the image signal from the first multiple line data memory section and the image signal from the second multiple line data memory section;

a temporary memory data selection section, controlled by the timing control section, to select the image signal from the first multiple line data memory section or the image signal from the second multiple line data memory section;

a first gradation conversion section for converting the gradation level of the image signal from the temporary memory data selection section to the relatively largest level or a gradation level greater than a prescribed value or to a gradation level which is increased or decreased by the gradation level of the input image signal;

a second gradation conversion section for converting the gradation level of the image signal from the intermediate image generation section to the relatively smallest level or a gradation level lower than the prescribed value or to a gradation level which is increased or decreased by the gradation level of the input image signal; and an output data selection section, controlled by the timing control section, for selecting the image signal from the first gradation conversion section or the image signal from the second gradation conversion section, and supplying the selected image signal to the image display section.

In one embodiment of the eighth aspect of the present invention, the gradation level which is greater than the prescribed value is a gradation level of greater than 90% where the relatively largest gradation level is 100%, and the gradation level which is lower than the prescribed value is a gradation level lower than 10% where the relatively smallest gradation level is 0%.

In one embodiment of the eighth aspect of the present invention, the gradation level which is greater than the prescribed value is a gradation level corresponding to a luminance level greater than 90% where the relatively largest luminance level is 100%, and the gradation level which is lower than the prescribed value is a gradation level corresponding to a luminance level lower than 10% where the relatively smallest luminance level is 0%.

In one embodiment of the eighth aspect of the present invention, the gradation level which is greater than the prescribed value is a gradation level greater than 98% where the relatively largest gradation level is 100%, and the gradation level which is lower than the prescribed value is a gradation level lower than 2% where the relatively smallest gradation level is 0%.

In one embodiment of the eighth aspect of the present invention, the gradation level which is greater than the prescribed value is a gradation level corresponding to a luminance level greater than 98% where the relatively largest luminance level is 100%, and the gradation level which is lower than the prescribed value is a gradation level corresponding to a luminance level lower than 2% where the relatively smallest luminance level is 0%.

In one embodiment of the eighth aspect of the present invention, the display control section performs display control on each of a plurality of pixel portions on a display screen.

In one embodiment of this invention, each pixel portion includes one pixel or a prescribed number of pixels.

In one embodiment of the ninth aspect of the present invention, the sub-frame periods have an identical length to each other or different lengths from each other.

In one embodiment of the ninth aspect of the present invention, when a response time of the image display section to a decrease in the luminance level is shorter than a response time of the image display section to an increase in the luminance level, the sub-frame period $\alpha$ is assigned to a second sub-frame period among the two sub-frame periods; and when the response time of the image display section to the decrease in the luminance level is longer than the response time of the image display section to the increase in the luminance level, the sub-frame period $\alpha$ is assigned to a first sub-frame period among the two sub-frame periods.

In one embodiment of the ninth aspect of the present invention, where a relatively largest luminance level of the image display section is Lmax and a relatively smallest luminance level of the image display section is Lmin, when a response time of the image display section to a luminance switch from the relatively largest luminance level of Lmax to the relatively smallest luminance level of Lmin is shorter than a response time of the image display section to a luminance switch from the relatively smallest luminance level of Lmin to the relatively largest luminance level of Lmax, the sub-frame period $\alpha$ is assigned to a second sub-frame period among the two sub-frame periods; and when the response time of the image display section to the luminance switch from the relatively largest luminance level of Lmax to the relatively smallest luminance level of Lmin is longer than the response time of the image display section to the luminance switch from the relatively smallest luminance level of Lmin to the relatively largest luminance level of Lmax, the sub-frame period $\alpha$ is assigned to a first sub-frame period among the two sub-frame periods.

In one embodiment of the ninth aspect of the present invention, the display control section sets an upper limit of the gradation level of the image signal supplied in each sub-frame period.

In one embodiment of the ninth aspect of the present invention, where an upper limit L1 is the gradation level of the image signal supplied in one of the sub-frame periods and an upper limit L2 is the gradation level of the image signal supplied in the other sub-frame period, the display control section sets L1 and L2 so as to fulfill the relationship of $L1 \geqq L2$.

In one embodiment of the ninth aspect of the present invention, the display control section sets the threshold level acting as reference for the gradation level of the image signal supplied in each sub-frame period, and also sets the gradation level of the image signal supplied in each sub-frame period, such that the relationship between the gradation level of the input image signal and the time-integrated values of luminance during one frame period exhibits an appropriate gamma luminance characteristic.

In one embodiment of this invention, the image display apparatus further comprises a gamma luminance characteristic setting section for externally setting the gamma luminance characteristic, wherein:

the display control section is capable of changing the gamma luminance characteristic which is externally set by the gamma luminance characteristic setting section.

In one embodiment of the ninth aspect of the present invention, the image display apparatus further comprises a temperature detection section for detecting a temperature of a display panel or the vicinity thereof, wherein:

in accordance with the temperature detected by the temperature detection section, the display control section sets the threshold level acting as reference for the gradation level of the image signal supplied in each sub-frame period, and also sets the gradation level of the image signal supplied in each sub-frame period after being increased or decreased in accordance with the gradation level of the input image signal.

In one embodiment of the ninth aspect of the present invention, where the input image signal has a plurality of color components, the display control section sets the gradation level of the image signal supplied in each sub-frame period, such that the ratio between the luminance level displayed in each sub-frame period of a color other than a color having a highest gradation level of the input image signal, is equal to the ratio between the luminance level displayed in each sub-frame period of the color having the highest gradation level of the input image signal.

In one embodiment of the ninth aspect of the present invention, the display control section includes:

a timing control section;

a line data memory section for receiving and temporarily storing one horizontal line of image signal;

a frame memory data selection section, controlled by the timing control section, to select data transfer from the data line memory section to a frame data memory section or data output of data which was input one frame before and is read from the frame data memory section;

a first gradation conversion section for converting the gradation level of the image signal from the line data memory section to the relatively largest level or a gradation level greater than a prescribed value or to a gradation level which is increased or decreased by the gradation level of the input image signal;

a second gradation conversion section for converting the gradation level of the image signal from the frame memory data selection section to the relatively smallest level or a gradation level lower than the prescribed value or to a gradation level which is increased or decreased by the gradation level of the input image signal; and an output data selection section, controlled by the timing control section, for selecting the image signal from the first gradation conversion section or the image signal from the second gradation conversion section, and supplying the selected image signal to the image display section.

In one embodiment of the ninth aspect of the present invention, the display control section includes:

a timing control section;

a line data memory section for receiving and temporarily storing one horizontal line of image signal;

a first multiple line data memory section and a second multiple line data memory section for temporarily storing a plurality of horizontal lines of image signals;

a frame memory data selection section, controlled by the timing control section, to select (i) transferring data from the line data memory section to a frame data memory section, or (ii) transferring data which was input one frame before and is read from the frame data memory section to the first multiple line data memory section and transferring data which was input two frames before and is read from the frame data memory section to the second multiple line data memory section;

a gradation level averaging section for calculating an average value of the gradation level of the image signal from the first multiple line data memory section and the gradation level of the image signal from the second multiple line data memory section, and supplying the average value to the second gradation conversion section;

a temporary memory data selection section, controlled by the timing control section, to select the image signal from the first multiple line data memory section or the image signal from the second multiple line data memory section;

a first gradation conversion section for converting the gradation level of the image signal from the temporary memory data selection section to the relatively largest level or a gradation level greater than a prescribed value or to a gradation level which is increased or decreased by the gradation level of the input image signal;

a second gradation conversion section for converting the gradation level of the image signal from the gradation level averaging section to the relatively smallest level or a gradation level lower than the prescribed value or to a gradation level which is increased or decreased by the gradation level of the input image signal; and an output data selection section, controlled by the timing control section, for selecting the image signal from the first gradation conversion section or the image signal from the second gradation conversion section, and supplying the selected image signal to the image display section.

In one embodiment of the ninth aspect of the present invention, the gradation level which is greater than the prescribed value is a gradation level of greater than 90% where the relatively largest gradation level is 100%, and the gradation level which is lower than the prescribed value is a gradation level lower than 10% where the relatively smallest gradation level is 0%.

In one embodiment of the ninth aspect of the present invention, the gradation level which is greater than the prescribed value is a gradation level corresponding to a luminance level greater than 90% where the relatively largest luminance level is 100%, and the gradation level which is lower than the prescribed value is a gradation level corresponding to a luminance level lower than 10% where the relatively smallest luminance level is 0%.

In one embodiment of the ninth aspect of the present invention, the gradation level which is greater than the prescribed value is a gradation level greater than 98% where the relatively largest gradation level is 100%, and the gradation level which is lower than the prescribed value is a gradation level lower than 2% where the relatively smallest gradation level is 0%.

In one embodiment of the ninth aspect of the present invention, the gradation level which is greater than the prescribed value is a gradation level corresponding to a luminance level greater than 98% where the relatively largest luminance level is 100%, and the gradation level which is lower than the prescribed value is a gradation level corresponding to a luminance level lower than 2% where the relatively smallest luminance level is 0%.

In one embodiment of the ninth aspect of the present invention, the display control section performs display control on each of a plurality of pixel portions on a display screen.

In one embodiment of this invention, each pixel portion includes one pixel or a prescribed number of pixels.

According to a tenth aspect of the present invention, an electronic apparatus is provided for performing image display on a display screen of an image display section of an image display apparatus according to the first aspect of the present invention.

According to an eleventh aspect of the present invention, a liquid crystal TV is provided, comprising:

an image display apparatus according to the first aspect of the present invention; and a tuner section for outputting a TV broadcast signal of a selected channel to the display control section of the image display apparatus.

According to a twelfth aspect of the present invention, a liquid crystal monitoring apparatus is provided, comprising:

an image display apparatus according to the first aspect of the present invention; and a signal processing section for outputting a monitor image signal, obtained by processing an external monitor signal, to the display control section of the image display apparatus.

According to a thirteenth aspect of the present invention, an image display method is provided for performing one frame of image display by a sum of time-integrated values of luminance displayed in an image display section inn sub-frame periods, where n is an integer of 2 or greater. The method comprises the following steps:

in a relatively central sub-frame period which is at a time-wise center, or closest to the time-wise center of, one frame period for image display, the step of supplying, to the image display section, an image signal of a relatively largest gradation level within the range in which a sum of time-integrated value of luminance in the n sub-frame periods does not exceed the luminance level corresponding to the gradation level of an input image signal;

when the sum of time-integrated values of luminance in the relatively central sub-frame period does not reach the luminance level corresponding to the gradation level of the input image signal, the step of supplying, to the image display section, an image signal of the relatively largest gradation level within the range in which the sum of time-integrated values of luminance in the n sub-frame periods does not exceed the luminance level corresponding to the gradation level of the input image signal, in each of a preceding sub-frame period before the relatively central sub-frame period and a subsequent sub-frame period after the relatively central sub-frame period;

when the sum of time-integrated values of luminance in the relatively central sub-frame period, the preceding sub-frame period and the subsequent sub-frame period still do not reach the luminance level corresponding to the gradation level of the input image signal, the step of supplying, to the image display section, an image signal of the relatively largest gradation level within the range in which the sum of time-integrated values of luminance in the n sub-frame periods does not exceed the luminance level corresponding to the gradation level of the input image signal, in each of a sub-frame period before the preceding sub-frame period and a sub-frame period after the subsequent sub-frame period;

the step of repeating the operation until the sum of time-integrated values of luminance in all the sub-frame periods in which the image signals have been supplied reaches the luminance level corresponding to the gradation level of the input image signal; and when the sum reaches the luminance level corresponding to the gradation level of the input image signal, the step of supplying, to the image display section, an image signal of a relatively smallest gradation level or an image signal of a gradation level lower than a prescribed value in the remaining sub-frame periods.

According to a fourteenth aspect of the present invention, an image display method is provided for performing one frame of image display by a sum of time-integrated values of luminance displayed in an image display section in n sub-frame periods, where n is an odd number of 3 or greater, wherein:

the sub-frame periods are referred to as a first sub-frame period, a second sub-frame period, . . . the n'th sub-frame period from the sub-frame period which is earliest in terms of time or from the sub-frame period which is latest in terms of time; and the sub-frame period which is at a time-wise center of one frame period for image display is referred to as the m'th sub-frame period, where m=(n+1)/2; and (n+1)/2-number of threshold levels are provided for the gradation level of an input image signal, and the threshold levels are referred to as T1, T2, . . . T[(n+1)/2] from the smallest threshold level;

the method comprising the following steps:

when the gradation level of the input image signal is equal to or less than T1, the step of supplying, to the image display section, an image signal of a gradation level which is increased or decreased in accordance with the gradation level of the input image signal in the m'th sub-frame period, and an image signal of a relatively smallest gradation level or an image signal lower than a prescribed value in the other sub-frame periods;

when the gradation level of the input image signal is greater than T1 and equal to or less than T2, the step of supplying, to the image display section, an image signal of a relatively largest gradation level or an image signal of a gradation level greater than the prescribed value in them'th sub-frame period, an image signal of a gradation level which is increased or decreased in accordance with the gradation level of the input image signal in each of the (m−1)'th sub-frame period and the (m+1)'th sub-frame period, and an image signal of the relatively smallest gradation level or an image signal of a gradation level lower then the prescribed value in the other sub-frame periods;

when the gradation level of the input image signal is greater than T2 and equal to or less than T3, the step of supplying, to the image display section, an image signal of the relatively largest gradation level or an image signal of a gradation level greater than the prescribed value in each of the m'th sub-frame period, the (m−1)'th sub-frame period and the (m+1)'th sub-frame period, an image signal of a gradation level which is increased or decreased in accordance with the gradation level of the input image signal in each of the (m−2)'th sub-frame period and the (m+2)'th sub-frame period, and an image signal of the relatively smallest gradation level or an image signal of a gradation level lower than the prescribed value in the other sub-frame periods; and in this manner, when the gradation level of the input image signal is greater than Tx−1, wherein x is an integer of 4 or greater, and equal to or less than Tx, the step of supplying, to the image display section, an image signal of the relatively largest gradation level or an image of a gradation level greater than the prescribed value in each of the [m−(x−2)]'th sub-frame period through the [m+(x−2)]'th sub-frame period, an image signal of a gradation level which is increased or decreased in accordance with the gradation level of the input image signal in each of the [m−(x−1)]'th sub-frame period through the [m+(x−1)]'th sub-frame period, and an image signal of the relatively smallest gradation level or an image signal of a gradation level lower than the prescribed value in the other sub-frame periods.

According to a fifteenth aspect of the present invention, an image display method for performing one frame of image display by a sum of time-integrated values of luminance displayed in an image display section in n sub-frame periods, where n is an even number of 2 or greater, wherein:

the sub-frame periods are referred to as a first sub-frame period, a second sub-frame period, . . . the n'th sub-frame period from the sub-frame period which is earliest in terms of time or from the sub-frame period which is latest in terms of time; and two sub-frame periods which are closest to a time-wise center of one frame period for image display are referred to as the mist sub-frame period and the m2nd sub-frame period, where m1=n/2 and m2=n/2+1; and n/2-number of threshold levels are provided for the gradation level of an input image signal, and the threshold levels are referred to as T1, T2, . . . T[n/2] from the smallest threshold level;

the method comprising the following steps:

when the gradation level of the input image signal is equal to or less than T1, the step of supplying, to the image display section, an image signal of a gradation level which is increased or decreased in accordance with the gradation level of the input image signal in each of the m1st sub-frame periods and the m2nd sub-frame periods, and an image signal of a relatively smallest gradation level or an image signal of a gradation level lower than a prescribed value in the other sub-frame periods;

when the gradation level of the input image signal is greater than T1 and equal to or less than T2, the step of supplying, to the image display section, an image signal of a relatively largest gradation level or an image signal of a gradation level greater than the prescribed value in each of the mist sub-frame period and the m2nd sub-frame period, an image signal of a gradation level which is increased or decreased in accordance with the gradation level of the input image signal in each of the (m1−1)'th sub-frame periods and the (m2+1)'th sub-frame periods, and an image signal of the relatively smallest gradation level or an image signal of a gradation level lower than the prescribed value in the other sub-frame periods;

when the gradation level of the input image signal is greater than T2 and equal to or less than T3, the step of supplying, to the image display section, an image signal of the relatively largest gradation level or an image signal of a gradation level greater than the prescribed value in each of the mist sub-frame period, the m2nd sub-frame period, the (m1−1)'th sub-frame period and the (m2+1)'th sub-frame period, an image signal of a gradation level which is increased or decreased in accordance with the gradation level of the input image signal in each of the (m1−2)'th sub-frame periods and the (m2+2)'th sub-frame periods, and an image signal of the relatively smallest gradation level or an image signal of a gradation level lower than the prescribed value in the other sub-frame periods; and in this manner, when the gradation level of the input image signal is greater than Tx−1, wherein x is an integer of 4 or greater, and equal to or less than Tx, the step of supplying, to the image display section, an image signal of the relatively largest gradation level or an image signal of a gradation level greater than the prescribed value in each of the [m1−(x−2)]'th sub-frame periods through the [m2+(x−2)]'th sub-frame period, an image signal of a gradation level which is increased or decreased in accordance with the gradation level of the input image signal in each of the [m1−(x−1)]'th sub-frame periods through the [m2+(x−1)]'th sub-frame period, and an image signal of the relatively smallest gradation level or an image signal of a gradation level lower than the prescribed value in the other sub-frame periods.

According to a sixteenth aspect of the present invention, an image display method is provided for performing one frame of image display by a sum of time-integrated values of luminance displayed in an image display section in two sub-frame periods, wherein one of the sub-frame periods is referred to as a sub-frame period α, and the other sub-frame period is referred to as a sub-frame period β;

the method comprising the following steps:

when the gradation level of an input image signal is equal to or less than a threshold level uniquely determined, the step of supplying, to the image display section, an image signal of a gradation level which is increased or decreased by the gradation level of the input image signal in the sub-frame period α, and an image signal of a relatively smallest gradation level or an image signal of a gradation level lower than a prescribed value in the sub-frame period β; and when the gradation level of the input image signal is greater than the threshold level, the step of supplying, to the image display section, an image signal of a relatively largest gradation level or an image signal of a gradation level greater than the prescribed value in the sub-frame period α; and an image signal of a gradation level which is increased or decreased by the gradation level of the input image signal in the sub-frame period β.

According to a seventeenth aspect of the present invention, an image display method is provided for performing one frame of image display by a sum of time-integrated values of luminance displayed in an image display section in two sub-frame periods, wherein one of the sub-frame periods is referred to as a sub-frame period α, and the other sub-frame period is referred to as a sub-frame period β; and threshold levels, T1 and T2, of the gradation levels in the two sub-frame periods are defined, and the threshold level T2 is greater than the threshold level T1;

the method comprising the following steps:

when the gradation level of an input image signal of supplying, to the image display section, an image signal of a gradation level which is increased or decreased in accordance with the gradation level of the input image signal in the sub-frame period α, and an image signal of a relatively smallest gradation level or an image signal of a gradation level lower than a prescribed value in the sub-frame period β;

when the gradation level of the input image signal is greater than the threshold level T1 and equal to or less than the threshold level T2, the step of supplying, to the image display section, an image signal of a gradation level which is increased or decreased in accordance with the gradation level of the input image signal in the sub-frame period α, and an image signal of a gradation level which is lower than the gradation level supplied in the sub-frame period α and which is increased or decreased in accordance with the gradation level of the input image signal in the sub-frame period β; and when the gradation level of the input image signal is greater than the threshold level T2, the step of supplying, to the image display section, an image signal of a relatively largest gradation level or an image signal of a gradation level which is greater than the prescribed value in the sub-frame period α, and an image signal of a gradation level which is increased or decreased in accordance with the gradation level of the input image signal in the sub-frame period β.

According to an eighteenth aspect of the present invention, an image display method is provided for performing one frame of image display by a sum of time-integrated values of luminance displayed in an image display section in two sub-frame periods, wherein one of the sub-frame periods is referred to as a sub-frame period α, and the other sub-frame period is referred to as a sub-frame period β; threshold levels, T1 and T2, of the gradation levels in the two sub-frame periods are defined, and the threshold level T2 is greater than the threshold level T1; and a gradation level L is uniquely determined;

the method comprising the following steps:

when the gradation level of an input image signal is equal to or less than the threshold level T1, the step of supplying, to the image display section, an image signal of a gradation level which is increased or decreased in accordance with the gradation level of the input image signal in the sub-frame period α, and an image signal of a relatively smallest gradation level or an image signal of a gradation level lower than a prescribed level in the sub-frame period β;

when the gradation level of the input image signal is greater than the threshold level T1 and equal to or less than the threshold level T2, the step of supplying, to the image display section, an image signal of the gradation level L in the sub-frame period α, and an image signal of a gradation level which is increased or decreased in accordance with the gradation level of the input image signal in the sub-frame period β; and when the gradation level of the input image signal is greater than the threshold level T2, the step of supplying, to the image display section, an image signal of a gradation level which is increased or decreased in accordance with the gradation level of the input image signal in the sub-frame period α, and an image signal of a relatively largest gradation level or an image signal of a gradation level greater than the prescribed value in the sub-frame period β.

According to a nineteenth aspect of the present invention, an image display method is provided for performing one frame of image display by a sum of time-integrated values of luminance displayed in an image display section in two sub-frame periods, wherein one of the sub-frame periods is referred to as a sub-frame period α, and the other sub-frame period is referred to as a sub-frame period β;

the method comprising the following steps:

generating an image in an intermediate state in terms of time through estimation based on two frames of images continuously input;

in the sub-frame period α, when the gradation level of an input image signal is equal to or less than a threshold level uniquely determined, the step of supplying, to the image display section, an image signal of a gradation level which is increased or decreased in accordance with the gradation level of the input image signal; and when the gradation level of the input image signal is greater than the threshold level, the step of supplying, to the image display section, an image signal of a relatively largest gradation level or an image signal of a gradation level greater than a prescribed value; and in the sub-frame period β, when the gradation level of the image signal in the intermediate state is equal to or less than the threshold level, the step of supplying, to the image display section, an image signal of a relatively smallest gradation level or an image signal of a gradation level lower than the prescribed value; and when the gradation level of the image signal in the intermediate state is greater than the threshold level, the step of supplying, to the image display section, an image signal of a gradation level which is increased or decreased in accordance with the gradation level of the image signal in the intermediate state.

According to a twentieth aspect of the present invention, an image display method is provided for performing one frame of image display by a sum of time-integrated values of luminance displayed in an image display section in two sub-frame periods, wherein one of the sub-frame periods is referred to as a sub-frame period α, and the other sub-frame period is referred to as a sub-frame period β;

the method comprising the following steps:

in the sub-frame period α, when the gradation level of an input image signal is equal to or less than a threshold level uniquely determined, the step of supplying, to the image display section, an image signal of a gradation level which is increased or decreased in accordance with the gradation level of the input image signal; and when the gradation level of the input image signal is greater than the threshold level, the step of supplying, to the image display section, an image signal of a relatively largest gradation level or an image signal of a gradation level greater than a prescribed value; and in the sub-frame period β, when an average value of the gradation level of the image signal in the current frame period and the gradation level of an image signal input one frame before or one frame after is equal to or less than the threshold level, the step of supplying, to the image display section, an image signal of a relatively smallest gradation level or an image signal of a gradation level lower than the prescribed value; and when the average value is greater than the threshold level, the step of supplying, to the image display section, an image signal of a gradation level which is increased or decreased in accordance with the average value.

According to a twenty first aspect of the present invention, a computer program is provided for allowing a computer to execute an image display method according to the thirteenth aspect of the present invention.

According to a twenty second aspect of the present invention, a computer-readable recording medium having a computer program according to the twenty first aspect of the present invention stored thereon.

According to a twenty third aspect of the present invention, a method of supplying, for display, an image of an input image signal including at least a moving object portion and a background portion, wherein a frame period is divided into a plurality of sub-frame periods including at least an α sub-frame period and a β sub-frame period, comprising:

supplying a gradation level of an input image signal to an image display section, wherein when both the moving object portion and background portion are of a luminance level below 50% of a relatively largest luminance, then a luminance level of a relatively smallest value is supplied in at least a β sub-frame period of the plurality of sub-frame periods, and wherein, when both the moving object portion and background portion are of a luminance level of at least 50% of relatively largest luminance, then a luminance level of a relatively largest value is supplied in at least an α sub-frame period of the plurality of sub-frame periods.

In a first embodiment of the twenty third aspect of the present invention, the plurality of sub-frame periods is two sub-frame periods.

According to a twenty fourth aspect of the present invention, a method of displaying is provided, including the method of the twenty third, further comprising:

displaying the input image signal at the supplied gradation level.

According to a twenty fifth aspect of the present invention, a method of displaying including the method of the first embodiment of the twenty third aspect of the present invention, further comprising:

displaying the input image signal at the supplied gradation level.

In one embodiment of the twenty fifth aspect of the present invention, when a response time of the image display section to a decrease in the luminance level is relatively shorter than a response time of the image display section to an increase in the luminance level, the a sub-frame period is assigned to a second sub-frame period of the two sub-frame periods; and when the response time of the image display section to the decrease in the luminance level is longer than the response time of the image display section to the increase in the luminance level, the sub-frame period $\alpha$ is assigned to a first sub-frame period of the two sub-frame periods.

According to a twenty sixth aspect of the present invention, a device for performing the method of the twenty fifth aspect of the present invention, wherein a response time of the image display section to a decrease in the luminance level is relatively shorter than a response time of the image display section to an increase in the luminance level, and the $\alpha$ sub-frame period is assigned to a second sub-frame period of the two sub-frame periods.

According to a twenty seventh aspect of the present invention, a device for performing the method of the twenty fifth aspect of the present invention, wherein a response of the image display section to the decrease in the luminance level is longer than the response time of the image display section to the increase in the luminance level, and the sub-frame period $\alpha$ is assigned to a first sub-frame period of the two sub-frame periods.

According to a twenty eighth aspect of the present invention, a computer program for allowing a computer to execute a method according to the twenty third aspect of the present invention.

According to a twenty ninth aspect of the present invention, a computer program for allowing a computer to execute a method according to the first embodiment of the twenty third aspect of the present invention.

According to a thirtieth aspect of the present invention, a computer program for allowing a computer to execute a method according to the twenty fourth aspect of the present invention.

According to a thirty first aspect of the present invention, a computer program for allowing a computer to execute a method according to the twenty fifth aspect of the present invention.

According to a thirty second aspect of the present invention, a computer program for allowing a computer to execute a method according to the embodiment of the twenty second of the present invention.

According to a thirty third aspect of the present invention, a computer-readable recording medium having a computer program according to the twenty eighth aspect of the present invention.

According to a thirty fourth aspect of the present invention, a computer-readable recording medium having a computer program according to the twenty ninth aspect of the present invention.

According to a thirty fifth aspect of the present invention, a computer-readable recording medium having a computer program according to the thirtieth aspect of the present invention.

According to a thirty sixth aspect of the present invention, a computer-readable recording medium having a computer program according to the thirty third aspect of the present invention.

According to a thirty seventh aspect of the present invention, a computer-readable recording medium having a computer program according to the thirty second aspect of the present invention.

According to a thirty eighth aspect of the present invention, a method is provided for supplying, for display, an image of an input image signal including at least a moving object portion and a background portion, wherein a frame period is divided into a plurality of sub-frame periods, comprising:

supplying a gradation level of an input image signal to an image display section, wherein when a luminance level of the moving object supplied in a first sub-frame period is of a luminance level relatively smaller than the luminance level supplied in a second sub-frame period, then a luminance level of the background supplied in the first sub-frame period is also of a luminance level relatively smaller than the luminance level supplied in the second sub-frame period, and wherein when a luminance level of the moving object supplied in a first sub-frame period is of a luminance level relatively larger than the luminance level supplied in a second sub-frame period, then a luminance level of the background supplied in the first sub-frame period is also of a luminance level relatively larger than the luminance level supplied in the second sub-frame period.

In one embodiment of the thirty eight aspect of the present invention, the plurality of sub-frame periods is two sub-frame periods.

According to a thirty ninth aspect of the present invention, a method of displaying including the method of the thirty eighth aspect of the present invention, further comprises:

displaying the input image signal at the supplied gradation level.

According to a fortieth aspect of the present invention, a method of displaying including the method of the embodiment of the thirty eighth aspect of the present invention, further comprises:

displaying the input image signal at the supplied gradation level.

According to a forty first aspect of the present invention, a computer program for allowing a computer to execute a method according to the thirty eighth aspect of the present invention.

According to a forty second aspect of the present invention, a computer program for allowing a computer to execute a method according to the embodiment of the thirty eighth aspect of the present invention.

According to a forty third aspect of the present invention, a computer program for allowing a computer to execute a method according to the thirty ninth aspect of the present invention.

According to a forty fourth aspect of the present invention, a computer program for allowing a computer to execute a method according to the forty aspect of the present invention.

According to a forty fifth aspect of the present invention, a computer program for allowing a computer to execute a method according to the forty first aspect of the present invention.

According to a forty sixth aspect of the present invention, a computer program for allowing a computer to execute a method according to the forty second aspect of the present invention.

According to a forty seventh aspect of the present invention, a computer program for allowing a computer to execute a method according to the forty third aspect of the present invention.

According to a forty eighth aspect of the present invention, a computer program for allowing a computer to execute a method according to the forty fourth aspect of the present invention.

According to a forty ninth aspect of the present invention, an apparatus is provided for displaying an image of an input image signal including at least a moving object portion and a background portion, wherein a frame period is divided into a plurality of sub-frame periods including at least an α sub-frame period and a β sub-frame period, comprising:

means for supplying a gradation level of an input image signal; and means for displaying the image signal at the supplied gradation, wherein when both the moving object portion and background portion are of a luminance level below 50% of relatively largest luminance, then a luminance level of a relatively smallest value is supplied in at least a β sub-frame period of the plurality of sub-frame periods, and wherein, when both the moving object portion and background portion are of a luminance level of at least 50% of relatively largest luminance, then a luminance level of a relatively largest value is supplied in at least an a sub-frame period of the plurality of sub-frame periods.

In one embodiment of the forty ninth aspect of the present invention, the plurality of sub-frame periods is two sub-frame periods.

In one embodiment of this invention, when a response time of the means for displaying to a decrease in the luminance level is relatively shorter than a response time of the means for displaying to an increase in the luminance level, the α sub-frame period is assigned to a second sub-frame period of the two sub-frame periods; and when the response time of the means for displaying to the decrease in the luminance level is longer than the response time of the means for displaying to the increase in the luminance level, the sub-frame period α is assigned to a first sub-frame period of the two sub-frame periods.

In one embodiment of this invention, a response time of the means for displaying to a decrease in the luminance level is relatively shorter than a response time of the means for displaying to an increase in the luminance level, and the α sub-frame period is assigned to a second sub-frame period of the two sub-frame periods.

In one embodiment of this invention, a response of the means for displaying to the decrease in the luminance level is longer than the response time of the means for displaying to the increase in the luminance level, and the sub-frame period α is assigned to a first sub-frame period of the two sub-frame periods.

According to a fiftieth aspect of the present invention, an apparatus is provided for displaying an image of an input image signal including at least a moving object portion and a background portion, wherein a frame period is divided into a plurality of sub-frame periods, comprising:

means for supplying a gradation level of an input image signal; and means for displaying the input image signal at the supplied gradation, wherein when a luminance level of the moving object supplied in a first sub-frame period is of a luminance level relatively smaller than the luminance level supplied in a second sub-frame period, then a luminance level of the background supplied in the first sub-frame period is also of a luminance level relatively smaller than the luminance level supplied in the second sub-frame period, and wherein when a luminance level of the moving object supplied in a first sub-frame period is of a luminance level relatively larger than the luminance level supplied in a second sub-frame period, then a luminance level of the background supplied in the first sub-frame period is also of a luminance level relatively larger than the luminance level supplied in the second sub-frame period.

In one embodiment of this invention, the plurality of sub-frame periods is two sub-frame periods.

According to a fifty first aspect of the present invention, an apparatus for displaying an image of an input image signal including at least a moving object portion and a background portion, wherein a frame period is divided into a plurality of sub-frame periods including at least an α sub-frame period and a β sub-frame period, comprising:

a display control section, adapted to supply a gradation level of an input image signal; and an image display section, adapted to display the image signal at the supplied gradation, wherein when both the moving object portion and background portion are of a luminance level below 50% of relatively largest luminance, then a luminance level of a relatively smallest value is supplied in at least a β sub-frame period of the plurality of sub-frame periods, and wherein, when both the moving object portion and background portion are of a luminance level of at least 50% of relatively largest luminance, then a luminance level of a relatively largest is supplied in at least an α sub-frame period of the plurality of sub-frame periods.

In one embodiment of this invention, the plurality of sub-frame periods is two sub-frame periods.

In one embodiment of this invention, when a response time of the image display section to a decrease in the luminance level is relatively shorter than a response time of the image display section to an increase in the luminance level, the α sub-frame period is assigned to a second sub-frame period of the two sub-frame periods; and when the response time of the image display section to the decrease in the luminance level is longer than the response time of the image display section to the increase in the luminance level, the sub-frame period α is assigned to a first sub-frame period of the two sub-frame periods.

In one embodiment of this invention, a response time of the image display section to a decrease in the luminance level is relatively shorter than a response time of the image display section to an increase in the luminance level, and the α sub-frame period is assigned to a second sub-frame period of the two sub-frame periods.

In one embodiment of this invention, a response of the image display section to the decrease in the luminance level is longer than the response time of the image display section to the increase in the luminance level, and the sub-frame period α is assigned to a first sub-frame period of the two sub-frame periods.

According to a fifty second aspect of the present invention, an apparatus is provided for displaying an image of an input image signal including at least a moving object portion and a background portion, wherein a frame period is divided into a plurality of sub-frame periods, comprising:

a display control section, adapted to supply a gradation level of an input image signal; and an image display section, adapted to display the input image signal at the supplied gradation, wherein when a luminance level of the moving object supplied in a first sub-frame period is of a luminance level relatively smaller than the luminance level supplied in a second sub-frame period, then a luminance level of the background supplied in the first sub-frame period is also of a luminance level relatively smaller than the luminance level supplied in the second sub-frame period, and wherein when a luminance level of the moving object supplied in a first sub-frame period is of a luminance level relatively larger than the luminance level supplied in a second sub-frame period, then a luminance level of the background supplied in the first sub-frame period is also of a luminance level relatively larger than the luminance level supplied in the second sub-frame period.

In one embodiment of this invention, the plurality of sub-frame periods is two sub-frame periods.

According to a fifty third aspect of the present invention, a method of supplying, for display, an image of an input image signal, wherein a frame period is divided into a plurality of sub-frames, comprising:

supplying a gradation level of an input image signal to an image display section, wherein a relatively largest luminance value is supplied in at least one relatively central of the plurality of sub-frames with relatively smallest luminance values being supplied in sub-frames relatively furthest from the relatively central of the plurality of sub-frames.

In a first embodiment of this invention, when the gradation level is at least 50% of relatively largest luminance, then a luminance level of a relatively largest luminance value is supplied to at least one relatively central sub-frame.

In a second embodiment of this invention, when the gradation level is less than 50% of the relatively largest luminance level, then a luminance level of a relatively smallest value is supplied in sub-frames relatively furthest from the relatively central of the plurality of sub-frames.

In a third embodiment of this invention, when the gradation level is less than 50% of the relatively largest luminance level, then a luminance level of a relatively smallest value is supplied in sub-frames relatively furthest from the relatively central of the plurality of sub-frames.

In fourth embodiment of this invention, when the plurality of sub-frames is odd in number, a relatively largest luminance value is supplied in at least one central sub-frame, and when the plurality of sub-frames is even in number, a relatively largest luminance value is supplied in at least two relatively central sub-frames.

According to a fifty fourth aspect of the present invention, a method of displaying including the method of the fifty third aspect of the present invention, further comprises:

displaying the input image signal at the supplied gradation level.

According to a fifty fifth aspect of the present invention, a computer program for allowing a computer to execute a method according to the fifty third aspect of the present invention.

According to a fifty sixth aspect of the present invention, a computer program for allowing a computer to execute a method according to the first embodiment of the fifty third aspect of the present invention.

According to a fifty seventh aspect of the present invention, a computer program for allowing a computer to execute a method according to the second embodiment of the fifty third aspect of the present invention.

According to a fifty eighth aspect of the present invention, a computer program for allowing a computer to execute a method according to the third embodiment of the fifty third aspect of the present invention.

According to a fifty ninth aspect of the present invention, a computer program for allowing a computer to execute a method according to the fourth embodiment of the fifty third aspect of the present invention.

According to a sixty aspect of the present invention, a computer program for allowing a computer to execute a method according to the fifty fourth aspect of the present invention.

According to a sixty first aspect of the present invention, a computer program for allowing a computer to execute a method according to the fifty fifth aspect of the present invention.

According to a sixty second aspect of the present invention, a computer program for allowing a computer to execute a method according to the fifty sixth aspect of the present invention.

According to a sixty third aspect of the present invention, a computer program for allowing a computer to execute a method according to the fifty seventh aspect of the present invention.

According to a sixty fourth aspect of the present invention, a computer program for allowing a computer to execute a method according to the fifty eighth aspect of the present invention.

According to a sixty fifth aspect of the present invention, a computer program for allowing a computer to execute a method according to the fifty ninth aspect of the present invention.

According to a sixty sixth aspect of the present invention, a computer program for allowing a computer to execute a method according to the sixty aspect of the present invention.

According to a sixty seventh aspect of the present invention, a method of supplying, for display, an image of an input image signal, wherein a frame period is divided into a plurality of sub-frames, comprising:

supplying a gradation level of an input image signal to an image display section, wherein luminance values of the gradation level are relatively lowered for sub-frames relatively outward from a relatively central of the plurality of sub-frames.

In a first embodiment of this invention, when the gradation level is at least 50% of relatively largest luminance, then a luminance level of a relatively largest luminance value is supplied to at least one relatively central of the plurality of sub-frames.

In a second embodiment of this invention, when the gradation level is less than 50% of the relatively largest luminance level, then a luminance level of a relatively smallest value is supplied in sub-frames relatively furthest from the relatively central of the plurality of sub-frames.

In a third embodiment of this invention, when the gradation level is less than 50% of the relatively largest luminance level, then a luminance level of a relatively smallest value is supplied in sub-frames relatively furthest from the relatively central of the plurality of sub-frames.

In a fourth embodiment of this invention, when the plurality of sub-frames is odd in number, a relatively largest luminance value is supplied in at least one central sub-frame, and when the plurality of sub-frames is even in number, a relatively largest luminance value is supplied in at least two relatively central sub-frames.

According to a sixty eighth aspect of the present invention, a method of displaying including the method of the sixty seventh aspect of the present invention, further comprising:

displaying the input image signal at the supplied gradation level.

According to a sixty ninth aspect of the present invention, a computer program for allowing a computer to execute a method according to the sixty seventh aspect of the present invention.

According to a seventieth aspect of the present invention, a computer program for allowing a computer to execute a method according to the first embodiment of the sixty seventh aspect of the present invention.

According to a seventy first aspect of the present invention, a computer program for allowing a computer to execute a method according to the second embodiment of the sixty seventh aspect of the present invention.

According to a seventy second aspect of the present invention, a computer program for allowing a computer to execute a method according to the third embodiment of the sixty seventh aspect of the present invention.

According to a seventy third aspect of the present invention, a computer program for allowing a computer to execute a method according to the fourth embodiment of the sixty seventh aspect of the present invention.

According to a seventy fourth aspect of the present invention, a computer program for allowing a computer to execute a method according to the sixty eighth aspect of the present invention.

According to a seventy fifth aspect of the present invention, a computer program for allowing a computer to execute a method according to the sixty ninth aspect of the present invention.

According to a seventy sixth aspect of the present invention, a computer program for allowing a computer to execute a method according to the seventieth aspect of the present invention.

According to a seventy seventh aspect of the present invention, a computer program for allowing a computer to execute a method according to the seventy first aspect of the present invention.

According to a seventy eighth aspect of the present invention, a computer program for allowing a computer to execute a method according to the seventy second aspect of the present invention.

According to a seventy ninth aspect of the present invention, a computer program for allowing a computer to execute a method according to the seventy third aspect of the present invention.

According to an eightieth aspect of the present invention, a computer program for allowing a computer to execute a method according to the seventy fourth aspect of the present invention.

According to an eighty first aspect of the present invention, an apparatus is provided for displaying an image of an input image signal, wherein a frame period is divided into a plurality of sub-frames, comprising:

means for supplying a gradation level of an input image signal; and means for displaying the input image signal at a supplied gradation level, wherein a relatively largest luminance value is supplied in at least one relatively central of the plurality of sub-frames with relatively smallest luminance values being supplied in sub-frames relatively furthest from the relatively central of the plurality of sub-frames.

In a first embodiment of this invention, when the gradation level is at least 50% of relatively largest luminance, then a luminance level of a relatively largest luminance value is supplied to at least one relatively central sub-frame.

In a second embodiment of this invention, when the gradation level is less than 50% of the relatively largest luminance level, then a luminance level of a relatively smallest value is supplied in sub-frames relatively furthest from the relatively central of the plurality of sub-frames.

In a second embodiment of this invention, when the gradation level is less than 50% of the relatively largest luminance level, then a luminance level of a relatively smallest value is supplied in sub-frames relatively furthest from the relatively central of the plurality of sub-frames.

In a third embodiment of this invention, when the plurality of sub-frames is odd in number, a relatively largest luminance value is supplied in at least one central sub-frame, and when the plurality of sub-frames is even in number, a relatively largest luminance value is supplied in at least two relatively central sub-frames.

According to an eighty second aspect of the present invention, an apparatus is provided for displaying an image of an input image signal, wherein a frame period is divided into a plurality of sub-frames, comprising:

a display control section, adapted to supply a gradation level of an input image signal; and an image display section, adapted to display the input image signal at a supplied gradation level, wherein a relatively largest luminance value is supplied in at least one relatively central of the plurality of sub-frames with relatively smallest luminance values being supplied in sub-frames relatively furthest from the relatively central of the plurality of sub-frames.

In a first embodiment of this invention, when the gradation level is at least 50% of relatively largest luminance, then a luminance level of a relatively largest luminance value is supplied to at least one relatively central sub-frame.

In a second embodiment of this invention, when the gradation level is less than 50% of the relatively largest luminance level, then a luminance level of a relatively smallest value is supplied in sub-frames relatively furthest from the relatively central of the plurality of sub-frames.

In a third embodiment of this invention, when the gradation level is less than 50% of the relatively largest luminance level, then a luminance level of a relatively smallest value is supplied in sub-frames relatively furthest from the relatively central of the plurality of sub-frames.

In a fourth embodiment of this invention, when the plurality of sub-frames is odd in number, a relatively largest luminance value is supplied in at least one central sub-frame, and when the plurality of sub-frames is even in number, a relatively largest luminance value is supplied in at least two relatively central sub-frames.

According to an eighty third aspect of the present invention, an apparatus is provided for displaying an image of an input image signal, wherein a frame period is divided into a plurality of sub-frames, comprising:

means for supplying a gradation level of an input image signal; and means for displaying the input image signal at the supplied gradation level, wherein luminance values of the gradation level are relatively lowered for sub-frames relatively outward from a relatively central of the plurality of sub-frames.

In a first embodiment of this invention, when the gradation level is at least 50% of relatively largest luminance, then a luminance level of a relatively largest luminance value is supplied to at least one relatively central of the plurality of sub-frames.

In a second embodiment of this invention, when the gradation level is less than 50% of the relatively largest luminance level, then a luminance level of a relatively smallest value is supplied in sub-frames relatively furthest from the relatively central of the plurality of sub-frames.

In a third embodiment of this invention, when the gradation level is less than 50% of the relatively largest luminance level, then a luminance level of a relatively smallest value is supplied in sub-frames relatively furthest from the relatively central of the plurality of sub-frames.

In a fourth embodiment of this invention, when the plurality of sub-frames is odd in number, a relatively largest luminance value is supplied in at least one central sub-frame, and when the plurality of sub-frames is even in number, a relatively largest luminance value is supplied in at least two relatively central sub-frames.

According to an eighty fourth aspect of the present invention, an apparatus is provided for displaying an image of an input image signal, wherein a frame period is divided into a plurality of sub-frame periods, comprising:

a display control section, adapted to supply a gradation level of an input image signal; and an image display section, adapted to display the input image signal at the supplied gradation level, wherein luminance values of the gradation level are relatively lowered for sub-frames relatively outward from a relatively central of the plurality of sub-frames.

In a first embodiment of this invention, when the gradation level is at least 50% of relatively largest luminance, then a luminance level of a relatively largest luminance value is supplied to at least one relatively central of the plurality of sub-frames.

In a second embodiment of this invention, when the gradation level is less than 50% of the relatively largest luminance level, then a luminance level of a relatively smallest value is supplied in sub-frames relatively furthest from the relatively central of the plurality of sub-frames.

In a third embodiment of this invention, when the gradation level is less than 50% of the relatively largest luminance level, then a luminance level of a relatively smallest value is supplied in sub-frames relatively furthest from the relatively central of the plurality of sub-frames.

In a fourth embodiment of this invention, when the plurality of sub-frames is odd in number, a relatively largest luminance value is supplied in at least one central sub-frame, and when the plurality of sub-frames is even in number, a relatively largest luminance value is supplied in at least two relatively central sub-frames.

According to an eighty fifth aspect of the present invention, a computer program is provided for allowing a computer to execute an image display method according to the fourteenth aspect of the present invention.

According to an eighty sixth aspect of the present invention, a computer-readable recording medium having a computer program according to the eighty fifth aspect of the present invention stored thereon.

According to an eighty seventh aspect of the present invention, a computer program for allowing a computer to execute an image display method according to the fifteenth aspect of the present invention.

According to an eighty eighth aspect of the present invention, a computer-readable recording medium having a computer program according to the eighty seventh aspect of the present invention stored thereon.

According to an eighty ninth aspect of the present invention, a computer program for allowing a computer to execute an image display method according to the sixteenth aspect of the present invention.

According to a ninetieth aspect of the present invention, a computer-readable recording medium having a computer program according to the eighty ninth aspect of the present invention stored thereon.

According to a ninety first aspect of the present invention, a computer program for allowing a computer to execute an image display method according to the seventeenth aspect of the present invention.

According to a ninety second aspect of the present invention, a computer-readable recording medium having a computer program according to the ninety first aspect of the present invention stored thereon.

According to a ninety third aspect of the present invention, a computer program for allowing a computer to execute an image display method according to the eighteenth aspect of the present invention.

According to a ninety fourth aspect of the present invention, a computer-readable recording medium having a computer program according to the ninety third aspect of the present invention stored thereon.

According to a ninety fifth aspect of the present invention, a computer program for allowing a computer to execute an image display method according to the nineteenth aspect of the present invention.

According to a ninety sixth aspect of the present invention, a computer-readable recording medium having a computer program according to the ninety fifth aspect of the present invention stored thereon.

According to a ninety seventh aspect of the present invention, a computer program for allowing a computer to execute an image display method according to the twentieth aspect of the present invention.

According to a ninety eighth aspect of the present invention, a computer-readable recording medium having a computer program according to the ninety seventh aspect of the present invention stored thereon.

According to a ninety ninth aspect of the present invention, an electronic apparatus is provided for performing image display on a display screen of an image display section of an image display apparatus according to the first aspect of the present invention.

According to a hundredth aspect of the present invention, a liquid crystal TV is provided, comprising:

an image display apparatus according to the second aspect of the present invention; and a tuner section for outputting a TV broadcast signal of a selected channel to the display control section of the image display apparatus.

According to a hundred first aspect of the present invention, a liquid crystal monitoring apparatus is provided, comprising:

an image display apparatus according to the second aspect of the present invention; and a signal processing section for outputting a monitor image signal, obtained by processing an external monitor signal, to the display control section of the image display apparatus.

According to a hundred second aspect of the present invention, an electronic apparatus for performing image display on a display screen of an image display section of an image display apparatus according to the second aspect of the present invention.

According to a hundred third aspect of the present invention, a liquid crystal TV is provided, comprising:

an image display apparatus according to the third aspect of the present invention; and a tuner section for outputting a TV broadcast signal of a selected channel to the display control section of the image display apparatus.

According to a hundred fourth aspect of the present invention, a liquid crystal monitoring apparatus is provided, comprising:

an image display apparatus according to the third aspect of the present invention; and a signal processing section for outputting a monitor image signal, obtained by processing an external monitor signal, to the display control section of the image display apparatus.

According to a hundred fifth aspect of the present invention, an electronic apparatus for performing image display on a display screen of an image display section of an image display apparatus according to the third aspect of the present invention.

According to a hundred sixth aspect of the present invention, a liquid crystal TV is provided, comprising:

an image display apparatus according to the fourth aspect of the present invention; and a tuner section for outputting a TV broadcast signal of a selected channel to the display control section of the image display apparatus.

According to a hundred seventh aspect of the present invention, a liquid crystal monitoring apparatus, comprising:

an image display apparatus according to the fourth aspect of the present invention; and a signal processing section for outputting a monitor image signal, obtained by processing an external monitor signal, to the display control section of the image display apparatus.

According to a hundred eighth aspect of the present invention, an electronic apparatus for performing image display on a display screen of an image display section of an image display apparatus according to the fourth aspect of the present invention.

According to a hundred ninth aspect of the present invention, a liquid crystal TV is provided, comprising:

an image display apparatus according to the fifth aspect of the present invention; and a tuner section for outputting a TV broadcast signal of a selected channel to the display control section of the image display apparatus.

According to a hundred tenth aspect of the present invention, a liquid crystal monitoring apparatus is provided, comprising:

an image display apparatus according to the fifth aspect of the present invention; and a signal processing section for outputting a monitor image signal, obtained by processing an external monitor signal, to the display control section of the image display apparatus.

According to a hundred eleventh aspect of the present invention, an electronic apparatus is provided for performing image display on a display screen of an image display section of an image display apparatus according to the fifth aspect of the present invention.

According to a hundred twelfth aspect of the present invention, a liquid crystal TV is provided, comprising:

an image display apparatus according to the sixth aspect of the present invention; and a tuner section for outputting a TV broadcast signal of a selected channel to the display control section of the image display apparatus.

According to a hundred thirteenth aspect of the present invention, a liquid crystal monitoring apparatus, comprising:

an image display apparatus according to the sixth aspect of the present invention; and a signal processing section for outputting a monitor image signal, obtained by processing an external monitor signal, to the display control section of the image display apparatus.

According to a hundred fourteenth aspect of the present invention, an electronic apparatus for performing image display on a display screen of an image display section of an image display apparatus according to the sixth aspect of the present invention.

According to a hundred fifteenth aspect of the present invention, a liquid crystal TV, comprising:

an image display apparatus according to the seventh aspect of the present invention; and a tuner section for outputting a TV broadcast signal of a selected channel to the display control section of the image display apparatus.

According to a hundred sixteenth aspect of the present invention, a liquid crystal monitoring apparatus is provided, comprising:

an image display apparatus according to the seventh aspect of the present invention; and a signal processing section for outputting a monitor image signal, obtained by processing an external monitor signal, to the display control section of the image display apparatus.

According to a hundred seventeenth aspect of the present invention, an electronic apparatus for performing image display on a display screen of an image display section of an image display apparatus according to the seventh aspect of the present invention.

According to a hundred eighteenth aspect of the present invention, a liquid crystal TV, comprising:

an image display apparatus according to the eighth aspect of the present invention; and a tuner section for outputting a TV broadcast signal of a selected channel to the display control section of the image display apparatus.

According to a hundred nineteenth aspect of the present invention, a liquid crystal monitoring apparatus, comprising:

an image display apparatus according to the eighth aspect of the present invention; and a signal processing section for outputting a monitor image signal, obtained by processing an external monitor signal, to the display control section of the image display apparatus.

According to a hundred twentieth aspect of the present invention, an electronic apparatus for performing image display on a display screen of an image display section of an image display apparatus according to the eighth aspect of the present invention.

According to a hundred twenty first aspect of the present invention, a liquid crystal TV, comprising:

an image display apparatus according to the ninth aspect of the present invention; and a tuner section for outputting a TV broadcast signal of a selected channel to the display control section of the image display apparatus.

According to a hundred twenty second aspect of the present invention, a liquid crystal monitoring apparatus, comprising:

an image display apparatus according to the ninth aspect of the present invention; and a signal processing section for outputting a monitor image signal, obtained by processing an external monitor signal, to the display control section of the image display apparatus.

According to a hundred twenty third aspect of the present invention, an electronic apparatus for performing image display on a display screen of an image display section of an image display apparatus according to the ninth aspect of the present invention.

According to a hundred twenty fourth aspect of the present invention, a liquid crystal TV is provided, comprising:

an apparatus for displaying according to the fifty first aspect of the present invention; and a tuner section for outputting a TV broadcast signal of a selected channel to the display control section of the apparatus for displaying.

According to a hundred twenty fifth aspect of the present invention, a liquid crystal monitoring apparatus, comprising:

an apparatus for displaying according to the fifty first aspect of the present invention; and a signal processing section for outputting a monitor image signal, obtained by processing an external monitor signal, to the display control section of the apparatus for displaying.

According to a hundred twenty sixth aspect of the present invention, an electronic apparatus for performing image display on a display screen of an image display section of an apparatus for displaying according to the fifty first aspect of the present invention.

According to a hundred twenty seventh aspect of the present invention, a liquid crystal TV, comprising:

an apparatus for displaying according to the fifty second aspect of the present invention; and a tuner section for outputting a TV broadcast signal of a selected channel to the display control section of the apparatus for displaying.

According to a hundred twenty eighth aspect of the present invention, a liquid crystal monitoring apparatus, comprising:

an apparatus for displaying according to the fifty second aspect of the present invention; and a signal processing section for outputting a monitor image signal, obtained by processing an external monitor signal, to the display control section of the apparatus for displaying.

According to a hundred twenty ninth aspect of the present invention, an electronic apparatus for performing image display on a display screen of an image display section of an apparatus for displaying according to the fifty second aspect of the present invention.

According to a hundred thirtieth aspect of the present invention, a liquid crystal TV, comprising:

an apparatus for displaying according to the eighty second aspect of the present invention; and a tuner section for outputting a TV broadcast signal of a selected channel to the display control section of the apparatus for displaying.

According to a hundred thirty first aspect of the present invention, a liquid crystal monitoring apparatus, comprising:

an apparatus for displaying according to the eighty second aspect of the present invention; and a signal processing section for outputting a monitor image signal, obtained by processing an external monitor signal, to the display control section of the apparatus for displaying.

According to a hundred thirty second aspect of the present invention, an electronic apparatus for performing image display on a display screen of an image display section of an apparatus for displaying according to the eighty second aspect of the present invention.

According to a hundred thirty third aspect of the present invention, a liquid crystal TV, comprising:

an apparatus for displaying according to the eighty fourth aspect of the present invention; and a tuner section for outputting a TV broadcast signal of a selected channel to the display control section of the apparatus for displaying.

According to a hundred thirty fourth aspect of the present invention, a liquid crystal monitoring apparatus, comprising:

an apparatus for displaying according to the eighty fourth aspect of the present invention; and a signal processing section for outputting a monitor image signal, obtained by processing an external monitor signal, to the display control section of the apparatus for displaying.

According to a hundred thirty fifth aspect of the present invention, an electronic apparatus for performing image display on a display screen of an image display section of an apparatus for displaying according to the eight fourth aspect of the present invention.

According to a hundred thirty sixth aspect of the present invention, a liquid crystal TV, comprising:

an apparatus for displaying according to the forty ninth aspect of the present invention; and a tuner section for outputting a TV broadcast signal of a selected channel to the means for supplying of the apparatus for displaying.

According to a hundred thirty seventh aspect of the present invention, a liquid crystal monitoring apparatus, comprising:

an apparatus for displaying according to the forty ninth aspect of the present invention; and a signal processing section for outputting a monitor image signal, obtained by processing an external monitor signal, to the means for supplying of the apparatus for displaying.

According to a hundred thirty eighth aspect of the present invention, an electronic apparatus for performing image display on a display screen of the means for displaying of an apparatus for displaying according to the forty ninth aspect of the present invention.

According to a hundred thirty ninth aspect of the present invention, a liquid crystal TV, comprising:

an apparatus for displaying according to the fiftieth aspect of the present invention; and a tuner section for outputting a TV broadcast signal of a selected channel to the means for supplying of the apparatus for displaying.

According to a hundred fortieth aspect of the present invention, a liquid crystal monitoring apparatus, comprising:

an apparatus for displaying according to the fiftieth aspect of the present invention; and a signal processing section for outputting a monitor image signal, obtained by processing an external monitor signal, to the means for supplying of the apparatus for displaying.

According to a hundred forty first aspect of the present invention, an electronic apparatus for performing image display on a display screen of the means for displaying of an apparatus for displaying according to the fiftieth aspect of the present invention.

According to a hundred forty second aspect of the present invention, a liquid crystal TV, comprising:

an apparatus for displaying according to the eighty first aspect of the present invention; and a tuner section for outputting a TV broadcast signal of a selected channel to the means for supplying of the apparatus for displaying.

According to a hundred forty third aspect of the present invention, a liquid crystal monitoring apparatus, comprising:

an apparatus for displaying according to the eighty first aspect of the present invention; and a signal processing section for outputting a monitor image signal, obtained by processing an external monitor signal, to the means for supplying of the apparatus for displaying.

According to a hundred forty fourth aspect of the present invention, an electronic apparatus for performing image display on a display screen of the means for displaying of an apparatus for displaying according to the eighty first aspect of the present invention.

According to a hundred forty fifth aspect of the present invention, a liquid crystal TV, comprising:

an apparatus for displaying according to the thirty third aspect of the present invention; and a tuner section for outputting a TV broadcast signal of a selected channel to the means for supplying of the apparatus for displaying.

According to a hundred forty sixth aspect of the present invention, a liquid crystal monitoring apparatus, comprising:

an apparatus for displaying according to the eighty third aspect of the present invention; and a signal processing section for outputting a monitor image signal, obtained by processing an external monitor signal, to the means for supplying of the apparatus for displaying.

According to a hundred forty seventh aspect of the present invention, an electronic apparatus for performing image display on a display screen of the means for displaying of an apparatus for displaying according to the eighty third aspect of the present invention.

According to the apparatus, method and program of the present invention, when a luminance level of the moving object supplied in a first sub-frame period is of a luminance level relatively smaller than the luminance level supplied in a second sub-frame period, then a luminance level of the background supplied in the first sub-frame period is also of a luminance level relatively smaller than the luminance level supplied in the second sub-frame period, and when a luminance level of the moving object supplied in a first sub-frame period is of a luminance level relatively larger than the luminance level supplied in a second sub-frame period, then a luminance level of the background supplied in the first sub-frame period is also of a luminance level relatively larger than the luminance level supplied in the second sub-frame period. Therefore, a reduction in image quality caused by due to the movement blur, which is the problem with conventional, general hold-type image display apparatuses, can be suppressed. In addition, the deterioration in the quality of moving images due to the movement blur, which is caused in general conventional hold-type image display apparatuses, can be alleviated. Even when the display is performed at the maximum gradation level, the reduction in the maximum luminance and contrast, which occurs with the minimum (luminance) insertion system (with which each one-frame period includes a minimum luminance period), can be suppressed.

Hereinafter, the function of the present invention provided by the above-described structure will be described.

According to the present invention, in a hold-type image display apparatus which sets a plurality of sub frame periods in one frame period, the gradation level of each sub frame period is controlled such that: the time-wise center of gravity of the display luminance does not move in accordance with the gradation level of the input image signal, while the reduction in the maximum luminance or contrast is suppressed. Thus, the quality of moving images is prevented from being lowered due to the movement blur.

For example, in the case where one frame of image display is performed by a sum of time-integrated values of luminance displayed in an image display section in n sub frame periods (where n is an integer of 2 or greater), the maximum or a sufficiently high gradation level (a gradation level greater than a prescribed value) is supplied in the sub frame period which is at the time-wise center, or closest to the time-wise center, of one frame period, in the range in which the gradation level of the input image signal does not exceed the corresponding luminance level. When the gradation level of the input image signal is reached, the minimum or a sufficiently low gradation level (a gradation level lower than the prescribed value) is supplied to the remaining sub frame periods.

In the case where n is an odd number of 3 or greater, the maximum or a sufficiently high gradation level (a gradation level greater than a prescribed value) is supplied in the sub frame period which is at the time-wise center (the m'th sub frame period, where $m=(n+1)/2$). A gradation level which is increased or decreased in accordance with the gradation level of the input image signal is supplied in the sub frame periods before and after the central sub frame period. The minimum or a sufficiently low gradation level (a gradation level lower than a prescribed value) is supplied in the remaining sub frame periods. The gradation level to be supplied to each sub frame period is determined by whether the gradation level of the input image signal is higher than the threshold level T.

In the case where n is an even number of 2 or greater, the maximum or a sufficiently high gradation level (a gradation level greater than a prescribed value) is supplied in the sub frame periods which are at the time-wise center, or closest to the time-wise center (the m1st sub frame period and the m2nd sub frame period, where $m1=n/2$ and $m2=n/2+1$). A gradation level which is increased or decreased in accordance with the gradation level of the input image signal is supplied in the sub frame periods before and after the central sub frame periods. The minimum or a sufficiently low gradation level (a gradation level lower than a prescribed value) is supplied in the remaining sub frame periods. The gradation level to be supplied to each sub frame period is determined by whether the gradation level of the input image signal is higher than the threshold level T.

By such control, the time-wise center of gravity of the display luminance is fixed to the sub frame period which is at the time-wise center, or closest to the time-wise center, of one frame period. Therefore, the problem with the technology of, for example, Japanese Laid-Open Publication No. 2001-296841, i.e., the problem that a change in the time-wise center of gravity of the display luminance in accordance with the gradation of the input image signal causes the abnormal luminance or the color imbalance, which lowers the image quality, is suppressed. Since the display luminance in one frame period appropriately changes, the deterioration in the quality of moving images due to the movement blur, which is caused in general conventional hold-type image display apparatuses, can be alleviated. Even when the display is performed at the maximum gradation level, the reduction in the maximum luminance and contrast, which occurs with the minimum (luminance) insertion system (with which each one-frame period includes a minimum luminance period), can be suppressed.

In the case where n is 2, where one of the sub frame periods is referred to as a sub frame period α and the other sub frame period is referred to as a sub frame period β, the maximum or a sufficiently high gradation level, or a gradation level which is increased or decreased by the gradation level of the input image signal is supplied in the sub frame period α. The gradation level to be supplied in sub frame period is determined by whether the gradation level of the input image signal is higher than the threshold level.

By such control, the movement of the time-wise center of gravity of luminance can be minimized. Therefore, the problem with the technology of, for example, Japanese Laid-Open Publication No. 2001-296841, i.e., the problem that a change in the time-wise center of gravity of the display luminance in accordance with the gradation of the input image signal causes the abnormal luminance or the color imbalance, which lowers the image quality, is suppressed. Since the display luminance in one frame period appropriately changes, the deterioration in the quality of moving images due to the movement blur, which is caused in general conventional hold-type image display apparatuses, can be alleviated. Even when the display is performed at the maximum gradation level, the reduction in the maximum luminance and contrast, which occurs with the minimum (luminance) insertion system, can be suppressed.

In the case where n is 2, a frame image of an intermediate state in terms of time may be generated based on two frames of images which are consecutively input. In this case, the gradation level supplied in the sub frame period β may be determined by whether the gradation level of the image in the intermediate state is higher than the threshold level. In such a case, the image in the intermediate state in terms of time is generated by estimation. Therefore, inaccurate display caused by interpolation errors which may be generated in some pixel portions can be inconspicuous.

In the case where n is 2, the gradation level supplied in the sub frame period β may be determined by whether the threshold is larger than the value obtained by averaging (i) the gradation level of the input image signal and (ii) the gradation level of the image signal which was input one frame period before or the image signal to be input one frame after.

The upper limits (the maximum levels) of the gradation levels supplied in the sub frame periods are set such that the level of the upper limit is highest for the sub frame period which is at the time-wise center or closest to the time-wise center is highest and decreases as the sub frame period is farther from the center, or such that the upper limits are the same. By such setting, even when the gradation of the input image signal is high, a sub frame period in which the luminance is low can be provided. Thus, even when the gradation of the input image signal is high, the deterioration in the quality of moving images caused by the movement blur (as caused in conventional hold-type image display apparatuses) can be alleviated. When n=2, the upper limit of the gradation level supplied in one of the sub frame periods can be set to be equal to or higher than the upper limit of the gradation level supplied in the other sub frame period.

The gradation levels supplied in the sub frame periods and the threshold levels can be set such that the relationship between the gradation level of the input image signal and the time-integrated luminance exhibits a gamma luminance characteristic. Thus, the deterioration in the quality of moving images caused by the movement blur (as caused in conventional hold-type image display apparatuses) can be alleviated, while guaranteeing the compatibility in gradation reproduce ability with image signals which are generated in consideration of the gamma luminance characteristic of CRTs.

A temperature detection section for detecting the temperature of a panel or the vicinity thereof may be provided, so that the gradation level supplied in the sub frame periods or the threshold levels can be changed in accordance with the detected temperature. Thus, the relationship between the gradation level of the input image signal and the display luminance can be maintained, even when a display element such as a liquid crystal display element, with which the response speed to a luminance increase and the response speed to a luminance decrease can be different under certain temperature, is used.

In the case where an input image signal has a plurality of color components, the gradation levels are set such that the ratio, between the luminance levels displayed in the sub frame periods, of the color having the highest gradation level of input image signal is equal to the ratio, between the luminance levels displayed in the sub frame periods, of the colors other than the color having the highest gradation level of input image signal.

By this, even when the luminance balance is significantly different among different colors, the phenomenon that abnormal colors appear by the luminance balance of the three colors being destroyed in the display of moving images can be prevented.

Hereinafter, various methods for allocating the luminance level assumed for the input image signal to the plurality of sub frame periods will be described in correspondence with claims. As described in more detail below, the gradation levels are adjusted so as to realize the luminance level assumed for the input image signal.

In the following description, for the sake of clarity, the gradation level of the input image signal is allocated such that the gradation level is gradually increased to a prescribed level. According to the present invention, the allocation is actually performed instantaneously by, for example, calculation or conversion using a look-up table or the like, based on the above manner of allocation in accordance with the gradation level of the input image signal.

As shown in FIG. 67(*a*), the luminance level assumed for the input image signal is sequentially allocated, starting from the sub frame period which is at the time-wise center, or closest to the time-wise center of, one frame period for image display. Next, the allocation is performed to the sub frame period to the left or to the right of the sub frame period which has been provided with the luminance level. The allocation is performed to one sub frame period at a time, until each sub frame period is filled. The remaining luminance level is allocated to the remaining sub frame period(s), such that the allocated luminance level is equal to the luminance level assumed for the input image signal. Thus, the allocation is completed.

As shown in FIG. 67(*b*), the luminance level assumed for the input image signal is sequentially allocated, starting from one sub frame period which is at the time-wise center of one frame period for image display. Next, the allocation is performed to two sub frame periods to the left or to the right of the sub frame period which has been provided with the luminance level. The allocation is performed simultaneously to two sub frame periods at a time, until each sub frame period is filled. The reference of the gradation level corresponding to the luminance level to be allocated to the next sub frame periods after certain sub frame periods are filled is the threshold level. The remaining luminance level is allocated to the next two sub frame periods, such that the allocated luminance level is equal to the luminance level assumed for the input image signal. Thus, the allocation is completed.

As shown in FIG. 67(*c*), the luminance level assumed for the input image signal is sequentially allocated, starting from two sub frame periods which are at the time-wise center of one frame period for image display. Next, the allocation is performed to two sub frame periods to the left or to the right of the sub frame periods which have been provided with the luminance level. The allocation is performed simultaneously to two sub frame periods at a time, until each sub frame period is filled. The reference of the gradation level corresponding to the luminance level to be allocated to the next sub frame periods after certain sub frame periods are filled is the threshold level. The remaining luminance level is allocated to the remaining sub frame period(s), such that the allocated luminance level is equal to the total luminance level assumed for the input image signal. Thus, the allocation is completed.

As shown in FIG. 67(*d*), the luminance level assumed for the input image signal is sequentially allocated, starting from one of two sub frame periods (as represented by dots). When the sub frame period is filled with the luminance level (as represented by hatching; the threshold level T), the luminance level is allocated to the other sub frame period (as represented by dots).

As shown in FIG. 68(*e*), the luminance level assumed for the input image signal is sequentially allocated, starting from one of two sub frame periods (as represented by dots). When the gradation level corresponding to the luminance level assumed for the input image signal reaches the threshold level T1 in the sub frame period, the luminance level is also allocated to the other sub frame period (as represented by dots) as well as to the first sub frame period. When the gradation level corresponding to the luminance level reaches the threshold level T2 in the first sub frame period, the remaining luminance level is allocated to the second sub frame period (as represented by dots), and the allocation is completed.

As shown in FIG. 68(*f*), the luminance level assumed for the input image signal is sequentially allocated, starting from one of two sub frame periods (as represented by dots). When the gradation level corresponding to the luminance level assumed for the input image signal reaches the threshold level T1 in the sub frame period, the luminance level allocated to the sub frame period is temporarily fixed (i.e., the allocation is paused), and the luminance level assumed for the input image signal is allocated to the other sub frame period (as represented by dots). When the gradation level corresponding to the luminance level assumed for the input image signal reaches the threshold level T2 in the second sub frame period, the luminance level allocated to the first sub frame period is released from the fixed state, and the remaining luminance level is allocated to the first sub frame period (as represented by dots).

As shown in FIG. 68(*g*), the luminance level assumed for the input image signal is sequentially allocated, starting from one of two sub frame periods (as represented by dots). When the gradation level of the input image signal reaches the threshold level T, the luminance level is the highest in one sub frame period. A luminance level is allocated to the other sub frame period in consideration of the image state of the next one frame. More specifically, it is checked if there is a difference between the image currently input and the image which is to be input next (i.e., the movement). When there is a difference, the remaining luminance level is allocated to the second sub frame period, such that the luminance level of the second sub frame period is the luminance level assumed for an input image signal in an intermediate state in terms of time between the image currently input and the image which is to be input next (i.e., the image between the two images is estimated). Then, the first sub frame period is filled with the luminance level assumed for the input image signal.

As shown in FIG. 68(*h*), the luminance level assumed for the input image signal is sequentially allocated, starting from one of two sub frame periods (as represented by dots). When the gradation level corresponding to the allocated luminance level reaches the threshold level T, the luminance level is highest in one sub frame period. An average value of the image currently input and the image which is to be input next is calculated, and the remaining luminance level assumed for an input image signal of the average value is allocated to the other sub frame period. Then, the first sub frame period is filled with the luminance level assumed for the input image signal.

As shown in FIGS. 69(*i*) and 69(*j*), the sub frame periods have the same length or different lengths. As the length of a sub frame period is shorter, a higher impulse effect is obtained. When the sub frame period is longer, the center of gravity of luminance tends to be closer to the longer sub frame period and does not move easily.

As shown in FIG. 69(*k*), the luminance level assumed for the input image signal is sequentially allocated, starting from one of two sub frame periods (as represented by dots). When the gradation level corresponding to the luminance level assumed for the input image signal reaches the threshold level T1 in the sub frame period, the luminance level is allocated also to the other sub frame period (as represented by dots). The luminance level is allocated such that the difference between the gradation levels or the luminance levels allocated to the two sub frame periods is constant.

As shown in FIG. 69(*l*), the luminance level assumed for the input image signal is sequentially allocated, starting from one of two sub frame periods (as represented by dots). When the gradation level corresponding to the luminance level assumed for the input image signal reaches the threshold level T1 in the sub frame period, the luminance level is allocated also to the other sub frame period (as represented by dots). The luminance level is allocated such that the difference between the gradation levels or the luminance levels allocated to the two sub frame periods is in accordance with a prescribed function (e.g., a value obtained by multiplying the constant by a prescribed coefficient).

As shown in FIG. 70(*m*), when the response time of the liquid crystal material to an increase in luminance>the response time of the liquid crystal material to a decrease in luminance, the allocation of the luminance level is started from the second sub frame period. When the response time of the liquid crystal material to an increase in luminance<the response time of the liquid crystal material to a decrease in luminance, the allocation of the luminance level is started from the first sub frame period.

As shown in FIG. 70(*n*), when the response time of the display element to a luminance switch from Lmin to Lmax (the luminance is increased)>the response time of the display element to a luminance switch from Lmax to Lmin (the luminance is decreased), the allocation of the luminance level is started from the second sub frame period. When the response time of the display element to a luminance switch from Lmin to Lmax (the luminance is increased)<the response time of the display element to a luminance switch from Lmax to Lmin (the luminance is decreased), the allocation of the luminance level is started from the first sub frame period.

As shown in FIG. 70(*o*), the luminance level assumed for the input image signal is sequentially allocated, starting from one of two sub frame periods (as represented by dots). When the gradation level corresponding to the luminance level assumed for the input image signal reaches the upper limit L (as represented by hatching; the threshold level T) in the sub frame period, the luminance level is allocated to the other sub frame period (as represented by dots).

As shown in FIG. 70(*p*), the luminance level assumed for the input image signal is allocated, starting from the sub frame period which is at the time-wise center of one frame period (as represented by dots). When the gradation level corresponding the luminance level in the central sub frame period reaches the highest upper limit L1 (as represented by hatching; the threshold level T1), the luminance level is simultaneously allocated to the sub frame periods to the right and to the left of the central sub frame period (as represented by dots); When the gradation level corresponding to the luminance level in these sub frame periods reaches the second highest upper limit L2 (as represented by hatching; the threshold level T2), the luminance level is allocated to the sub frame periods which are to the left and to the right of these sub frame periods (as represented by dots), until the gradation level corresponding to the luminance level in these sub frame periods reaches the lowest upper limit L3.

As shown in FIG. 71(*q*), the luminance level assumed for the input image signal is sequentially allocated, starting from one of two sub frame periods (as represented by dots). When the gradation level corresponding to the luminance level reaches the higher upper limit L1 (as represented by hatching; the threshold level T) in the sub frame period, the luminance level is allocated to the other sub frame period until the luminance level reaches the lower upper limit L2 (as represented by dots).

As shown in FIG. 71(*r*), the luminance level assumed for the input image signal is allocated, starting from one of two sub frame periods which are at the time-wise center of one frame period (as represented by dots). The luminance level in the sub frame period is set such that the time-integrated luminance reproduces an appropriate gamma luminance characteristic. When the sub frame period is filled (as represented by hatching), the luminance level assumed for the input image signal is allocated to the other of the two sub frame periods which are at the time-wise center of one frame period (as represented by dots). The luminance level in the sub frame period is set such that the time-integrated luminance reproduces an appropriate gamma luminance characteristic. When that sub frame period is filled (as represented by hatching), the luminance level assumed for the input image signal is allocated to the sub frame period which is adjacent to that sub frame period (as represented by dots). The luminance level in the sub frame period is set such that the time-integrated luminance reproduces an appropriate gamma luminance characteristic. When that sub frame period is filled (as represented by hatching), the luminance level assumed for the input image signal is allocated to the sub frame period which is adjacent to the first central sub frame period (as represented by dots). The luminance level in the sub frame period is set such that the time-integrated luminance reproduces an appropriate gamma luminance characteristic. Such an operation is repeated. Thus, the luminance level assumed for the input image signal is allocated, first to the sub frame period which is at the time-wise center or closest to the time-wise center, and then the sub frame periods to the left and to the right of the central sub frame period.

As shown in FIG. 71(*s*), the luminance level assumed for the input image signal is allocated, starting from one of the sub frame periods which is at the time-wise center of one frame period (as represented by dots). The luminance level in the sub frame period is set such that the time-integrated luminance reproduces an appropriate gamma luminance characteristic. When the sub frame period is filled (as represented by hatching; the threshold level T1), the luminance level assumed for the input image signal is simultaneously allocated to the sub frame periods to the left of and to the right of the central sub frame period (as represented by dots). The luminance level in the sub frame period is set such that the time-integrated luminance reproduces an appropriate gamma luminance characteristic. When these sub frame period are filled (as represented by hatching; the threshold level T2), the luminance level assumed for the input image signal is simultaneously allocated to the sub frame periods which are to the left and to the right of these sub frame periods (as represented by dots). The luminance level in the sub frame period is set such that the time-integrated luminance reproduces an appropriate gamma luminance characteristic. Such an operation is repeated. Thus, the luminance level assumed for the input image signal is allocated, first to the sub frame period which is at the time-wise center, and then the sub frame periods to the left and to the right of the central sub frame period.

According to the present invention, in an image display apparatus for performing one frame period of image display by a sum of time-integrated values of luminance displayed in a plurality of sub frame periods, the gradation level of the image signals supplied in each sub frame period is controlled. By this, when a moving image is displayed, the distance, by which the time-wise center of gravity of luminance moves in accordance with the gradation level of the input image signal, can be minimized. This provides the following effects: (i) the reduction in the maximum luminance or contrast is suppressed, (ii) the quality deterioration due to inaccurate luminance and color imbalance, observed because the time-wise center of gravity of luminance which relies on the gradation level of the input image signal at the time of display of moving images significantly moves, is suppressed; and (iii) the deterioration in moving images due to the movement blur, which is a problem with a conventional hold-type image display apparatus is alleviated.

According to the present invention, the gradation level of the image signal supplied in each sub frame period and the threshold level acting as reference for the gradation level are set, such that the relationship between the gradation level of the input image signal and the time-integrated luminance in one frame period exhibits an appropriate gamma luminance characteristic. Therefore, the deterioration in quality of moving images due to the movement blur can be alleviated while guaranteeing the compatibility in terms of gradation reproduceability with conventional image signals which are generated in consideration of the gamma luminance characteristic of CRTs.

According to the present invention, the gradation level of the image signal supplied in each sub frame period and the threshold level acting as reference for the gradation level are set, in accordance with the temperature of the display panel or the vicinity thereof. Therefore, the relationship between the gradation level of the input image signal and the display luminance can be maintained, even when a display element such as a liquid crystal display element, with which the response speed to a luminance increase and the response speed to a luminance decrease can be different under certain temperature, is used.

Thus, the invention described herein makes possible the advantages of providing a hold-type image display apparatus for suppressing the reduction in the maximum luminance and contrast, minimizing the deterioration in quality caused by the time-wise center of gravity of the display luminance being different in accordance with the gradation level of an input image signal, and minimizing the deterioration of quality of moving images represented by afterimage and movement blur, while being compatible in terms of gradation representation with an image signal which is generated so as to be output to image display devices having a general luminance characteristic (e.g., a gamma luminance characteristic); an electronic apparatus, a liquid crystal TV, a liquid crystal monitoring apparatus, which use such an image display apparatus for a display section; an image display method performing image display using such an image display apparatus; a display control program for allowing a computer to execute the image display method; and a computer-readable recording medium having the display control program recorded thereon.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of illustrative examples 1 through 12 with reference to the accompanying drawings.

In this specification, the term "gradation level" refers to a level of a signal which is input. The term "luminance level" refers to the level of the brightness of an image which is displayed.

Figure 1:
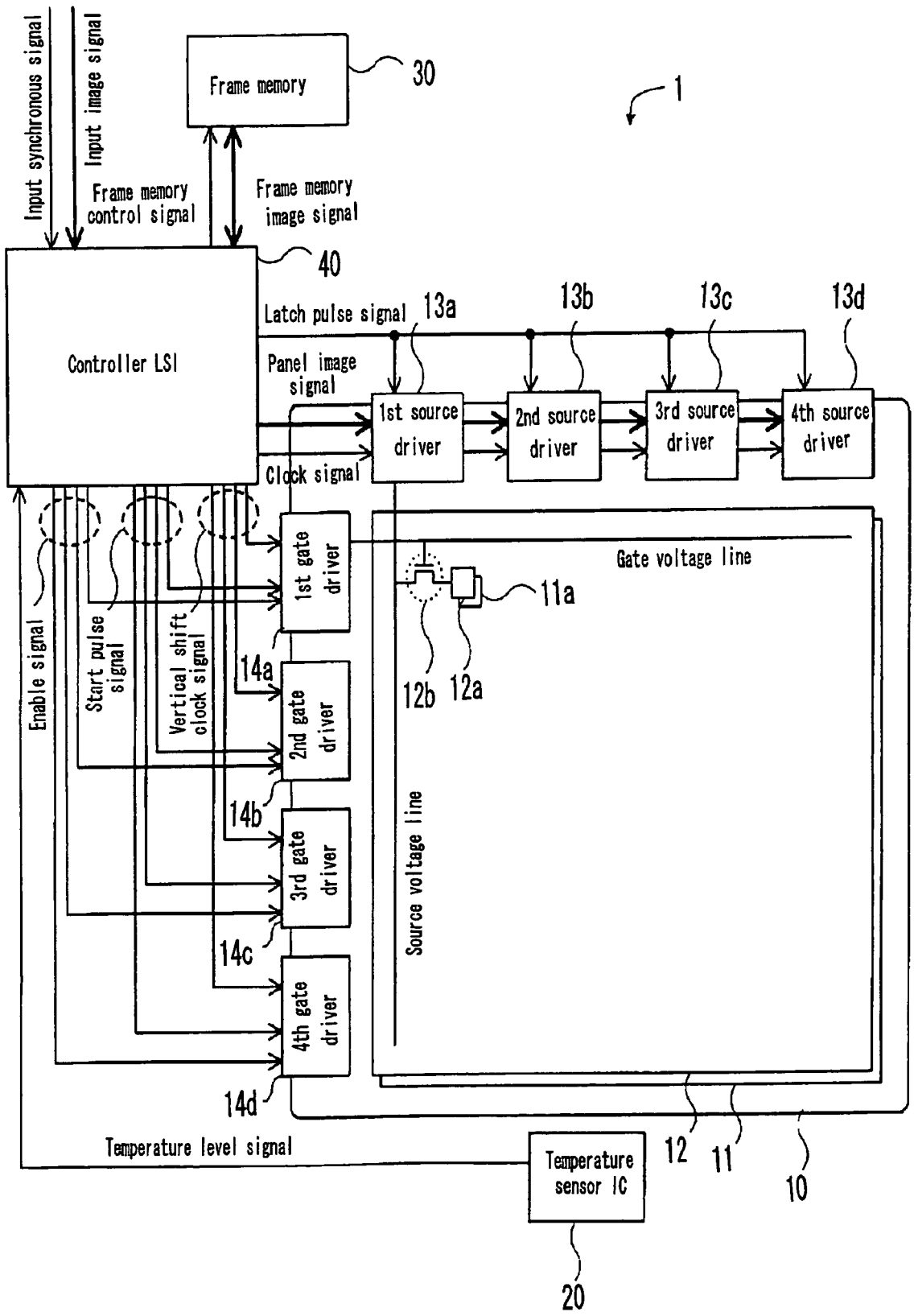
FIG. 1 is a block diagram illustrating a basic structure of an image display apparatus according to the present invention.

FIG. 1 is a block diagram illustrating a basic structure of an image display apparatus 1 according to Examples 1 through 8 of the present invention.

As shown in FIG. 1, the image display apparatus 1 includes a display panel 10 (image display section, i.e., an image display section), a temperature sensor IC 20 (temperature detection section) for detecting the temperature of the display panel 10 or the temperature of a portion in the vicinity of the display panel 10, a frame memory 30 (frame data memory section) for storing an image of one frame, and a controller LSI 40 (display control section) for controlling various sections of the image display 1.

The display panel 10 includes a display element array 11, a TFT substrate 12, source drivers 13*a* through 13*d*, and gate drivers 14*a* through 14*d*.

The display element array 11 includes a plurality of display elements 11*a* (pixel portions) in a matrix. The plurality of display elements 11*a* are formed of a liquid crystal material or an organic EL (electroluminescence) material.

In a display area of the TFT substrate 12, a plurality of pixel electrodes 12*a* for respectively driving the display elements 11*a* and a plurality of TFTs 12*b* are provided. The plurality of TFTs 12*b* are for switching on or off the supply of a display voltage to the pixel electrodes 12*a* respectively. The plurality of pixel electrodes 12*a* and the plurality of TFTs 12*b* are arranged in a matrix in correspondence with the display elements 11*a*. In an area along the display element array 11 and the TFT substrate 12, the first through fourth source drivers 13*a* through 13*d* and the first through gate drivers 14*a* through 14*d* are provided. The first through fourth source drivers 13*a* through 13*d* are for driving the pixel electrodes 12*a* and the display elements 11*a* via the respective TFTs 12*b*. The first through gate drivers 14*a* through 14*d* are for driving the TFTs 12*b*.

In the display area of the TFT substrate 12, a plurality of source voltage lines connected to the source drivers 13*a* through 13*d* to provide source voltages (display voltages) and a plurality of gate voltage lines connected to the gate drivers 14*a* through 14*d* to provide gate voltages (scanning signal voltages) are provided. The plurality of source voltage lines and the plurality of gate voltage lines are arranged to cross each other, for example, perpendicular to each other. At each of the intersections of the source voltages lines and the gate voltage lines, a pixel electrode 12*a* and a TFT 12*b* are provided. A gate electrode of each TFT 12*b* is connected to the respective gate voltage line (i.e., the gate voltage line running through the respective intersection). A source electrode of each TFT 12*b* is connected to the respective source voltage line (i.e., the source voltage line running through the respective intersection). A drain electrode of each TFT 12*b* is connected to the respective pixel electrode 12*a*.

The leftmost source voltage line connected to each source driver (source drivers 13*a* through 13*d*) will be referred to as the first source voltage line, and the source voltage line adjacent to the first source voltage line will be referred to as the second source voltage line. The source voltage lines will be referred to in this manner, and the rightmost source voltage line connected to each source driver will be referred to as the final source voltage line. The uppermost gate voltage line connected to each gate driver (gate drivers 14*a* through 14*d*) will be referred to as the first gate voltage line, and the gate voltage line adjacent to the first gate voltage line will be referred to as the second gate voltage line. The gate voltage lines will be referred to in this manner, and the lowermost gate voltage line connected to each gate driver will be referred to as the final gate voltage line.

For the sake of simplicity, FIG. 1 shows only the first source voltage line connected to the first source driver 13*a*, the first gate voltage line connected to the first gate driver 14*a*, a TFT 12*b* connected thereto, the pixel electrode 12*a* connected to the TFT 12*b*, and the display element 11*a* corresponding to the pixel electrode 12*a*.

In the vicinity of the display panel 10, the temperature sensor IC 20 for detecting the temperature of the display panel 10 or the vicinity thereof and for outputting the temperature as a temperature level signal is provided. The frame memory 30 for holding input image signals is also provided in the vicinity of the display panel 10. The controller LSI 40 is also provided in the vicinity of the display panel 10 for outputting signals to the source drivers 13*a* through 13*d* and the gate drivers 14*a* through 14*d*, for accessing the frame memory 30 and storing data therein, and for reading the temperature level signal which is output from the temperature sensor IC 20 and correcting and controlling the luminance in accordance with the temperature.

A basic display method using the image display apparatus 1 having such a structure will be described.

The controller LSI 40 sends image signals corresponding to pixel portions of one horizontal line to the first source driver 13*a* sequentially in synchronization with a clock signal. Since the first through fourth source drivers 13*a* through 13*d* are connected as shown in FIG. 1, image signals corresponding to the pixel portions of one horizontal line are temporarily held in the first through fourth source drivers 13*a* through 13*d* by the clock signal pulses corresponding to the pixel portions of the one horizontal line. When the controller LSI 40 outputs a latch pulse signal to the first through fourth source drivers 13*a* through 13*d* in this state, each of the first through fourth source drivers 13*a* through 13*d* outputs a display voltage level corresponding to the image signal of the corresponding pixel portion to the source voltage lines corresponding to the pixel portions of the one horizontal line.

The controller LSI 40 also outputs enable signals, start pulse signals and vertical shift clock signals as control signals to the first through fourth gate drivers 14*a* through 14*d*. While the enable signal is at a LOW level, the gate voltage line is in an OFF state. When a start pulse signal is input at the rising edge of a vertical shift clock signal while the enable signal is put to a HIGH level, the first gate voltage line of the corresponding gate driver is placed into an ON state. When the start pulse signal is not input at the rising edge of the vertical clock shift signal, the gate voltage line immediately subsequent to the gate voltage line, which was placed into an ON state at the immediately previous time, is placed into an ON state.

By one gate voltage line being placed into an ON state while the display voltages corresponding to the pixel portions of one horizontal line are output to the source voltage line, the TFTs 12*b* connected to this gate voltage line (corresponding to the pixel portions of the one horizontal line) are placed into an ON state. By this, the pixel electrodes 12*a* corresponding to pixels of the one horizontal line are each supplied with charge (display voltage) from the respective source voltage line. Thus, the state of the corresponding display element 11*a* changes, and image display is performed. Such display control is repeated for each horizontal line, and thus image display is performed in the entire display screen.

Hereinafter, an image display apparatus 1 and an image display method according to the present invention will be described by way of specific examples 1 through 8. In Examples 1 through 8, the image display apparatus 1 described above including the controller LSI 40 is used.

Example 1

In Example 1 of the present invention, image display is performed for each pixel portion on the screen by the sum of time-integrated values (or levels) of luminance during the first and second sub frame periods. During one of the two sub frame periods which is uniquely defined (for example, a first sub frame period), an image signal of the maximum gradation level, or an image signal of a gradation level which is increased or decreased in accordance with the gradation level of the input image signal, is supplied. This sub frame period is referred to as the "sub frame period α". During the other sub frame period (for example, a second sub frame period), an image signal of the minimum gradation level, or an image signal of a gradation level which is increased or decreased in accordance with the gradation level of the input image signal, is supplied. This sub frame period is referred to as the "sub frame period β". Such control is performed in units of single pixel or in units of a prescribed number of pixels.

How to determine which of the sub frame period α and the sub frame period β is assigned to the first sub frame period and the second sub frame period will be described later.

In Example 1, the display panel 10 uses, as a display element, a liquid crystal material which has a high temperature dependency of the response speed.

Figure 2:
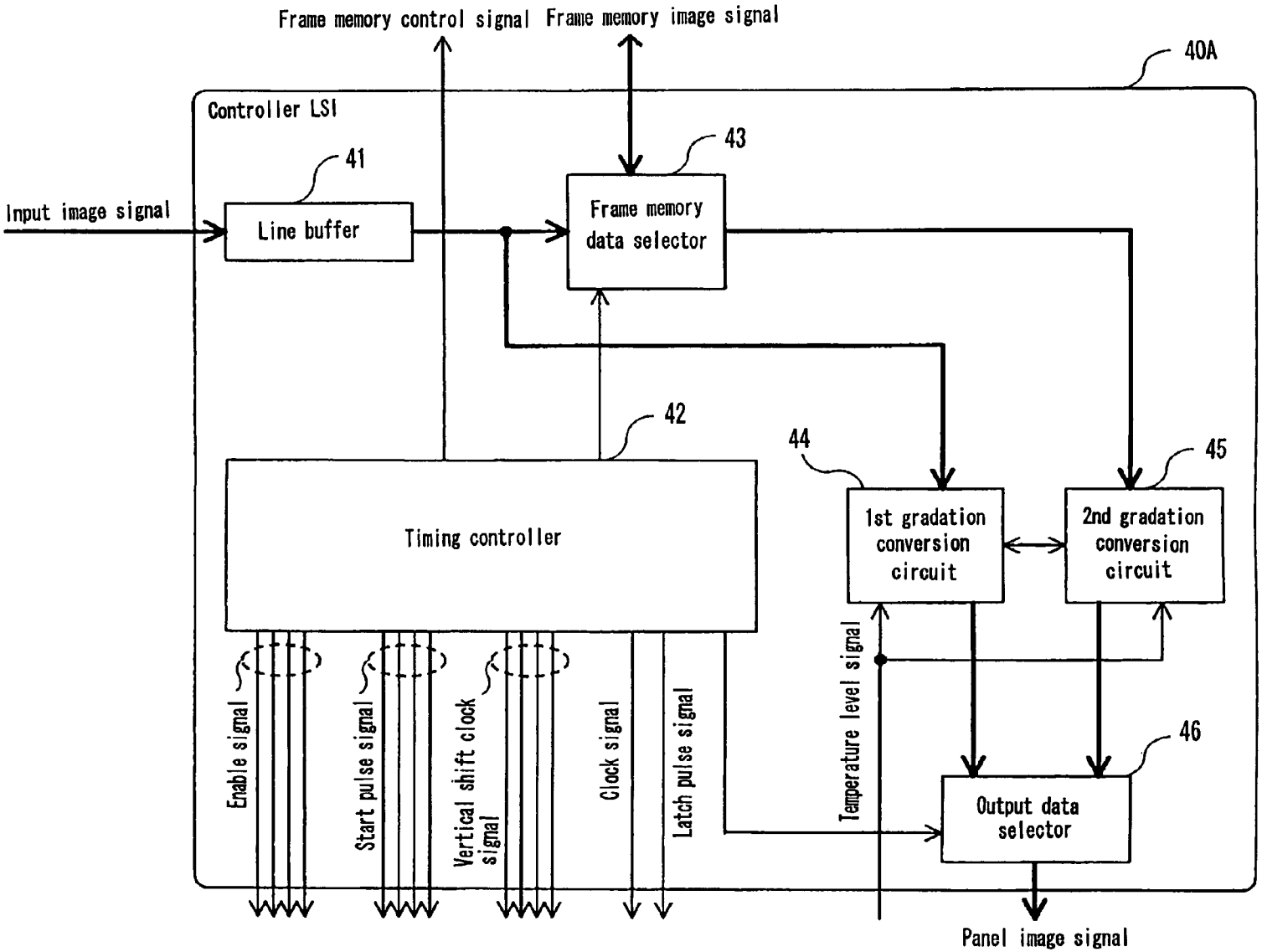
FIG. 2 is a block diagram of an exemplary structure of a controller LSI shown in FIG. 1.

FIG. 2 is a block diagram of a structure of a controller LSI 40 (as the display control section; shown in FIG. 1) in Example 1. In Example 1, the controller LSI 40 is represented by reference numeral 40A.

As shown in FIG. 2, the controller LSI 40A includes a line buffer 41 (line data memory section), a timing controller 42 (timing control section), a frame memory data selector 43 (frame memory data selection section), a first gradation conversion circuit 44 (first gradation conversion section), a second gradation conversion circuit 45 (second gradation conversion section), and an output data selector 46 (output data selection section).

The line buffer 41 receives the input image signal horizontal line by horizontal line, and temporarily stores the input image signal. The line buffer 41 includes a receiving port and a sending port independently, and therefore can receive and send signals simultaneously.

The timing controller 42 controls the frame memory data selector 43 to alternately select data transfer to the frame memory 30 or data read from the frame memory 30. The timing controller 42 also controls the output data selector 46 to alternately select data output from the first gradation conversion circuit 44 or data output from the second gradation conversion circuit 45. Namely, the timing controller 42 selects the first sub frame period or the second sub frame period for the output data selector 46, as described later in detail.

The frame memory data selector 43 is controlled by the timing controller 42 to alternately select data transfer or data read. In data transfer, the frame memory data selector 43 transfers the input image signal stored in the line buffer 41 to the frame memory 30, horizontal line by horizontal line. In data read, the frame memory data selector 43 reads an input image signal which was read one frame period before and has been stored in the frame memory 30, horizontal line by horizontal line, and transfers the read data to the second gradation conversion circuit 45.

The first gradation conversion circuit 44 converts the gradation level of the input image signal supplied from the line buffer 41 to the maximum gradation level or a gradation level which is increased or decreased in accordance with the gradation level of the input image signal.

The second gradation conversion circuit 45 converts the gradation level of the image signal supplied from the frame data selector 43 to the minimum gradation level or a gradation level which is increased or decreased in accordance with the gradation level of the input image signal.

The first gradation conversion circuit 44 and the second gradation conversion circuit 45 have a function of changing the conversion value in accordance with a temperature level signal which is output from the temperature sensor IC 20. In Example 1, the first gradation conversion circuit 44 and the second gradation conversion circuit 45 include look-up tables which store output values in correspondence with input values. Alternatively, output values may be calculated by a calculation circuit.

The output data selector 46 is controlled by the timing controller 42 to alternately select an image signal which is output from the first gradation conversion circuit 44, or an image signal which is output from the second gradation conversion circuit 45, horizontal line by horizontal line. The output data selector 46 outputs the selected image signal as a panel image signal.

An operation of an image display apparatus in Example 1 including the controller LSI 40A having the above-described structure will be described.

Figure 3:
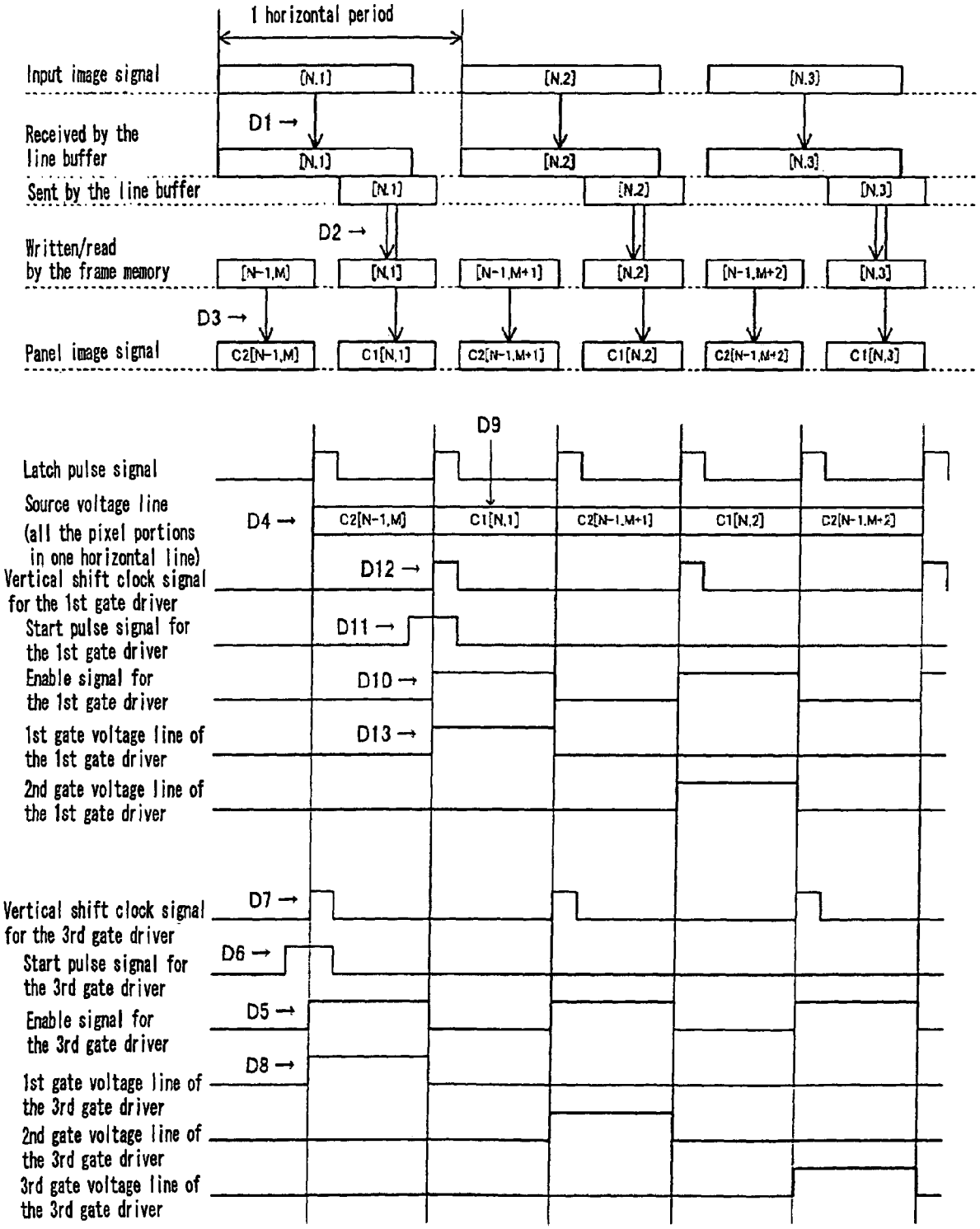
FIG. 3 is a timing diagram of signals in an image display apparatus in Example 1 according to the present invention.

FIG. 3 is a timing diagram of signals in the image display apparatus in Example 1 illustrated by horizontal periods. In FIG. 3, an image signal is input for the first horizontal line through the third horizontal line of the N'th frame.

In FIG. 3, the letters in brackets ([ ]) represent the frame and the horizontal line in which the image signal which is being transferred was input. For example, [f, 1] represents that an image signal which was input in the first horizontal line of the f'th frame is being transferred. [N, 2] represents that an image signal which was input in the second horizontal line of the N'th frame is being transferred. The M'th line is the middle horizontal line on the screen. In Example 1, the M'th line is the horizontal line which is driven by the first gate voltage line of the third gate driver 14*c*. "C1" represents that an image signal obtained by converting the input image signal, which was input in the frame and the horizontal line shown in the immediately subsequent brackets ([ ]), by the first gradation conversion circuit 44 is being transferred. "C2" represents that an image signal obtained by converting the input image signal, which was input in the frame and horizontal line shown in the immediately subsequent brackets ([ ]), by the second gradation conversion circuit 45 is being transferred.

In operation, an input image signal is first received by the line buffer 41 as represented by arrow D1 in FIG. 3.

Then, as represented by arrow D2, while one horizontal line of image signal is being received, the image signal is written from the line buffer 41 to the frame memory 30 via the frame memory data selector 43, and is also transferred from the line buffer 41 to the first gradation conversion circuit 44. The first gradation conversion circuit 44 outputs the converted image signal as a panel image signal.

As represented by arrow D3, alternately with the image signal being written to the frame memory 30, an image signal of the horizontal line, which is a half frame period before the horizontal line of the image signal which is being written, is read from the frame memory 30, horizontal line by horizontal line. The read image signal is converted by the second gradation conversion circuit 44 via the frame memory data selector 43 and is output as a panel image signal.

One horizontal line of panel image signal is output from the controller LSI 40A and is transferred to the first through fourth source drivers 13*a* through 13*d* by a clock signal. Then, when a latch pulse signal is provided, a display voltage corresponding to the display luminance of each pixel portion is output from the respective source voltage line. At this point, the gate driver corresponding to the horizontal line, which is to be supplied with charge (display voltage) on the source voltage line to perform image display, is supplied with a vertical shift clock signal or a gate start pulse signal as necessary. Thus, the scanning signal on the corresponding gate voltage line is placed into an ON state. For a gate driver which is not to be used for image display, the enable signal is put to a LOW level and thus the scanning signal of the corresponding gate voltage line is placed into an OFF state.

In the example shown in FIG. 3, as represented by arrow D4, the M'th line (one horizontal line) of image signal of the (N−1)'th frame is transferred to the source driver. Then, as represented by arrow D5, the enable signal from the controller LSI 40A to the third gate driver 14*c* is put to a HIGH level. As represented by arrows D6 and D7, a start pulse signal and a vertical shift clock signal are supplied to the third gate driver 14*c*. As a result, as represented by arrow D8, the TFT 12*b* connected to the first gate voltage line of the third gate driver 14*a* (corresponding to the M'th line on the screen in terms of the display position) is placed into an ON state. Thus, image display is performed. At this point, the enable signals to the first, second and fourth gate drivers 14*a*, 14*b* and 14*d*, which are not at the display position, are put to a LOW level, and the TFTs 12*b* connected to the first, second and fourth gate drivers 14*a*, 14*b* and 14*d* are in an OFF state.

Next, as represented by arrow D9, the first line (one horizontal line) of image signal of the N'th frame is transferred to the source driver. Then, as represented by arrow D10, the enable signal from the controller LSI 40A to the first gate driver 14*a* is put to a HIGH level. As represented by arrows D10 and D11, a start pulse signal and a vertical shift clock signal are supplied to the first gate driver 14*a*. As a result, as represented by arrow D13, the TFT 12*b* connected to the first gate voltage line of the first gate driver 14*a* (corresponding to the first line on the screen in terms of the display position) is placed into an ON state. Thus, image display is performed. At this point, the enable signals to the second through fourth gate drivers 14*b*, 14*c* and 14*d*, which are not at the display position, are put to a LOW level, and the TFTs 12*b* connected to the second through fourth gate drivers 14*b*, 14*c* and 14*d* are in an OFF state.

Figure 4:
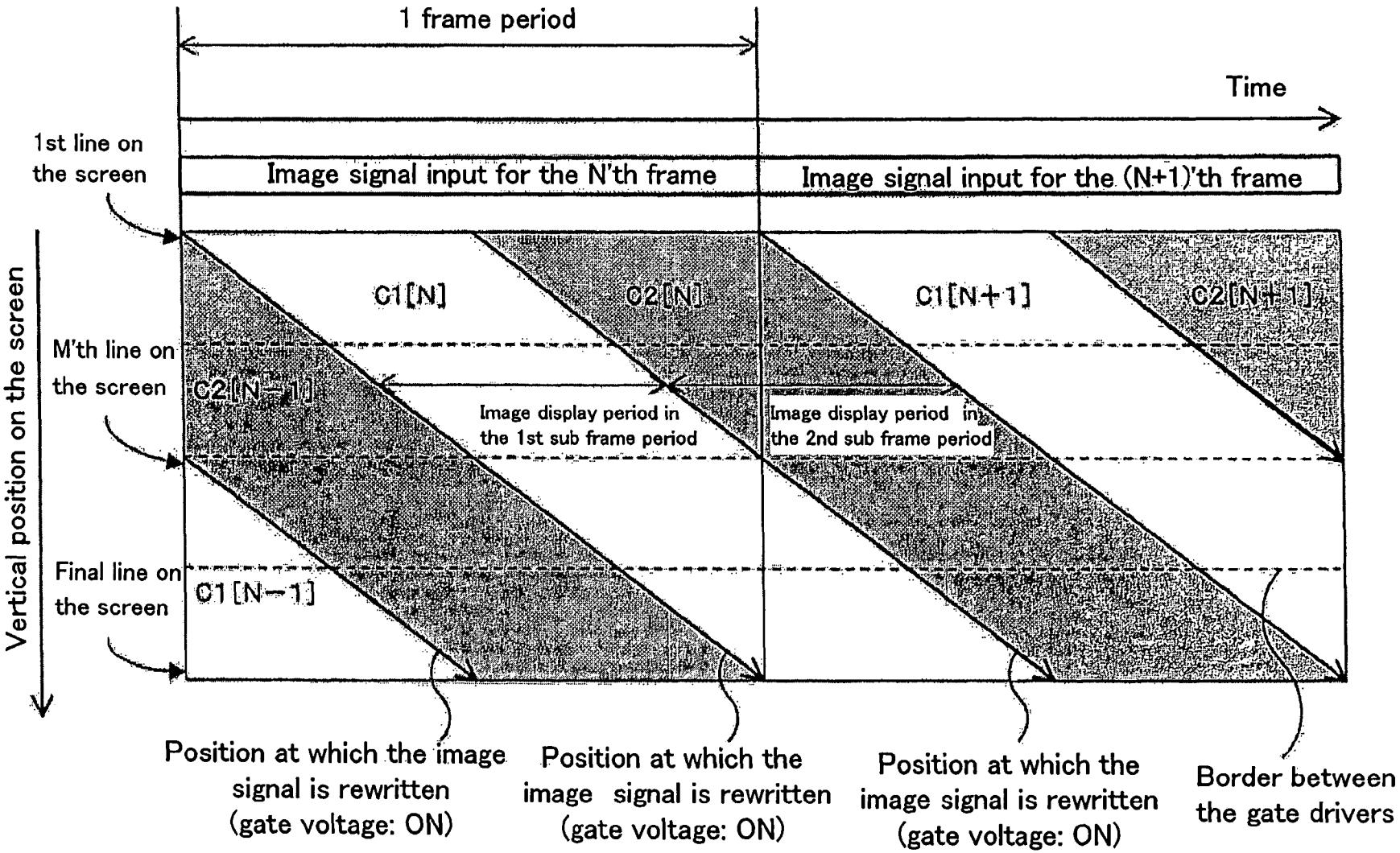
FIG. 4 shows how an image signal on the screen is rewritten by repeating the display control shown in the image display apparatus in Example 1.

FIG. 4 shows how the image signal on the screen is rewritten by repeating the display control shown in FIG. 3. Specifically, FIG. 4 shows how the image signal is rewritten in the period in which the image signal of the N'th frame and the (N+1)'th frame is input.

In FIG. 4, the oblique arrows represent the vertical position and the timing at which one horizontal line of image signal is rewritten. Ci[f] represents that the image signal of the f'th frame is displayed by an image signal obtained by conversion performed by the i'th gradation conversion circuit (the first gradation conversion circuit 44 or the second gradation conversion circuit 45). The image display information is retained until the image signal of the same line is rewritten. In FIG. 4, the white areas represent the positions where the image display information obtained by conversion performed by the first gradation conversion circuit 44 is retained, and the hatched areas represent the positions where the image display information obtained by conversion performed by the second gradation conversion circuit 45 is retained. The dotted lines represent the borders between the first through fourth gate drivers 14*a* through 14*d* which are driven.

Paying attention to a vertical position of one horizontal line on the screen, the following is appreciated: during a half of one frame, image display is performed by an image signal obtained by conversion by the first gradation conversion circuit 44; and during the next half of the frame, image display is performed by an image signal obtained by conversion by the second gradation conversion circuit 45. The first half of the frame is referred to as the first sub frame period, and the second half of the frame is referred to as the second sub frame period.

Whether the sub frame period α is assigned to the first sub frame period or the second sub frame period, and whether the sub frame period β is assigned to the first sub frame period or the second sub frame period, is determined by the response speed characteristic, of the display panel used, to a luminance switch.

In the case of the display panel used in Example 1, the response speed to a luminance switch from the minimum luminance level to the maximum luminance level is low (i.e., the response time to such a luminance switch is long), and the response is not completed in one sub frame period. By contrast, the response speed to a luminance switch from the maximum luminance level to the minimum luminance level is high, and the luminance response is substantially completed in one sub frame period.

Figure 5:
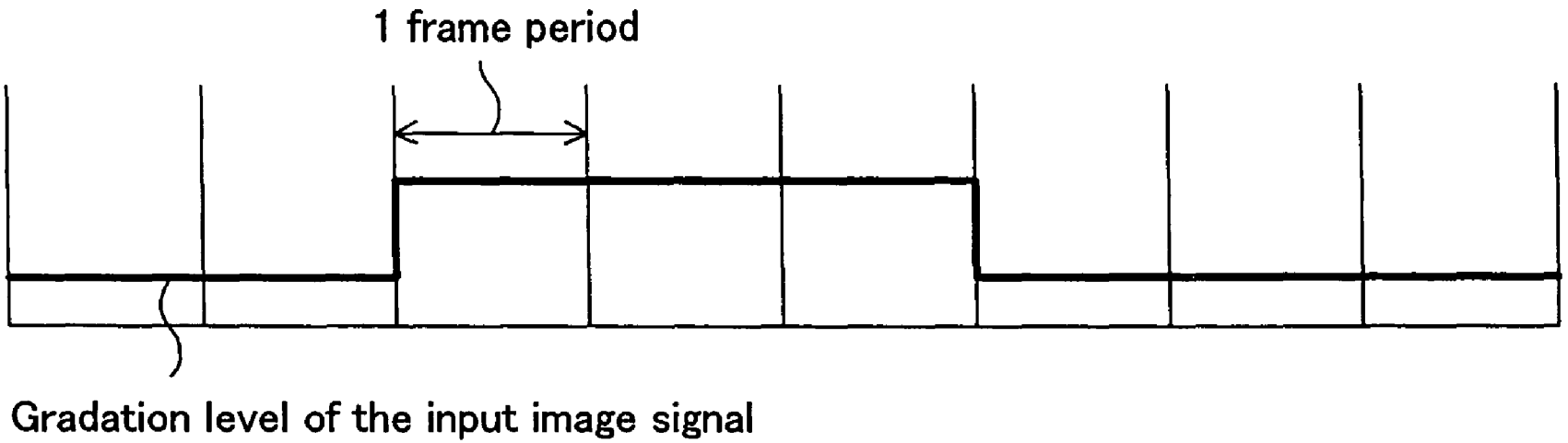
FIG. 5 shows a change in the gradation level of an input image signal when a prescribed display panel is used.
Figure 6:
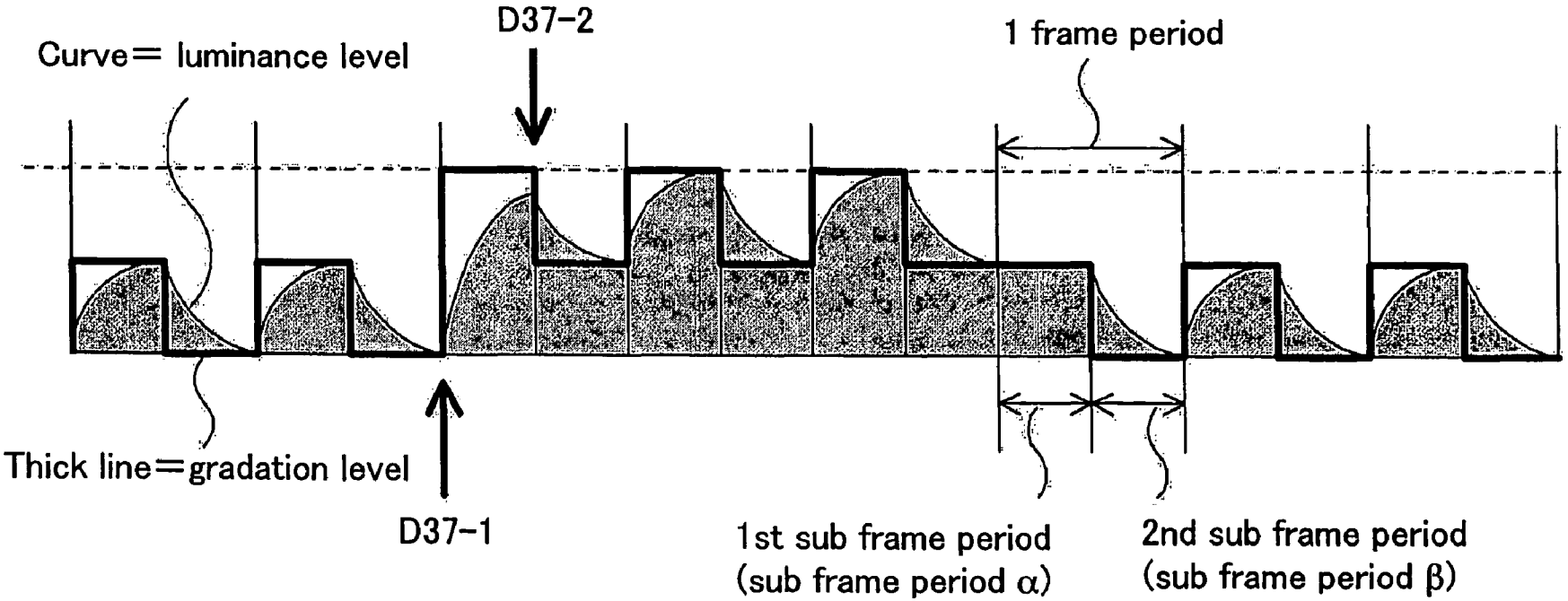
FIG. 6 shows a luminance change in a display panel when a sub frame period $\alpha$ is assigned to a first sub frame period and a sub frame period $\beta$ is assigned to a second sub frame period, in the case where the gradation level of the input image signal is changed as shown in FIG. 5.

With such a display panel, in the case where the gradation level of the input image signal is changed as shown in FIG. 5, the sub frame period α is assigned to the first sub frame period and the sub frame period β is assigned to the second sub frame period. FIG. 6 shows a luminance change in such a case.

In FIG. 6, as represented by arrow D37-1, the gradation level changes most drastically in the first sub frame period when the level of the input image signal rises significantly. As described above, with the display panel used in Example 1, the response speed to a luminance switch from the minimum luminance level to the maximum luminance level is low and thus the luminance response is not completed in one sub frame period. Therefore, the luminance response has not been sufficiently completed at the end of the first sub frame period represented by arrow D37-2. As a result, the state of the luminance change is different from that of the immediately subsequent frame, in which the gradation level of the input image signal is the same. This results in the following inconveniences in the actual image: pseudo profiles are generated at the edge of the moving object; or in the case of color display, the color balance among different colors is destroyed and abnormal colors appear.

Figure 7:
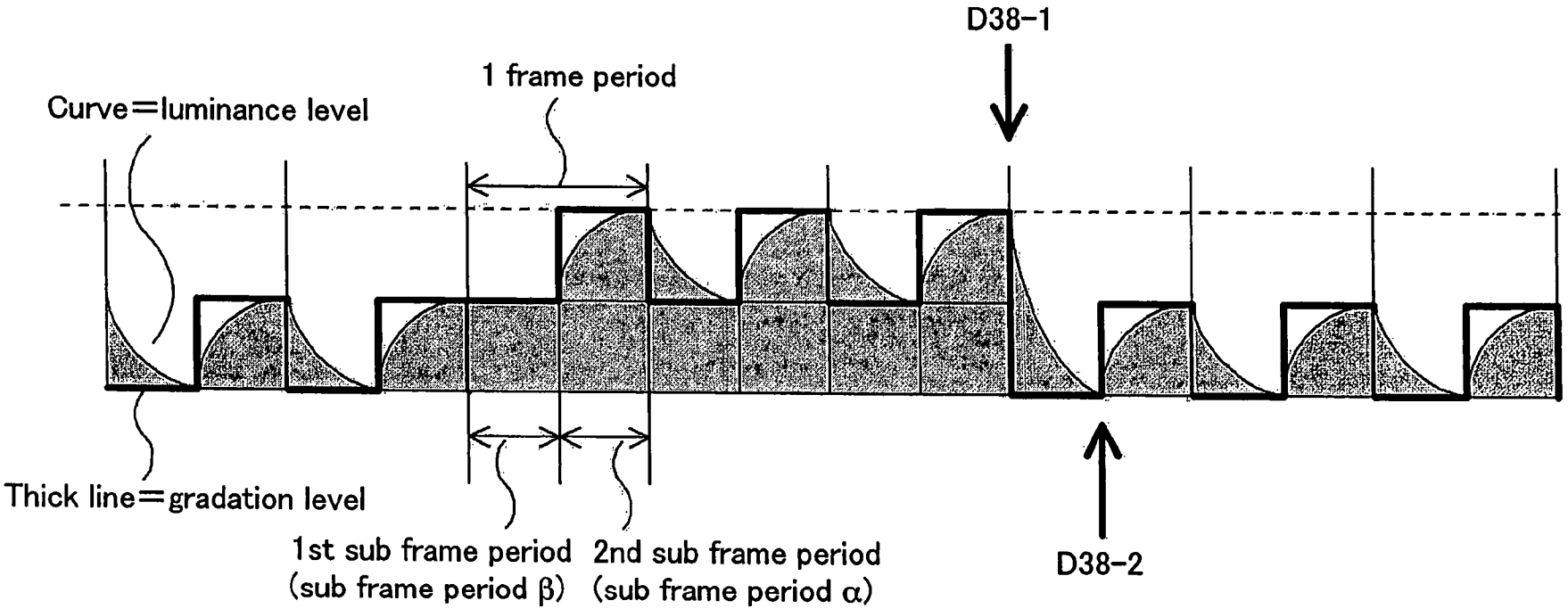
FIG. 7 shows a luminance change in a display panel when the sub frame period $\beta$ is assigned to the first sub frame period and the sub frame period $\alpha$ is assigned to the second sub frame period, in the case where the gradation level of the input image signal is changed as shown in FIG. 5.

Next, the sub frame period α is assigned to the second sub frame period and the sub frame period β is assigned to the first sub frame period, in the case where the gradation level of the input image signal is changed as shown in FIG. 5. FIG. 7 shows a display luminance change in such a case.

In FIG. 7, as represented by arrow D38-1, the gradation level changes most drastically in the first sub frame period when the level of the input image signal falls significantly. As described above, with the display panel used in Example 1, the response speed to a luminance switch from the maximum luminance level to the minimum luminance level is high and thus the luminance response is substantially completed in one sub frame period. Therefore, the luminance response is sufficiently completed at the end of the first sub frame period represented by arrow D38-2. As a result, the state of the luminance change is the same as that of the immediately subsequent frame, in which the gradation level of the input image signal is the same. Therefore, no such inconveniences occur that pseudo profiles are generated at the edge of the moving object, or in the case of color display, the color balance among different colors is not spoiled and abnormal colors do not appear. For this reason, in Example 1, the sub frame period α is assigned to the second sub frame period and the sub frame period β is assigned to the first sub frame period.

An image display method performed using the image display apparatus in Example 1 will be described.

In Example 1, the second sub frame period is referred to as the sub frame period α as described above. In the sub frame period α, the input image signal is converted by the first gradation conversion circuit 44, such that an image signal of a gradation level which is increased or decreased in accordance with the gradation level of the input image signal is supplied when the gradation level of the input image signal is equal to or less than a threshold level uniquely determined, and such that an image signal of the maximum gradation level is supplied when the gradation level of the input image signal is greater than the threshold level.

The first sub frame period is referred to as the sub frame period β as described above. In the sub frame period β, the input image signal is converted by the second gradation conversion circuit 45, such that an image signal of the minimum gradation level is supplied when the gradation level of the input image signal is equal to or less than the threshold level uniquely determined, and such that an image signal of a gradation level which is increased or decreased in accordance with the gradation level of the input image signal is supplied when the gradation level of the input image signal is greater than the threshold level.

Here, the luminance levels which are the target values for the first sub frame period and the second sub frame period will be described.

Figure 8:
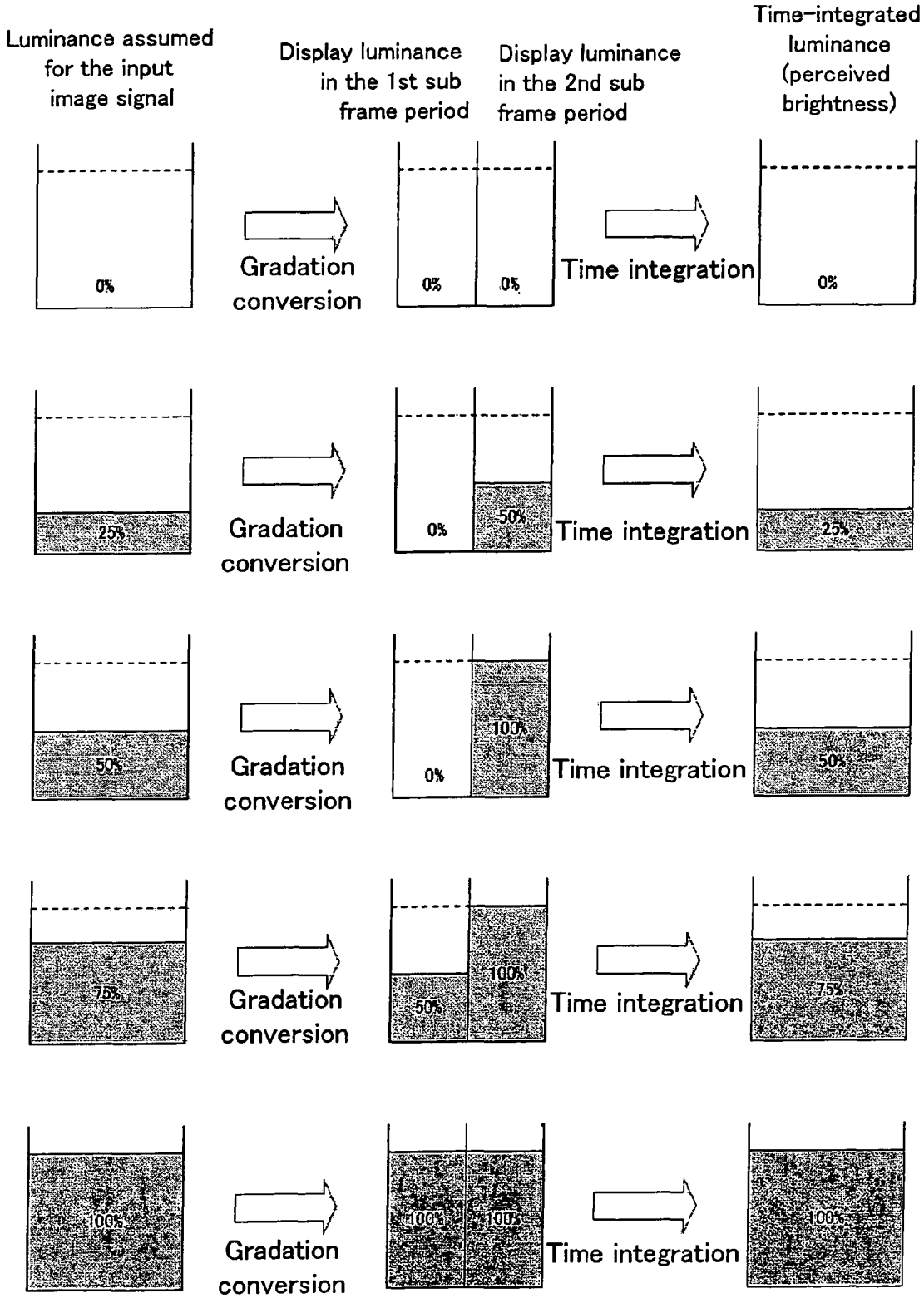
FIG. 8 illustrates the target luminance levels in Example 1.

FIG. 8 illustrates the target luminance levels in Example 1.

In FIG. 8, the left part shows the luminance level assumed for the input image signal. The middle part shows the display luminance in each of the first sub frame period and the second sub frame period. The right part shows the time-integrated luminance in the two sub frame periods of one frame period. This value is considered to match the brightness actually perceived by the observer's eye. Here, the maximum possible value which can be obtained by time integration of luminance of the display panel 10 is set to 100%. FIG. 8 shows the luminance levels assumed for the input image signal in consideration of the gamma luminance characteristic of 0%, 25%, 50%, 75% and 100%.

As shown in FIG. 8, the luminance level assumed for the input image signal of ½ (50%) of the maximum luminance is set as the threshold level, which is a reference for the gradation level of the image signal supplied in each sub frame period. When the luminance level assumed for the input image signal is ½ (50%) of the maximum luminance or less, the luminance in the second sub frame period is expressed as follows.

Luminance in the second sub frame period= luminance assumed for the input image signal× 2 (prescribed ratio, i.e., multiplication value: 2).

Thus, the luminance in the second sub frame period is increased or decreased in accordance with the luminance assumed for the input image signal. For example, when the luminance assumed for the input image signal is 25%, the luminance in the second sub frame period is 25%×2=50%.

When the luminance assumed for the input image signal is greater than ½ (50%) of the maximum luminance, the luminance in the second sub frame period is the maximum luminance (100%).

When the luminance assumed for the input image signal is ½ (50%) of the maximum luminance or less, the luminance in the first sub frame period is the minimum luminance (0%).

When the luminance assumed for the input image signal is greater than ½ (50%) of the maximum luminance, the luminance in the first sub frame period is expressed as follows.

Luminance in the first sub frame period=luminance assumed for the input image signal×2−1 (prescribed ratio, i.e., multiplication value: 2).

Thus, the luminance in the first sub frame period is increased or decreased in accordance with the luminance assumed for the input image signal. For example, when the luminance assumed for the input image signal is 75% (¾), the luminance in the first sub frame period is (¾)×2−1=50%.

As described above, the gradation level of the input image signal is converted by the first gradation conversion circuit 44 (in the first sub frame period) and by the second gradation conversion circuit 45 (in the second sub frame period) in accordance with the set luminance level, and the converted values are respectively output in the first sub frame period and the second sub frame period. In this manner, the time-wise center of gravity of the display luminance does not rely on the gradation level of the input image signal and is fixed to the second sub frame period. Therefore, the reduction in image quality caused by the abnormal luminance or the color imbalance, which is the problem with the technology of, for example, Japanese Laid-Open Publication No. 2001-296841, can be suppressed.

Current general image signals, for example, TV broadcast signals, video reproduction signals, and PC (personal computer) image signals, are mostly generated and output in consideration of the gamma luminance characteristic of CRTs (cathode ray tubes). In this case, the gradation level of an image display signal and the display luminance assumed for the gradation level do not have a linear relationship. Accordingly, in order to realize appropriate gradation representation by display devices such as liquid crystal display devices and EL display devices, the source driver generally includes a circuit having substantially the same gamma luminance characteristic as that of a CRT as a circuit for converting the image signal into a source voltage.

In Example 1, the gradation level of an input image signal and the display luminance assumed for the gradation level have the following relationship.

Display luminance=(gradation level of the input image signal/the maximum gradation level)$^{\gamma}$ ($\gamma$=2.2) expression (1)

(where the maximum value of the display luminance is "1", and the minimum value of the display luminance is "0").

In Example 1, the source drivers 13*a* through 13*d* of the display panel 10 are designed to have the same gamma luminance characteristic as that of expression (1). This is done such that the relationship between the gradation level of an input image signal and the display luminance assumed for the gradation level can be reproduced when one frame of input image signal is simply reproduced in one frame period, like in the general conventional hold-type display apparatuses. In this case, the gradation level of the input image signal and the display luminance assumed for the gradation level have the relationship shown in FIG. 54.

Even in the case where one frame of image display is performed in two sub frame periods as in Example 1, it is preferable to be able to reproduce the relationship between the gradation level of the input image signal and the display luminance assumed for the gradation level.

In order to realize this, in Example 1, (a) the threshold level which is a reference for the gradation level of the image signal in each sub frame period, and (b) the gradation level of the image signal supplied in each sub frame period after being increased or decreased in accordance with the gradation level of the input image signal, are set such that the relationship between the gradation level of the input image signal and the time-integrated value of luminance in one frame period exhibits an appropriate gamma luminance characteristic.

In Example 1, the priority is given to suppressing the reduction in luminance, rather than to solving the movement blur at all the gradation levels. When the gradation level of the input image signal is maximum, the image display is performed at the maximum possible luminance of the display panel 10.

In this case, the gradation level of the input image signal, and the gradation level supplied in the first sub frame period and the gradation level supplied in the second sub frame period, have the following relationship.

$$(\text{Gradation level of the input image signal/the maximum gradation level})^{\gamma}=\{(\text{the gradation level supplied in the first subframe period/the maximum gradation level})^{\gamma}+(\text{the gradation level supplied in the second sub frame period/the maximum gradation level})^{\gamma}\}/2(\gamma=2,2) \quad \text{expression (2)}$$

Figure 9:
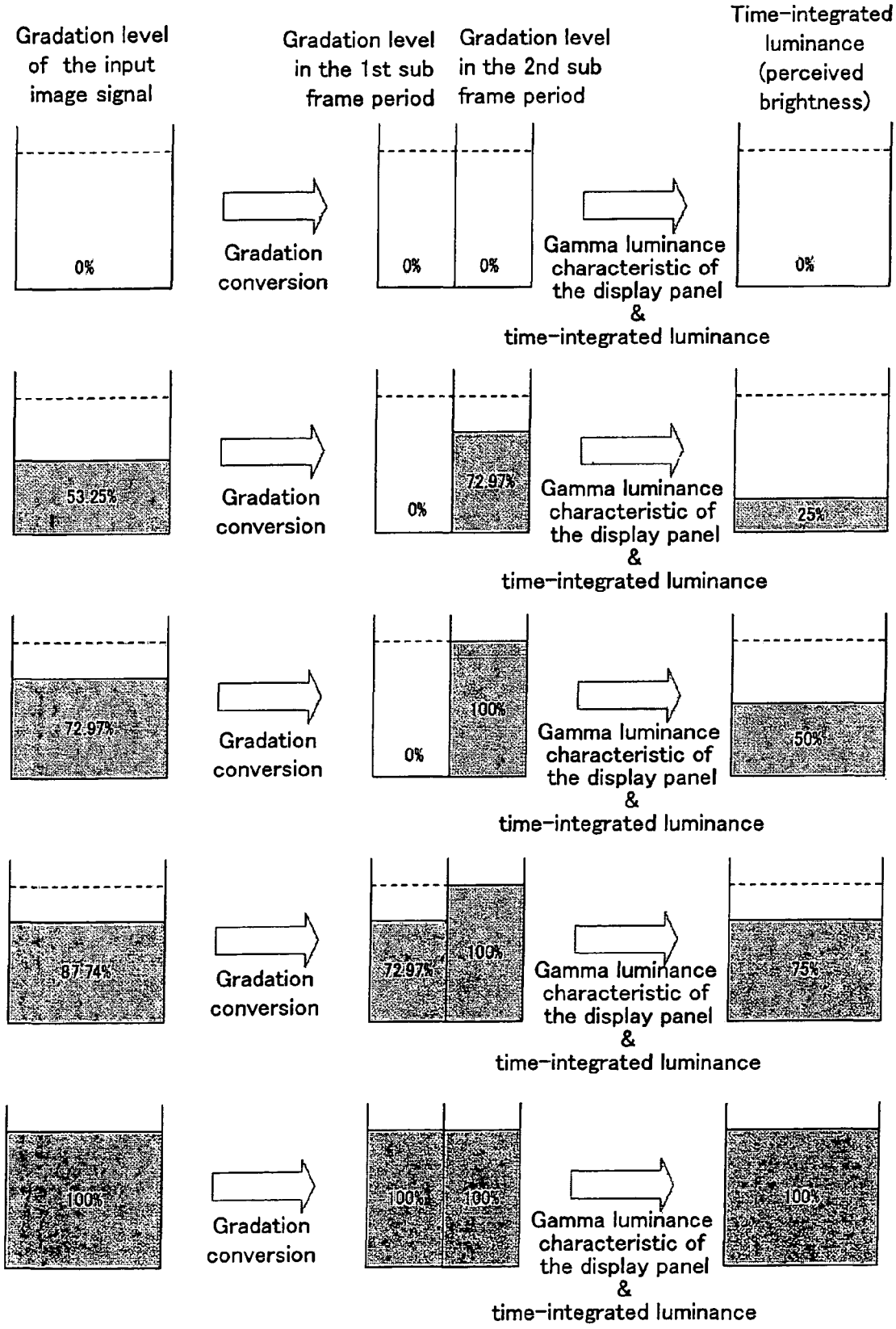
FIG. 9 shows the relationship between the gradation level of the input image signal, and the gradation levels supplied in the first sub frame period and the second sub frame period, which fulfills expression (2) in Example 1.

FIG. 9 shows the relationship between the gradation level of the input image signal, and the gradation level supplied in the first sub frame period and the gradation level supplied in the second sub frame period, which fulfills expression (2).

In FIG. 9, the left part shows the gradation level of the input image signal. The middle part shows the gradation level which is supplied in each of the first sub frame period and the second sub frame period after being converted from the gradation level of the input image signal. The right part shows the time-integrated value of luminance in the two sub frame periods of one frame period. FIG. 9 shows the time-integrated value of luminance of 0%, 25%, 50%, 75% and 100%.

As shown in FIG. 9, the luminance assumed for the input image signal of ½ (50%) of the maximum luminance, i.e., the gradation level of the input image signal of 72.97%, is set as the threshold level, which is a reference for the gradation level of the image signal supplied in each sub frame period. When the gradation level of the input image signal is 72.97% or less, the gradation level of the image signal supplied in the second sub frame period is increased or decreased in accordance with the luminance assumed for the input image signal, so as to fulfill expression (2). The gradation level of the image signal supplied in the first sub frame period is minimum (0%).

When the gradation level of the input image signal is greater than 72.97%, the gradation level of the image signal supplied in the second sub frame period is maximum (100%). The gradation level of the image signal supplied in the first sub frame period is increased or decreased in accordance with the luminance assumed for the input image signal, so as to fulfill expression (2).

The gradation level of the image signal supplied in the first sub frame period is obtained as a result of the input image signal being temporarily stored in, and output from, the line buffer 41 and converted by the first gradation conversion circuit 44 in the control LSI 40A. The gradation level of the image signal supplied in the second sub frame period is obtained as a result of the input image signal being temporarily stored in, and output from, the frame memory 30 and converted by the second gradation conversion circuit 45 in the control LSI 40A.

Figure 54:
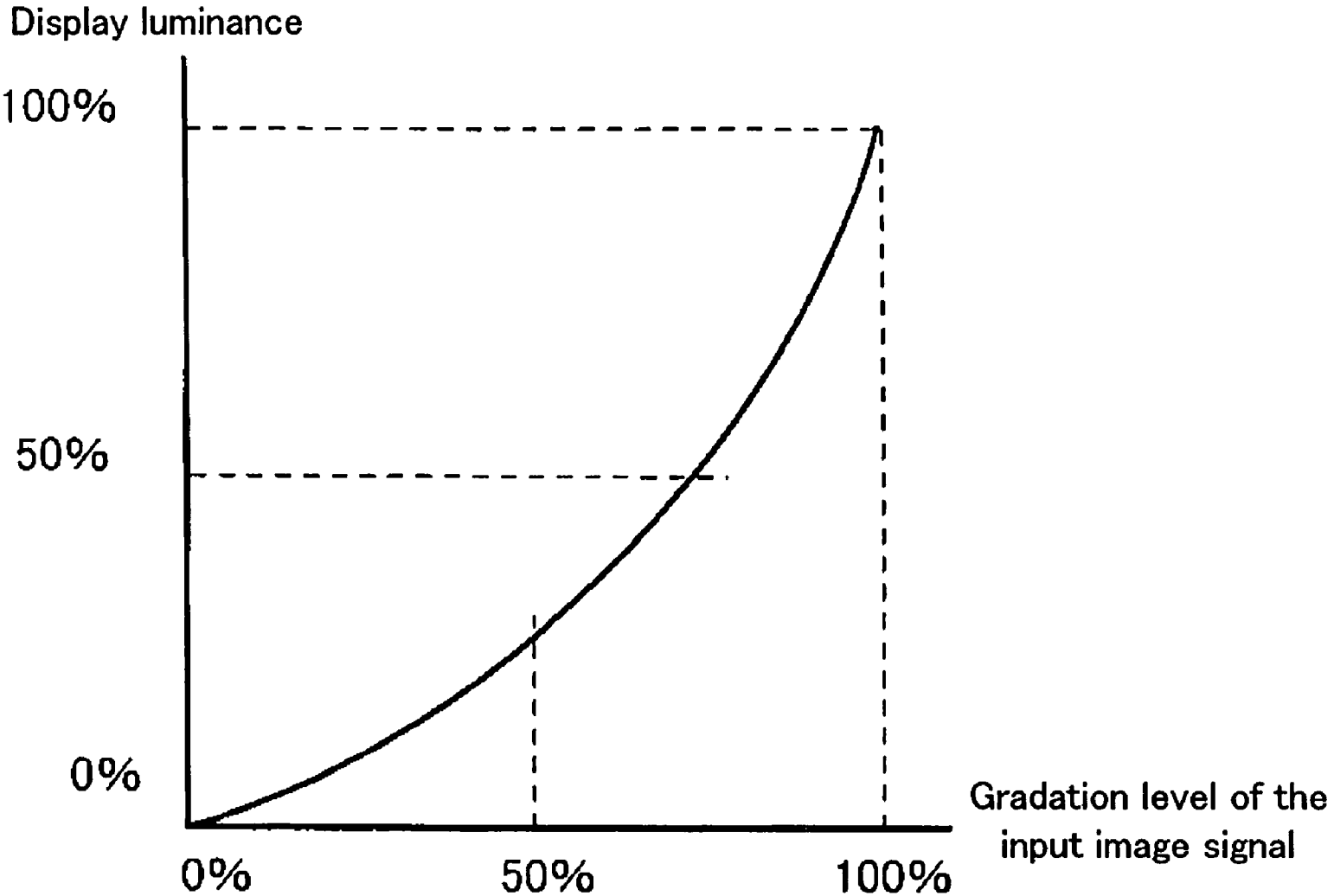
FIG. 54 shows the relationship between the gradation level of a conventional input image signal generated in consideration of a gamma luminance characteristic of a CRT and the display luminance, and the relationship between the gradation level of an image signal and the display luminance in a conventional hold-type image display apparatus which is compatible with the conventional image signal.
Figure 55:
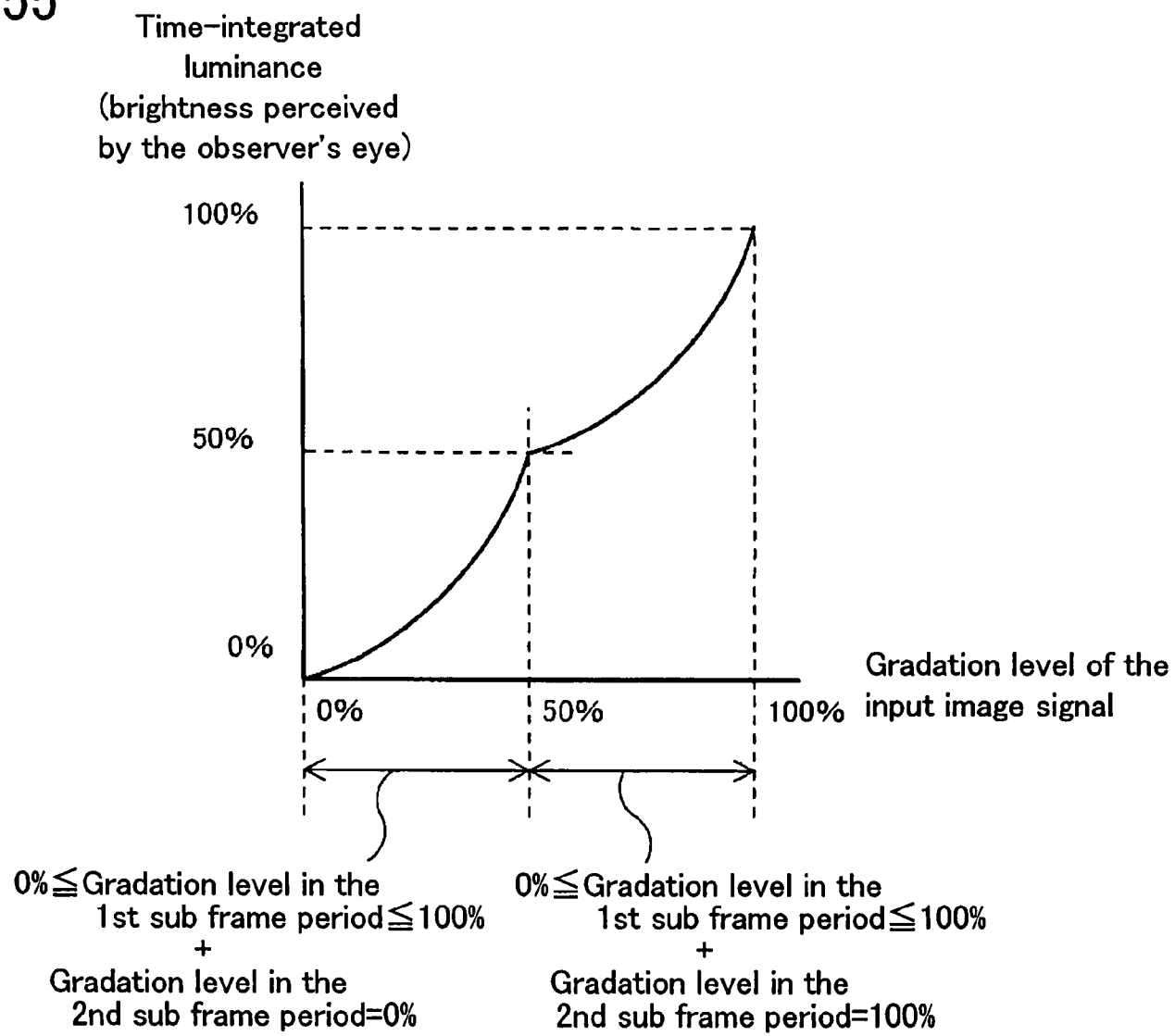
FIG. 55 shows the relationship between the gradation level of an image signal and the display luminance in an image display apparatus proposed by example 7 of Japanese Laid-Open Publication No. 2001-296841 which includes a conventional hold-type display panel.

When the converted gradation levels as shown in the middle part of FIG. 9 are supplied, the image display is performed in the first and second sub frame periods at the luminance in accordance with the gamma luminance characteristic which is possessed by the source driver of the display panel 10, and represented by expression (1) and shown in FIG. 54.

As a result, the time-integrated luminance in the first and second sub frame periods of one frame period as shown in the right part of FIG. 9 is perceived by the observer's eye as the brightness. This time-integrated luminance reproduces the gamma luminance characteristic assumed for the input image signal as represented by expression (1) and shown in FIG. 54. It is understood that an appropriate gamma luminance characteristic is reproduced by the image display apparatus and the image display method in Example 1.

Figure 50:
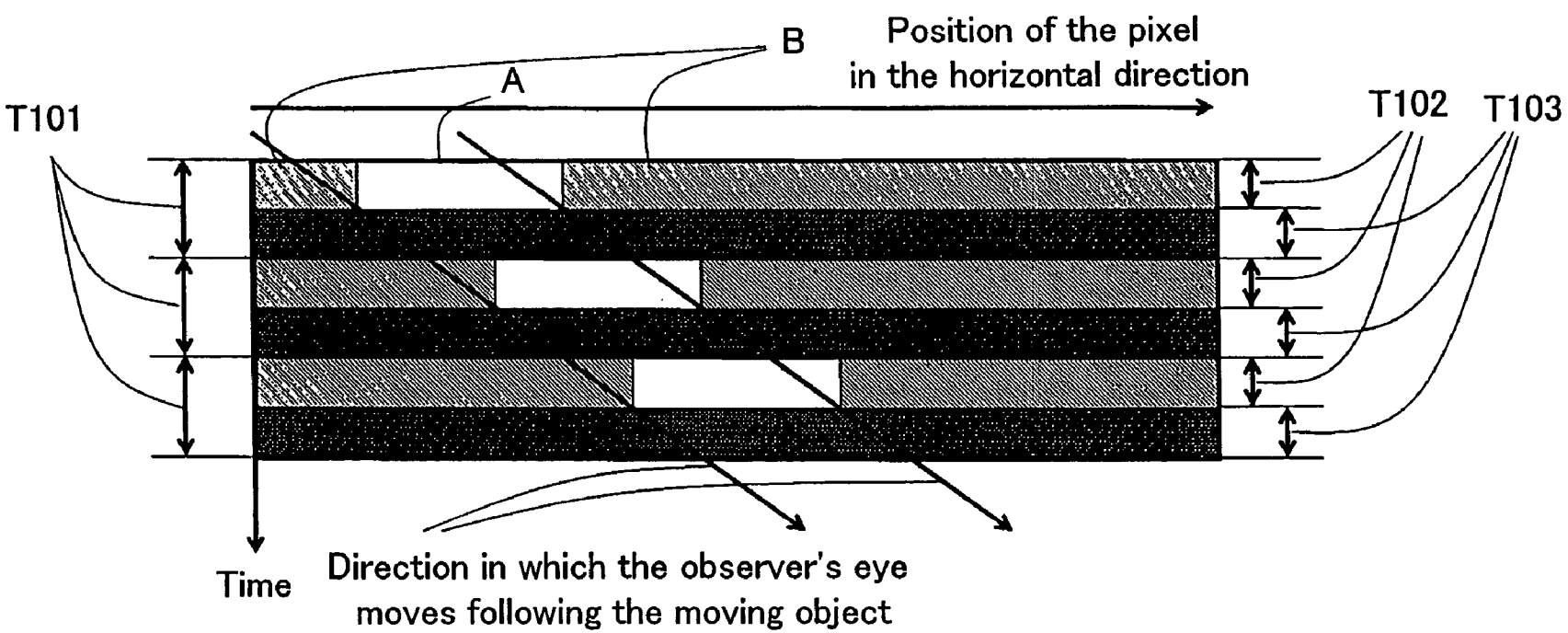
FIG. 50 shows a luminance change in accordance with time of one horizontal line in a screen when an object horizontally moves with a still background in a hold-type image display apparatus adopting the minimum (luminance) insertion system.
Figure 51:
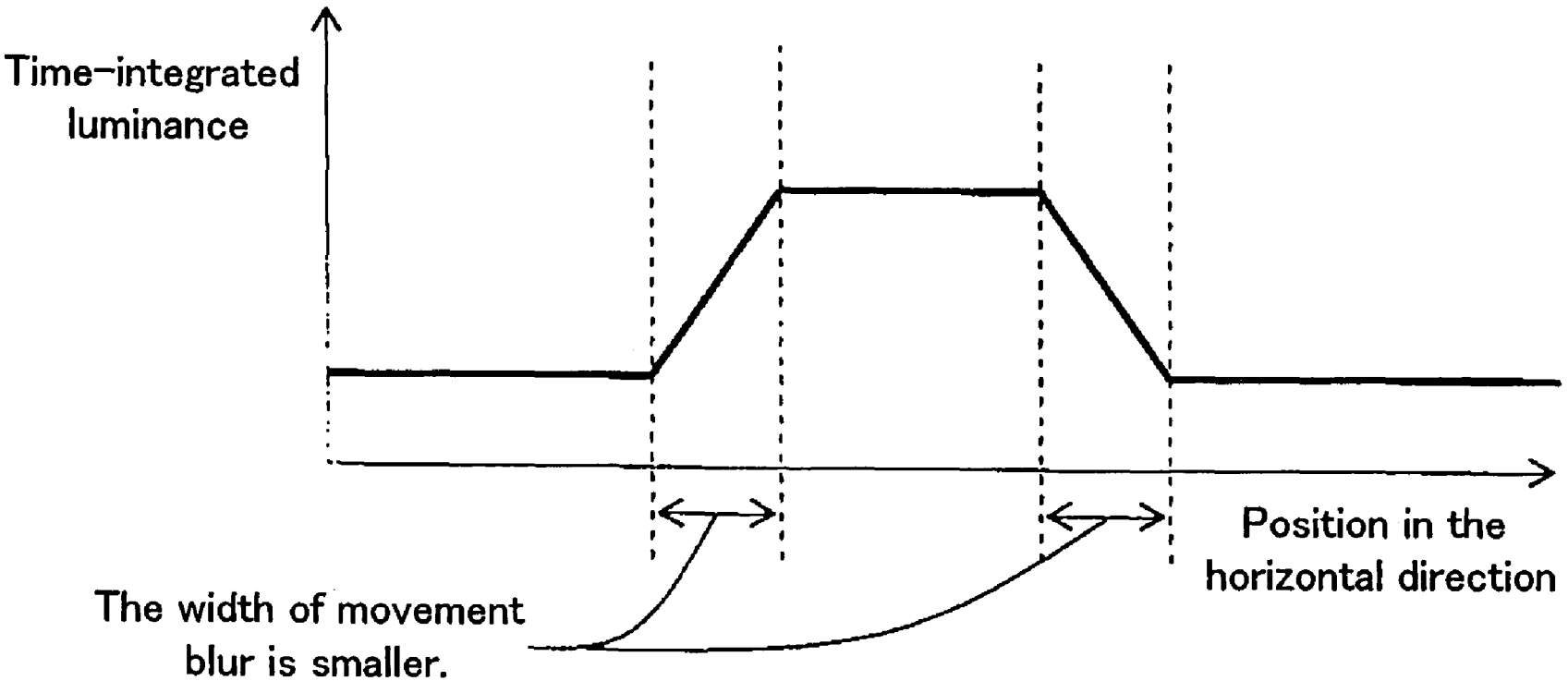
FIG. 51 shows the distribution in brightness of the image shown in FIG. 50 which is viewed by the observer's eye paying attention to the moving object.

For displaying an image of an object moving in the horizontal direction with a still background using the image display apparatus and method in Example 1, when the gradation level of the input image signal is sufficiently low, an image of the minimum gradation level is supplied in the second sub frame period for both the display portion of the still background and the display portion of the moving object. Therefore, as in the case of the image display apparatus which adopt the minimum (luminance) insertion system shown in FIGS. 50 and 51, the movement blur is alleviated to improve the quality of moving images.

In the following description, an image of an object having a gradation level of as high as 72.97% or greater (display luminance of 50% or greater) moving with a background having a still higher luminance is input to a general conventional hold-type image display apparatus and also the image display apparatus in Example 1.

Figure 48:
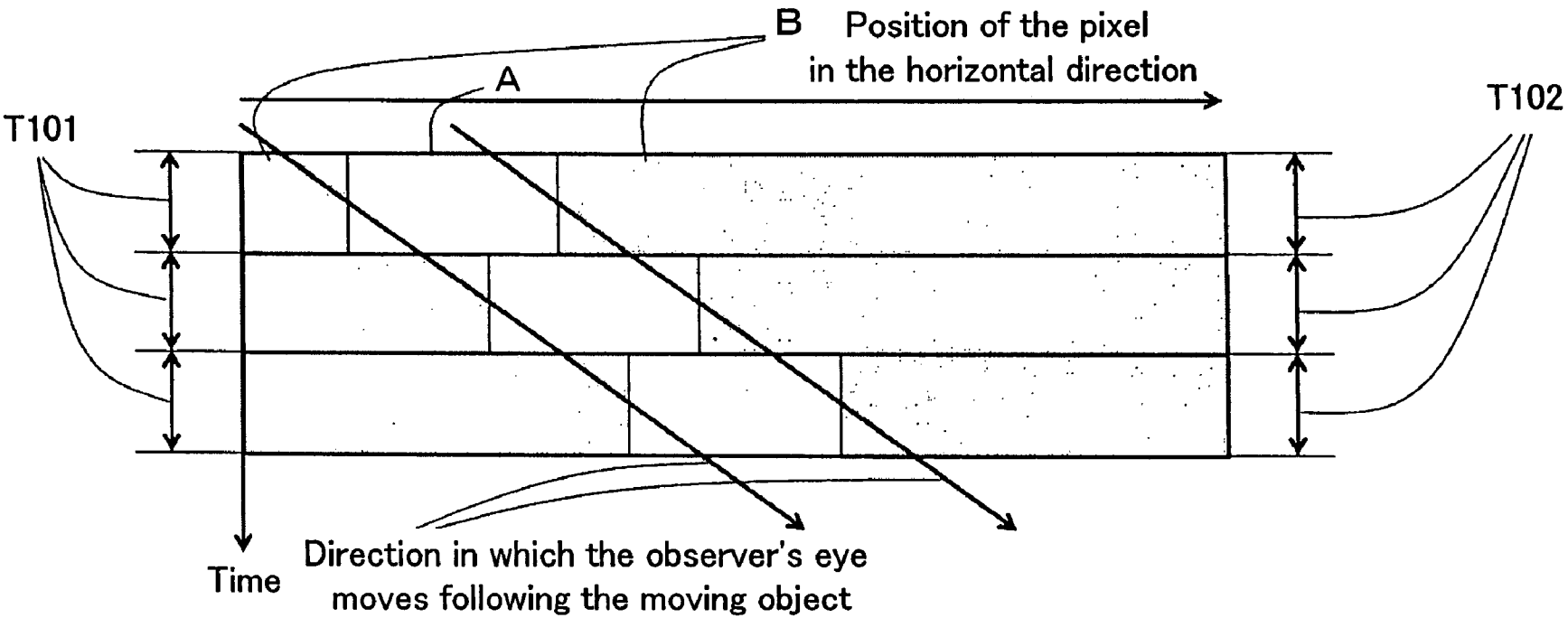
FIG. 48 shows a luminance change in accordance with time of one horizontal line in a screen when an object horizontally moves with a still background in a general conventional hold-type image display apparatus.
Figure 56:
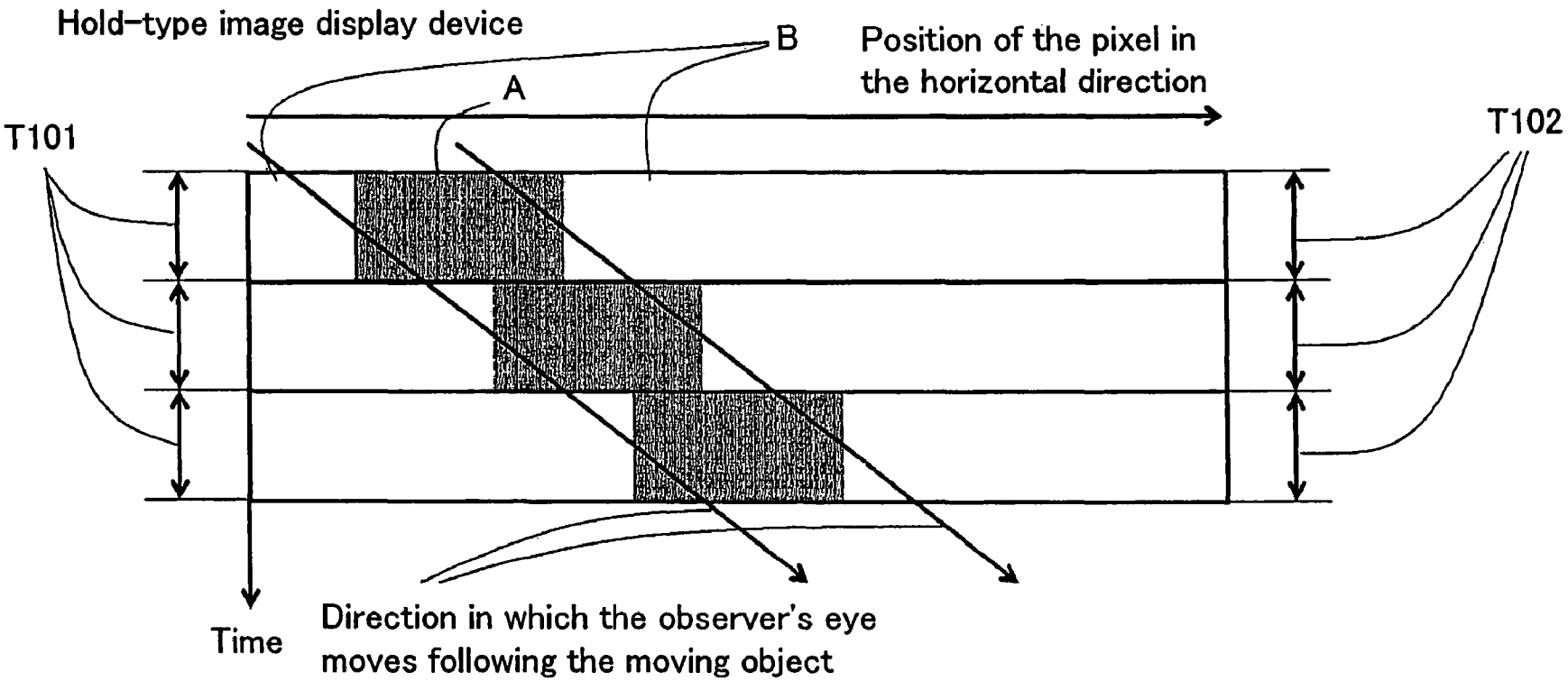
FIG. 56 shows a luminance change in accordance with time of one horizontal line in a screen when an object horizontally moves with a still background in a general hold-type image display apparatus.
Figure 57:
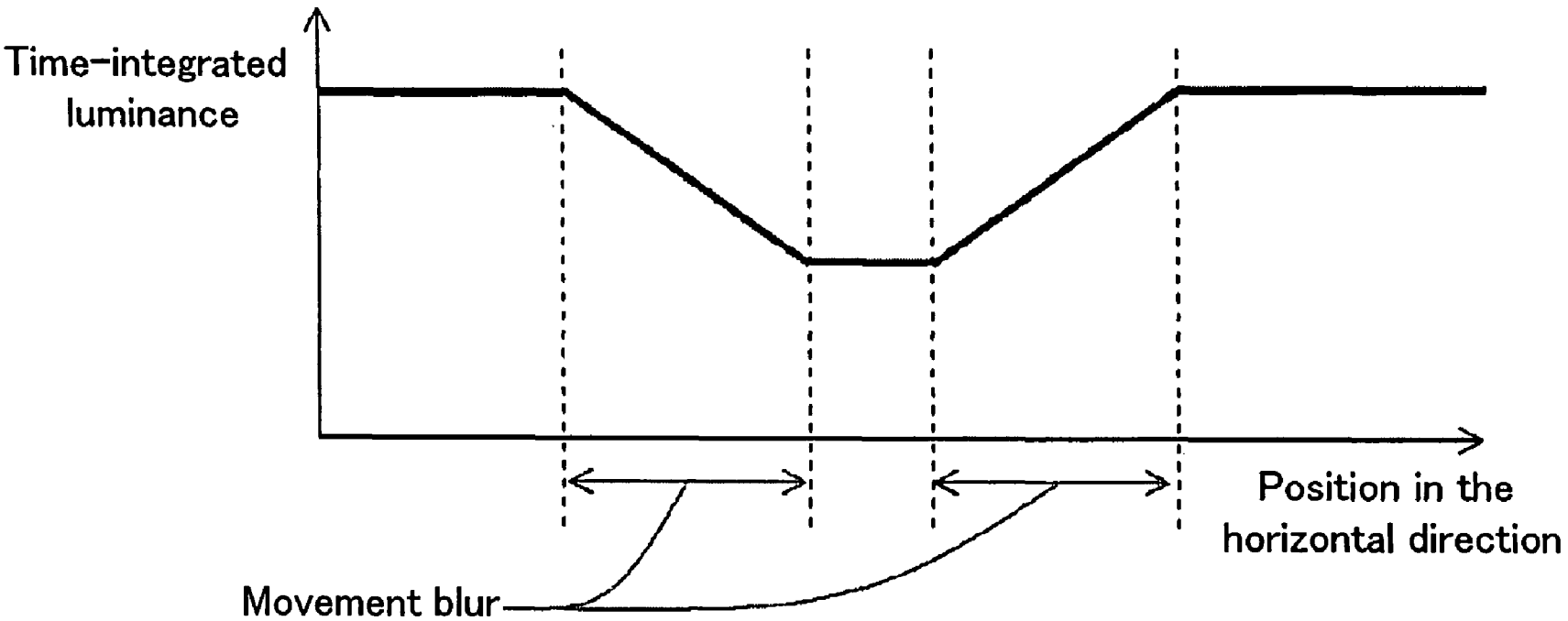
FIG. 57 shows the distribution in brightness of the image shown in FIG. 56 which is viewed by the observer's eye paying attention to the moving object.

FIG. 56 shows a luminance change in accordance with time of one horizontal line in a screen when the above-mentioned image is input to a general conventional hold-type image display apparatus. In FIG. 56, like in FIG. 48, each one-frame period T101 is entirely a light-on period T102. Neither the first sub frame period nor the second sub frame period is provided. FIG. 57 shows the distribution in brightness of the image shown in FIG. 56 which is viewed by the observer's eye paying attention to the moving object.

Figure 58:
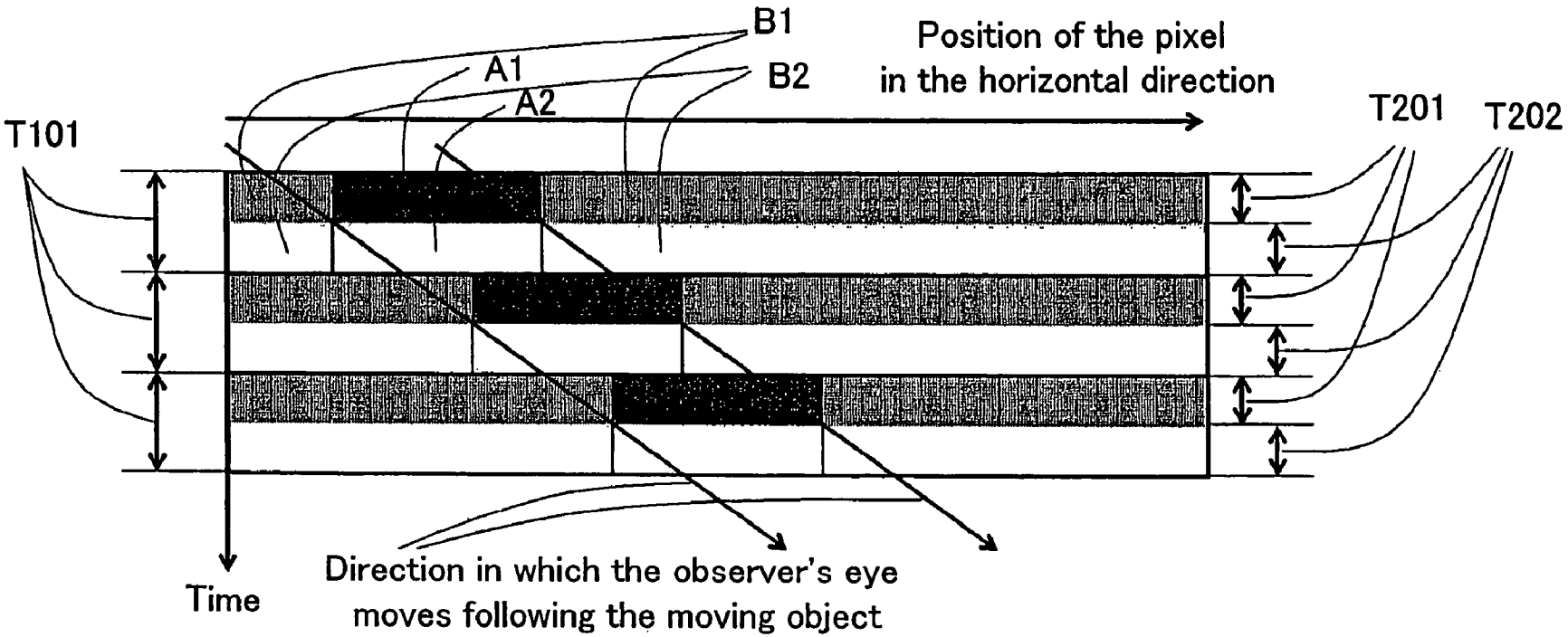
FIG. 58 shows a luminance change in accordance with time of one horizontal line in a screen when an object having a specific luminance horizontally moves with a still background with a specific luminance in an image display apparatus in Example 1.

FIG. 58 shows a luminance change in accordance with time of one horizontal line in a screen when the above-mentioned image is input to the image display apparatus in Example 1.

Figure 59:
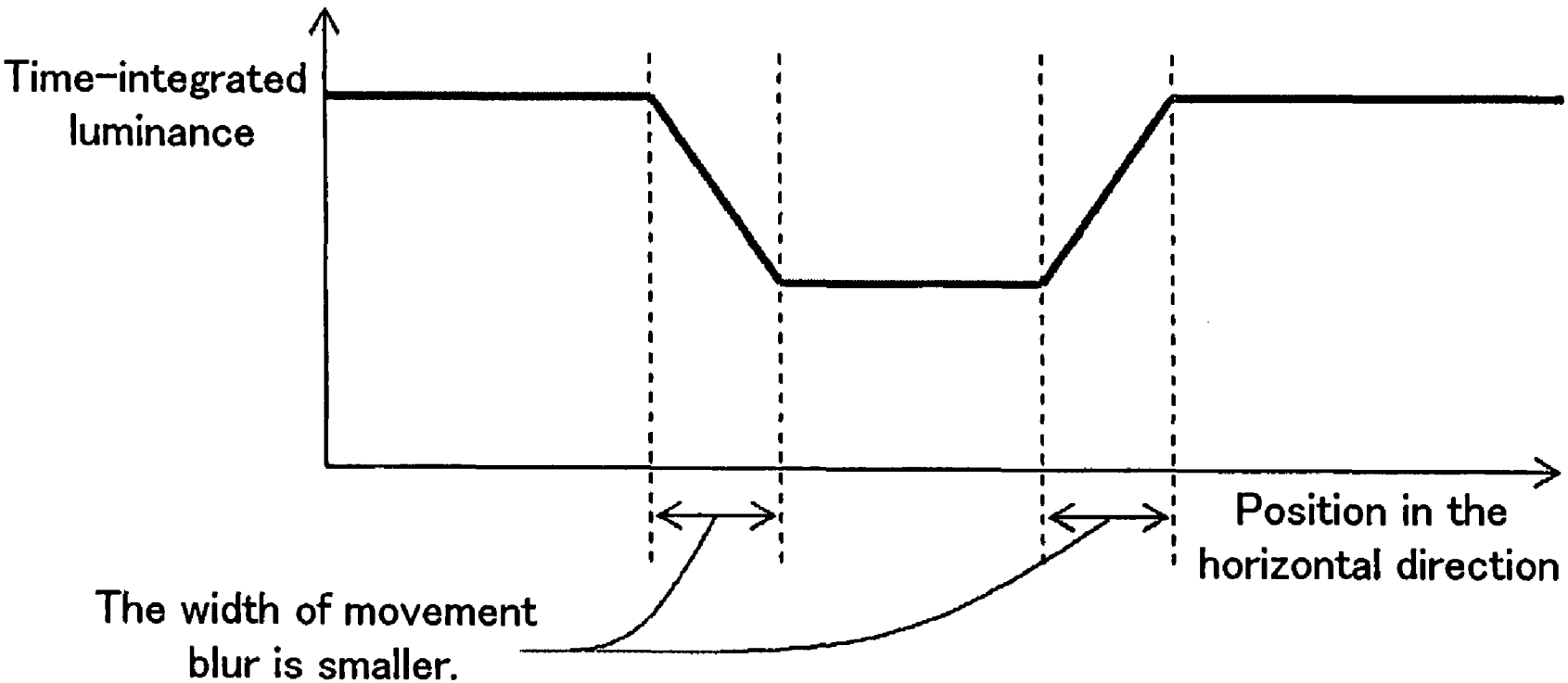
FIG. 59 shows the distribution in brightness of the image shown in FIG. 58 which is viewed by the observer's eye paying attention to the moving object.

As shown in FIG. 58, each one-frame period T101 includes two sub frame periods T201 (first sub frame period) and T202 (second sub frame period). Since the gradation level of the moving object and the gradation level of the still background are both greater than 72.97%, the second sub frame period (A2) of the moving object and the second sub frame period (B2) of the still background are displayed at the maximum luminance. The first sub frame period (A1) of the moving object and the first sub frame period (B1) of the still background are displayed at different luminance levels. FIG. 59 shows the distribution in brightness of the image shown in FIG. 58 which is viewed by the observer's eye paying attention to the moving object. It is appreciated that the movement blur is alleviated as compared to the case of the general conventional hold-type image display apparatus (FIG. 57). As can be appreciated, in Example 1, the maximum (luminance) insertion method provides improvements by a different operation principle from that of the minimum (luminance) insertion system.

Figure 10:
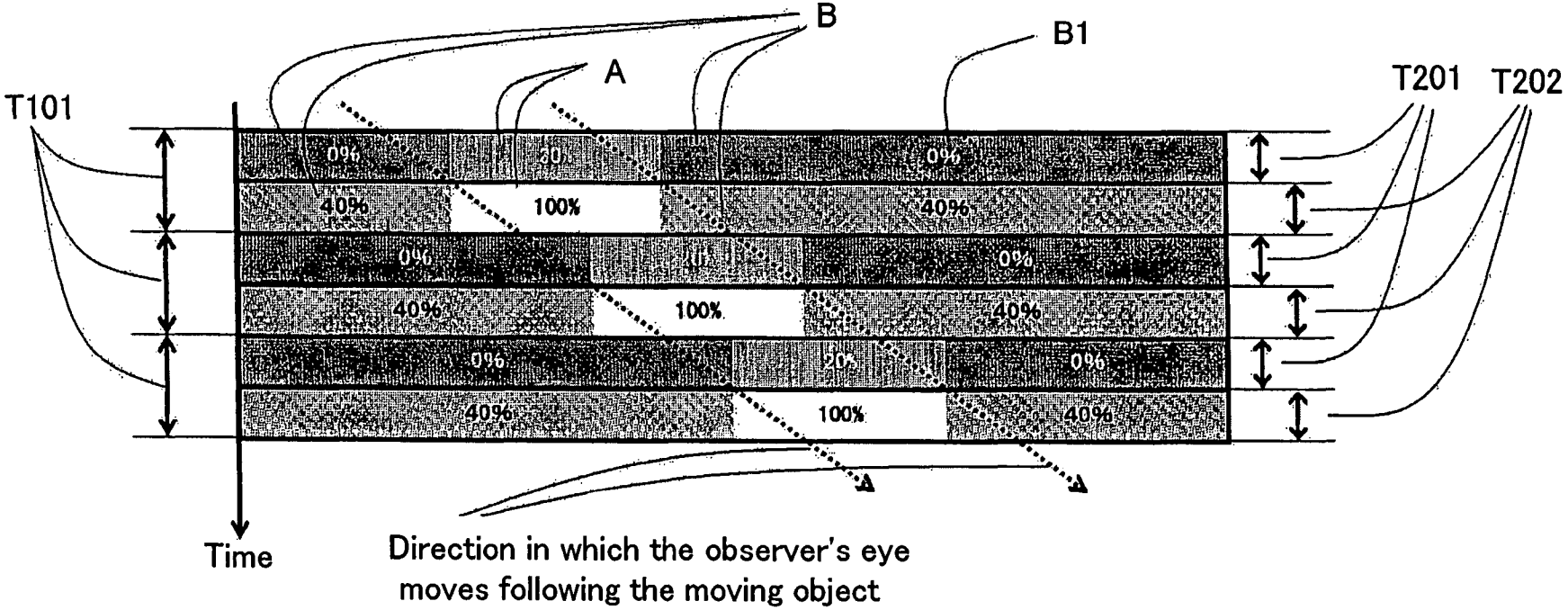
FIG. 10 shows a luminance change in accordance with the time on one horizontal line in a screen when an object horizontally moves with a still background in the image display apparatus in Example 1.
Figure 52:
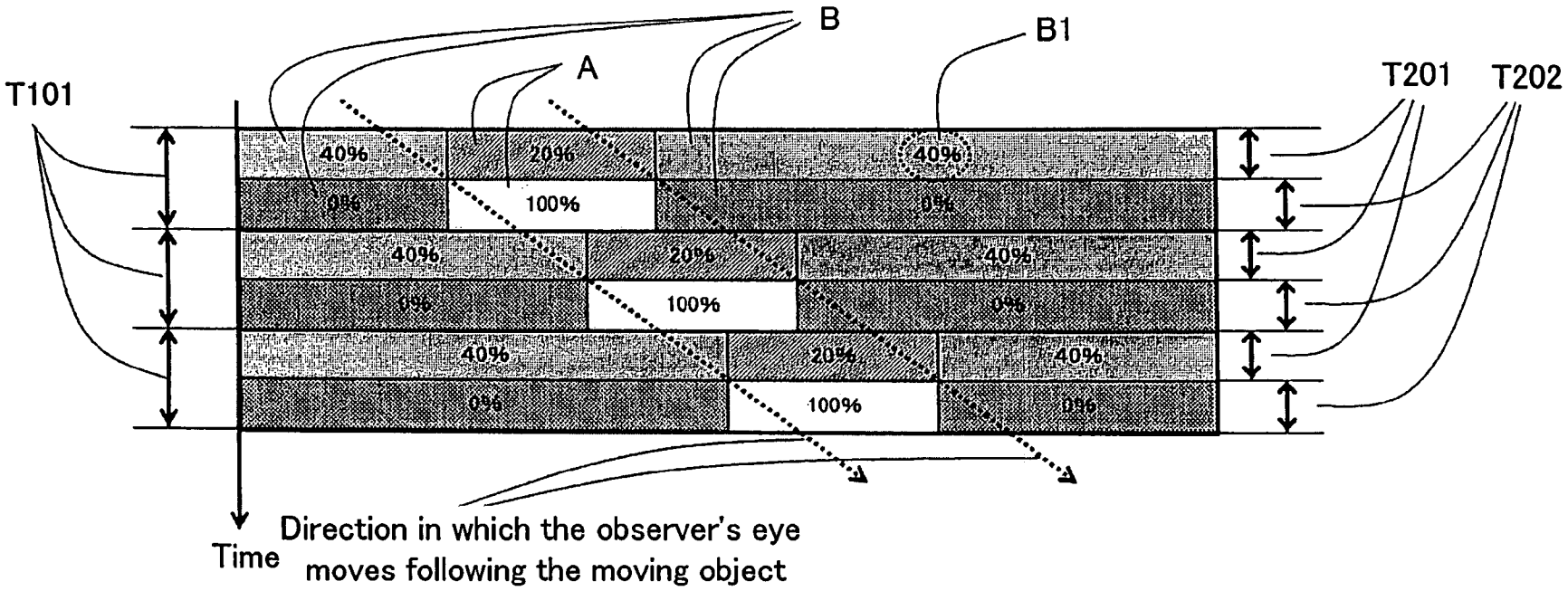
FIG. 52 shows a luminance change in accordance with time of one horizontal line in a screen when an object horizontally moves with a still background in a conventional hold-type image display apparatus disclosed by Japanese Laid-Open Publication No. 2001-296841.
Figure 53:
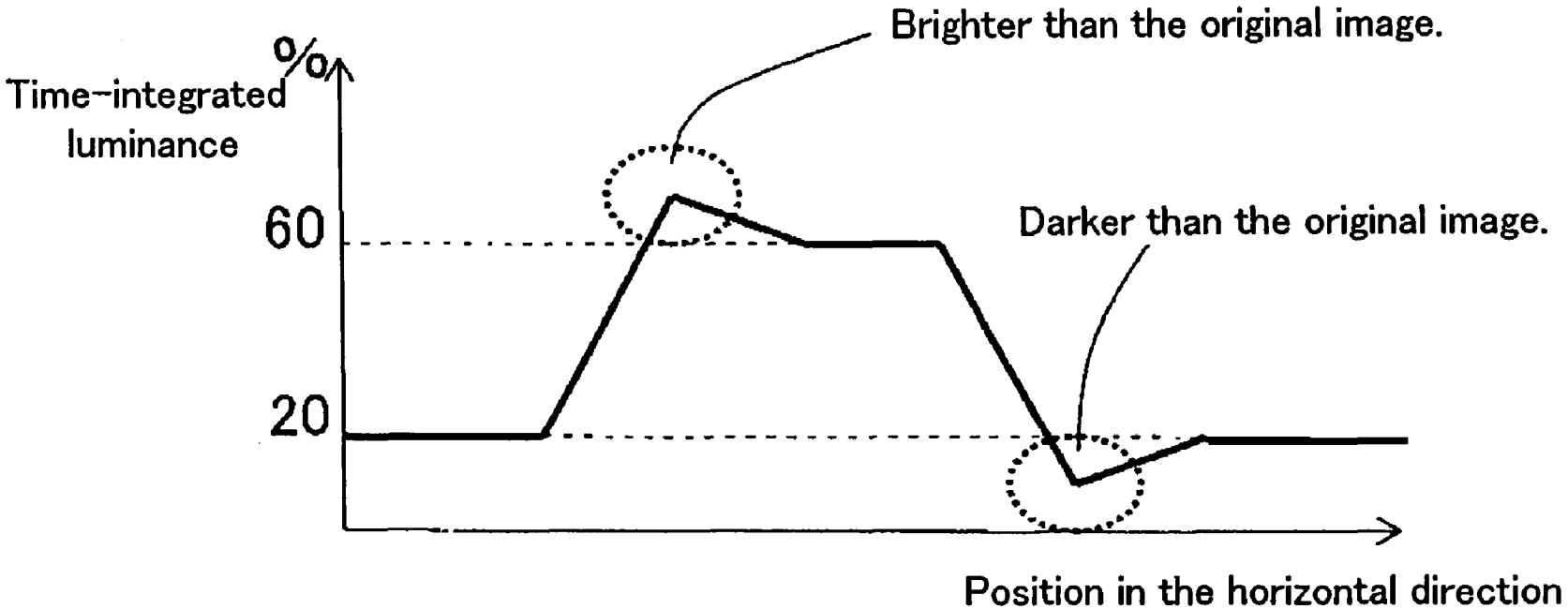
FIG. 53 shows the distribution in brightness of the image shown in FIG. 52 which is viewed by the observer's eye paying attention to the moving object.

FIG. 10 shows a luminance change in accordance with time of one horizontal line in a screen when an object horizontally moves with a still background in the image display apparatus in Example 1. The object horizontally moves with the still background as described in example 7 of Japanese Laid-Open Publication No. 2001-296841 (FIGS. 52 and 53).

In FIG. 10, the horizontal axis represents the luminance state in the horizontal direction of the screen (the position of the pixel portion in the horizontal direction), and the vertical axis represents the time. FIG. 10 shows images displayed on the screen in three frames.

In FIG. 10, each one-frame period T101 includes two sub frame periods T201 (first sub frame period) and T202 (second sub frame period). For the display portion B of the still background, the gradation level of the input image signal is low. Therefore, in the first sub frame period T201, the display portion B is in a light-off state at the minimum luminance of 0%. In the second sub frame period T202, the display portion B is in a light-on state at the luminance of 40% with an image signal of a gradation level which is increased or decreased in accordance with the gradation level of the input image signal. For the display portion A of the moving object, the gradation level of the input image signal is higher than a prescribed threshold. Therefore, in the first sub frame period T201, the display portion A is in a light-on state at the luminance of 20% with an image signal of a gradation level which is increased or decreased in accordance with the gradation level of the input image signal. In the second sub frame period T202, the display portion A is in a light-on state at the maximum luminance of 100%. The numerals with "%" represents the luminance level of the image with respect to the maximum display ability of 100%. For example, the numeral surrounded by the dotted line for B1 represents the luminance of 0%.

Figure 11:
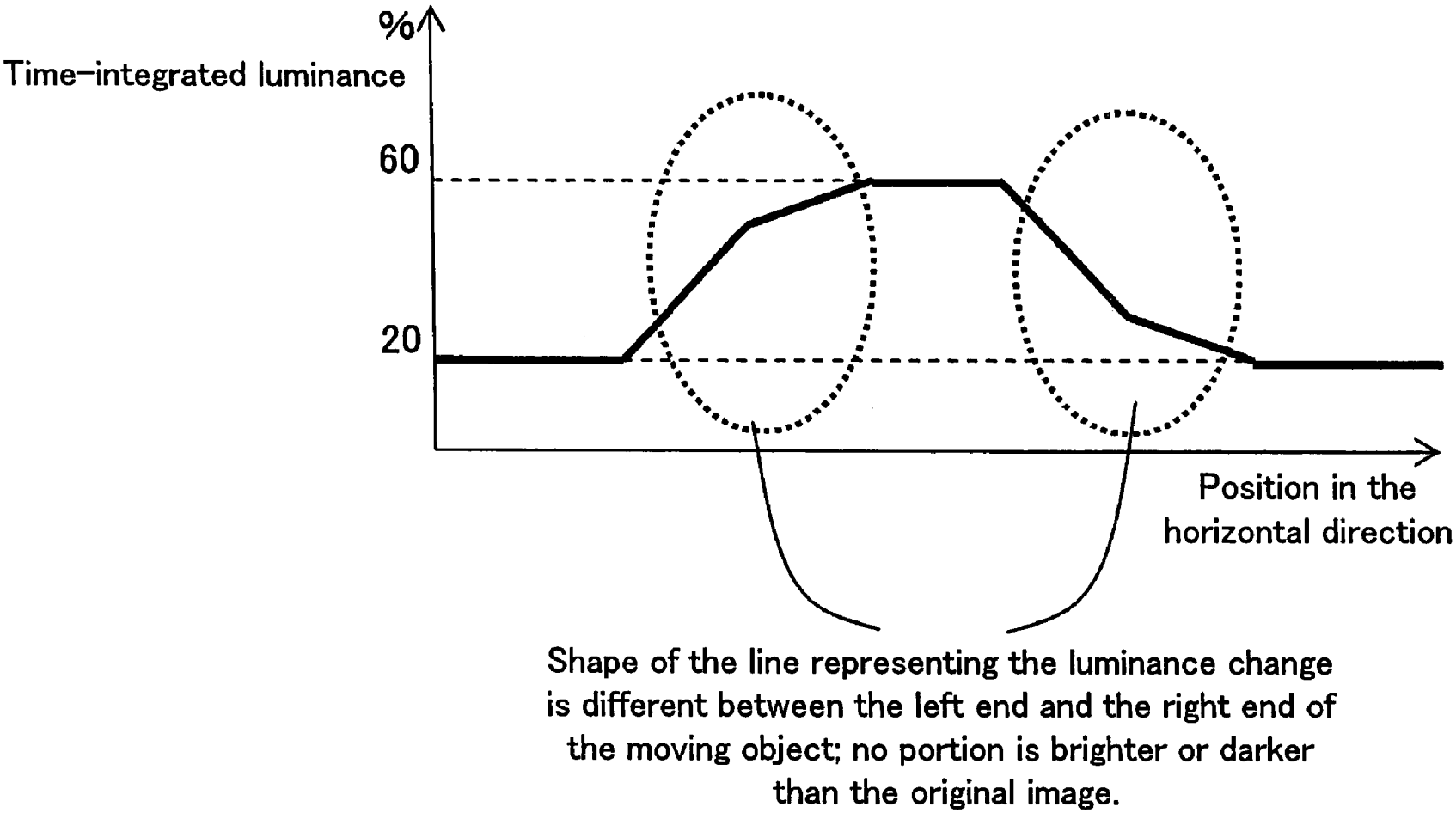
FIG. 11 shows the distribution in brightness of the image shown in FIG. 10 which is viewed by the observer's eye paying attention to the moving object.

FIG. 11 shows the distribution in brightness of the image shown in FIG. 10 which is viewed by the observer's eye paying attention to the moving object.

FIG. 11 shows that the shape of the line representing the luminance change is different between the left end and the right end of the moving object as represented by the dotted circles. However, the drawback shown in FIG. 53 that there are portions which are brighter or darker than the original image is alleviated.

Next, a temperature correction function of the image display apparatus in Example 1 will be described.

The image display apparatus in Example 1 uses liquid crystal elements as the display elements 11*a* of the display panel 10. The response speed of liquid crystal material is generally known to be lower in lower temperatures and higher in higher temperatures. Under certain temperature conditions, the response speed of increasing the transmittance with respect to a change in the gradation level may be different from the response speed of decreasing the transmittance with respect to a change in the gradation level. Such a difference in response speed in accordance with the temperature, and which response speed (i.e., the response speed of increasing or decreasing the transmittance) is higher, depends on the using conditions of the liquid crystal materials.

In the case of the liquid crystal material used in Example 1, the response speed of increasing the transmittance and the response speed of decreasing the transmittance are substantially the same when the temperature is high, and the response speed of decreasing the transmittance becomes lower as the temperature is lowered. With such a liquid crystal material, the luminance may be different under certain temperature conditions even when the same gradation level of image signal is supplied to the image display apparatus which performs one frame of image display using time-integrated luminance of the two sub frame periods.

Figure 12:
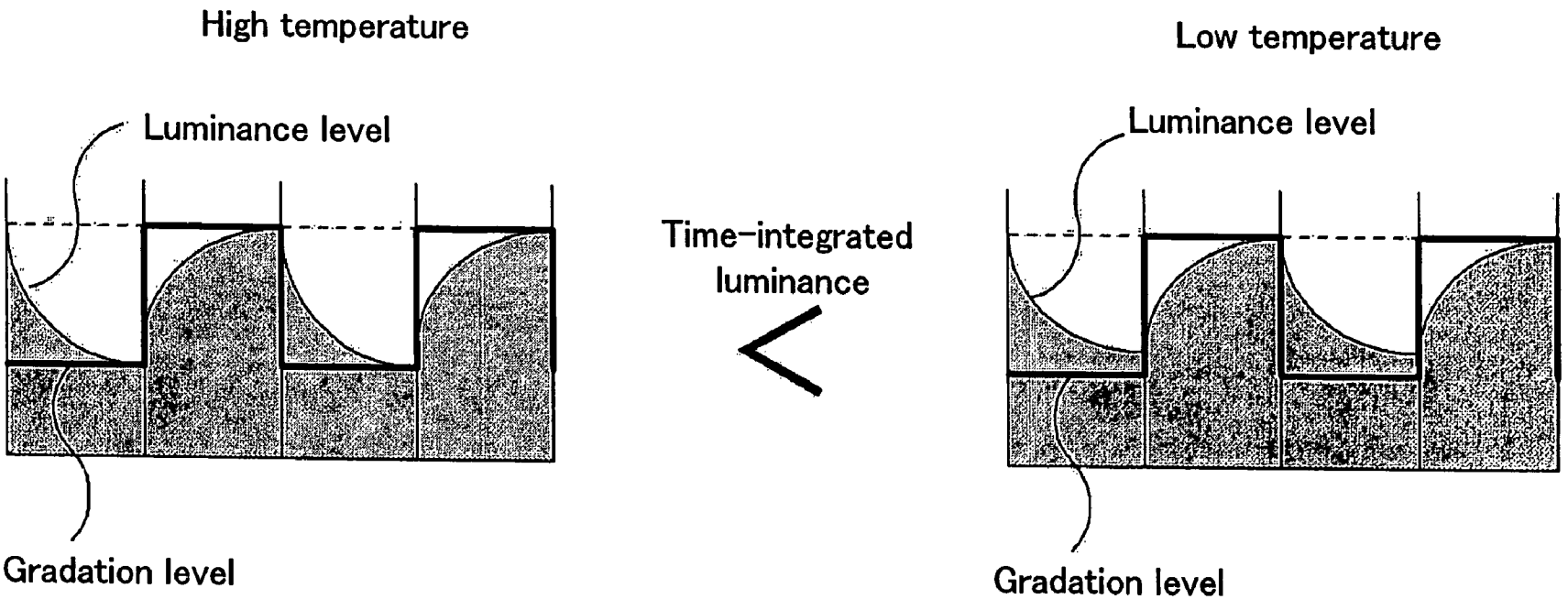
FIG. 12 shows a difference in luminance in accordance with the temperature conditions when the gradation level of the image signal supplied to a display panel used in Example 1 is not adjusted in accordance with the temperature conditions.

FIG. 12 shows a difference in luminance in accordance with the temperature conditions when the gradation level of the image signal supplied to the display panel 10 used in Example 1 is not adjusted in accordance with the temperature conditions. The left part shows the response speed of the liquid crystal material at a high temperature, and the right part shows the response speed of the liquid crystal material at a low temperature. The thick lines represent the gradation level. Both at the high temperature and the low temperature, the same gradation level of image signal is input. The hatched areas represent the luminance which is changed in accordance with the response speed of the liquid crystal material.

As described above, in the case of the liquid crystal material used in Example 1, the response speed of decreasing the transmittance is lowered (i.e., the luminance is lowered) as the temperature is lowered. Accordingly, at the low temperature shown in the right part of FIG. 12, the luminance level is not sufficiently lowered in the first sub frame period as compared to at the high temperature shown in the left part of FIG. 12. As a result, the time-integrated luminance is increased. Therefore, even when the same gradation level of input image signal is supplied at the high temperature and the low temperature, the brightness perceived by the observer's eye is different. It is not preferable for an image display apparatus that the brightness perceived by the observer's eye is different depending on the temperature conditions. In order to solve this problem, the image display apparatus in Example 1 has a temperature correction function as described below.

A temperature level signal which is output from the temperature sensor IC 20 provided in the vicinity of the display panel 10 is input to the first gradation conversion circuit 44 and the second gradation conversion circuit 45. As described above, the first gradation conversion circuit 44 and the second gradation conversion circuit 45 include look-up tables. More specifically, the first gradation conversion circuit 44 and the second gradation conversion circuit 45 each include a plurality of look-up tables, and the look-up table used for gradation conversion is switched in accordance with the temperature level signal from the temperature sensor IC 20.

Figure 13:
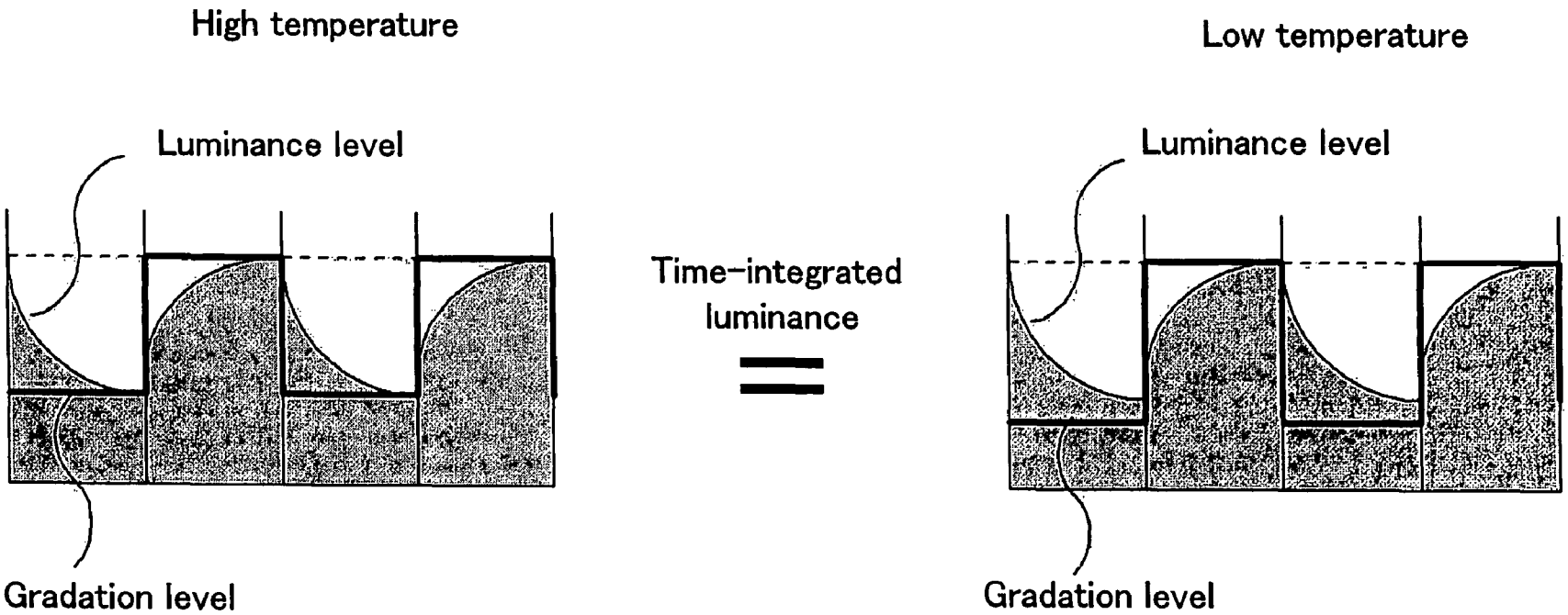
FIG. 13 shows a difference in luminance in accordance with the temperature conditions when the gradation level of the image signal supplied to the display panel used in Example 1 is adjusted in accordance with the temperature conditions.

FIG. 13 shows a difference in luminance in accordance with the temperature conditions when the gradation level of the image signal supplied to the display panel 10 used in Example 1 is adjusted in accordance with the temperature conditions. The left part shows the response speed of the liquid crystal material at a high temperature, and the right part shows the response speed of the liquid crystal material at a low temperature. The thick lines represent the gradation level. The hatched areas represent the luminance which is changed in accordance with the response of the liquid crystal material.

Owing to the above-described temperature correction function, at the low temperature shown in the right part of FIG. 13, a lower gradation level of image signal is input than at the high temperature shown in the left part of FIG. 13. Thus, the luminance change caused by the delay in the response speed of the liquid crystal material at the low temperature is made equivalent to the luminance change at the high temperature. In this manner, the brightness perceived by the observer's eye can be maintained with respect to the same gradation level of image signal, regardless of the temperature conditions.

As described above, according to Example 1 of the present invention, when an image of an object moving with a still background is displayed, the movement blur is alleviated while reducing the maximum value of time-integrated luminance, which is the brightness perceived by the observer's eye, by only 25%, and without generating portions which are abnormally brighter or abnormally darker than the original image. Thus, the quality of moving images of a hold-type image display apparatus can be improved. In addition, the image can be displayed with gradation representation having a gamma luminance characteristic suitable to the input image signal. Even when the display panel 10 uses a liquid crystal material, the relationship between the gradation level of the input image signal and the brightness perceived by the observer's eye can be maintained regardless of the temperature conditions.

Example 2

In Example 2 of the present invention, one frame of image display is performed by the sum of the time-integrated values of luminance during the first and second sub frame periods of each one-frame period. An image display apparatus in Example 2 includes display control section for performing image display control on an image display portion in the two sub frame periods.

One of the two sub frame periods is referred to as the sub frame period α, and the other sub frame period is referred to as the sub frame period β. Threshold levels, T1 and T2, of the gradation level in the two sub frame periods are defined. The threshold level T2 is larger than the threshold level T1.

When the gradation level of the input image signal is equal to or less than the threshold level T1, an image signal of a gradation level which is increased or decreased in accordance with the gradation level of the input image signal is supplied to an image display section of the image display apparatus in the sub frame period α, and an image signal of the minimum gradation level is supplied to the image display section in the sub frame period β.

When the gradation level of the input image signal is greater than the threshold level T1 and equal to or less than the threshold level T2, an image signal of a gradation level which is increased or decreased in accordance with the gradation level of the input image signal is supplied to the image display section in the sub frame period α, and an image signal of a gradation level which is increased or decreased in accordance with the gradation level of the input image signal and which is lower than the gradation level supplied in the sub frame period α is supplied to the image display section in the sub frame period β.

When the gradation level of the input image signal is greater than the threshold level T2, an image signal of the maximum gradation level is supplied to the image display section in the sub frame period α, and an image signal of a gradation level which is increased or decreased in accordance with the gradation level of the input image signal is supplied to the image display section in the sub frame period β.

Figure 14:
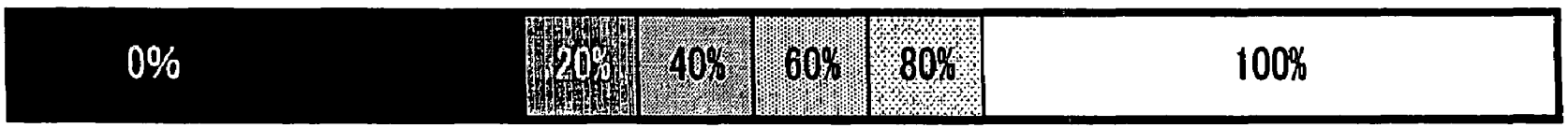
FIG. 14 shows the luminance assumed for the input image signal is gradually changed in the image display apparatus in Example 1.
Figure 15:
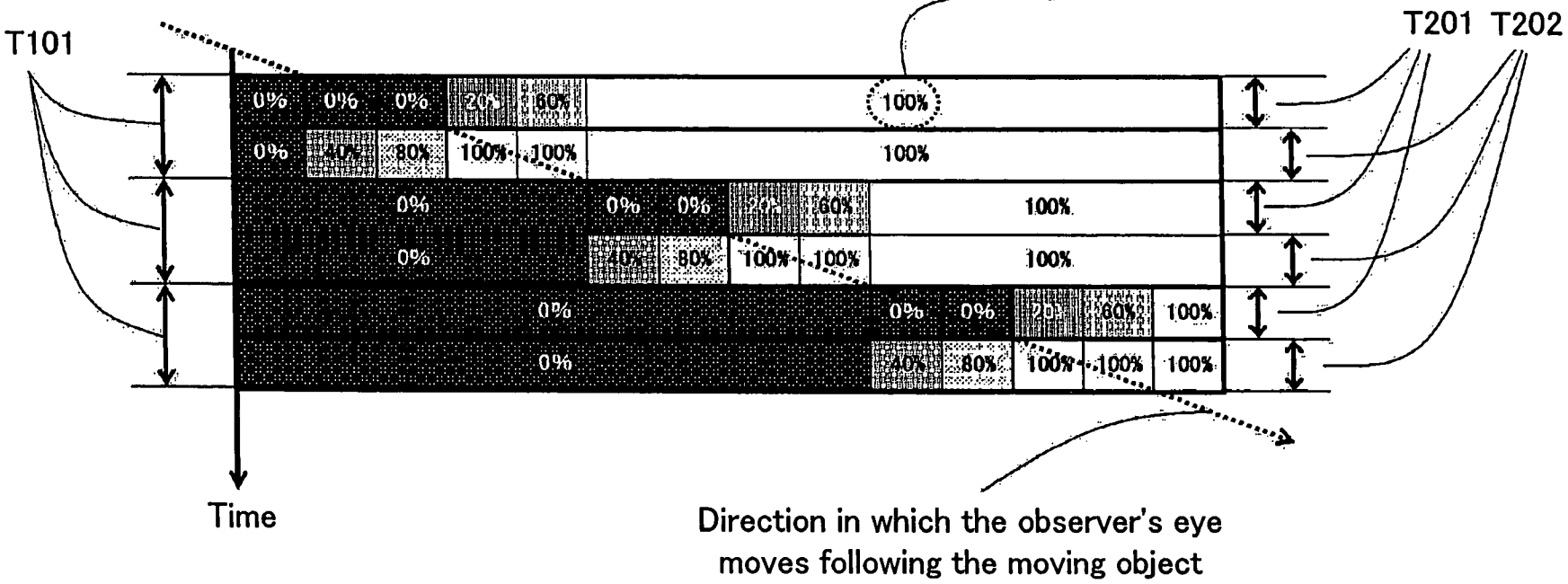
FIG. 15 shows a luminance change in accordance with time of one horizontal line in a screen when an object with the luminance shown in FIG. 14 horizontally moves with a still background in the image display apparatus in Example 1.

For example, the luminance assumed for the input image signal is gradually changed as shown in FIG. 14. FIG. 15 shows a luminance change in accordance with the time on one horizontal line in a screen when an object with the luminance shown in FIG. 14 horizontally moves with a still background in the image display apparatus in Example 1. In Example 1, the luminance in the first sub frame period (T201) is fixed to 0% until the luminance assumed for the input image signal reaches 50%. After the luminance assumed for the input image signal exceeds 50%, the luminance in the first sub frame period increases in accordance with the luminance assumed for the input image signal. The luminance in the second sub frame period (T202) increases in accordance with luminance assumed for the input image signal until the luminance assumed for the input image signal reaches 50%. After the luminance assumed for the input image signal exceeds 50%, the luminance in the second sub frame period is fixed to 100%.

Figure 16:
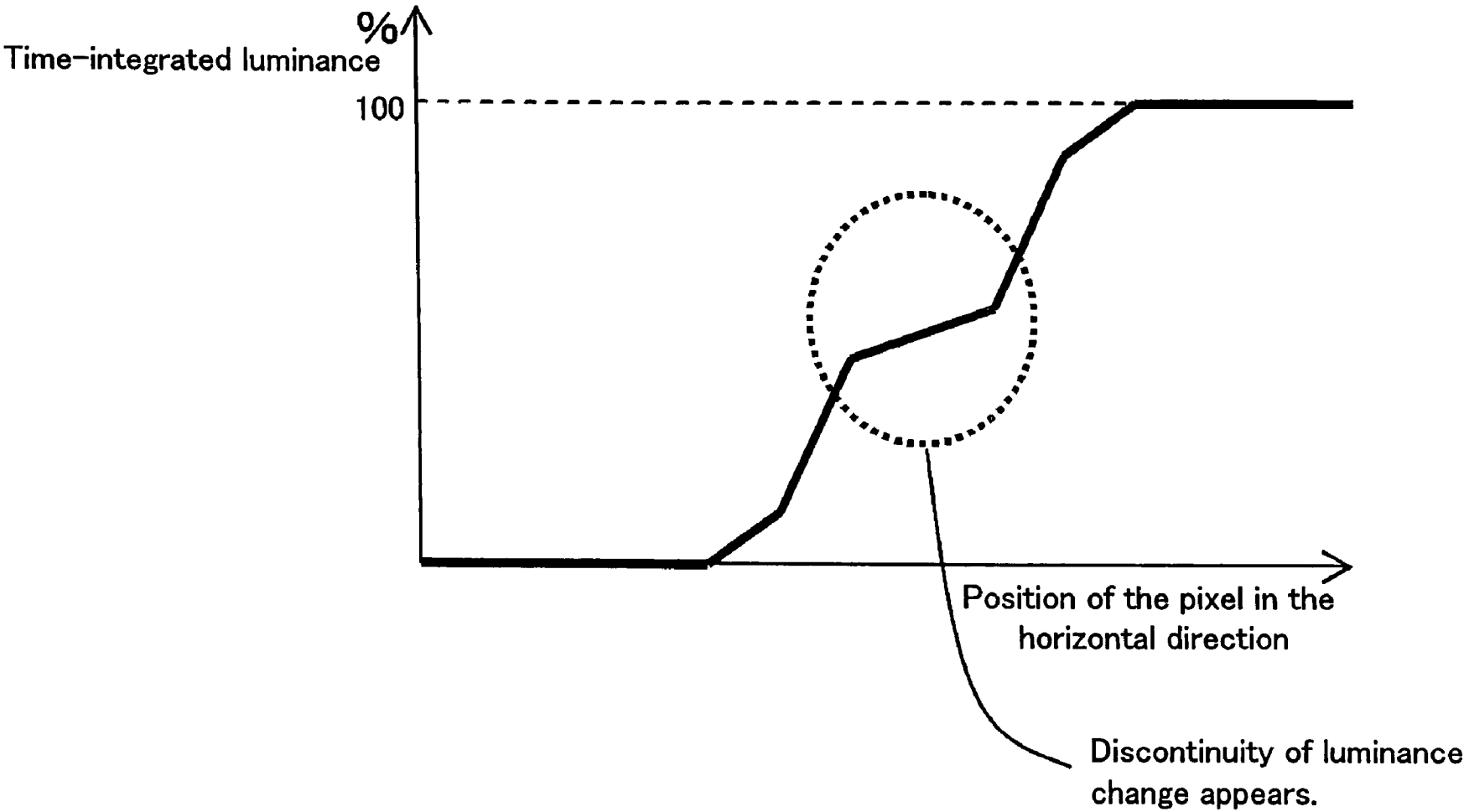
FIG. 16 shows the distribution in brightness of the image shown in FIG. 15 which is viewed by the observer's eye paying attention to the moving object.

FIG. 16 shows the distribution in brightness of the image shown in FIG. 15 which is viewed by the observer's eye paying attention to the moving object.

As shown in FIG. 16, discontinuity (represented by the dotted circle) appears in the luminance change which should be smooth. Such discontinuity may be possibly viewed by the observer's eye as an abnormal portion such as a pseudo profile or the like.

Figure 17:
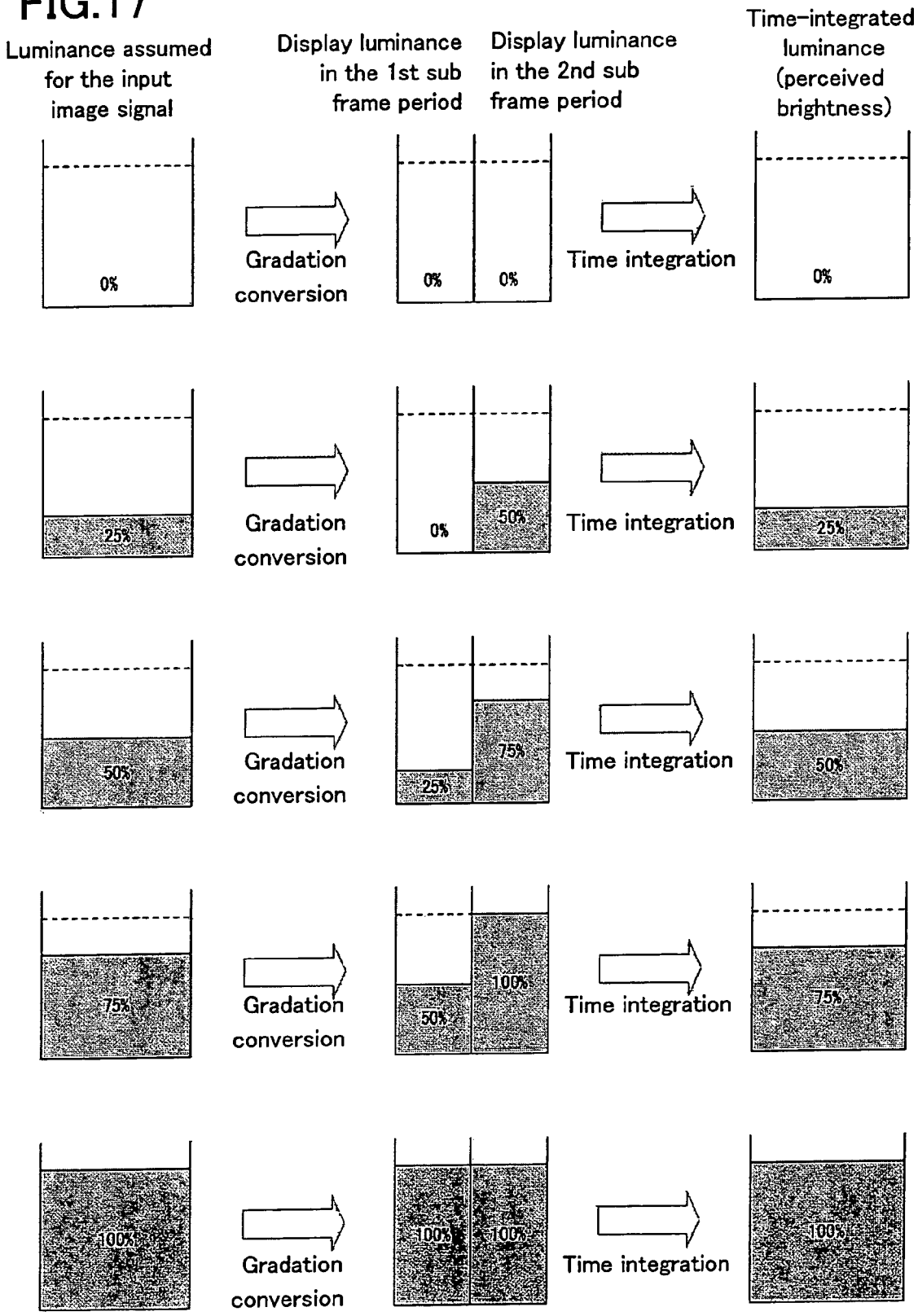
FIG. 17 illustrates the target luminance levels in Example 2 according to the present invention.

In Example 2, in order to suppress such an inconvenience, the gradation distribution in the first and second sub frame periods is performed in a different manner from that in Example 1. FIG. 17 illustrates the target luminance levels in Example 2.

In Example 2, the threshold level T1 is defined as the gradation level when the assumed luminance is 25%, and the threshold level T2 is defined as the gradation level when the assumed luminance is 75%. When the luminance assumed for the input image signal is equal to or less than the threshold level T1 (25%), the image display is performed at the minimum luminance level of 0% in the first sub frame period (the sub frame period β), and the image display is performed at a luminance level which is increased or decreased in accordance with the gradation level of the input image signal in the second sub frame period (the sub frame period α).

When the luminance assumed for the input image signal is greater than the threshold level T1 (25%) and equal to or less than the threshold level T2 (75%), the image display is performed at the luminance level of 0% to 50% in the first sub frame period (the sub frame period β), and the image display is performed at the luminance level of 50% to 100% in the second sub frame period (the sub frame period α). The luminance level in the sub frame period β and the luminance level in the sub frame period α are determined in accordance with the gradation level of the input image signal, and the difference between the luminance levels of the sub frame period β and the sub frame period α is maintained at 50%. Regarding the relationship between the sub frame period β and the sub frame period α, the luminance levels thereof may be fixed, the difference between the gradation levels supplied may be fixed, or the ratio of the gradation levels supplied may be fixed. The luminance levels of the sub frame period α and the sub frame period β, or the gradation levels supplied in the sub frame period α and the sub frame period β, may be defined by some function.

When the luminance assumed for the input image signal is greater than the threshold level T2 (75%), the image display is performed at a luminance level which is increased or decreased in accordance with the gradation level of the input image signal in the first sub frame period (the sub frame period β), and the image display is performed at the maximum luminance level of 100% in the second sub frame period (the sub frame period α).

In Example 1, the target display luminance level for each of the first sub frame period and the second sub frame period, when the luminance assumed for the input image signal is 25% or greater and less than 75%, is gradually increased from the second sub frame period to the first sub frame period. By contrast, in Example 2, the target display luminance is increased both in the second sub frame period and the first sub frame period. When the luminance assumed for the input image signal is less than 25% or equal to or greater than 75%, Example 2 works in the same manner as in Example 1.

As described above, FIG. 17 illustrates the target luminance levels in Example 2. Comparing FIG. 17 and FIG. 8 which illustrates the target luminance levels in Example 1, it is appreciated that the display luminance levels in the first sub frame period and the second sub frame period are different between Example 1 and Example 2 when, for example, the luminance assumed for the input image signal is 50%. In Example 1, the target display luminance is increased to 100% in the second sub frame period and then increased from 0% in the first sub frame period. By contrast, in Example 2, the target display luminance is increased from 50% to 100% in the second sub frame period while being increased from 0% to 50% in the first sub frame period.

Next, the gradation level which is supplied in each sub frame period in order to maintain the above-described target display luminance when the luminance assumed for the input image signal is 25% or greater and less than 75% will be described.

In Example 2, like in Example 1, the display panel has a gamma luminance characteristic. The input image signal also has a gamma luminance characteristic in consideration of the CRTs. For maintaining the difference between the luminance level in the first sub frame period and the luminance level in the second sub frame period to 50%, the relationship between the gradation level in the first sub frame period and the gradation level in the second sub frame period is expressed as follows.

$$(\text{Gradation level of the second sub frame period/the maximum gradation level})^{\gamma}-(\text{gradation level of the first sub frame period/the maximum gradation level})^{\gamma}=0.5(\gamma=2.2) \quad \text{expression (3)}$$

Figure 18:
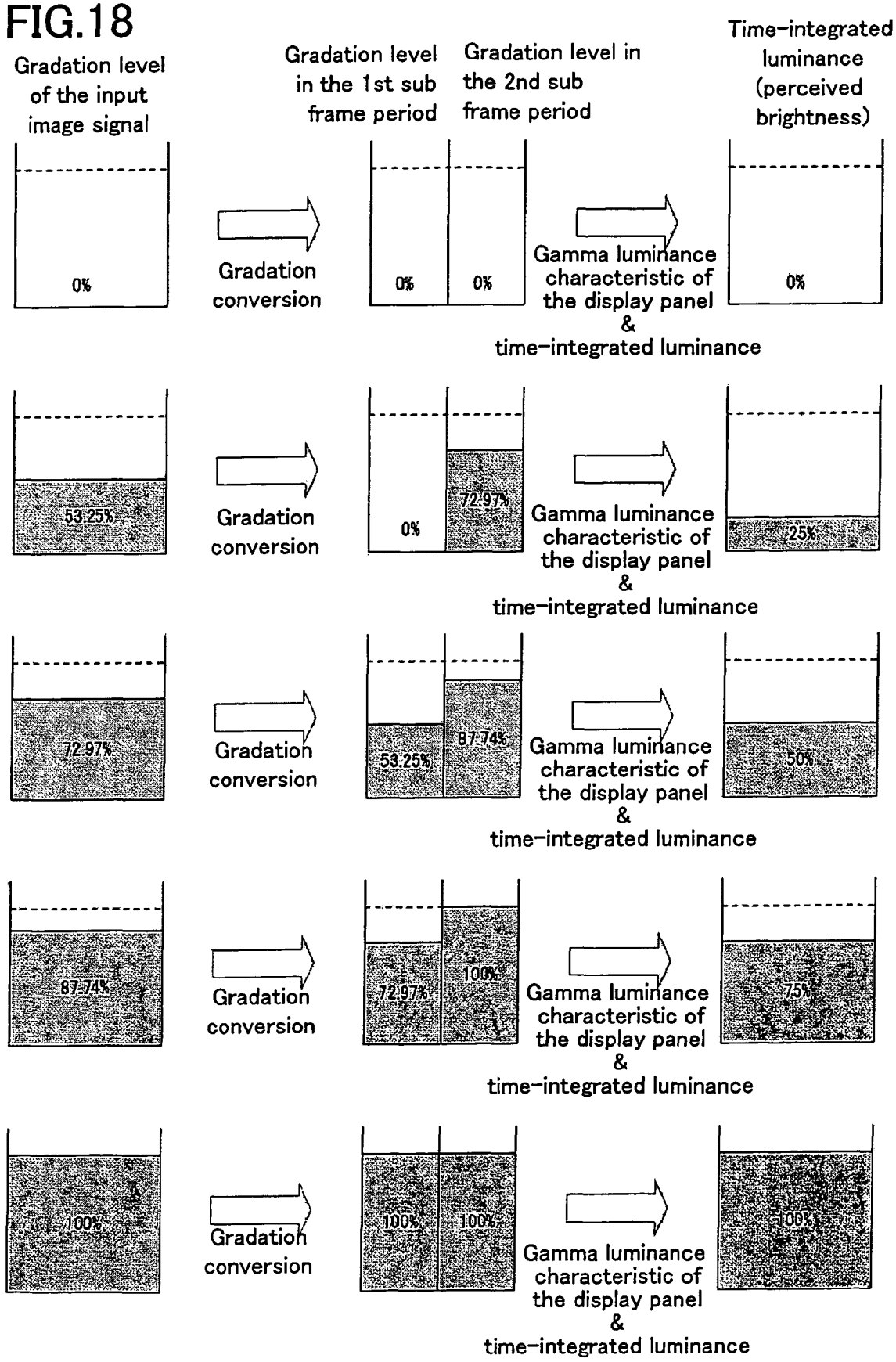
FIG. 18 shows the relationship between the gradation level of the input image signal, and the gradation levels supplied in the first sub frame period and the second sub frame period, which fulfills expression (2) in Example 2.

The relationship regarding the gradation level of the input image signal is the same as expression (2) described in Example 1. Based on these expressions, FIG. 18 shows the relationship between the gradation level of the input image signal, the gradation levels supplied in the first sub frame period and the second sub frame period, and the time-integrated luminance, i.e., the brightness perceived by the observer's eye. In Example 1, FIG. 9 illustrates the relationship between the gradation level of the input image signal, the gradation levels supplied in the first sub frame period and the second sub frame period, and the time-integrated luminance, i.e., the brightness perceived by the observer's eye. Comparing FIG. 18 and FIG. 9, the difference between the gradation level supplied in the first sub frame period and the gradation level supplied in the second sub frame period is smaller when the time-integrated luminance is 50% in Example 2 than in Example 1.

Figure 19:
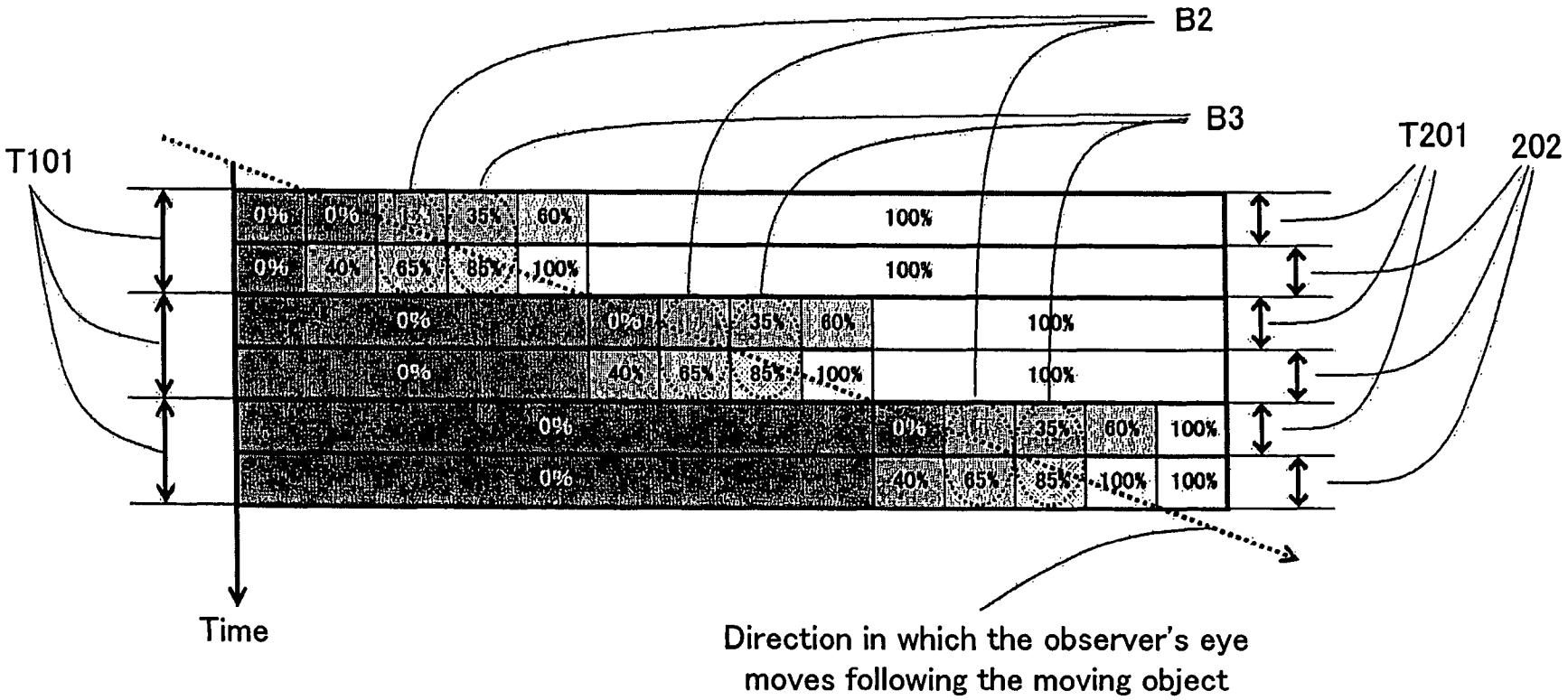
FIG. 19 shows a luminance change in accordance with time of one horizontal line in a screen when an object horizontally moves with a still background in an image display apparatus in Example 2.

FIG. 19 shows a luminance change in accordance with time of one horizontal line in a screen when an object with the luminance gradually changing as shown in FIG. 14 horizontally moves with a still background in the image display apparatus in Example 2. Paying attention to the portion B2 (assumed luminance: 40%) and the portion B3 (assumed luminance: 60%), it is appreciated that the difference between the luminance in the first sub frame period T201 and the second sub frame period T202 is 50%, unlike in FIG. 15 (Example 1).

Figure 20:
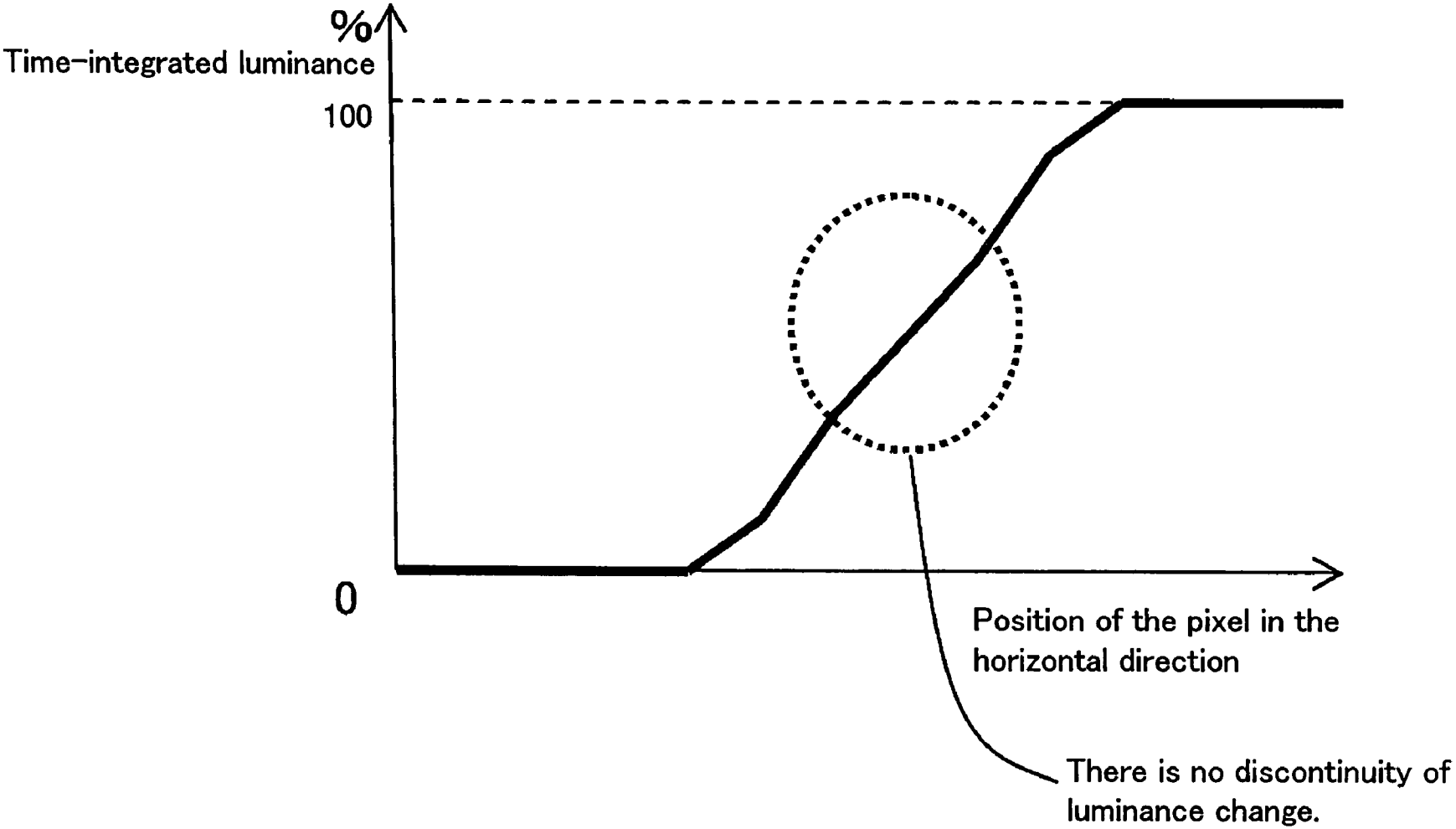
FIG. 20 shows the distribution in brightness of the image shown in FIG. 19 which is viewed by the observer's eye paying attention to the moving object.

FIG. 20 shows the distribution in brightness of the image shown in FIG. 19 which is viewed by the observer's eye paying attention to the moving object. It is appreciated that the discontinuity in the luminance change (represented by the dotted circle in FIG. 16) disappears (as represented by the dotted circle in FIG. 20).

As described above, Example 2 of the present invention provides the effect of avoiding the phenomenon that the observer views discontinuity in the luminance change even when an image of an object with the luminance gradually changing as shown in FIG. 14 horizontally moves while a still background is displayed, in addition to the effects provided by Example 1.

Example 3

In Example 3 of the present invention, one frame of image display is performed by the sum of the time-integrated values of luminance during the first and second sub frame periods. In Example 3, an image display apparatus includes a display control section for performing image display control on an image display portion in the two sub frame periods of one frame period.

One of the two sub frame periods is referred to as the sub frame period α, and the other sub frame period is referred to as the sub frame period β. Threshold levels, T1 and T2, of the gradation level in the two sub frame periods are defined. The threshold level T2 is larger than the threshold level T1. A gradation level (value) L is uniquely determined.

When the gradation level of the input image signal is equal to or less than the threshold level T1, an image signal of a gradation level which is increased or decreased in accordance with the gradation level of the input image signal is supplied to an image display section of the image display apparatus in the sub frame period α, and an image signal of the minimum gradation level is supplied to the image display section in the sub frame period β.

When the gradation level of the input image signal is greater than the threshold level T1 and equal to or less than the threshold level T2, an image signal of the gradation level L is supplied to the image display section in the sub frame period α, and an image signal of a gradation level which is increased or decreased in accordance with the gradation level of the input image signal is supplied to the image display section in the sub frame period β.

When the gradation level of the input image signal is greater than the threshold level T2, an image signal of a gradation level which is increased or decreased in accordance with the gradation level of the input image signal is supplied to the image display section in the sub frame period α, and an image signal of the maximum gradation level is supplied to the image display section in the sub frame period β.

In Example 3, whether the luminance in the sub frame period α is higher or lower than the luminance in the sub frame period β varies in accordance with the gradation level of the input image signal. Therefore, unlike in Example 1, the sub frame period which is assigned to the first sub frame period and the sub frame period which is assigned to the second sub frame period cannot be determined by the relationship between the response speed to a luminance switch from the minimum luminance level to the maximum luminance level and the response speed to a luminance switch from the maximum luminance level to the maximum luminance level. Which sub frame period is assigned to the first sub frame period and which sub frame period is assigned to the second sub frame period is preferably determined in accordance with, for example, the other characteristics of the display panel, or the characteristics of the image displayed. In this example, the sub frame period β is assigned to the first sub frame period, and the sub frame period α is assigned to the second sub frame period.

Figure 21:
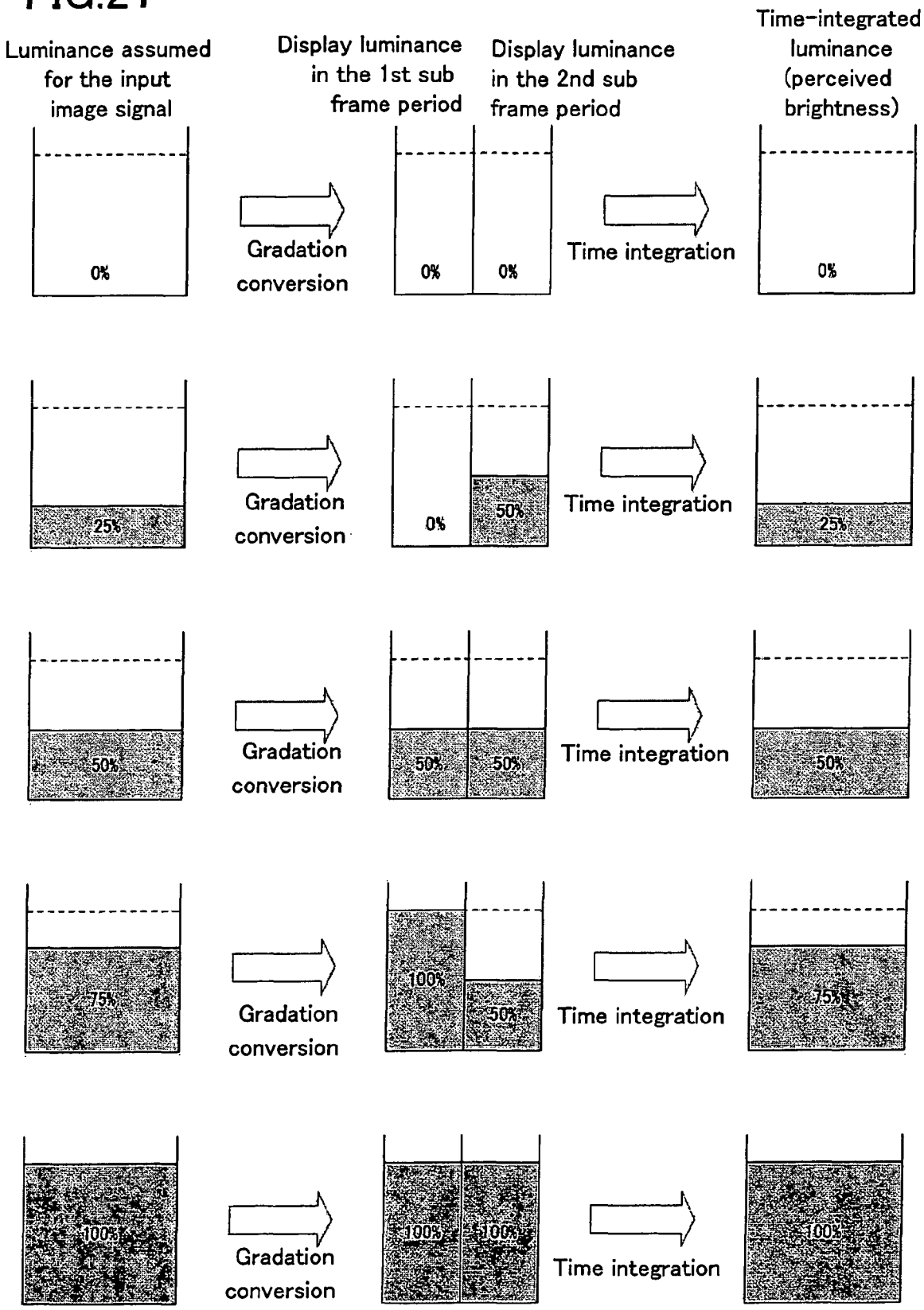
FIG. 21 illustrates the target luminance levels in Example 3 according to the present invention.

FIG. 21 illustrates the target luminance levels in Example 3.

In Example 3, as shown in FIG. 21, the threshold level T1 is defined as the gradation level when the assumed luminance is 25%, the threshold level T2 is defined as the gradation level when the assumed luminance is 75%, and the prescribed gradation value L is defined as the gradation level when the assumed luminance is 50%.

When the luminance assumed for the input image signal is equal to or less than the threshold level T1, the image display is performed at the minimum luminance level of 0% in the first sub frame period (the sub frame period β), and the image display is performed at a luminance level which is increased or decreased in accordance with the gradation level of the input image signal in the second sub frame period (the sub frame period α).

When the luminance assumed for the input image signal is greater than the threshold level T1 (25%) and equal to or less than the threshold level T2 (75%), the image display is performed at the luminance level corresponding to the gradation value L (50%) in the first sub frame period (the sub frame period β), and the image display is performed at a luminance level which is increased or decreased in accordance with the gradation level of the input image signal in the second sub frame period (the sub frame period α).

When the luminance assumed for the input image signal is greater than the threshold level T2 (75%), the image display is performed at a luminance level which is increased or decreased in accordance with the gradation level of the input image signal, and the image display is performed at the maximum luminance level of 100% in the second sub frame period (the sub frame period α).

Figure 22:
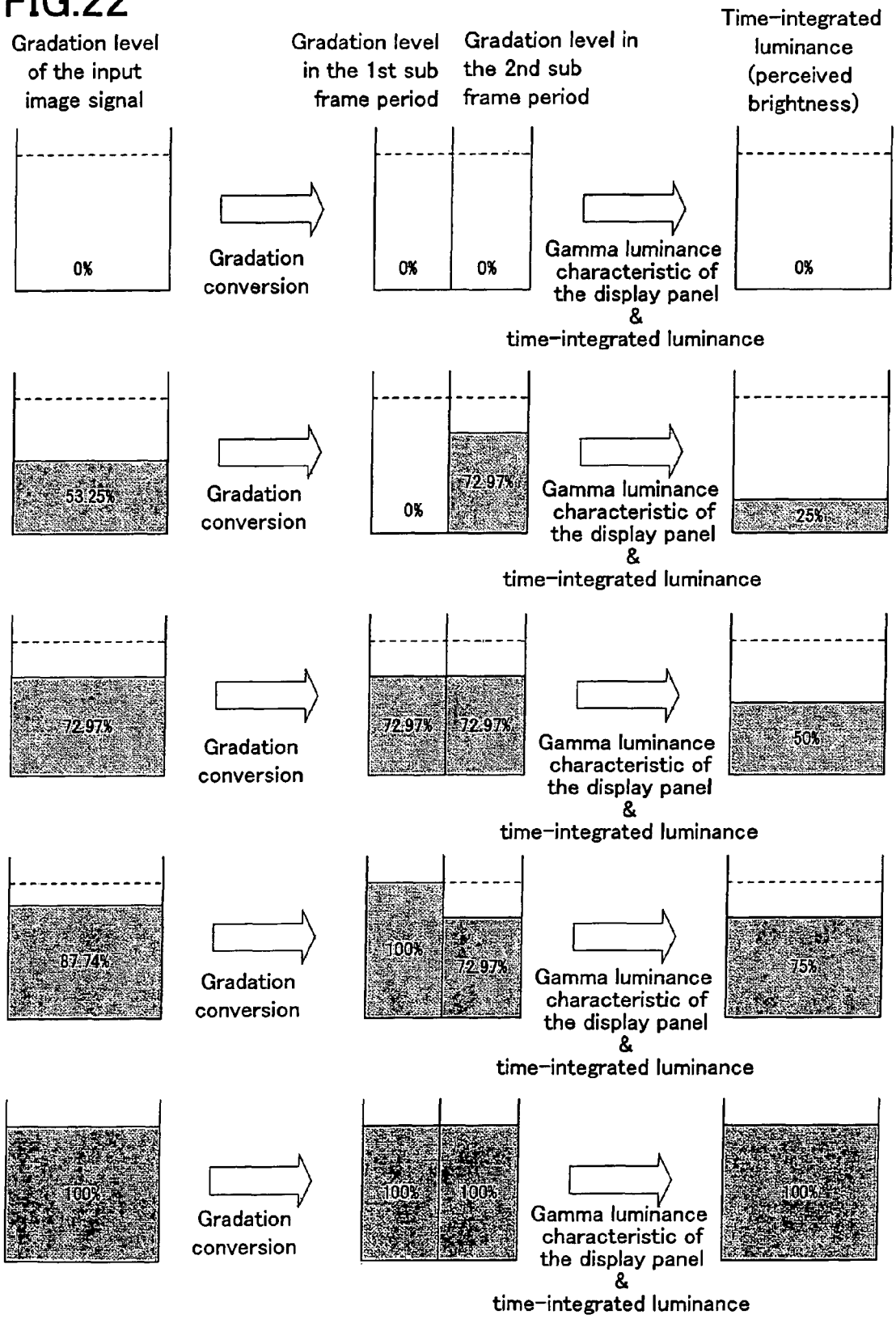
FIG. 22 shows the relationship between the gradation level of the input image signal, and the gradation levels supplied in the first sub frame period and the second sub frame period, which fulfills expression (2) in Example 3.

FIG. 22 shows the gradation levels of the image signal supplied in the first sub frame period and the second sub frame period in order to realize the target display luminance described above.

In Example 3, like in Example 1, the display panel has the gamma luminance characteristic represented by expression (1), and the input image signal is also generated in consideration of the gamma luminance characteristic represented by expression (1).

Figure 23:
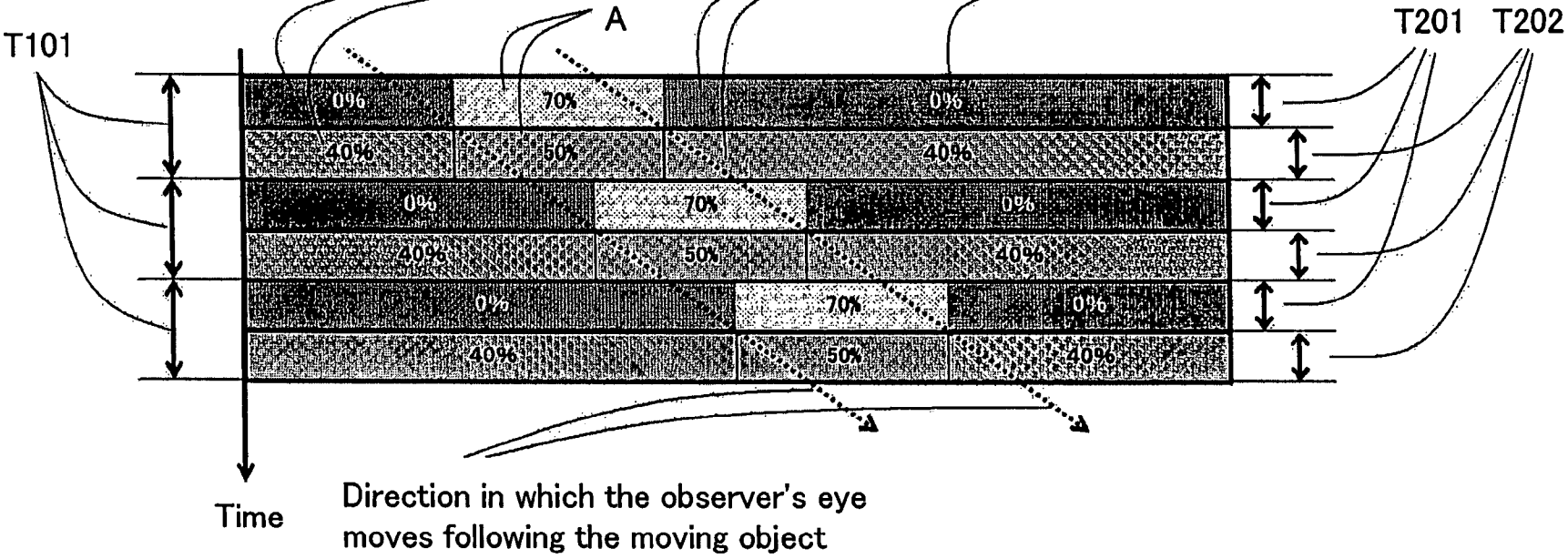
FIG. 23 shows a luminance change in accordance with time of one horizontal line in a screen when an object horizontally moves with a still background in an image display apparatus in Example 3.

FIG. 23 shows a luminance change in accordance with time of one horizontal line in a screen when an object horizontally moves with a still background in the image display apparatus in Example 3. The object horizontally moves with the still background as described in example 7 of Japanese Laid-Open Publication No. 2001-296841 (FIGS. 52 and 53). The portion B of the still background is displayed at the same luminance as that of FIG. 10 (Example 1). Regarding the potion A of the moving object, the luminance assumed for the input image signal exceeds 50%, and therefore the luminance level in the second sub frame period (T202) is higher than the luminance level in the first sub frame period (T201).

Figure 24:
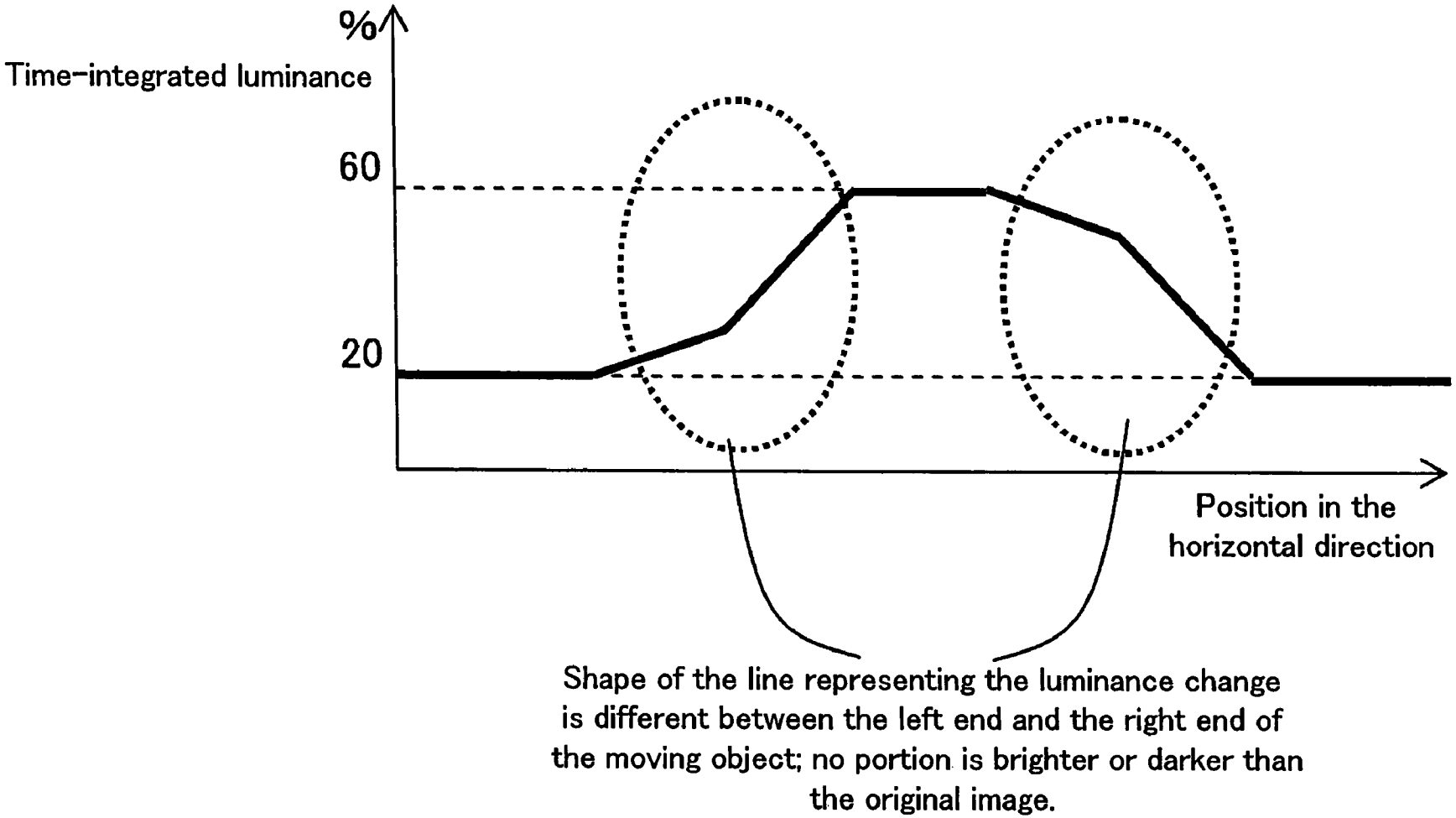
FIG. 24 shows the distribution in brightness of the image shown in FIG. 23 which is viewed by the observer's eye paying attention to the moving object.

FIG. 24 shows the distribution in brightness of the image shown in FIG. 23 which is viewed by the observer's eye paying attention to the moving object. It is appreciated that the discontinuity in the luminance change (represented by the dotted circle in FIG. 16) disappears (as represented by the dotted circle in FIG. 20). FIG. 24 exhibits the phenomenon that the shape of the line representing the luminance change is different between the left end and the right end of the moving object as represented by the dotted circles. However, like in Example 1, the drawback shown in FIG. 53 that there are portions which are brighter or darker than the original image is alleviated.

Example 4

An image display apparatus in Example 4 of the present invention uses a display panel having different response characteristics from those of the display panel in Example 1. For one of the two sub frame periods, an upper limit is provided for the supplied gradation level, so that the movement blur is alleviated. For the sake of simplicity, the display panel is represented also by reference numeral 10.

In the case of the display panel used in Example 4 of the present invention, the response speed to a luminance switch from the maximum luminance level to the minimum luminance level is low, and the response is not completed in one sub frame period. By contrast, the response speed to a luminance switch from the minimum luminance level to the maximum luminance level is high, and the response is substantially completed in one sub frame period. Accordingly, the sub frame period α is assigned to the first sub frame period, and the sub frame period β is assigned to the second sub frame period.

The target luminance levels for the first sub frame period and the second sub frame period in Example 4 will be described.

Figure 25:
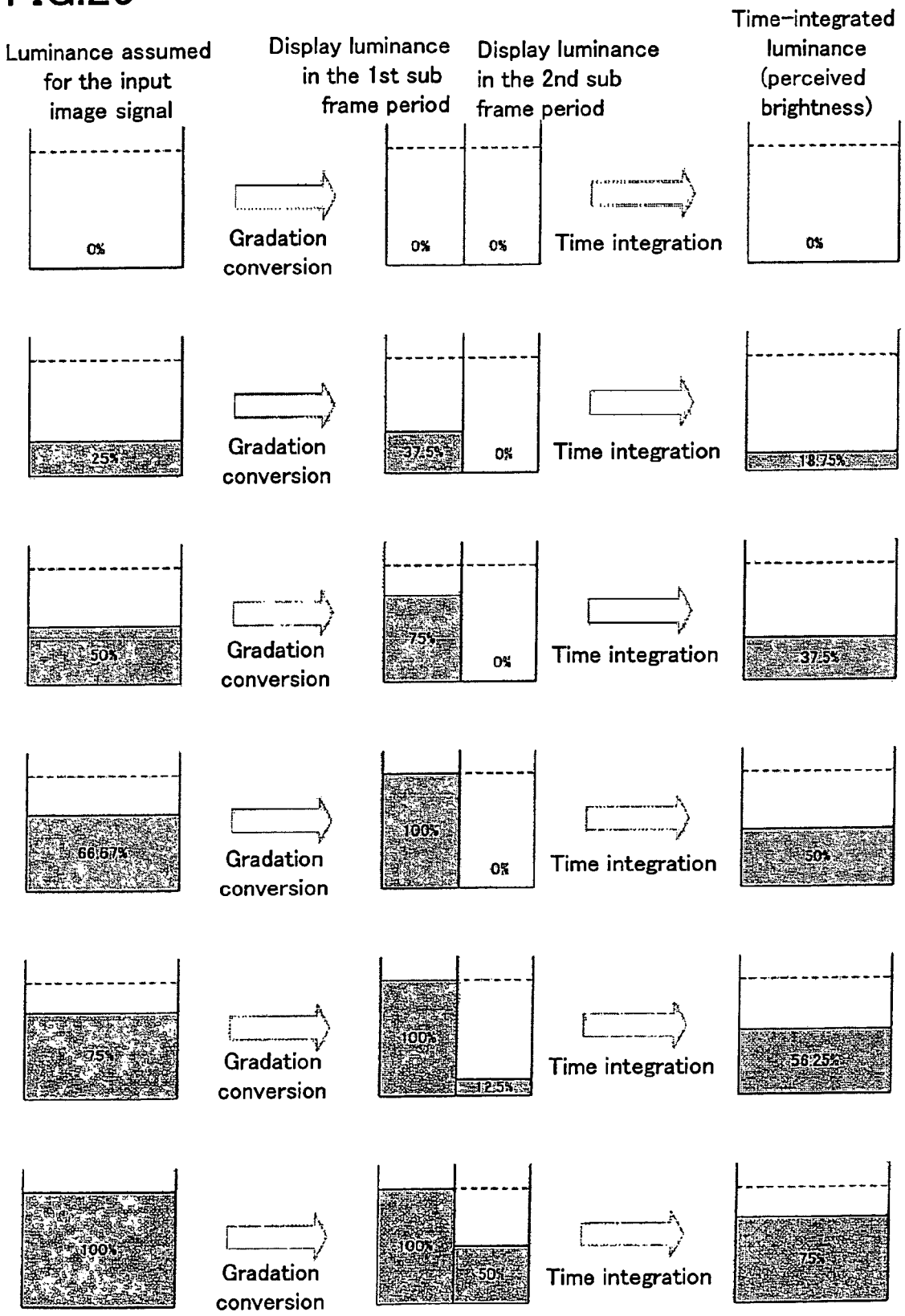
FIG. 25 illustrates the target luminance levels in Example 4 according to the present invention.

FIG. 25 illustrates the target luminance levels in Example 4.

In FIG. 25, the left part shows the luminance assumed for the input image signal. The middle part shows the display luminance in each of the first sub frame period and the second sub frame period. The right part shows the time-integrated luminance in the two sub frame periods of one frame period. This value is considered to match the brightness actually perceived by the observer's eye. Here, the maximum possible value which can be obtained by time integration of luminance of the display panel 10 is set to 100%. FIG. 25 shows the luminance levels assumed for the input image signal in consideration of the gamma luminance characteristic of 0%, 25%, 50%, 66.67%, 75% and 100%.

As shown in FIG. 25, the luminance assumed for the input image signal of ⅔ (66.67%) of the maximum luminance is set as the threshold level which is a reference for the gradation level of the image signal supplied in each sub frame period. When the luminance assumed for the input image signal is ⅔ (66.67%) of the maximum luminance or less, the luminance in the first sub frame period is expressed as follows.

Luminance in the first sub frame period=
Luminance assumed for the input image signal×
1.5 (prescribed ratio, i.e., multiplication value:
1.5).

Thus, the luminance in the first sub frame period is increased or decreased in accordance with the luminance assumed for the input image signal. For example, when the luminance assumed for the input image signal is 25%, the luminance in the first sub frame period is 25%×1.5=37.5%.

When the luminance assumed for the input image signal is greater than ⅔ (66.67%) of the maximum luminance, the luminance in the first sub frame period is maximum (100%). The maximum value of 100% is obtained by multiplying the threshold level of 66.67% (⅔) by 1.5.

When the luminance assumed for the input image signal is ⅔(66.67%) of the maximum luminance or less, the luminance in the second sub frame period is minimum (0%).

When the luminance assumed for the input image signal is greater than ⅔ (66.67%) of the maximum luminance, the luminance in the second sub frame period is expressed as follows.

Luminance in the second sub frame period=
(luminance assumed for the input image signal−⅔)×
1.5 (prescribed ratio, i.e., multiplication value:
1.5).

Thus, the luminance in the second sub frame period is increased or decreased in accordance with the luminance assumed for the input image signal. For example, when the luminance assumed for the input image signal is 75% (¾), the luminance in the second sub frame period is (¾−⅔)×1.5=12.5%.

In Example 4, in order to improve the quality of moving images, an upper limit L1 of the gradation level of the image signal supplied in the first sub frame period and an upper limit L2 of the gradation level of the image signal supplied in the second sub frame period are set to fulfill the relationship of L1≧L2. In this example, the upper limit L1 for the first sub frame period is 100%, and the upper limit L2 for the second sub frame period is 50%.

Since the upper limit L2 for the second sub frame period is set to 50%, the maximum value of the brightness perceived by the observer's eye is reduced by 25%. However, even when the luminance for the input image signal is maximum (100%), there is a difference in luminance between the first sub frame period and the second sub frame period. Therefore, the movement blur is alleviated.

In Example 4, like in Example 1, the display panel and the luminance has the gamma luminance characteristic represented by expression (1), and the input image signal is also generated in consideration of the gamma luminance characteristic represented by expression (1). The gradation level of an input image signal and the display luminance assumed for the gradation level have the relationship as represented by expression (1).

In Example 4, (a) the threshold level which is a reference for the gradation level of the image signal in each sub frame period, and (b) the gradation level of the image signal supplied in each sub frame period after being increased or decreased in accordance with the gradation level of the input image signal, are set such that the relationship between the gradation level of the input image signal and the time-integrated luminance in one frame period exhibits an appropriate gamma luminance characteristic.

In Example 4, the time-integrated luminance in the two sub frame periods is considered to match the brightness actually perceived by the observer's eye. Especially in Example 4, in order to alleviate the movement blur even when the gradation level of the input image signal is high, the luminance level in the second sub frame period is restricted to be half of or less than the maximum possible value of the display panel. In the following description, the luminance level (time-integrated luminance in one frame period) which is 75% of the maximum possible value of the display panel will be described as the maximum luminance level which can be provided by the image display apparatus in Example 4.

In this case, the gradation level of the input image signal, and the gradation level supplied in the first sub frame period and the gradation level supplied in the second sub frame period, have the following relationship.

(Gradation level of the input image signal/the maximum gradation level)$^{\gamma}$={(the gradation level supplied in the first sub frame period/the maximum gradation level)$^{\gamma}$+(the gradation level supplied in the second sub frame period/the maximum gradation level)$^{\gamma}$}/2×(1/0.75) (Γ=2,2) expression 4)

Figure 26:
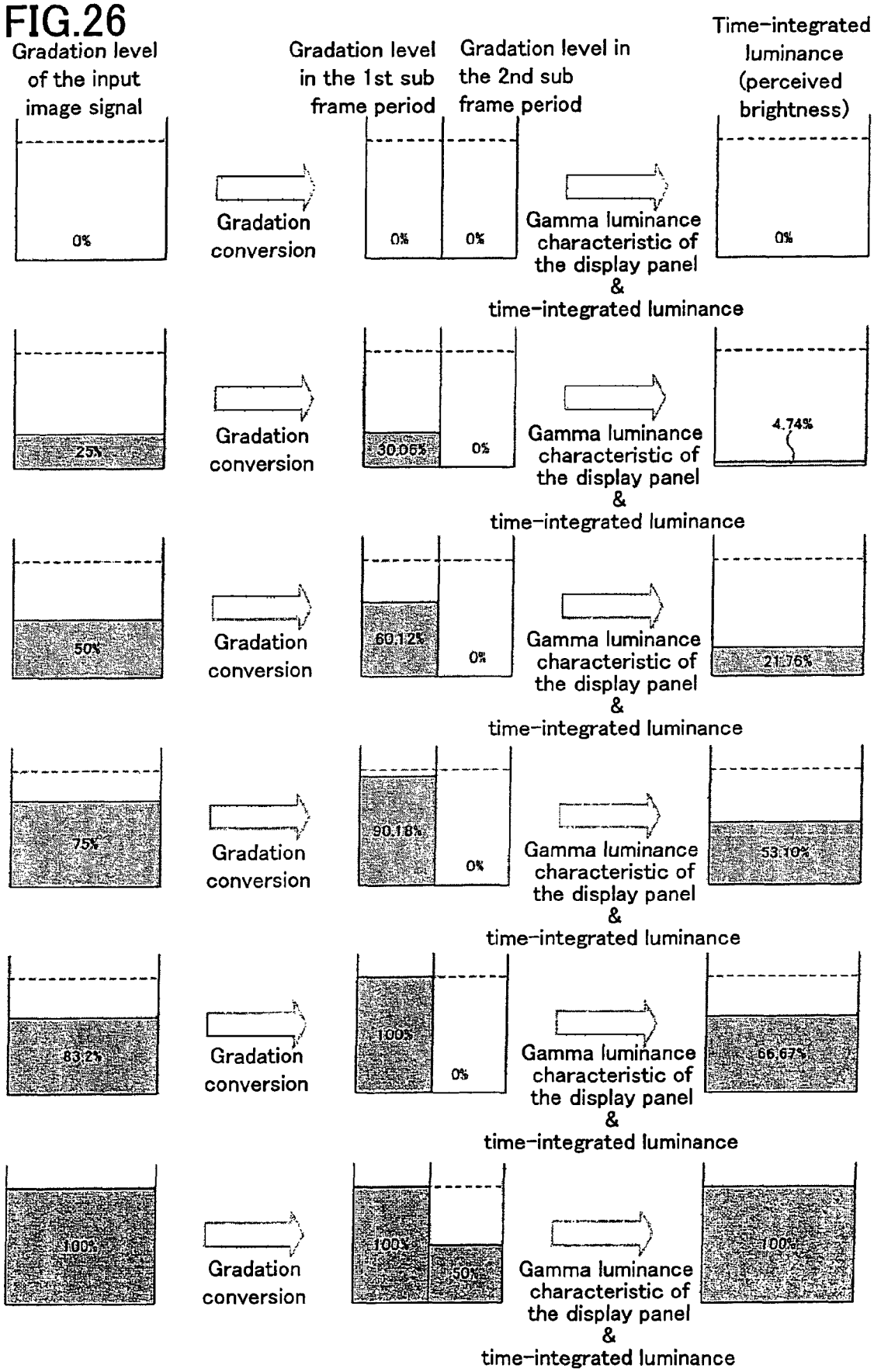
FIG. 26 shows the relationship between the gradation level of the input image signal, and the gradation levels supplied in the first sub frame period and the second sub frame period, which fulfills expression (2) in Example 4.

FIG. 26 shows the relationship between the gradation level of the input image signal, and the gradation level supplied in the first sub frame period and the gradation level supplied in the second sub frame period, which fulfills expression (4).

In FIG. 26, the left part shows the gradation level of the input image signal. The middle part shows the gradation level which is supplied in each of the first sub frame period and the second sub frame period after being converted from the gradation level of the input image signal. The right part shows the time-integrated luminance in the two sub frame periods of one frame period. FIG. 26 shows the time-integrated values of luminance of 0%, 25%, 50%, 75%, 83.2% and 100%.

As shown in FIG. 26, the luminance assumed for the input image signal of 83.2% is set as the threshold level which is reference for the gradation level of the image signal supplied in each sub frame period. When the gradation level of the input image signal is 83.2% or less, the gradation level of the image signal supplied in the first sub frame period is increased or decreased in accordance with the luminance assumed for the input image signal so as to fulfill expression (4). The gradation level of the image signal supplied in the second sub frame period is minimum (0%).

When the gradation level of the input image signal is greater than 83.2%, the gradation level of the image signal supplied in the first sub frame period is maximum (100%). The gradation level of the image signal supplied in the second sub frame period is increased or decreased in accordance with the luminance assumed for the input image signal so as to fulfill expression (4).

The gradation level of the image signal supplied in the first sub frame period is obtained as a result of the input image signal being temporarily stored in, and output from, the line buffer 41 and converted by the first gradation conversion circuit 44 in the control LSI 40A. The gradation level of the image signal supplied in the second sub frame period is obtained as a result of the input image signal being temporarily stored in, and output from, the frame memory 30 and converted by the second gradation conversion circuit 45 in the control LSI 40A.

When the converted gradation levels as shown in the middle part of FIG. 26 are supplied, the image display is performed in the first and second sub frame periods at the luminance in accordance with the gamma luminance characteristic which is possessed by the source driver of the display panel 10, and represented by expression (1) and shown in FIG. 54.

As a result, the time-integrated luminance in the first and second sub frame periods of one frame period, as shown in the right part of FIG. 26, is perceived by the observer's eye as the brightness. This time-integrated luminance reproduces the gamma luminance characteristic assumed for the input image signal as represented by expression (1) and shown in FIG. 54. It is understood that an appropriate gamma luminance characteristic is reproduced by the image display apparatus and the image display method in Example 4.

For displaying an image of an object moving in the horizontal direction with a still background using the image display apparatus and method in Example 4, when the gradation level of the input image signal is sufficiently low, the minimum gradation level is supplied in the second sub frame period for both the display portion of the still background and the display portion of the moving object. Therefore, as in the case of the image display apparatus which adopts the minimum (luminance) insertion system shown in FIGS. 52 and 53, the movement blur is alleviated and the contrast is enhanced to improve the quality of moving images.

Figure 27:
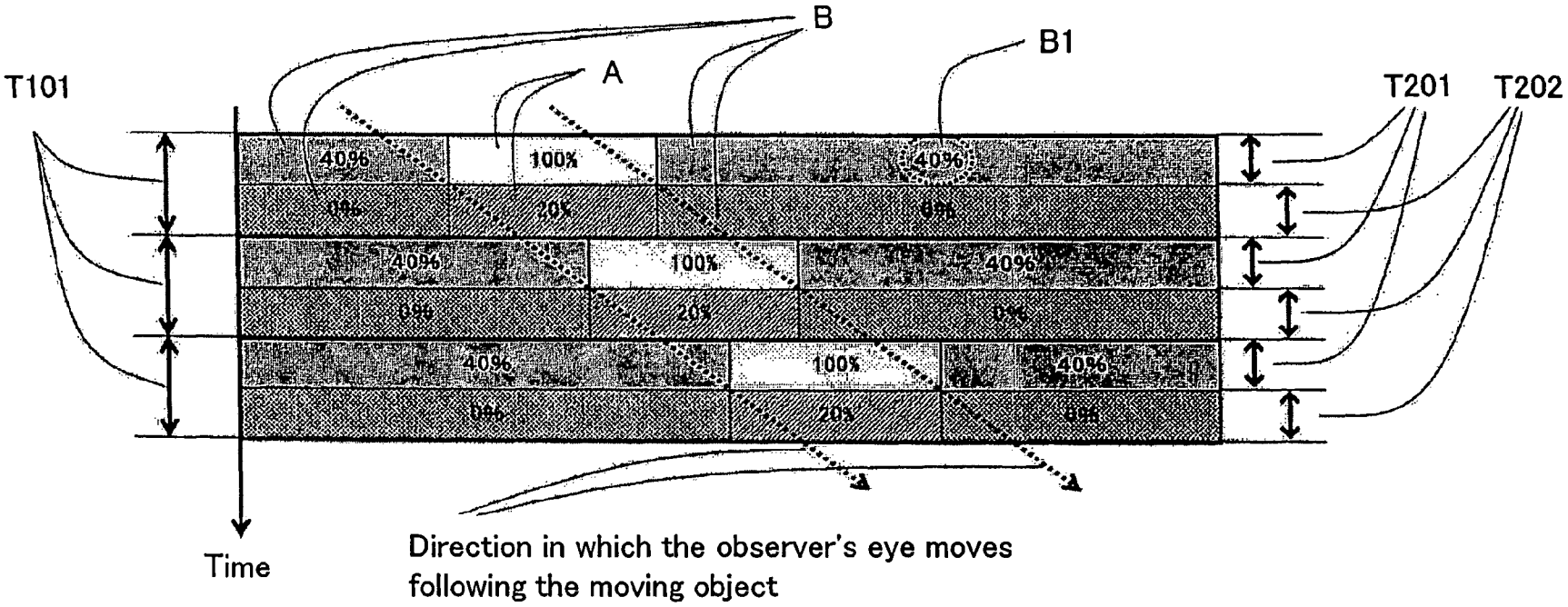
FIG. 27 shows a luminance change in accordance with time of one horizontal line in a screen when an object horizontally moves with a still background in an image display apparatus in Example 4.

FIG. 27 shows a luminance change in accordance with time of one horizontal line in a screen when an object horizontally moves with a still background in the image display apparatus in Example 4. The object horizontally moves with the still background as described in example 7 of Japanese Laid-Open Publication No. 2001-296841 (FIGS. 52 and 53).

In FIG. 27, the horizontal axis represents the luminance state in the horizontal direction of the screen (the position of the pixel portion in the horizontal direction), and the vertical axis represents the time. FIG. 27 shows images displayed on the screen in three frames.

In FIG. 27, each one-frame period T101 includes two sub frame periods T201 (first sub frame period) and T202 (second sub frame period). For the display portion B of the still background, the gradation level of the input image signal is low. Therefore, in the first sub frame period T201, the display portion B is in a light-on state at the luminance of 40% with an image signal of a gradation level which is increased or decreased in accordance with the gradation level of the input image signal. In the second sub frame period T202, the display portion B is in a light-off state at the minimum luminance of 0%. For the display portion A of the moving object, the gradation level of the input image signal is higher than a prescribed threshold. Therefore, in the first sub frame period T201, the display portion A is in a light-on state at the maximum luminance of 100%. In the second sub frame period T202, the display portion A is in a light-on state at the luminance of 20% with an image signal of a gradation level which is increased or decreased in accordance with the gradation level of the input image signal. The numerals with "%" represent the luminance level of the image with respect to the maximum display ability of 100%. For example, the numeral surrounded by the dotted line for B1 represents the luminance of 40%.

Figure 28:
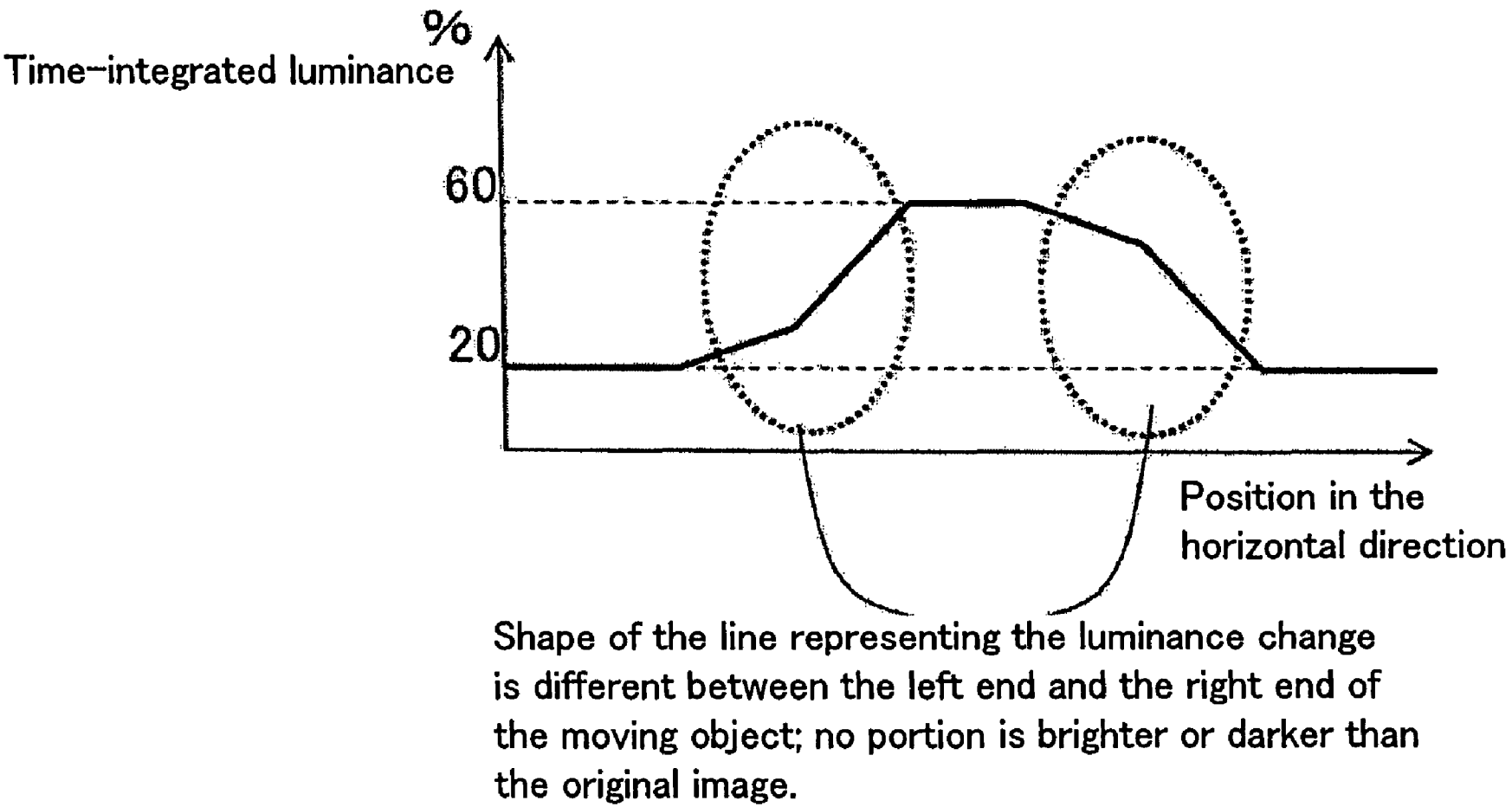
FIG. 28 shows the distribution in brightness of the image shown in FIG. 27 which is viewed by the observer's eye paying attention to the moving object.
Figure 29:
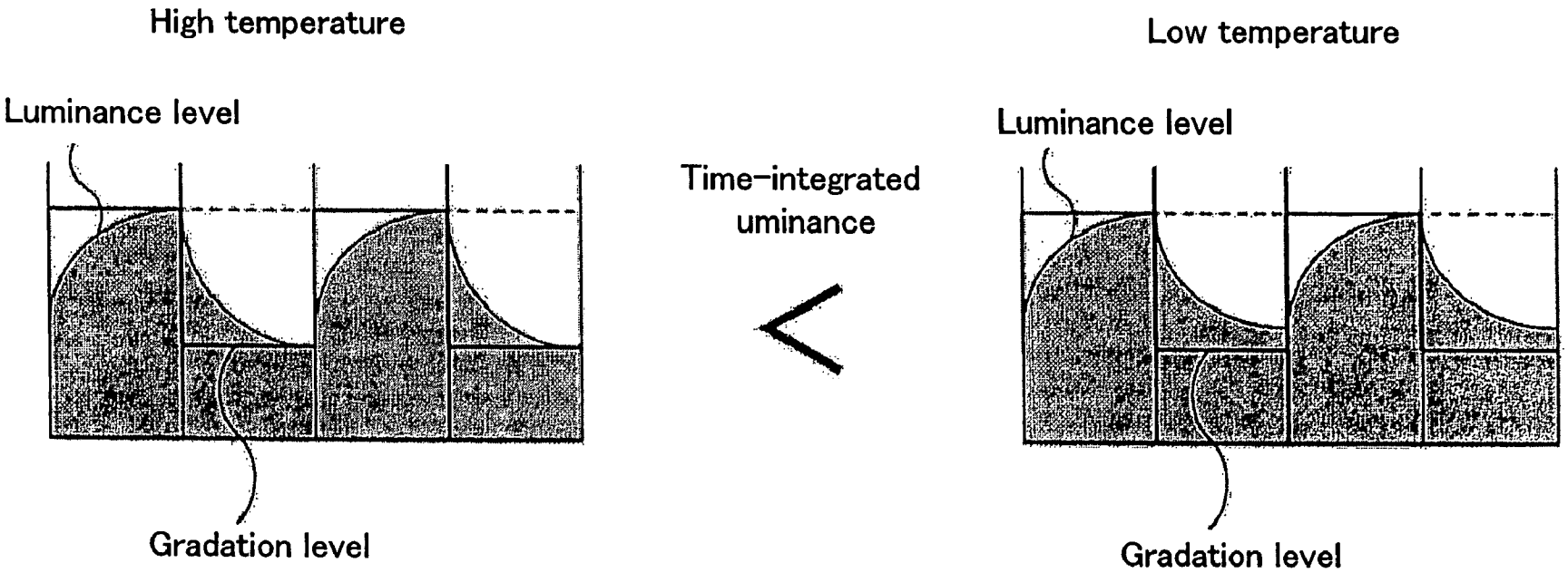
FIG. 29 shows a difference in luminance in accordance with the temperature conditions when the gradation level of the image signal supplied to a display panel used in Example 4 is not adjusted in accordance with the temperature conditions.

FIG. 28 shows the distribution in brightness of the image shown in FIG. 27 which is viewed by the observer's eye paying attention to the moving object.

FIG. 28 shows that the shape of the line representing the luminance change is different between the left end and the right end of the moving object as represented by the dotted circles. However, the drawback shown in FIG. 53 that there are portions which are brighter or darker than the original image is alleviated.

Figure 30:
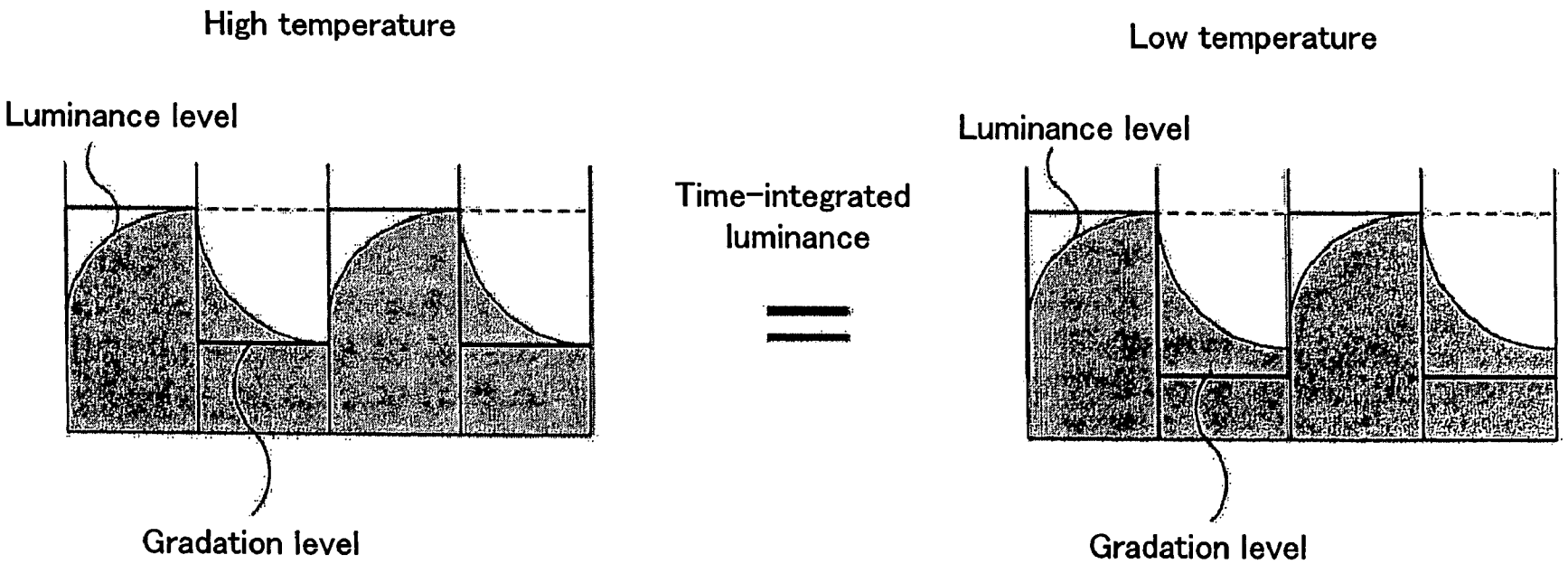
FIG. 30 shows a difference in luminance in accordance with the temperature conditions when the gradation level of the image signal supplied to the display panel used in Example 4 is adjusted in accordance with the temperature conditions.

FIG. 30 shows a difference in luminance in accordance with the temperature conditions when the gradation level of the image signal supplied to the display panel 10 used in Example 4 is adjusted in accordance with the temperature conditions. The left part shows the response speed of the liquid crystal material at a high temperature, and the left part shows the response speed of the liquid crystal material at a low temperature. The thick lines represent the gradation level. The hatched areas represent the luminance which is changed in accordance with the response speed of the liquid crystal material.

Owing to the above-described temperature correction function, at the low temperature in the right part of FIG. 30, a lower gradation level of image signal is supplied than at the high temperature in the left part of FIG. 30, especially in the second sub frame period. Thus, a luminance change caused by the delay in the response of the liquid crystal material at the low temperature is made equivalent to the luminance change at the high temperature. In this manner, the brightness perceived by the observer's eye can be maintained with respect to the same gradation level of image signal, regardless of the temperature conditions.

As described above, according to Example 4 of the present invention, when an image of an object moving with a still background is displayed, the movement blur is alleviated while reducing the maximum value of time-integrated luminance, which is the brightness perceived by the observer's eye, by only 25%, without generating portions which are abnormally brighter or abnormally darker than the original image. Thus, the quality of moving images of a hold-type image display apparatus can be improved. In addition, the image can be displayed with gradation representation having a gamma luminance characteristic suitable to the input image signal.

Example 5

In Example 5 of the present invention, an image display apparatus represents colors by supplying image signals of separate gradation levels for the three primary colors of red, green and blue.

Figure 31:
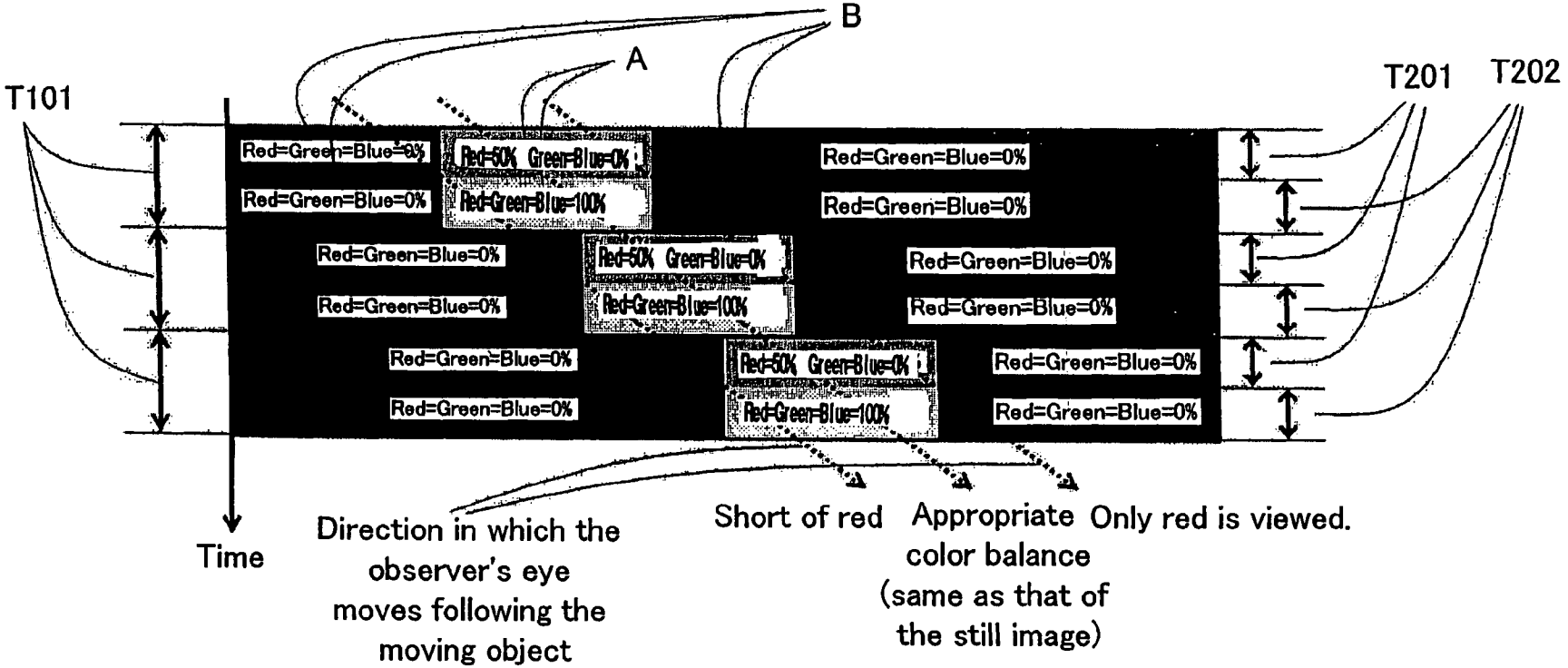
FIG. 31 shows a luminance change in accordance with time of one horizontal line in a screen when an object having a strong red component and weak green and blue components horizontally moves with a black still background in an image display apparatus in Example 5 according to the present invention.

FIG. 31 shows a luminance change in accordance with time of one horizontal line in a screen when an object horizontally moves with a still background in the image display apparatus in Example 5 having substantially the same structure as that of Example 1. The three colors of red, green and blue are displayed at separate levels of luminance. For the still background, the luminance level of all the colors is 0%. For the moving object, the luminance assumed for a red input image signal is 75%, and the luminance assumed for each of a green input image signal and a blue input image signal is 50%.

As shown in FIG. 31, the luminance assumed for the input image signal and the luminance levels in the first and second sub frame periods have the relationships described above with reference to FIG. 8, for each of red, green and blue. Therefore, the portion A of the moving object is displayed at the luminance of 50% for red in the first sub frame period and is displayed at the luminance of 100% for red, green and blue in the second sub frame period.

Paying attention to the dotted arrow representing the observer's eye following the moving object, it is appreciated that an appropriate color is viewed in the central part of the object as in a still image, but only red is viewed at the right end of the object and the left end of the object appears to be short of red. Since the luminance balance of the three colors is destroyed, abnormal colors may be viewed.

The reason is that the red input image signal has a high gradation level and is displayed in the first and second sub frame periods, whereas the green and blue input image signals have a low gradation level and are displayed only in the first sub frame period. This results in the time-wise center of gravity being different between red and the other two colors.

In order to avoid such a phenomenon, in Example 5, the gradation levels of image signals supplied in the first sub frame period and the second sub frame period are controlled regarding the two colors other than the color having the highest gradation level of input image signal.

This is specifically performed as follows. Regarding the color having the highest gradation level of input image signal among the three colors, an image signal having the maximum gradation level, or an image signal of a gradation level which is increased or decreased in accordance with the gradation level of the input image signal, is supplied in the second sub frame period. In the first sub frame period, an image signal having the minimum gradation level, or an image signal of a gradation level which is increased or decreased in accordance with the gradation level of the input image signal, is supplied, as in Example 1. Regarding each of the other two colors, the gradation levels are set such that the ratio between the luminance level displayed in the first sub frame period and the luminance level displayed in the second sub frame period is equal to the ratio, of the color having the highest gradation level of input image signal, between the luminance level displayed in the first sub frame period and the luminance level displayed in the second sub frame period. The image signal is supplied to each sub frame period at each obtained gradation level.

In Example 5, the time flow of the image signal and the method for driving the display panel 10 are substantially the same as those of Example 1, and will not be repeated. Hereinafter, a method for converting the gradation level of the colors other than the color having the highest gradation level of input image signal, using the first gradation level conversion circuit 44 and the second gradation level conversion circuit 45, will be described as a difference from the method of Example 1.

The display panel 10 used in Example 5 has the following gamma luminance characteristic as in Example 1.

$$\text{Display luminance}=(\text{gradation level of the input image signal/the maximum gradation level})^{\gamma} \quad (\gamma=2.2) \qquad \text{expression (1)}$$

(where the maximum value of the display luminance is "1" and the minimum value of the display luminance is "0").

For a pixel portion in a frame, the ratio between the gradation level of image signal, of the color having the highest gradation level of input image signal, supplied in the first sub frame period and the maximum gradation level is $X_1$. The ratio between the gradation level of image signal of that color supplied in the second sub frame period and the maximum gradation level is $X_2$.

$X_1$=gradation level in the first sub frame period/the maximum gradation level $X_2$=gradation level in the second sub frame period/the maximum gradation level The display luminance in each sub frame period is as follows due to the gamma luminance characteristic.

Display luminance in the first sub frame period=$X_1^{\gamma}$

Display luminance in the second sub frame period=$X_2^{\gamma}$

Similarly, the ratio between the gradation level of image signal, of a color other than the color having the highest gradation level of input image signal, supplied in the first sub frame period and the maximum gradation level is $Y_1$. The ratio between the gradation level of image signal of that color supplied in the second sub frame period and the maximum gradation level is $Y_2$.

$Y_1$=gradation level in the first sub frame period/the maximum gradation level $Y_2$=gradation level in the second sub frame period/the maximum gradation level The display luminance in each sub frame period is as follows due to the gamma luminance characteristic.

Display luminance in the first sub frame period=$Y_1^{\gamma}$

Display luminance in the second sub frame period=$Y_2^{\gamma}$

In Example 5, as described above, the ratio between the luminance level displayed in the first sub frame period and the luminance level displayed in the second sub frame period of a color other than the color having the highest gradation level of input image signal is equal to the ratio between the luminance level displayed in the first sub frame period and the luminance level displayed in the second sub frame period of the color having the highest gradation level of input image signal.

Therefore, the following relationship is obtained.

$$Y_1^{\gamma}:Y_2^{\gamma}=X_1^{\gamma}:X_2^{\gamma} \qquad \text{expression (5)}$$

Where the gradation level of the input image signal of a color other than the color having the maximum gradation level of input image signal is Y, the following expression needs to be fulfilled in order to provide an appropriate gamma luminance characteristic to the relationship between the gradation level of input image signal and the time-integrated luminance of one frame period, as described in Example 4.

$$Y^{\gamma}=(Y_1^{\gamma}+Y_2^{\gamma})/2 \qquad \text{expression (6)}$$

From expressions (5) and (6), $$Y_1=Y\cdot\{2X_1^{\gamma}/(X_1^{\gamma}+X_2^{\gamma})\}^{1/\gamma} \qquad \text{expression (7)}$$

$$Y_2=Y\cdot\{2X_2^{\gamma}/(X_1^{\gamma}+X_2^{\gamma})\}^{1/\gamma} \qquad \text{expression (8)}$$

Accordingly, the output gradation level of a color other than the color having the highest gradation level of input image signal is determined by performing the calculation in accordance with expressions (7) and (8) using the first gradation conversion circuit 44 and the second gradation conversion circuit 45 in the controller LSI 40A.

Figure 32:
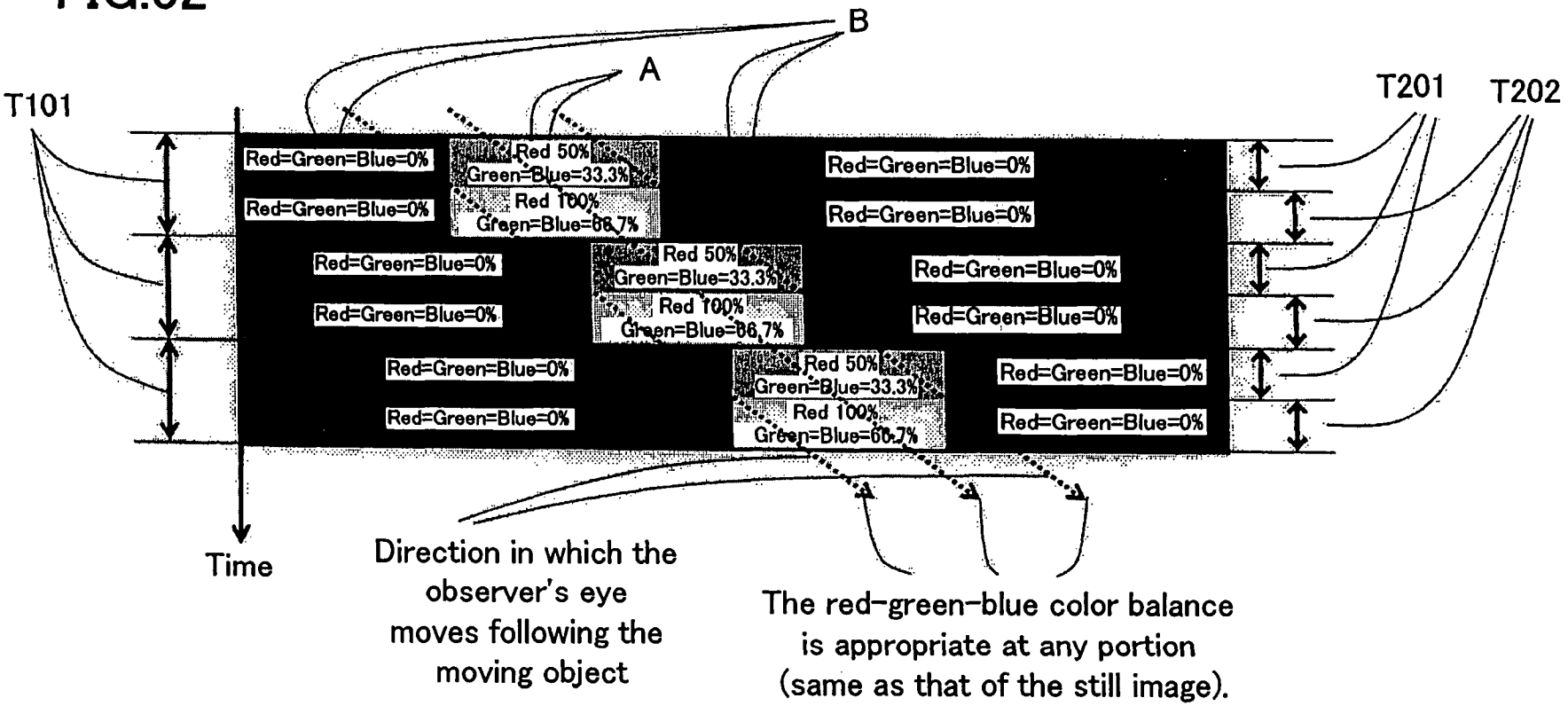
FIG. 32 shows a luminance change in accordance with time of one horizontal line in a screen when an object having a strong red component and weak green and blue components horizontally moves with a black still background in another image display apparatus in Example 5.

FIG. 32 shows a luminance change in accordance with time of one horizontal line in a screen when an object horizontally moves with a still background in the image display apparatus in Example 5. For the still background, the luminance level of all the colors is 0%. For the moving object, the luminance assumed for a red input image signal is 75%, and the luminance assumed for each of a green input image signal and a blue input image signal is 50% as in FIG. 31.

As shown in FIG. 32, unlike in FIG. 31, the luminance ratio among red, green and blue is maintained at an appropriate value in each sub frame period. Therefore, the phenomenon that abnormal colors appear by the luminance balance of the three colors being destroyed at the ends of the moving object does not occur.

Example 6

In Example 6 of the present invention, one frame of image display is performed by the sum of time-integrated values of luminance during two sub frame periods (i.e., the first sub frame period and the second sub frame period). Based on two frames of image continuously input, an image in an intermediate state in terms of time is generated through estimation. When the gradation level of the input image signal is equal to or less than a threshold level uniquely determined, an image signal of a gradation level which is increased or decreased in accordance with the gradation level of the input image signal is supplied in one of the sub frame period uniquely defined (for example, the first sub frame period). When the gradation level of the input image signal is greater than the threshold level, an image signal of the maximum gradation level is supplied also in one of the sub frame periods uniquely defined (for example, the first sub frame period). When the gradation level of the image signal in the intermediate state is equal to or less than the threshold level, an image signal of the minimum gradation level is supplied in the other sub frame period (for example, the second sub frame period). When the gradation level of the image signal in the intermediate state is greater than the threshold level, an image signal of a gradation level which is increased or decreased in accordance with the gradation level of the image signal in the intermediate state is supplied also in the other sub frame period (for example, the second sub frame period).

Figure 33:
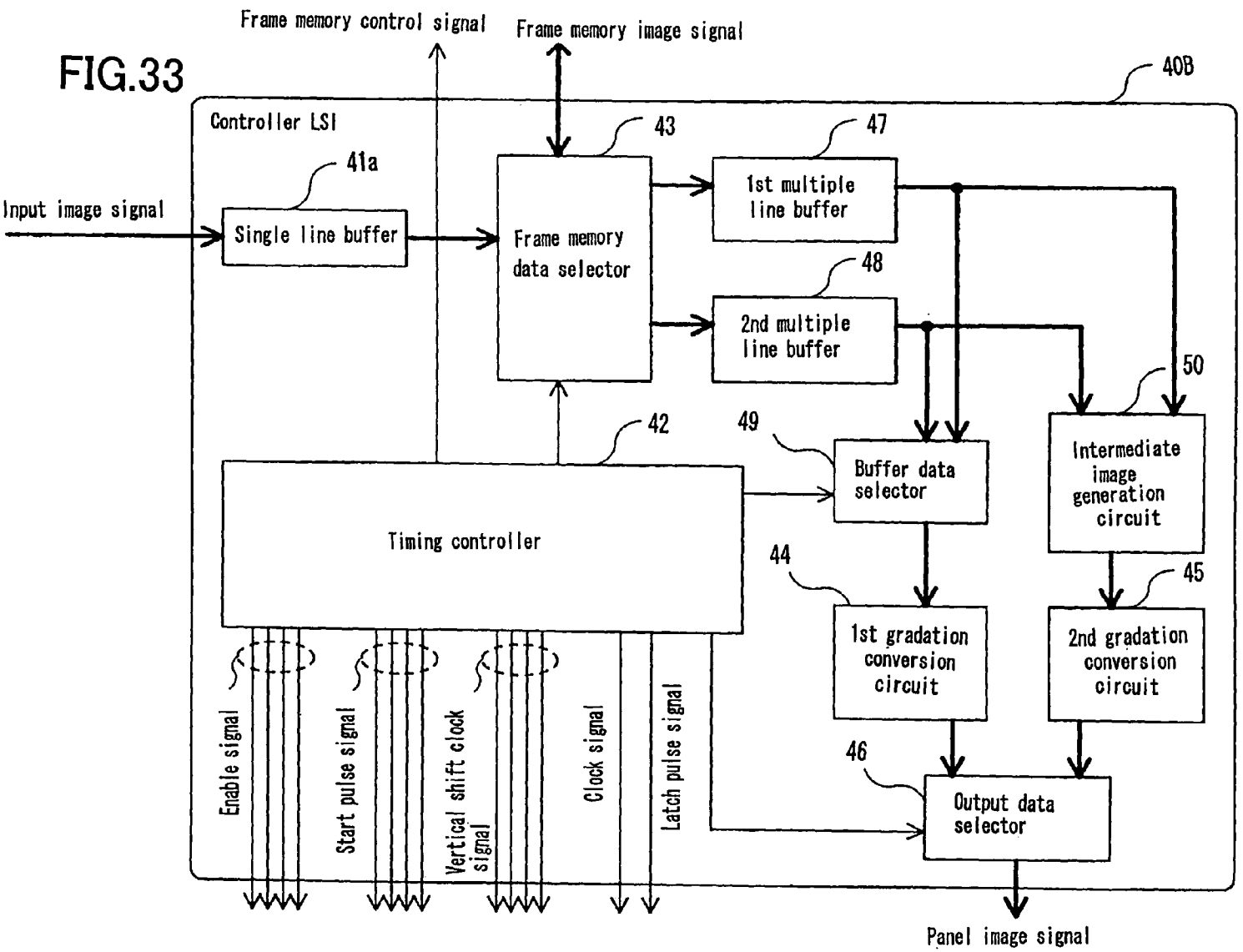
FIG. 33 is a block diagram of an exemplary structure of a controller LSI shown in FIG. 1.

FIG. 33 is a block diagram of a structure of a controller LSI 40 (as the display control section; shown in FIG. 1) in Example 6. In Example 6, the controller LSI 40 is represented by reference numeral 40B.

As shown in FIG. 33, the controller LSI 40B includes a single line buffer 41*a* (line data memory section), a timing controller 42 (timing control section), a frame memory data selector 43 (frame memory data selection section), a first gradation conversion circuit 44 (first gradation conversion section), a second gradation conversion circuit 45 (second gradation conversion section), an output data selector 46 (output data selection section), a first multiple line buffer 47 (first multiple line data memory section), a second multiple line buffer 48 (second multiple line data memory section), a buffer data selector 49 (temporary memory data selection section), and an intermediate image generation circuit 50 (intermediate image generation section).

The single line buffer 41*a* receives the input image signal horizontal line by horizontal line, and temporarily stores the input image signal. The single line buffer 41*a* includes a receiving port and a sending port independently, and therefore can receive and send signals simultaneously.

The frame memory data selector 43 is controlled by the timing controller 42 to transfer the input image signal stored in the single line buffer 41*a* to the frame memory 30, horizontal line by horizontal line. Thus, the input image signal is transferred to the frame memory 30 within one frame period. The frame memory 30 cannot simultaneously send and receive data. Therefore, the timing controller 42 switches the frame memory data selector 43 (timing control) such that data is read from the frame memory 30 while the input image signal is not transferred to the frame memory 30. More specifically, an input image signal which was read one frame period before and has been stored in the frame memory 30 is read horizontal line by horizontal line, and is transferred to the first multiple line buffer 47. In parallel to this, and in a time division manner, an input image signal which was read two frame periods before and has been stored in the frame memory 30 is read horizontal line by horizontal line, and is transferred to the second multiple line buffer 48.

The intermediate image generation circuit 50 compares the image signals stored in the first multiple line buffer 47 and the second multiple line buffer 48, so as to estimate and generate an image signal in an intermediate state in terms of time between the image signal which was input one frame period before and the image signal which was input two frame periods before.

The first multiple line buffer 47 and the second multiple line buffer 48 can store several tens of horizontal lines of image signal. The intermediate image generation circuit 50 compares the above-mentioned two image signals by the range of the number of pixel portions in the horizontal direction×several tens of horizontal lines, in order to generate an image signal in an intermediate state in terms of time. Such an image signal is generated, for example, as follows. From the image signal which was input two frame periods before, one partial area is picked up. A sum of the gradation levels of pixel portions in this partial area is obtained. A partial area having the same shape is found from the image signal which was input one frame period before, such that the difference between (a) the sum of the gradation levels of the pixel portions in the partial area of the image signal which was input two frame periods before, and (b) the sum of the gradation levels of the pixel portions in the partial area of the image signal which was input one frame period before, is minimum. The partial area found from the image signal which was input one frame period before is estimated as the transfer destination of the partial area of the image signal which was input two frame periods before. An image signal is obtained by moving the partial area of the image signal which was input two frame periods before, by half the distance of transfer. In this manner, an image signal in an intermediate state in terms of time is generated. The method will not be described in more detail since Example 6 is not provided to specify the method for generating such an image signal. With such a method for generating an image signal in an intermediate state in terms of time, it is not easy to generate an image with completely accurate interpolation. Therefore, inaccurate display may occur in some of the pixel portions due to interpolation errors.

The image signal generated by the intermediate image generation circuit 50 is sequentially transferred to the second gradation conversion circuit 45.

The image signal which was input one frame period before and is held in the first multiple line buffer 47 and the image signal which was input two frame periods before and is held in the second multiple line buffer 48 are also transferred to the buffer data selector 49.

The buffer data selector 49 is controlled by the timing controller 42 to select the image signal which was input one frame period before and is supplied from the first multiple line buffer 47 or the image signal which was input two frame periods before and is supplied from the second multiple line buffer 48, in accordance with the display timing. The selected image signal is transferred to the first gradation conversion circuit 44.

The first gradation conversion circuit 44 converts the gradation level of the input image signal supplied from the buffer data selector 49 to the maximum gradation level or a gradation level which is increased or decreased in accordance with the gradation level of the input image signal, like in Example 4.

The second gradation conversion circuit 45 converts the gradation level of the image signal supplied from the intermediate image generation circuit 50 to the minimum gradation level or a gradation level which is increased or decreased in accordance with the gradation level of the input image signal, like in Example 4.

The output data selector 46 is controlled by the timing controller 42 to select the image signal which is output from the first gradation conversion circuit 44 and to output the image signal as the panel image signal in the first sub frame period, or to select the image signal which is output from the second gradation conversion circuit 45 and to output the image signal as the panel image signal in the second sub frame period.

An operation of an image display apparatus in Example 6 including the controller LSI 40B having the above-described structure will be described.

Figure 34:
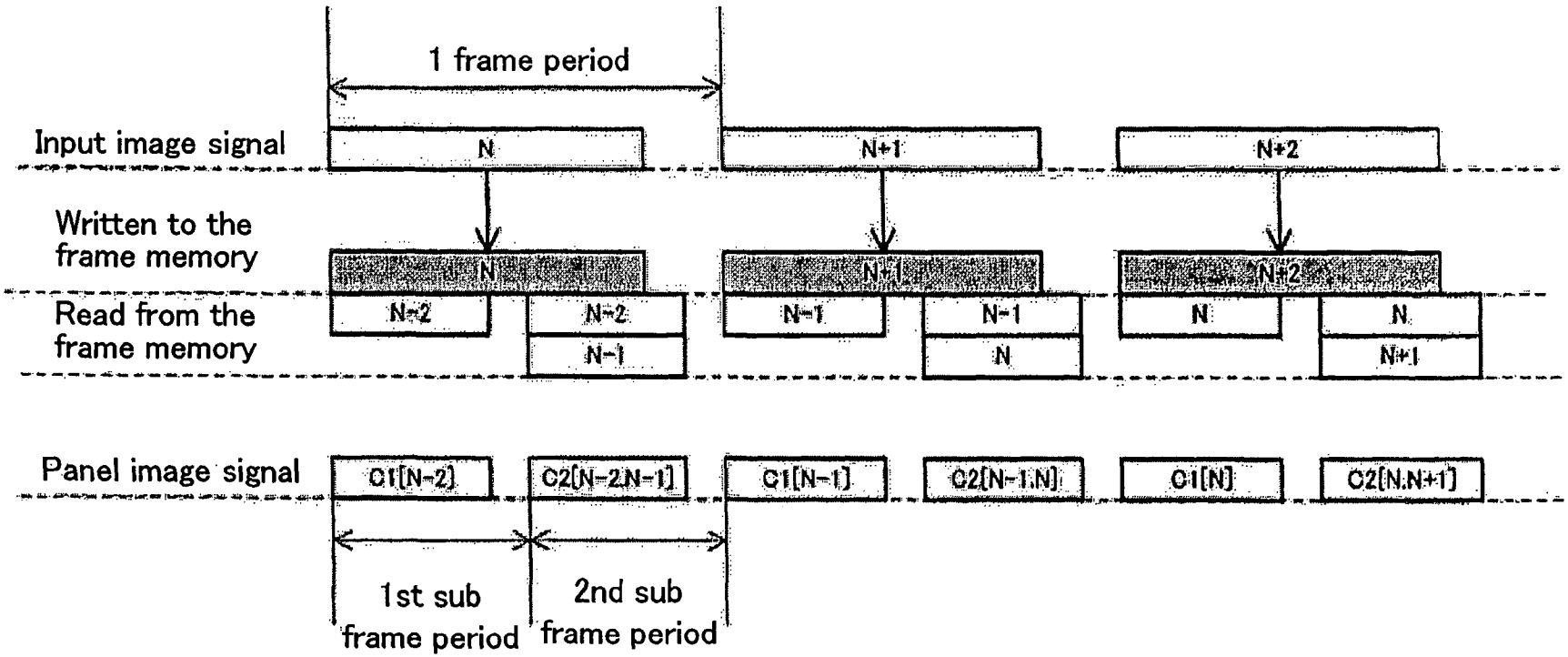
FIG. 34 is a timing diagram of signals in an image display apparatus in Example 6 according to the present invention.

FIG. 34 is a timing diagram of signals in the image display apparatus in Example 6 by horizontal periods.

In FIG. 34, each rectangular block represents a transfer period of one frame of image signal. The letters in the rectangular blocks, for example, "N" and "N+1" each represent which frame of image signal is being transferred. Ci[f] in the rectangular blocks of the panel image signal represents a signal obtained by converting the input image signal for the f'th frame by the i'th gradation conversion circuit (the first gradation conversion circuit 44 or the second gradation conversion circuit 45). The brackets with a comma ([,]) represents an image signal in an intermediate state between the two frames in terms of time. For example, C2[N−1, N] represents that a signal obtained by converting an image signal in an intermediate state between the (N−1)'th frame and the N'th state by the second gradation conversion circuit 45 is being transferred.

Regarding the frame memory 30, the hatched areas represent a period in which signals are written, and the white areas represent a period in which signals are read. Since the frame memory 30 cannot simultaneously read and write data, data read and data write are performed in a time division manner.

As shown in FIG. 34, in Example 6, a period in which one frame period of image signal is input includes two sub frame periods (first and second sub frame periods). In the first sub frame period, an image signal obtained by converting the image signal which was input two frame periods before using the first gradation conversion circuit 44 is output. In the second sub frame period, an image signal obtained by converting, by the second gradation conversion circuit 45, the image signal in an intermediate state in terms of time between the image signal which was input one frame period before and the image signal which was input two frame periods before is output.

In Example 6, the display panel 10 is driven by a different method from that of Example 1 shown in FIGS. 3 and 4. Example 6 adopts a general method of sequentially transferring the image signal, horizontal line by horizontal line, from the uppermost line on the screen.

Figure 35:
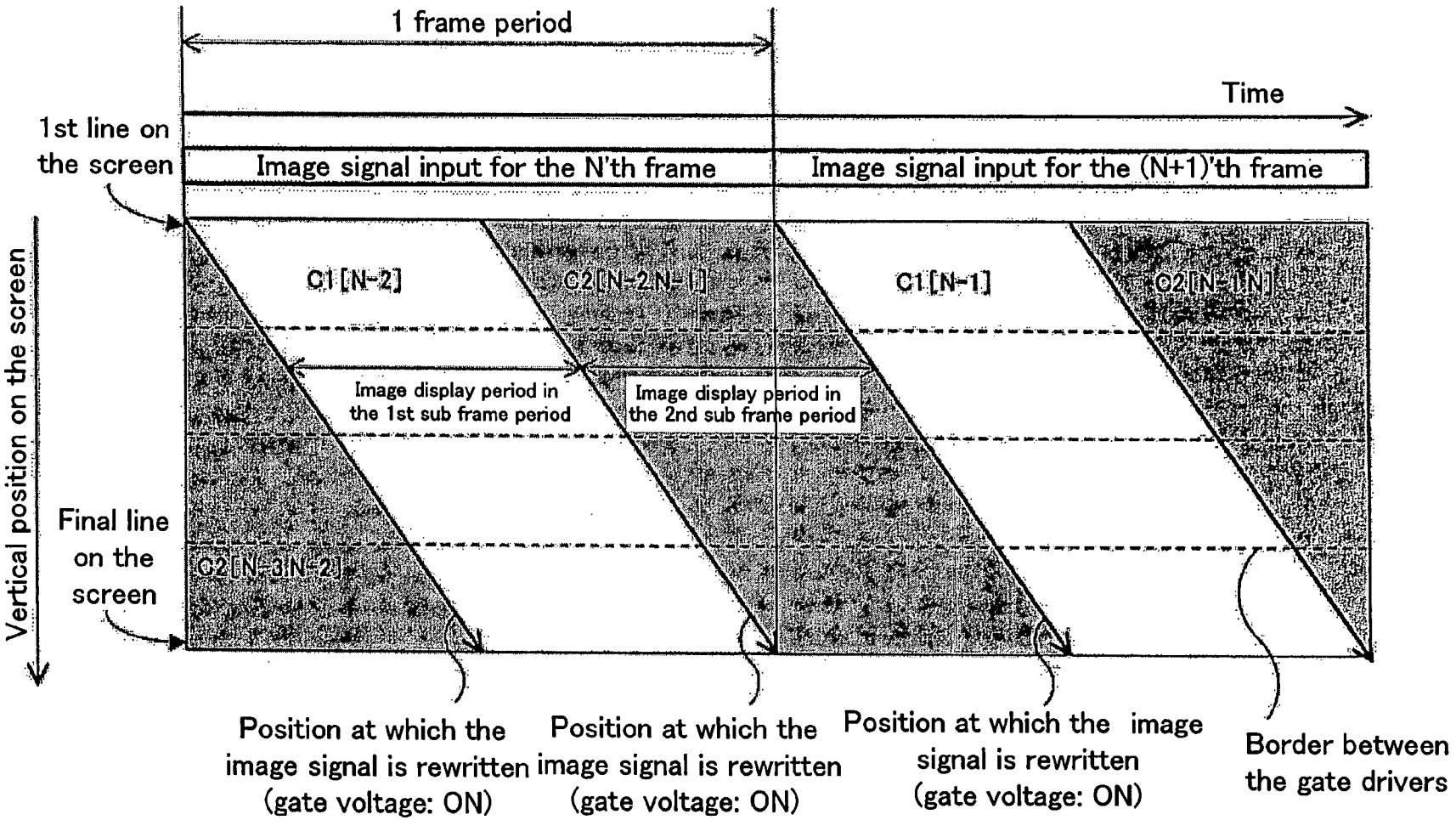
FIG. 35 shows how an image signal on the screen is rewritten in the image display apparatus in Example 6.

FIG. 35 shows how the image signal on the screen is rewritten in the image display apparatus 6 in Example 6. Specifically, FIG. 35 shows how the image signal is rewritten in the period in which the image signal for the N'th frame and the (N+1)'th frame is input.

In FIG. 35, the oblique arrows represent the vertical position and the timing at which one horizontal line of image signal is rewritten. Ci[f] represents that the image signal for the f'th frame is displayed by an image signal converted using the i'th gradation conversion circuit (the first gradation conversion circuit 44 or the second gradation conversion circuit 45). The brackets with a comma ([,]) represents an image signal in an intermediate state between the two frames in terms of time. The image display information is retained until the image signal for the same line is rewritten. In FIG. 35, the white areas represent the positions where the image display information converted by the first gradation conversion circuit 44 is retained, and the hatched areas represent the positions where the image display information converted by the second gradation conversion circuit 45 is retained. The dotted lines represent the borders between the first through fourth gate drivers 14*a* through 14*d* which are driven.

Paying attention to a vertical position of one horizontal line on the screen, the following is appreciated: during a half of one frame, image display is performed by an image signal obtained by converting the image signal which was input two frame periods before using the first gradation conversion circuit 44; and during the next half of the frame, image display is performed by an image signal obtained by converting, by the second gradation conversion circuit 45, the image signal in an intermediate state in terms of time between the image signal which was input one frame period before and the image signal which was input two frame periods before. The first half of the frame is referred to as the first sub frame period, and the second half of the frame is referred to as the second sub frame period.

Figure 36:
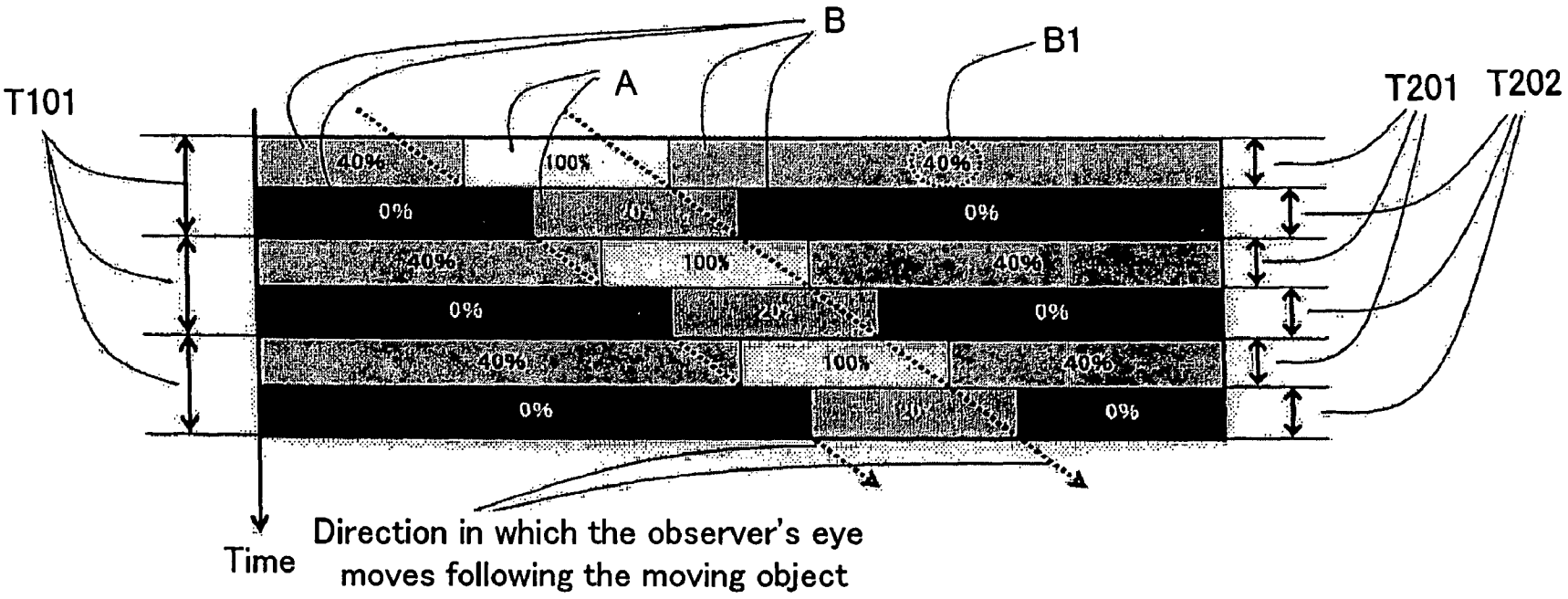
FIG. 36 shows a luminance change in accordance with time of one horizontal line in a screen when an object horizontally moves with a still background in the image display apparatus in Example 6.

FIG. 36 shows a luminance change in accordance with time of one horizontal line in a screen when an object horizontally moves with a still background in the image display apparatus in Example 6. The display luminance levels of the moving object and the still background are the same as those in FIG. 27 (Example 4).

In FIG. 36, the horizontal axis represents the luminance state in the horizontal direction of the screen (the position of the pixel portion in the horizontal direction), and the vertical axis represents the time. FIG. 36 shows images displayed on the screen in three frames.

In FIG. 36, each one-frame period T101 includes two sub frame periods T201 (first sub frame period) and T202 (second sub frame period). For the display portion B of the still background, the gradation level of the input image signal is low. Therefore, in the first sub frame period T201, the display portion B is in a light-on state at the luminance of 40% with an image signal of a gradation level which is increased or decreased at a prescribed ratio in accordance with the gradation of the input image signal. In the second sub frame period T202, the display portion B is in a light-off state at the minimum luminance of 0%. For the display portion A of the moving object, the gradation level of the input image signal is sufficiently high. Therefore, in the first sub frame period T201, the display portion A is in a light-on state at the luminance of 100%. In the second sub frame period T202, the display portion A is in a light-on state at the luminance of 20% with an image signal of a gradation level which is increased or decreased at a prescribed ratio in accordance with the gradation level of an image signal in an intermediate state in terms of time (generated by estimation). The numerals with "%" represent the luminance level of the image with respect to the maximum display ability of 100%. For example, the numeral surrounded by the dotted line for B1 represents the luminance of 40%.

The image displayed in the second sub frame period is generated based on an image in an intermediate state in terms of time between image signals which were previously input. Therefore, the moving object is displayed at a position which is on the line followed by the observer's eye which is paying attention to the moving object.

Figure 37:
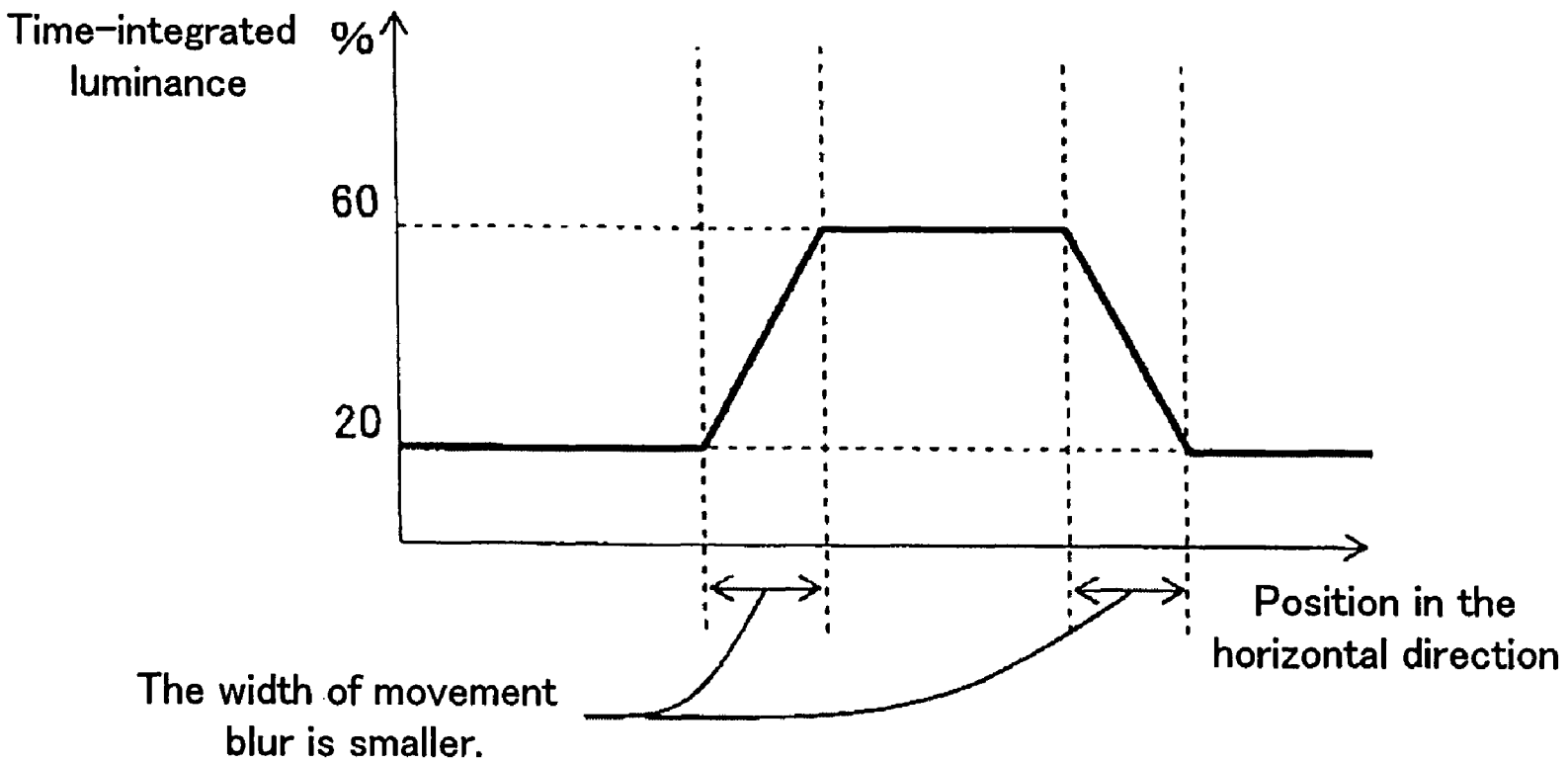
FIG. 37 shows the distribution in brightness of the image shown in FIG. 36 which is viewed by the observer's eye paying attention to the moving object.

FIG. 37 shows the distribution in brightness of the image shown in FIG. 36 which is viewed by the observer's eye paying attention to the moving object.

Figure 49:
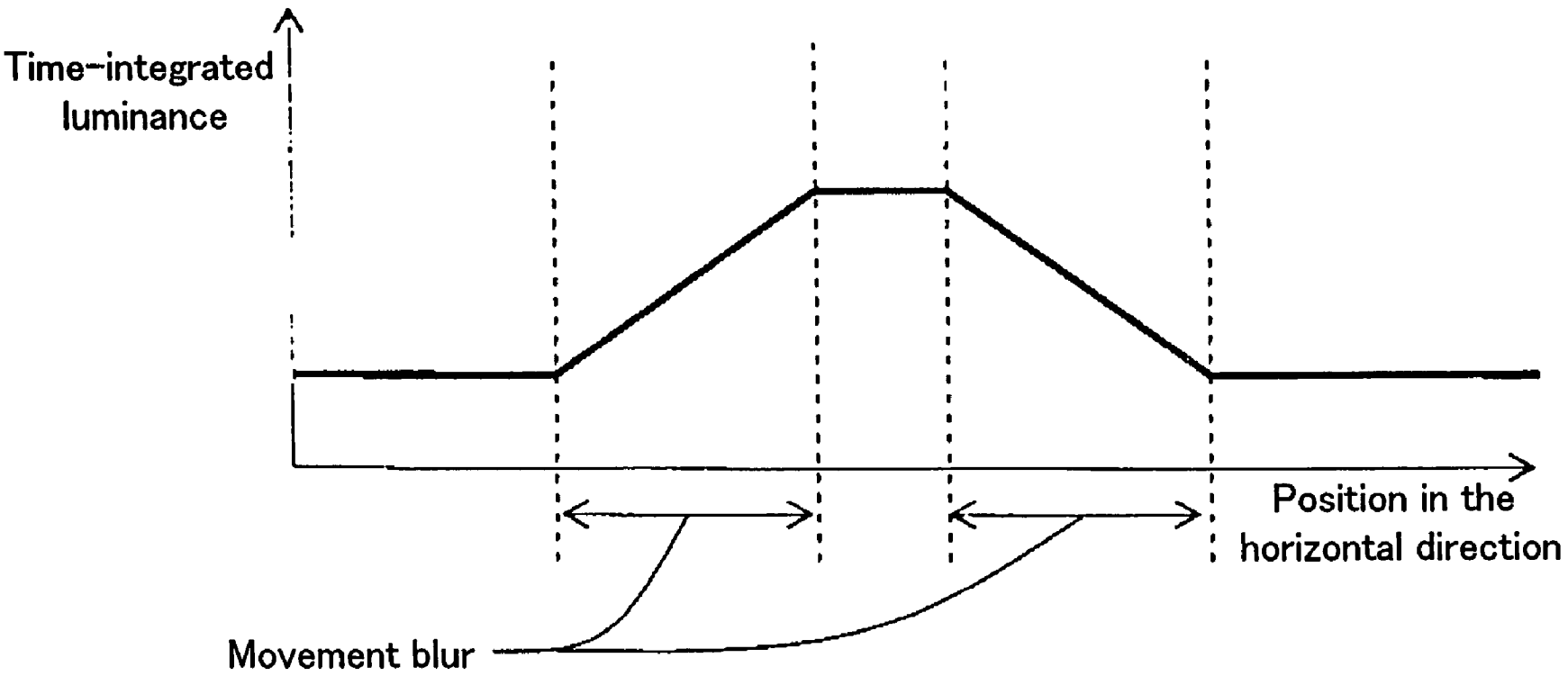
FIG. 49 shows the distribution in brightness of the image shown in FIG. 48 which is viewed by the observer's eye paying attention to the moving object.

The display portion A of the moving object is on the line followed by the observer's eye in the image displayed in the second sub frame period. Therefore, it is easy for the observer to recognize the border between the still background and the moving object. As a result, the width of the movement blur is smaller than in the case of the general conventional hold-type image display apparatus shown in FIG. 49. The width of the movement blur is even smaller than in the case of the image display apparatus in Example 4 shown in FIG. 28. The phenomenon shown in FIG. 53 that there are portions which are brighter or darker than the original image does not occur.

In the case where an image signal in as intermediate state is estimated and generated based on two frames of image signals, inaccurate display may occur at some of the pixel portion due to interpolation errors. Such inaccurate display can be made inconspicuous by assigning the image signal in the intermediate state in terms of time to the second sub frame period, in which the conversion is performed to a relatively low gradation level, and assigning an image signal externally input to the first sub frame period, in which the conversion is performed to a relatively high gradation level.

In Example 6, as in Example 4, the upper limit L1 of the gradation level of the image signal supplied in one of the sub frame periods and the upper limit L2 of the gradation level of the image signal supplied in the other sub frame period are set to fulfill the relationship of $L1 \geqq L2$. By such setting, even when the luminance assumed for the input image signal is maximum, a luminance difference equal to or greater than a prescribed value can be provided between the first sub frame period and the second sub frame period. Therefore, the movement blur can be alleviated.

In Example 6, (a) the threshold level which is a reference for the gradation level of the image signal in each sub frame period, and (b) the gradation level of the image signal supplied in each sub frame period after being increased or decreased in accordance with the gradation level of the input image signal, can be set such that the relationship between the gradation level of the input image signal and the time-integrated value of luminance in one frame period exhibits an appropriate gamma luminance characteristic. By such setting, images can be displayed with gradation representation having a gamma luminance characteristic suitable to the input image signal.

In Example 6, (a) the threshold level which is a reference for the gradation level of the image signal in each sub frame period, and (b) the gradation level of the image signal supplied in each sub frame period after being increased or decreased (for example, by multiplication with a prescribed value) in accordance with the gradation level of the input image signal, can be set in accordance with the temperature level signal from the temperature sensor IC 20 for detecting the temperature of the display panel 10 or the temperature in the vicinity thereof. By such setting, even when the display panel 10 uses a liquid crystal material, the relationship between the gradation level of the input image signal and the brightness perceived by the observer's eye can be maintained regardless of the temperature conditions.

In Example 6, in the case where an input image signal has a plurality of color components, the gradation levels of the image signals supplied in each sub frame period can be set as follows. Regarding each of the two colors (for example, green and blue) other than the color having the highest gradation level of input image signal (for example, red), the gradation levels are set such that the ratio between the luminance level displayed in the first sub frame period and the luminance level displayed in the second sub frame period is equal to the ratio, of the color having the highest gradation level of input image signal, between the luminance level displayed in the first sub frame period and the luminance level displayed in the second sub frame period. With such setting, the luminance ratio among the colors is maintained at an appropriate value, and deterioration in image quality due to inaccurate color balance can be prevented.

Example 7

In Example 7 of the present invention, one frame of image display is performed by the sum of time-integrated values of luminance during two sub frame periods (i.e., the first sub frame period and the second sub frame period).

When the gradation level of the input image signal is equal to or less than a threshold level uniquely determined, an image signal of a gradation level which is increased or decreased in accordance with the gradation level of the input image signal is supplied in one of the sub frame periods uniquely defined (for example, the first sub frame period).

When the gradation level of the input image signal is greater than the threshold level, an image signal of the maximum gradation level is supplied also in one of the sub frame periods uniquely defined (for example, the first sub frame period).

When an average value of the gradation level of the image signal in the current frame period and the gradation level of an image signal input one frame before or one frame after is equal to or less than the threshold level, an image signal of the minimum gradation level is supplied in the other sub frame period (for example, the second sub frame period).

When such an average value is greater than the threshold level, an image signal of a gradation level which is increased or decreased in accordance with the average value is supplied also in the other sub frame period (for example, the second sub frame period).

Figure 38:
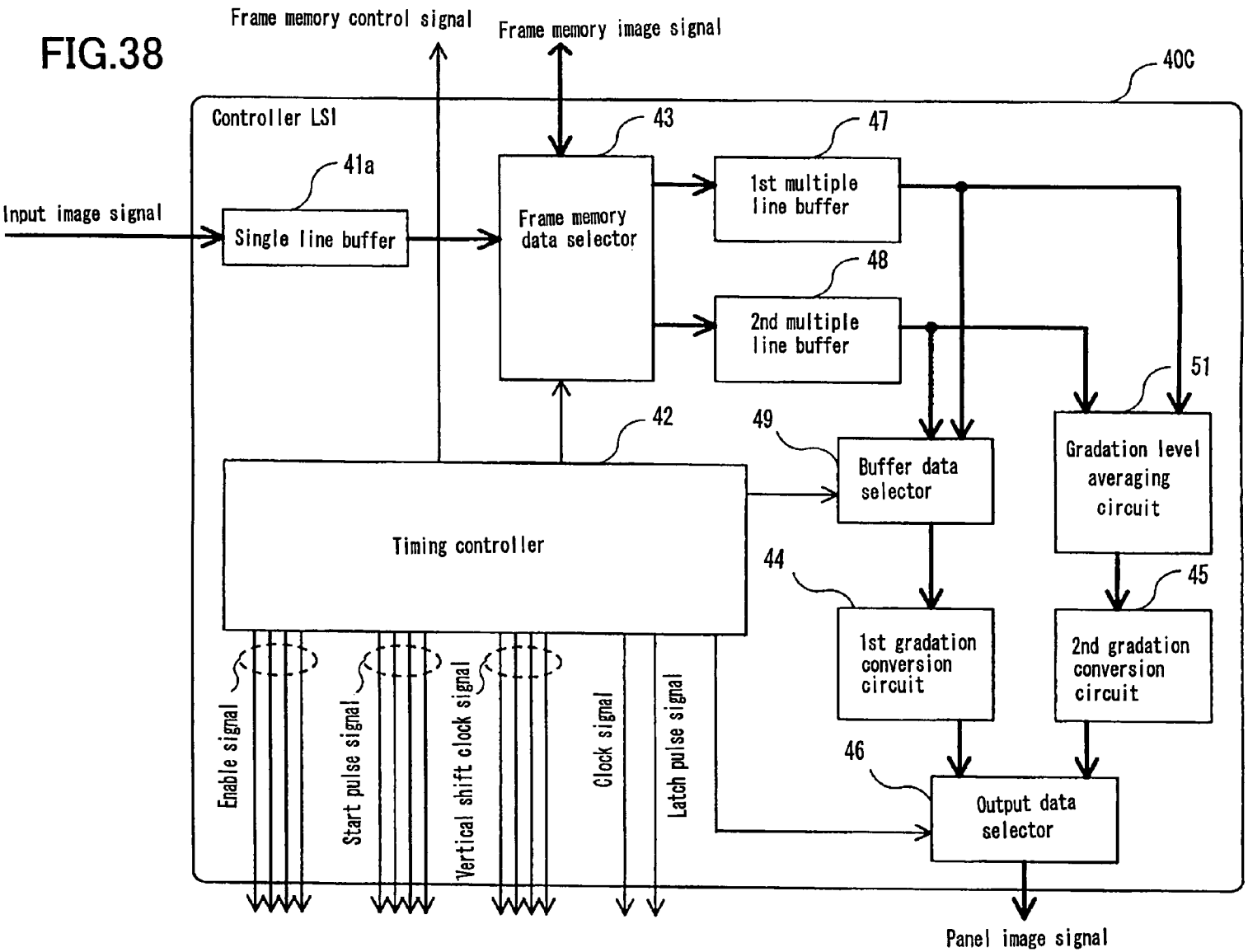
FIG. 38 is a block diagram of an exemplary structure in Example 7 according to the present invention of a controller LSI shown in FIG. 1.

FIG. 38 is a block diagram of a structure of a controller LSI 40 (as the display control section; shown in FIG. 1) in Example 7. In Example 7, the controller LSI 40 is represented by reference numeral 40C.

As shown in FIG. 38, the controller LSI 40C includes a gradation level averaging circuit 51 (gradation level averaging section) instead of the intermediate image generation circuit 50 in FIG. 33 (Example 6). The gradation level averaging circuit 51 adds the gradation levels of the two image signals respectively stored in the first multiple line buffer 47 and the second multiple line buffer 48, and divides the sum by 2, so as to calculate an average value of the gradation levels of the two image signals. The obtained average value is supplied to the second gradation conversion circuit 45.

The controller LSI 40C operates in substantially the same manner as the controller LSI 40B in Example 6.

The frame-by-frame flow of the signals in Example 7 is as shown in FIG. 34, like in Example 6. It should be noted, though, that in Example 7, the brackets with a comma ([,]) represents an image signal obtained by an average value of the two frames of image signals.

In this manner, in the first sub frame period, an image signal obtained by converting an image signal input already input by the first gradation conversion circuit 44 is output; and in the second sub frame period, an image signal obtained by converting, by the second gradation conversion circuit 45, an average value of two frames of image signals which were input successively, is output.

Figure 39:
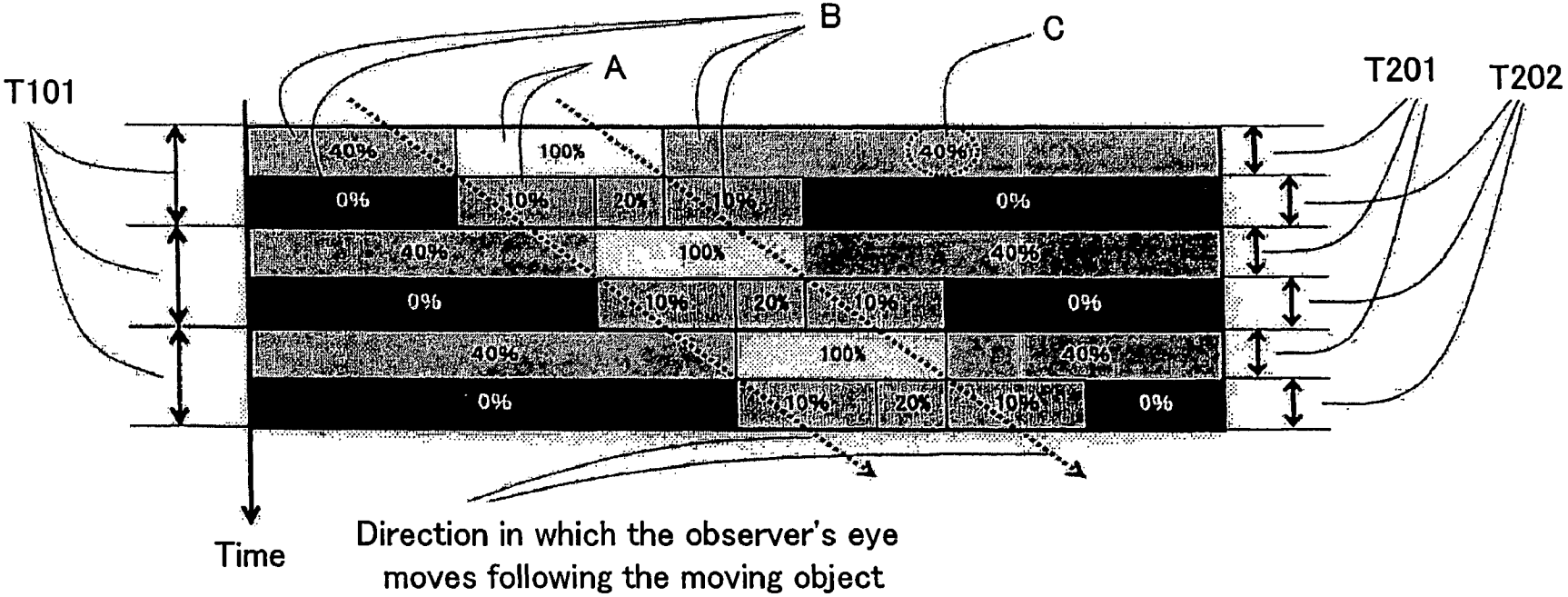
FIG. 39 shows a luminance change in accordance with time of one horizontal line in a screen when an object horizontally moves with a still background in an image display apparatus in Example 7.

FIG. 39 shows a luminance change in accordance with time of one horizontal line in a screen when an object horizontally moves with a still background in an image display apparatus in Example 7. The display luminance levels of the moving object and the still background are the same as those in FIG. 27 (Example 4).

In FIG. 39, the horizontal axis represents the luminance state in the horizontal direction of the screen (the position of the pixel portion in the horizontal direction), and the vertical axis represents the time. FIG. 39 shows images displayed on the screen in three frames.

In FIG. 39, each one-frame period T101 includes two sub frame periods T201 (first sub frame period) and T202 (second sub frame period). For the display portion B of the still background, the gradation level of the input image signal is low. Therefore, in the first sub frame period T201, the display portion B is in a light-on state at the luminance of 40% with an image signal of a gradation level which is increased or decreased in accordance with the gradation of the input image signal. In the second sub frame period T202, the display portion B is in a light-off state at the minimum luminance of 0%. For the display portion A of the moving object, the gradation level of the input image signal and the average value of the gradation values of the two frames of image signals successively input are sufficiently high. Therefore, in the first sub frame period T201, the display portion A is in a light-on state at the luminance of 100%. In the second sub frame period T202, the display portion A is in a light-on state at the luminance of 10%, 20% and then 10% with an image signal of a gradation level which is increased or decreased in accordance with the average value of the gradation levels of the two frames of image signal which are successively input. The period in which the luminance is 10% is the period in which the gradation level as an average value of the gradation level of the moving object and the gradation level of the still background is converted by the second gradation conversion circuit 45. The numerals with "%" represent the luminance level of the image with respect to the maximum display ability of 100%. For example, the numeral surrounded by the dotted line for C represents the luminance of 40%.

According to such setting, when the gradation level of the input image signal is sufficiently low, an image signal of the minimum gradation level is supplied in the second sub frame period both for the display portion A of the moving object and the display portion B of the still background. Therefore, the quality of moving images can be improved (as in the image display apparatus which adopts the minimum (luminance) insertion system shown in FIGS. 50 and 51).

Figure 40:
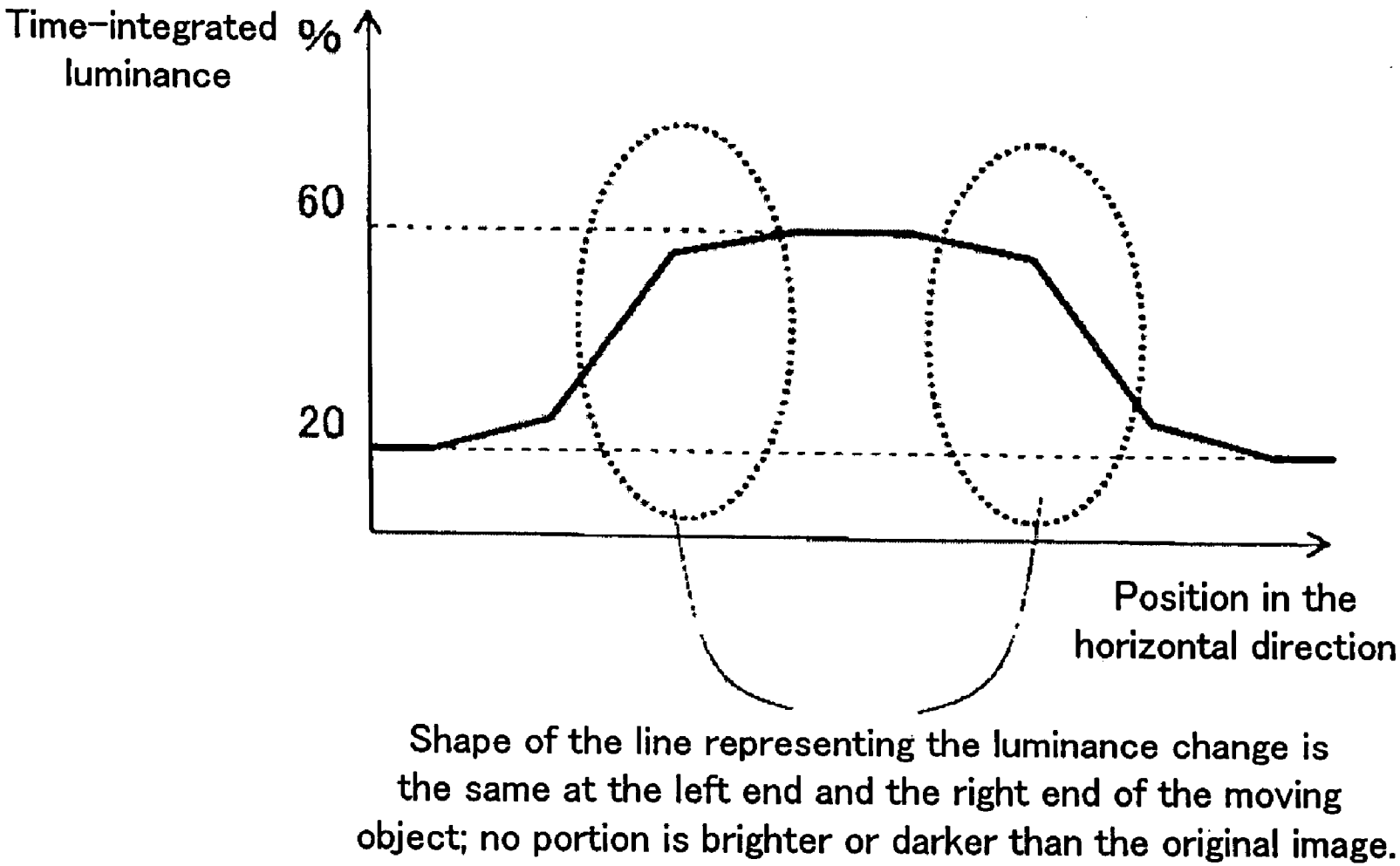
FIG. 40 shows the distribution in brightness of the image shown in FIG. 39 which is viewed by the observer's eye paying attention to the moving object.

FIG. 40 shows the distribution in brightness of the image shown in FIG. 39 which is viewed by the observer's eye paying attention to the moving object.

The phenomenon shown in FIG. 28 (Example 4) that the shape of the line representing the luminance change is different between the left end and the right end of the moving object as represented by the dotted circles disappears. The drawback shown in FIG. 53 that there are portions which are brighter or darker than the original image is solved.

In Example 7, the upper limit L1 of the gradation level of the image signal supplied in one of the sub frame periods and the upper limit L2 of the gradation level of the image signal supplied in the other sub frame period are set to fulfill the relationship of L1≧L2. By such setting, even when the luminance assumed for the input image signal is maximum, a luminance difference equal to or greater than a prescribed value can be provided between the first sub frame period and the second sub frame period. Therefore, the movement blur can be alleviated.

In Example 7, (a) the threshold level which is a reference for the gradation level of the image signal in each sub frame period, and (b) the gradation level of the image signal supplied in each sub frame period after being increased or decreased in accordance with the gradation level of the input image signal, can be set such that the relationship between the gradation level of the input image signal and the time-integrated value of the display luminance in one frame period exhibits an appropriate gamma luminance characteristic. By such setting, images can be displayed with gradation representation having a gamma luminance characteristic suitable to the input image signal.

In Example 7, (a) the threshold level which is a reference for the gradation level of the image signal in each sub frame period, and (b) the gradation level of the image signal supplied in each sub frame period after being increased or decreased (for example, by multiplication with a prescribed value) in accordance with the gradation level of the input image signal, can be set in accordance with the temperature level signal from the temperature sensor IC 20 for detecting the temperature of the display panel 10 or the temperature in the vicinity thereof. By such setting, even when the display panel 10 uses a liquid crystal material, the relationship between the gradation level of the input image signal and the brightness perceived by the observer's eye can be maintained regardless of the temperature conditions.

In Example 7, in the case where an input image signal has a plurality of color components, the gradation levels of the image signals supplied in each sub frame period can be set as follows. Regarding each of the two colors (for example, green and blue) other than the color having the highest gradation level of input image signal (for example, red), the gradation levels are set such that the ratio between the luminance level displayed in the first sub frame period and the luminance level displayed in the second sub frame period is equal to the ratio, of the color having the highest gradation level of input image signal, between the luminance level displayed in the first sub frame period and the luminance level displayed in the second sub frame period. With such setting, the luminance ratio among the colors is maintained at an appropriate value, and deterioration in image quality due to inaccurate color balance can be prevented.

Example 8

In Example 8 of the present invention, one frame of image display is performed by the sum of time-integrated values of luminance during three sub frame periods. In a sub frame period which is at the center of one frame period in terms of time (center sub frame period), an image signal of the maximum gradation level or an image signal of a gradation level which is increased or decreased in accordance with the gradation level of the input image signal is supplied. In each of a sub frame period before the center sub frame period and a sub frame period after the center sub frame period, an image signal of the minimum gradation level or an image signal of a gradation level which is increased or decreased in accordance with the gradation level of the input image signal is supplied. The center of one frame period in terms of time will also be referred to as the "time-wise center".

Figure 41:
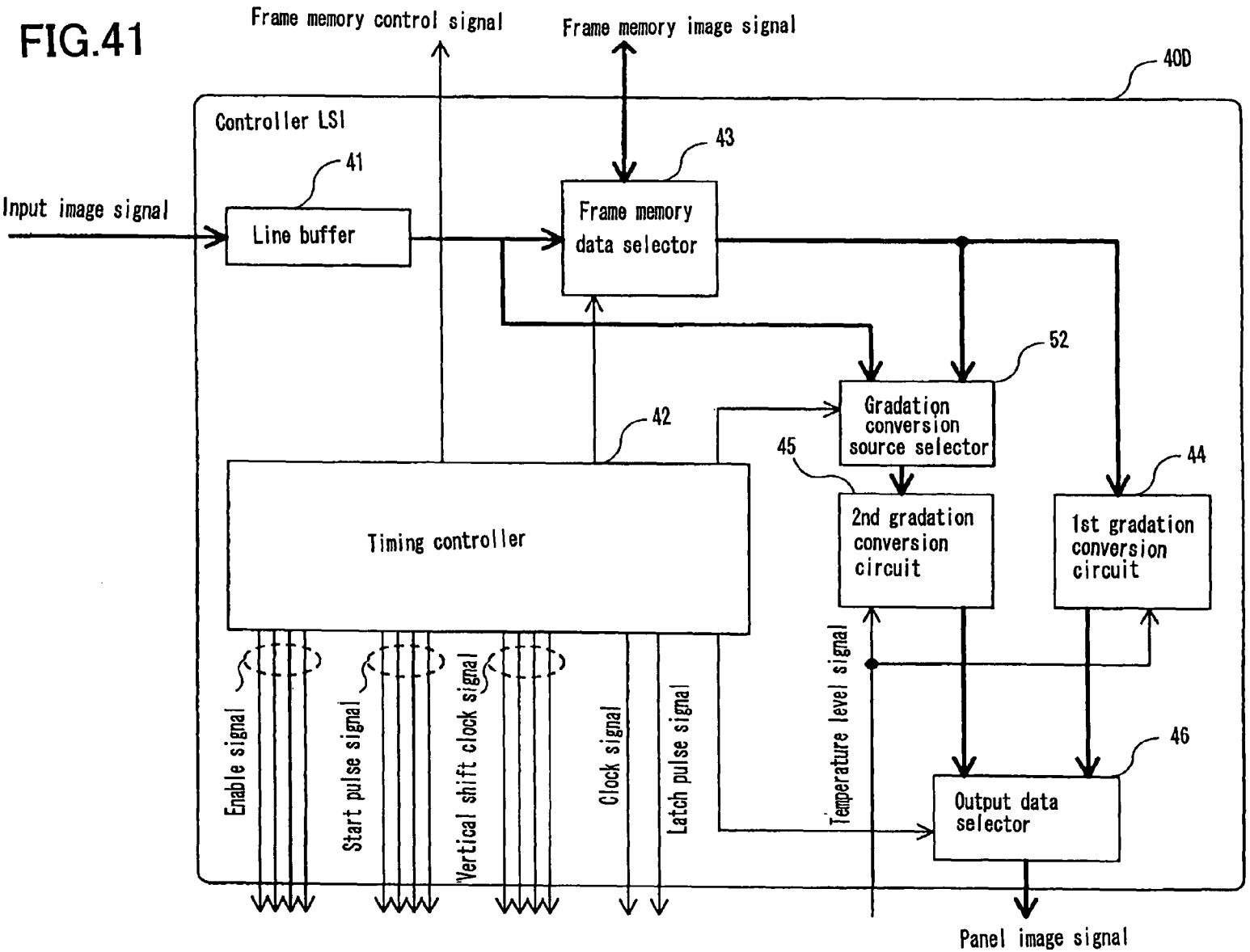
FIG. 41 is a block diagram of an exemplary structure in Example 8 according to the present invention of a controller LSI shown in FIG. 1.

FIG. 41 is a block diagram of a structure of a controller LSI 40 (as the display control section; shown in FIG. 1) in Example 8. In Example 8, the controller LSI 40 is represented by reference numeral 40D.

As shown in FIG. 41, the controller LSI 40D includes a line buffer 41 (line data memory section), a timing controller 42 (timing control section), a frame memory data selector 43 (frame memory data selection section), a gradation conversion source selector 52 (gradation conversion source selection section), a first gradation conversion circuit 44 (first gradation conversion section), a second gradation conversion circuit 45 (second gradation conversion section), and an output data selector 46 (output data selection section).

The line buffer 41 receives the input image signal horizontal line by horizontal line, and temporarily stores the input image signal. The line buffer 41 includes a receiving port and a sending port independently, and therefore can receive and send signals simultaneously.

The frame memory data selector 43 is controlled by the timing controller 42 to transfer the input image signal stored in the line buffer 41 to the frame memory 30, horizontal line by horizontal line. The input image signal stored in the line buffer 41 is also transferred to the gradation conversion source selector 52.

Alternately with the data transfer to the frame memory 30, the timing controller 42 reads an image signal which was stored before and has been stored in the frame memory 30 from two vertical positions on the screen, horizontal line by horizontal line. Then, the timing controller 42 switches the frame memory data selector 43 such that the read image signal is transferred to the first gradation conversion circuit 44 and the gradation conversion source selector 52. At this point, an image signal which is ¼ frame before is read from the frame memory 30 and transferred to the first gradation conversion circuit 44, and an image signal which is ¾ frame before is read from the frame memory 30 and is transferred to the gradation conversion source selector 52.

The gradation conversion source selector 52 is controlled by the timing controller 42 to select the image signal from the line buffer 41 or the image signal which is ¾ frame before from the frame memory data selector 43 in accordance with the display timing. The gradation conversion source selector 52 transfers the selected image signal to the second gradation conversion circuit 45.

The first gradation conversion circuit 44 converts the gradation level of the image signal which is ¼ frame before, which is supplied from the frame memory data selector 43, to the maximum gradation level or a gradation level which is increased or decreased in accordance with the gradation level of the input image signal (like in Example 4).

The second gradation conversion circuit 45 converts the gradation level of the image signal which is ¾ frame before, which is supplied from the gradation conversion source selector 52, to the minimum gradation level or a gradation level which is increased or decreased in accordance with the gradation level of the input image signal (like in Example 4).

The output data selector 46 is controlled by the timing controller 42 to select the image signal from the first gradation conversion circuit 44 or the image signal from the second gradation conversion circuit 45 in accordance with the display timing. The output data selector 46 sends the selected image signal to the image display section as a panel image signal.

An operation of an image display apparatus in Example 8 including the controller LSI 40D having the above-described structure will be described.

Figure 42:
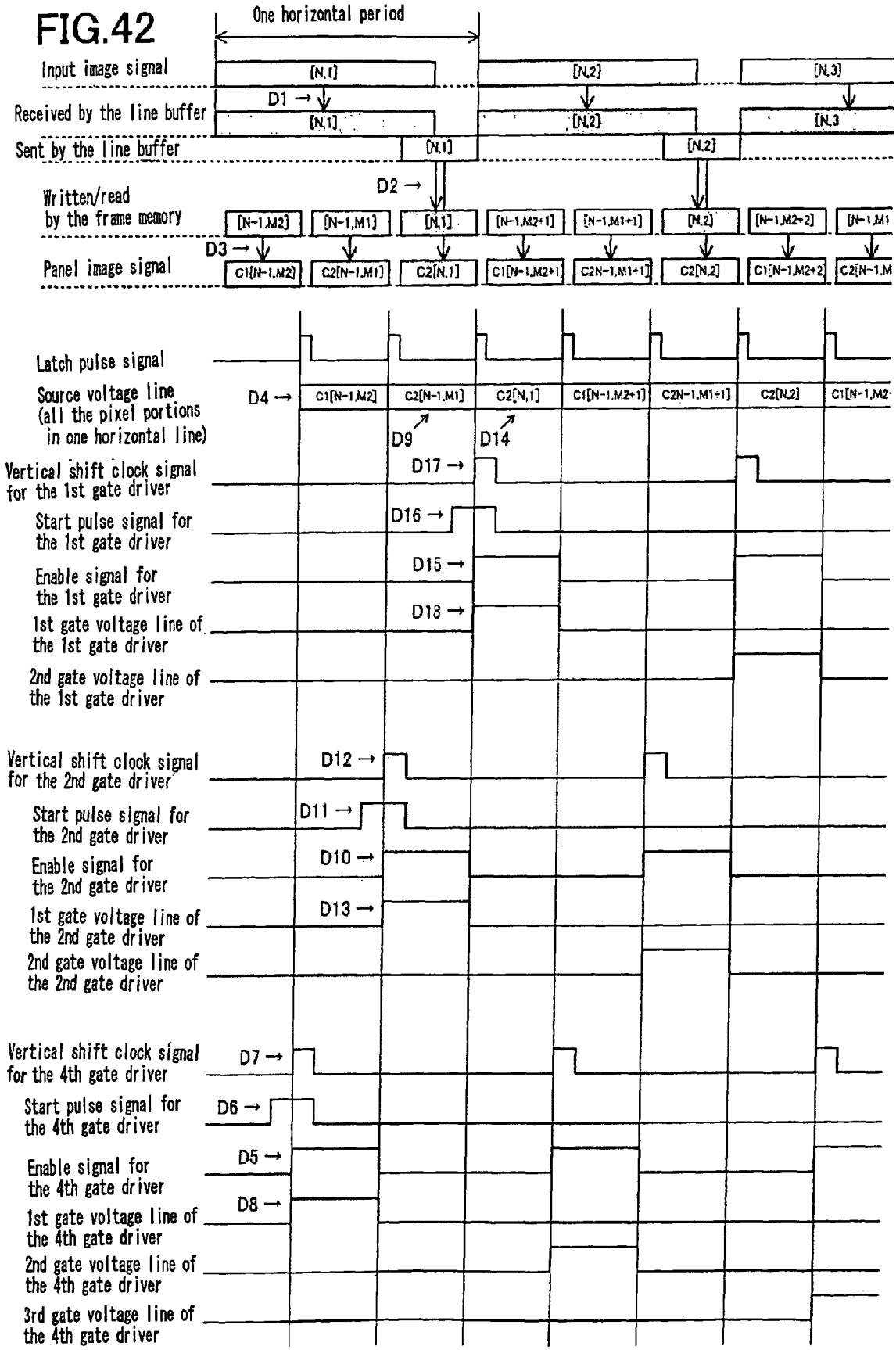
FIG. 42 is a timing diagram of signals in an image display apparatus in Example 8 according to the present invention.

FIG. 42 is a timing diagram of signals in the image display apparatus in Example 8 by horizontal periods. In FIG. 42, an image signal is input for the first horizontal line through the third horizontal line of the Nth frame.

In FIG. 42, each rectangular block represents a transfer period of one frame of image signal. The letters in brackets ([ ]) represent the frame and the horizontal line in which the image signal which is being transferred was input. For example, [f, 1] represents that an image signal which was in the first horizontal line of the f'th frame is being transferred. [N, 2] represents that an image signal which was input in the second horizontal line of the N'th frame is being transferred. The M1st line is a horizontal line which is ¼ of the screen away from the first horizontal line on the screen in the vertical direction. In Example 8, the M1st line is the horizontal line which is driven by the first gate voltage line of the second gate driver 14*b*. The M2nd line is a horizontal line which is ¾ of the screen away from the first horizontal line on the screen in the vertical direction. In Example 8, the M2nd line is the horizontal line which is driven by the first gate voltage line of the fourth gate driver 14*d*. "C1" represents that an image signal converted by the first gradation conversion circuit 44 from the input image signal which was input in the frame and horizontal line shown in the immediately subsequent bracket ([ ]) is being transferred. "C2" represents that an image signal converted by the second gradation conversion circuit 45 from the input image signal which was input in the frame and horizontal line shown in the immediately subsequent bracket ([ ]) is being transferred.

In operation, an input image signal is first received by the line buffer 41, horizontal line by horizontal line, as represented by arrow D1 in FIG. 42.

In parallel with this, as shown by arrow D3, one horizontal line image signal which was stored in the frame memory 30 ¼ of the screen before, in the vertical direction, from the image signal which is currently input is read from the frame memory 30 and supplied to the first gradation conversion circuit 44. The image signal is converted by the first gradation conversion circuit 44 and output as a panel image signal. Similarly, one horizontal line image signal which was stored in the frame memory 30 ¾ of the screen before, in the vertical direction, from the image signal which is currently input is read from the frame memory 30 and supplied to the second gradation conversion circuit 45. The image signal is converted by the second gradation conversion circuit 45 and output to the image display section as a panel image signal. One horizontal line of image signal which is currently input and received by the line buffer 41 is written to the frame memory 30 as represented by arrow D2 and is also supplied to the second gradation conversion circuit 45. The image signal is converted by the second gradation conversion circuit 45 and output as a panel image signal.

One horizontal line of panel image signal is output from the controller LSI 40D and is transferred to the first through fourth source drivers 13*a* through 13*d* by a clock signal. Then, when a latch pulse signal is provided, a display voltage corresponding to the display luminance of each pixel portion is output from the respective source voltage line. At this point, the gate driver corresponding to the horizontal line, which is to be supplied with charge (display voltage) on the source voltage line for image display, is supplied with a vertical shift clock signal or a gate start pulse signal as necessary. Thus, the corresponding gate voltage line is placed into an ON state. For a gate driver which is not to be used for image display, the enable signal is put to a LOW level and thus the corresponding gate voltage line is placed into an OFF state. In this manner, during a period in which one horizontal line of image signal is input, three horizontal lines of image signals are transferred to the display panel for image display. This operation is repeated.

In the example shown in FIG. 42, as represented by arrow D4, the M2nd line (one horizontal line) of image signal of the (N−1)'th frame is transferred to the source driver. Then, as represented by arrow D5, the enable signal from the controller LSI 40D to the fourth gate driver 14*d* is put to a HIGH level. As represented by arrows D6 and D7, a start pulse signal and a vertical shift clock signal are supplied to the fourth gate driver 14*d*. As a result, as represented by arrow D8, the TFT 12*b* connected to the first gate voltage line of the fourth gate driver 14*d* (corresponding to the M2nd line on the screen in terms of the display position) is placed into an ON state. Thus, image display is performed. At this point, the enable signals to the first through third gate drivers 14*a*, 14*b* and 14*c* which are not at the display position are put to a LOW level, and the TFTs 12*b* connected to the first through third gate drivers 14*a*, 14*b* and 14*c* are in an OFF state.

Next, as represented by arrow D9, the M1st line (one horizontal line) of image signal of the (N−1)'th frame is transferred to the source driver. Then, as represented by arrow D10, the enable signal from the controller LSI 40D to the second gate driver 14*b* is put to a HIGH level. As represented by arrows D10 and D11, a start pulse signal and a vertical shift clock signal are supplied to the second gate driver 14*b*. As a result, as represented by arrow D13, the TFT 12*b* connected to the second gate voltage line of the first gate driver 14*b* (corresponding to the M1st line on the screen in terms of the display position) is placed into an ON state. Thus, image display is performed. At this point, the enable signals to the first, third and fourth gate drivers 14*a*, 14*c* and 14*d* which are not at the display position are put to a LOW level, and the TFTs 12*b* connected to the first, third and fourth gate drivers 14*a*, 14*c* and 14*d* are in an OFF state.

Then, as represented by arrow D14, the first line (one horizontal line) of image signal of the N'th frame is transferred to the source driver. Then, as represented by arrow D15, the enable signal from the controller LSI 40D to the first gate driver 14*a* is put to a HIGH level. As represented by arrows D16 and D17, a start pulse signal and a vertical shift clock signal are supplied to the first gate driver 14*a*. As a result, as represented by arrow D18, the TFT 12*b* connected to the first gate voltage line of the first gate driver 14*a* (corresponding to the first line on the screen in terms of the display position) is placed into an ON state. Thus, image display is performed. At this point, the enable signals to the second through fourth gate drivers 14*b*, 14*a* and 14*d* which are not at the display position are put to a LOW level, and the TFTs 12*b* connected to the second through fourth gate drivers 14*b*, 14*c* and 14*d* are in an OFF state.

Figure 43:
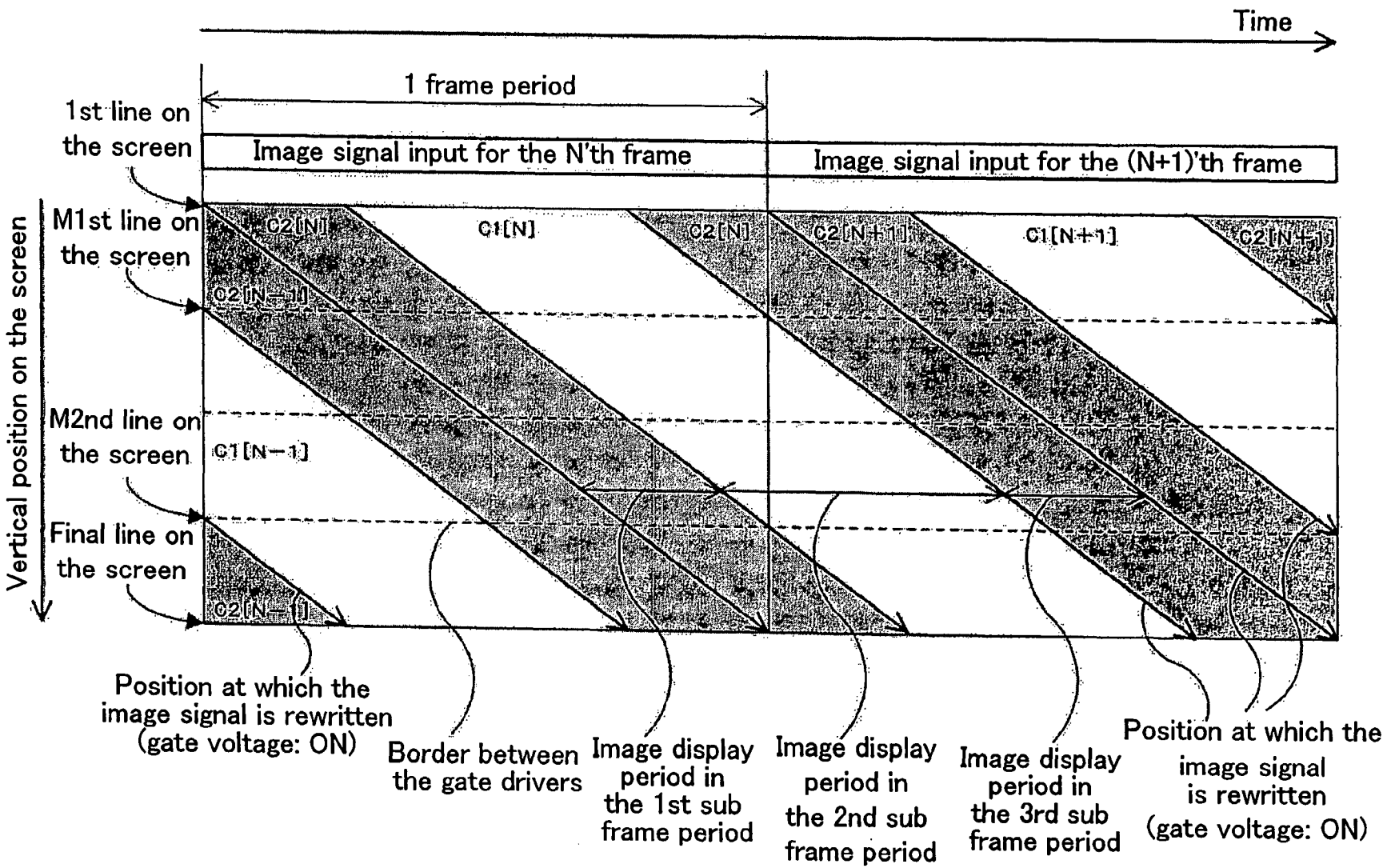
FIG. 43 shows how an image signal on the screen is rewritten in the image display apparatus in Example 8.

FIG. 43 shows how the image signal on the screen is rewritten by repeating the display control shown in FIG. 42.

Specifically, FIG. 43 shows how the image signal is rewritten in the period in which the image signal for the N'th frame and the (N+1)'th frame is input.

In FIG. 43, the oblique arrows represent the vertical position and the timing at which one horizontal line of image signal is rewritten. Ci[f] represents that the image signal for the f'th frame is displayed by an image signal converted by the i'th gradation conversion circuit (the first gradation conversion circuit 44 or the second gradation conversion circuit 45). The image display information is retained until the image signal for the same line is rewritten. In FIG. 43, the white areas represent the positions where the image display information converted by the first gradation conversion circuit 44 is retained, and the hatched areas represent the positions where the image display information converted by the second gradation conversion circuit 45 is retained. The dotted lines represent the borders between the first through fourth gate drivers 14*a* through 14*d* which are driven.

Paying attention to a vertical position of one horizontal line on the screen, the following is appreciated: during a half of one frame, image display is performed by an image signal converted by the first gradation conversion circuit 44; and during each ¼ of one frame before and after the half frame, image display is performed by an image signal converted by the second gradation conversion circuit 45. The first ¼ of one frame period is referred to as a first sub frame period, the half frame period following this is referred to a second sub frame period, and the final ¼ of one frame period is referred to a third sub frame period.

As shown in FIG. 42, when one frame of image signal is input, (a) a period in which the image signal converted by the first gradation conversion circuit 44 is used for display, and (b) a period in which the image signal converted by the second gradation conversion circuit 45 is used for display, are both half of one frame period. Therefore, the first gradation conversion circuit 44 and the second gradation conversion circuit 45 can convert the image signals such that the converted gradation levels have substantially the same relationship with the gradation level of the input image signal as in Example 4. Thus, the movement blur is alleviated to improve the quality of moving images, and an appropriate gamma luminance characteristic is obtained.

For displaying an image of an object moving in the horizontal direction with a still background using the image display apparatus and method in Example 8, when the gradation level of the input image signal is sufficiently low, the minimum gradation level is supplied in the first sub frame period and the third sub frame period for both the display portion of the still background and the display portion of the moving object. Therefore, as in the case of the image display apparatus which adopts the minimum (luminance) insertion system shown in FIGS. 50 and 51, the movement blur is alleviated to improve the quality of moving images.

Figure 44:
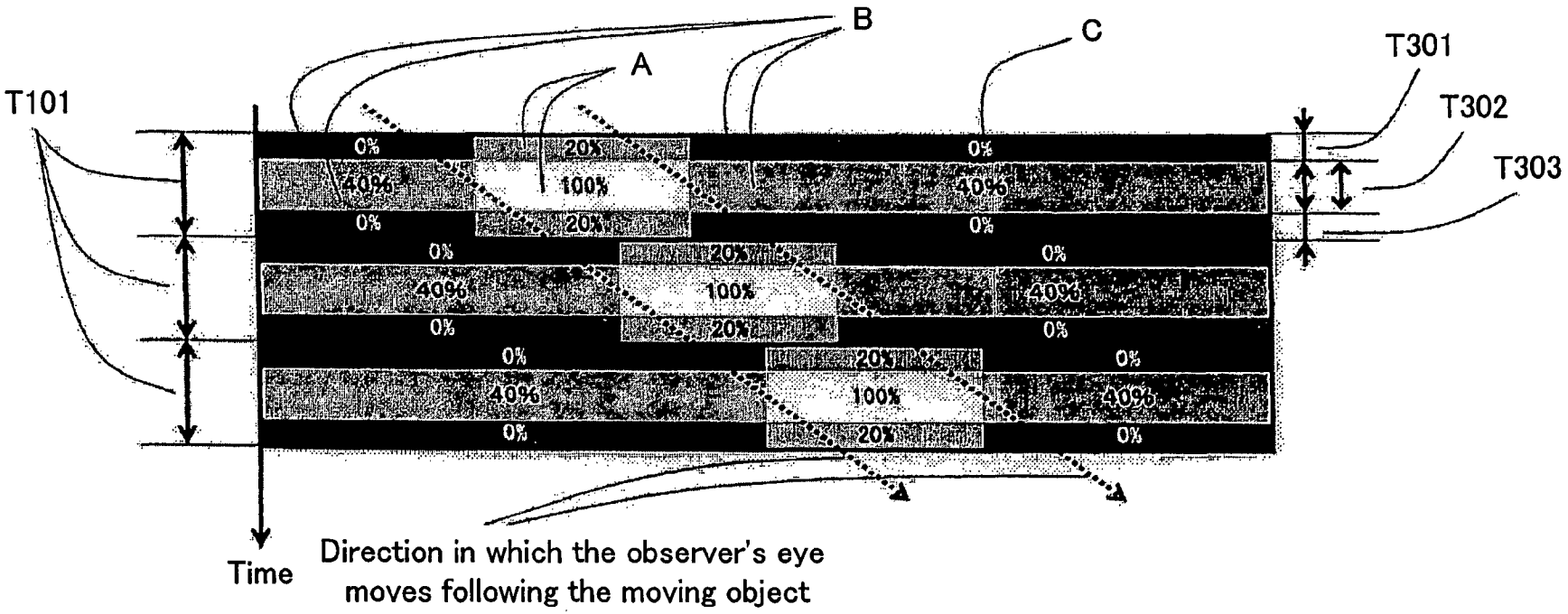
FIG. 44 shows a luminance change in accordance with time of one horizontal line in a screen when an object horizontally moves with a still background in the image display apparatus in Example 8.

FIG. 44 shows a luminance change in accordance with time of one horizontal line in a screen when an object horizontally moves with a still background in the image display apparatus in Example 8. The display luminance levels of the moving object and the still background are the same as those in FIG. 27 (Example 4).

In FIG. 44, the horizontal axis represents the luminance state in the horizontal direction of the screen (the position of the pixel portion in the horizontal direction), and the vertical axis represents the time. FIG. 44 shows images displayed on the screen in three frames.

In FIG. 44, each one-frame period T101 includes three sub frame periods T301 (first sub frame period), T302 (second sub frame period), and T303 (third sub frame period). For the display portion B of the still background, the gradation level of the input image signal is low. Therefore, in the second sub frame period T302, the display portion B is in a light-on state at the luminance of 40% with an image signal of a gradation level which is increased or decreased in accordance with the gradation of the input image signal. In the first and third sub frame periods T301 and T303, the display portion B is in a light-off state at the minimum luminance of 0%. For the display portion A of the moving object, the gradation level of the input image signal is sufficiently high. Therefore, in the second sub frame period T302, the display portion A is in a light-on state at the luminance of 100%. In the first and third sub frame periods T301 and T303, the display portion A is in a light-on state at the luminance of 20% with an image signal of a gradation level which is increased or decreased in accordance with the gradation level of the input image signal. The numerals with "%" represent the luminance level of the image with respect to the maximum display ability of 100%. For example, the numeral surrounded by the dotted line for C represents the luminance of 0%.

Figure 45:
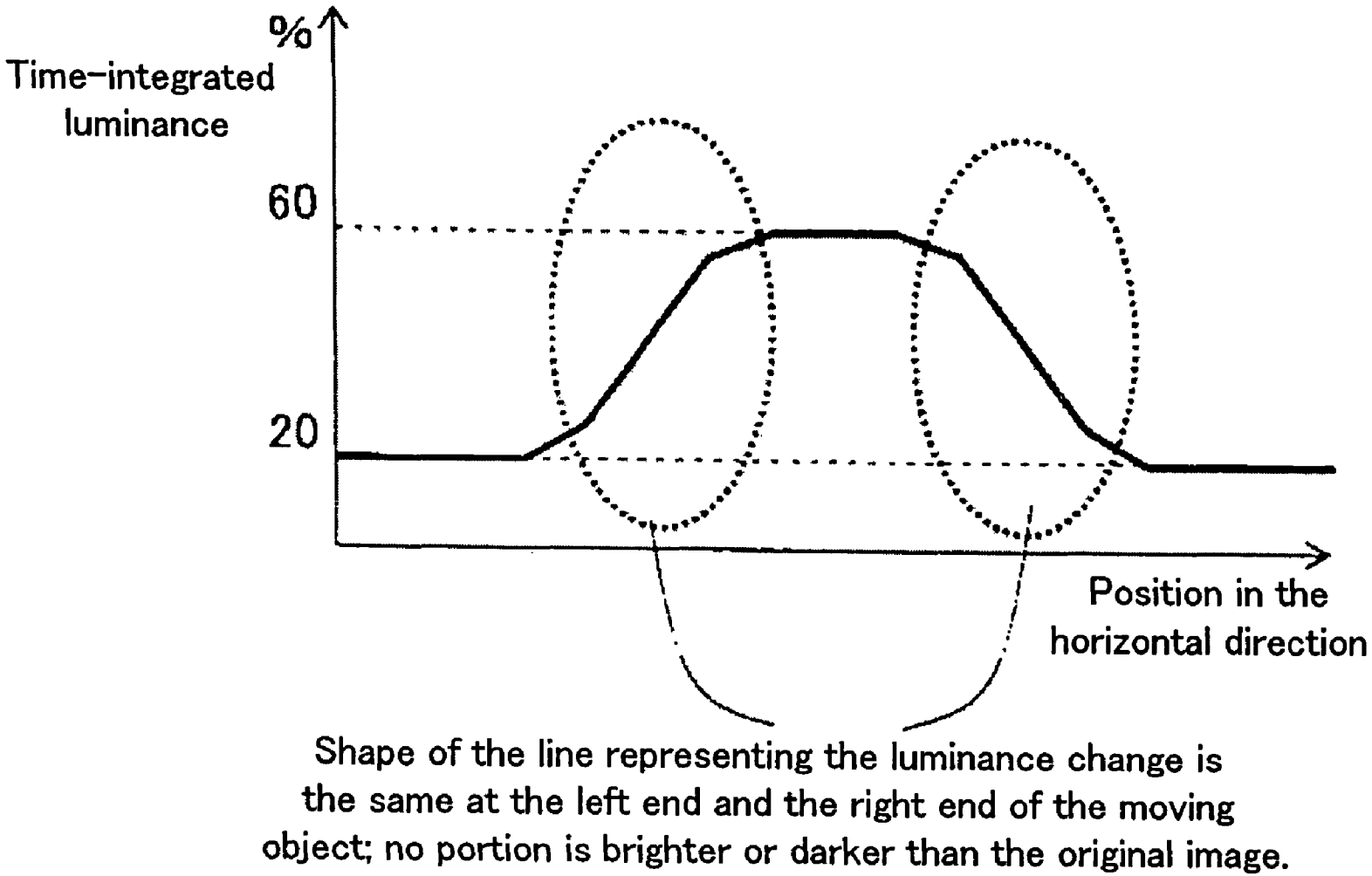
FIG. 45 shows the distribution in brightness of the image shown in FIG. 44 which is viewed by the observer's eye paying attention to the moving object.
Figure 46:
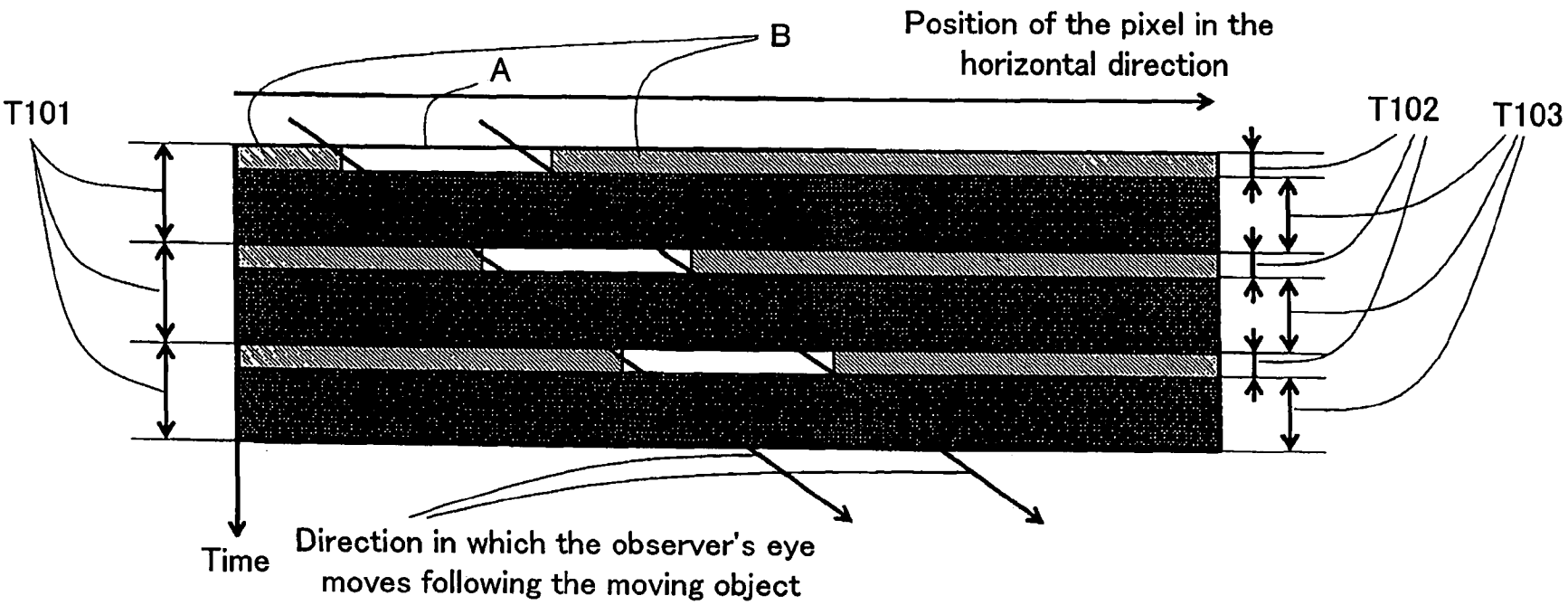
FIG. 46 shows a luminance change in accordance with time of one horizontal line in a screen when an object horizontally moves with a still background in a conventional impulse-type image display apparatus.
Figure 47:
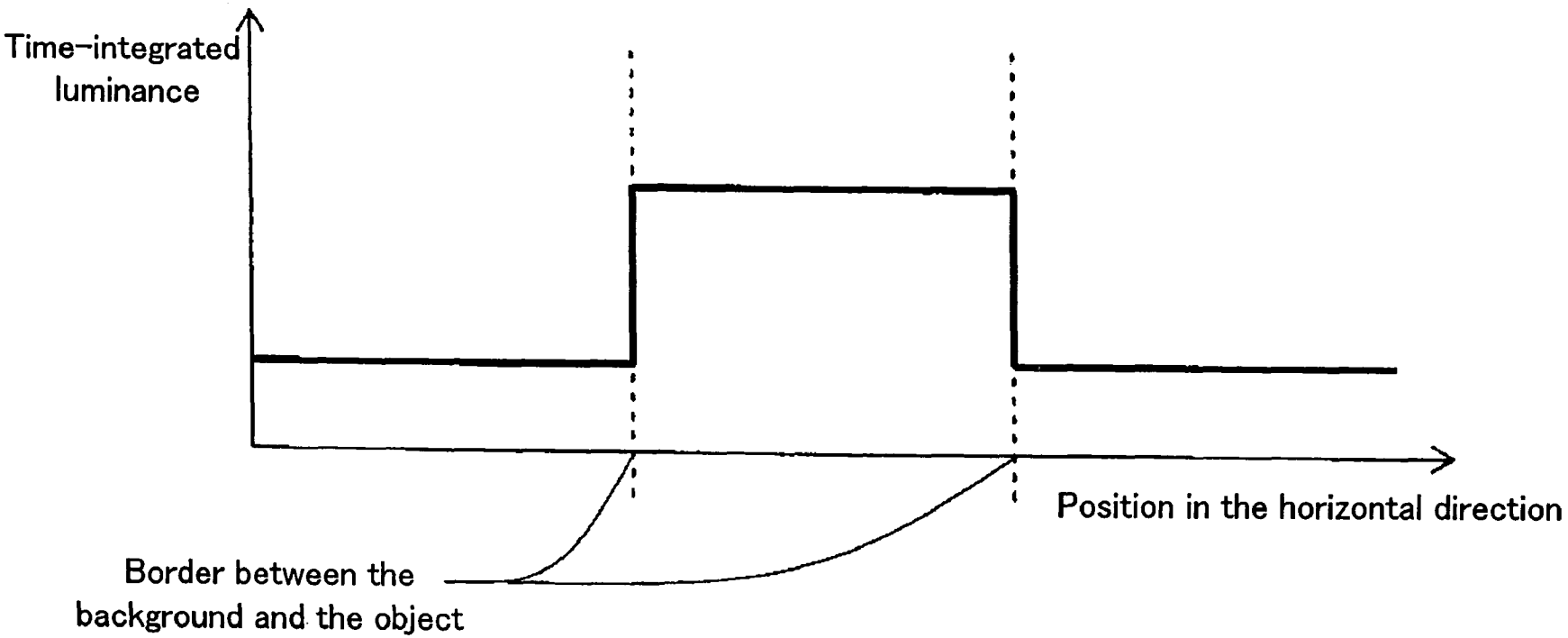
FIG. 47 shows the distribution in brightness of the image shown in FIG. 46 which is viewed by the observer's eye paying attention to the moving object.

FIG. 45 shows the distribution in brightness of the image shown in FIG. 44 which is viewed by the observer's eye paying attention to the moving object.

The phenomenon shown in FIG. 28 (Example 4) that the shape of the line representing the luminance change is different between the left end and the right end of the moving object as represented by the dotted circles is solved. The drawback shown in FIG. 53 that there are portions which are brighter or darker than the original image is solved.

In Example 8 (as in Example 4), (a) the threshold level which is a reference for the gradation level of the image signal in each sub frame period, and (b) the gradation level of the image signal supplied in each sub frame period after being increased or decreased in accordance with the gradation level of the input image signal, can be set in accordance with the temperature level signal from the temperature sensor IC 20 for detecting the temperature of the display panel 10 or the temperature in the vicinity thereof. By such setting, even when the display panel 10 uses a liquid crystal material, the relationship between the gradation level of the input image signal and the brightness perceived by the observer's eye can be maintained regardless of the temperature conditions.

In Example 8, in the case where an input image signal contains a plurality of color components, the gradation levels of the image signals supplied in each sub frame period can be set as follows. Regarding each of the two colors (for example, green and blue) other than the color having the highest gradation level of input image signal (for example, red), the gradation levels are set such that the ratio between the luminance level displayed in the first sub frame period and the luminance level displayed in the second sub frame period is equal to the ratio, of the color having the highest gradation level of input image signal, between the luminance level displayed in the first sub frame period and the luminance level displayed in the second sub frame period. With such setting, the luminance ratio among the colors is maintained at an appropriate value, and deterioration in image quality due to inaccurate color balance can be prevented.

According to an image display apparatus in Examples 1 through 7 of the present invention, one frame of image display is performed by the sum of time-integrated values of luminance during two sub frame periods. According to an image display apparatus in Example 8 of the present invention, one frame of image display is performed by the sum of time-integrated values of luminance during three sub frame periods. The present invention is not limited to these. The present invention is applicable to an image display apparatus for performing one frame of image display by the sum of time-integrated values of luminance during n sub frame periods (where n is an integer of 2 or greater).

One frame of image display is performed by the sum of time-integrated values of luminance during n sub frame periods (where n is an integer of 2 or greater), for example, as follows. In a sub frame period which is at the center, (when n is an odd number), or which is closest to the center (when n is an even number), of one frame period in terms of time, an image signal of the following gradation level is supplied: the maximum gradation level within the range in which the sum of time-integrated luminance levels in the n sub frame periods does not exceed the luminance level of the input image signal. (The sub frame period which is at the center or which is closest to the center of one frame period in terms of time will be referred to as the "central sub frame period".) When the sum of time-integrated luminance levels in the central sub frame period still does not reach the luminance level of the input image signal, an image signal of the following gradation level is supplied in each of the sub frame periods before and after the central sub frame period: the maximum gradation level within the range in which the sum of time-integrated luminance levels in the n sub frame periods does not exceed the luminance level of the input image signal. (The sub frame period before the central sub frame period will be referred to as the "preceding sub frame period", and the sub frame period after the central sub frame period will be referred to as the "subsequent sub frame period".) The image signal may be supplied in the preceding sub frame period and the subsequent sub frame period simultaneously. Alternatively, the image signal may be first supplied in the preceding sub frame period and then in the subsequent sub frame period. Still alternatively, the image signal may be first supplied in the subsequent sub frame period and then in the preceding sub frame period. When the sum of time-integrated luminance levels in the central sub frame period, the preceding sub frame period and the subsequent sub frame period still does not reach the luminance level of the input image signal, an image signal of the following gradation level is supplied in each of the sub frame periods before the preceding sub frame period and the sub frame period after the subsequent sub frame period: the maximum gradation level within the range in which the sum of time-integrated luminance levels in then sub frame periods does not exceed the luminance level of the input image signal. Such an operation is repeated until the sum of time-integrated luminance levels in all the sub frame periods in which the image signals have been supplied reaches the luminance level of the input image signal. When this occurs, an image signal of the minimum gradation level is supplied in the remaining sub frame period(s).

In the case where "n" is an odd number of 3 or greater, one frame of image display is performed by the sum of time-integrated values of luminance during n sub frame periods, for example, as follows. The sub frame periods are referred to the first sub frame period, the second sub frame period, . . . the n'th sub frame period from the sub frame period which is earliest in terms of time or from the sub frame period which is latest in terms of time. The sub frame period which is at the center in terms of time is referred to as the "m'th sub frame period" (where m=(n+1)/2. (n+1)/2-number of threshold levels are provided as references for the gradation level of the input image signal. The threshold levels are referred to as T1, T2, . . . T[(n+1)/2] from the smallest threshold level. When the gradation level of the input image signal is T1 or less, an image signal of a gradation level which is increased or decreased in accordance with the gradation level of the input image signal, is supplied in the m'th sub frame period, and an image signal of the minimum gradation level is supplied in the other sub frame periods. When the gradation level of the input image signal is greater than T1 and equal to or less than T2, an image signal of the maximum gradation level is supplied in the m'th sub frame period, an image signal of a gradation level which is increased or decreased in accordance with the gradation level of the input image signal is supplied in each of the (m−1)'th sub frame period and the (m+1)'th sub frame period, and an image signal of the minimum gradation level is supplied in the other sub frame periods. When the gradation level of the input image signal is greater than T2 and equal to or less than T3, an image signal of the maximum gradation level is supplied in each of the m'th sub frame period, the (m−1)'th sub frame period and the (m+1)'th sub frame period, an image signal of a gradation level which is increased or decreased in accordance with the gradation level of the input image signal is supplied in each of the (m−2)'th sub frame periods and the (m+2)'th sub frame period, and an image signal of the minimum gradation level is supplied in the other sub frame periods. In this manner, when the gradation level of the input image signal is greater than Tx−1 (x is an integer of 4 or greater) and equal to or less than Tx, an image signal of the maximum gradation level is supplied in each of the [m−(x−2)]'th sub frame period through the [m+(x−2)]'th sub frame period, an image signal of a gradation level which is increased or decreased in accordance with the gradation level of the input image signal is supplied in each of the [m−(x−1)]'th sub frame periods through the [m+(x−1)]'th sub frame periods, and an image signal of the minimum gradation level is supplied in the other sub frame periods.

In the case where "n" is an even number of 2 or greater, one frame of image display is performed by the sum of time-integrated values of luminance during n sub frame periods, for example, as follows. The sub frame periods are referred to as the first sub frame period, the second sub frame period, . . . the n'th sub frame period from the sub frame period which is earliest in terms of time or from the sub frame period which is latest in terms of time. Two sub frame periods which are closest to the center in terms of time are referred to as the "mist sub frame period" (where m1=n/2) and the "m2nd sub frame period" (where m2=n/2+1). n/2-number of threshold levels are provided as references for the gradation level of the input image signal. The threshold levels are referred to as T1, T2, . . . T[n/2] from the smallest threshold level. When the gradation level of the input image signal is T1 or less, an image signal of a gradation level which is increased or decreased in accordance with the gradation level of the input image signal is supplied in each of the m1st sub frame period and the m2nd sub frame period, and an image signal of the minimum gradation level is supplied in the other sub frame periods. When the gradation level of the input image signal is greater than T1 and equal to or less than T2, an image signal of the maximum gradation level is supplied in each of the m1st sub frame period and the m2nd sub frame period, an image signal of a gradation level which is increased or decreased in accordance with the gradation level of the input image signal is supplied in each of the (m1−1)'th sub frame periods and the (m2+1)'th sub frame periods, and an image signal of the minimum gradation level is supplied in the other sub frame periods. When the gradation level of the input image signal is greater than T2 and equal to or less than T3, an image signal of the maximum gradation level is supplied in each of the mist sub frame periods, the m2nd sub frame periods, the (m1−1)'th sub frame periods and the (m2+1)'th sub frame periods, an image signal of a gradation level which is increased or decreased in accordance with the gradation level of the input image signal is supplied in each of the (m1−2)'th sub frame periods and the (m2+2)'th sub frame periods, and an image signal of the minimum gradation level is supplied in the other sub frame periods. In this manner, when the gradation level of the input image signal is greater than Tx−1 (x is an integer of 4 or greater) and equal to or less than Tx, an image signal of the maximum gradation level is supplied in each of the [m1−(x−2)]'th sub frame period through the [m2+(x−2)]'th sub frame period, an image signal of a gradation level which is increased or decreased in accordance with the gradation level of the input image signal is supplied in each of the [m1−(x−1)]'th sub frame period through the [m2+(x−1)]'th sub frame period, and an image signal of the minimum gradation level is supplied in the other sub frame periods.

An upper limit of the gradation level of the image signal supplied in each sub frame period can be determined as follows. Upper limits of the gradation levels of the image signals supplied in the first, second, . . . n'th sub frame periods are respectively referred to as L1, L2, . . . Ln. The sub frame period which is at the center, or closest to the center, of one frame period in terms of time is referred to as the j'th sub frame period. The upper limits are defined so as to fulfill the following relationships.

$$L[j-i] \geqq L[j-(i+1)];$$

$$L[j+i] \geqq L[j+(i+1)]$$

where i is an integer of 0 or greater and less than j.

The upper limits thus determined can be used as the maximum values of the gradation levels supplied in the respective sub frame periods.

With such control, the time-wise center of gravity of display luminance can be fixed to the position which is at the center, or closest to the center, of one frame period in terms of time. Therefore, the deterioration in image quality caused by inaccurate luminance or color balance, which occurs when the position of the time-wise center of gravity of display luminance varies in accordance with the gradation level of the input image signal (as described in, for example, Japanese Laid-Open Publication No. 2001-296841) can be suppressed. Since the luminance levels are different among the sub frame periods, the movement blur is alleviated to improve the quality of moving images. Even when the display is performed at the maximum gradation level, the reduction in the maximum luminance and contrast, which occurs with the minimum (luminance) insertion system (with which each one-frame period includes a minimum luminance period), can be suppressed.

Example 9

In Example 9 of the present invention, one frame of image display is performed by the sum of time-integrated values of luminance during two sub frame periods (i.e., the first sub frame period and the second sub frame period). The gamma luminance characteristic is changed using a digital input system source driver.

Also in Example 9, when the gradation level of the input image signal is 50% or less, an image signal of a gradation level of, for example, several percent, instead of the minimum gradation level (0%) is supplied in one of the two sub frame periods. When the gradation level of the input image signal is greater than 50%, an image signal of a gradation level of, for example, several percent less than 100%, instead of the maximum gradation level (100%) is supplied in one of the two sub frame periods. The gradation levels are allocated to the first sub frame period and the second sub frame period such that the gradation level of the image signal supplied in one of the two sub frame periods is half or less than half of the gradation level of the image signal supplied in the other sub frame period. The gradation level of the image signal supplied in one of the two sub frame periods is preferably 10% or less of, and more preferably 2% or less of, the gradation level of the image signal supplied in the other sub frame period, in order to provide the effect of the present invention. When the gradation level of the image signal supplied in one of the two sub frame periods is 2% or less of the gradation level of the image signal supplied in the other sub frame period, for example, only one gradation level among 256 gradation levels is given to one of the two sub frame periods.

Figure 60:
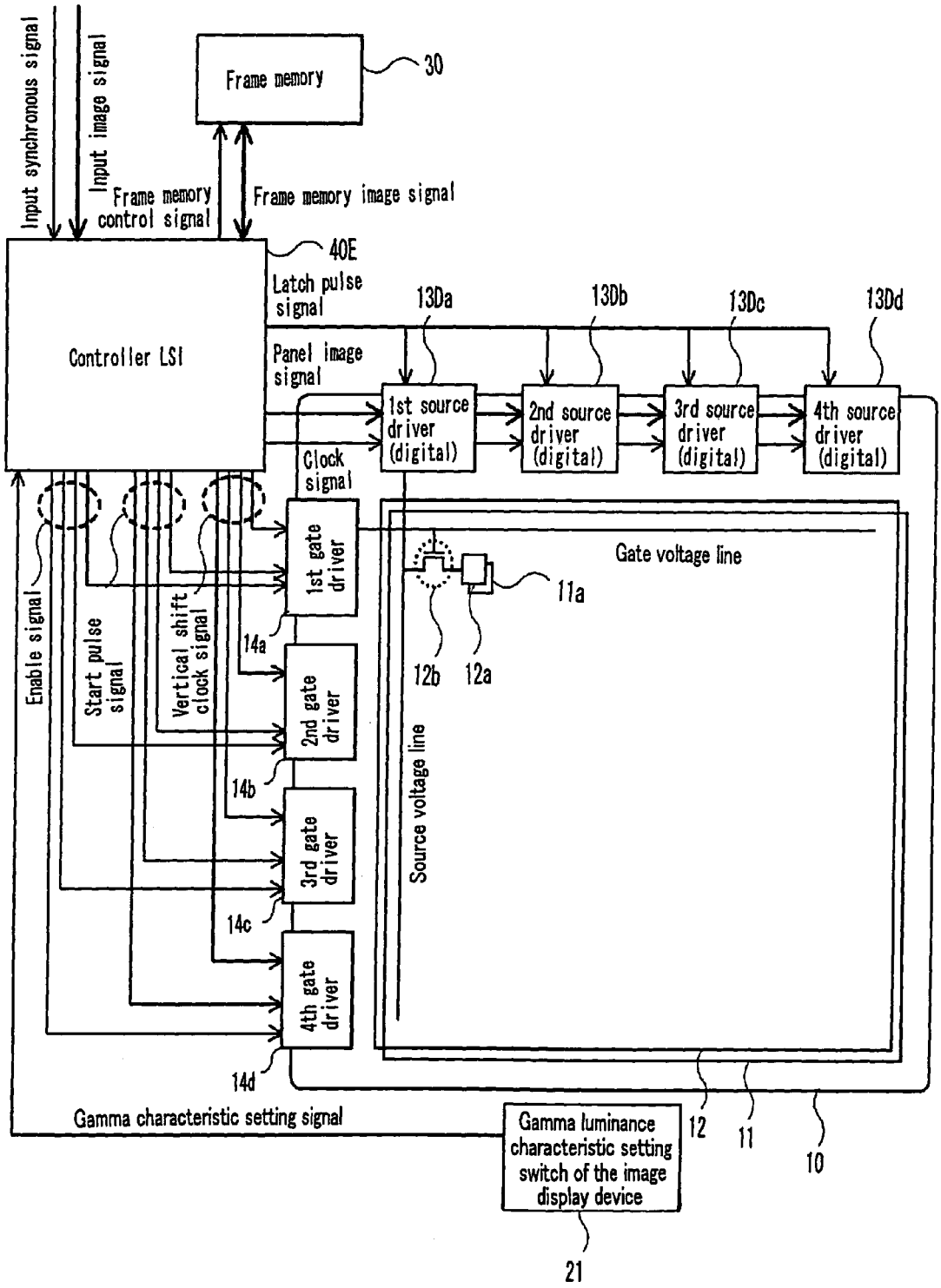
FIG. 60 is a block diagram illustrating a basic structure of an image display apparatus in Example 9 according to the present invention.

FIG. 60 is a block diagram illustrating a basic structure of an image display apparatus according to Example 9 of the present invention. Identical elements as those of FIG. 1 will bear identical reference numeral thereto and detailed descriptions thereof will be omitted.

As shown in FIG. 60, the image display apparatus in Example 9 has basically the same structure as that of Example 1, and is mainly different in the following points. The image display apparatus in Example 9 includes digital input system source drivers 13Da through 13Dd instead of the source drivers 13*a* through 13*d*, and includes a gamma luminance characteristic setting switch 21 (gamma luminance characteristic setting section) instead of the temperature sensor IC 20. The gamma luminance characteristic setting switch 21 switches the gamma luminance characteristic to "2.1", "2.2" or "2.3". The image display apparatus in Example 9 also includes a controller LSI 40E for switching the gamma luminance characteristic using the gamma luminance characteristic setting switch 21 to perform display control. In FIG. 60, the gamma luminance characteristic setting switch 21 is provided instead of the temperature sensor IC 20. Alternatively, the gamma luminance characteristic setting switch 21 may be provided together with the temperature sensor IC 20.

The digital input system source drivers 13Da through 13Dd each receive a panel image signal as digital display data, select one of preset voltages in accordance with the value of the respective digital display data, and output the selected voltage as a gradation voltage. In the case of, for example, 8-bit input system source drivers, 256 gradation voltages which can be output are pre-set. Each digital input system source driver selects a gradation voltage which is uniquely defined, in accordance with one of 256 values (0 through 255) determined by the input 8-bit digital display data.

Figure 61:
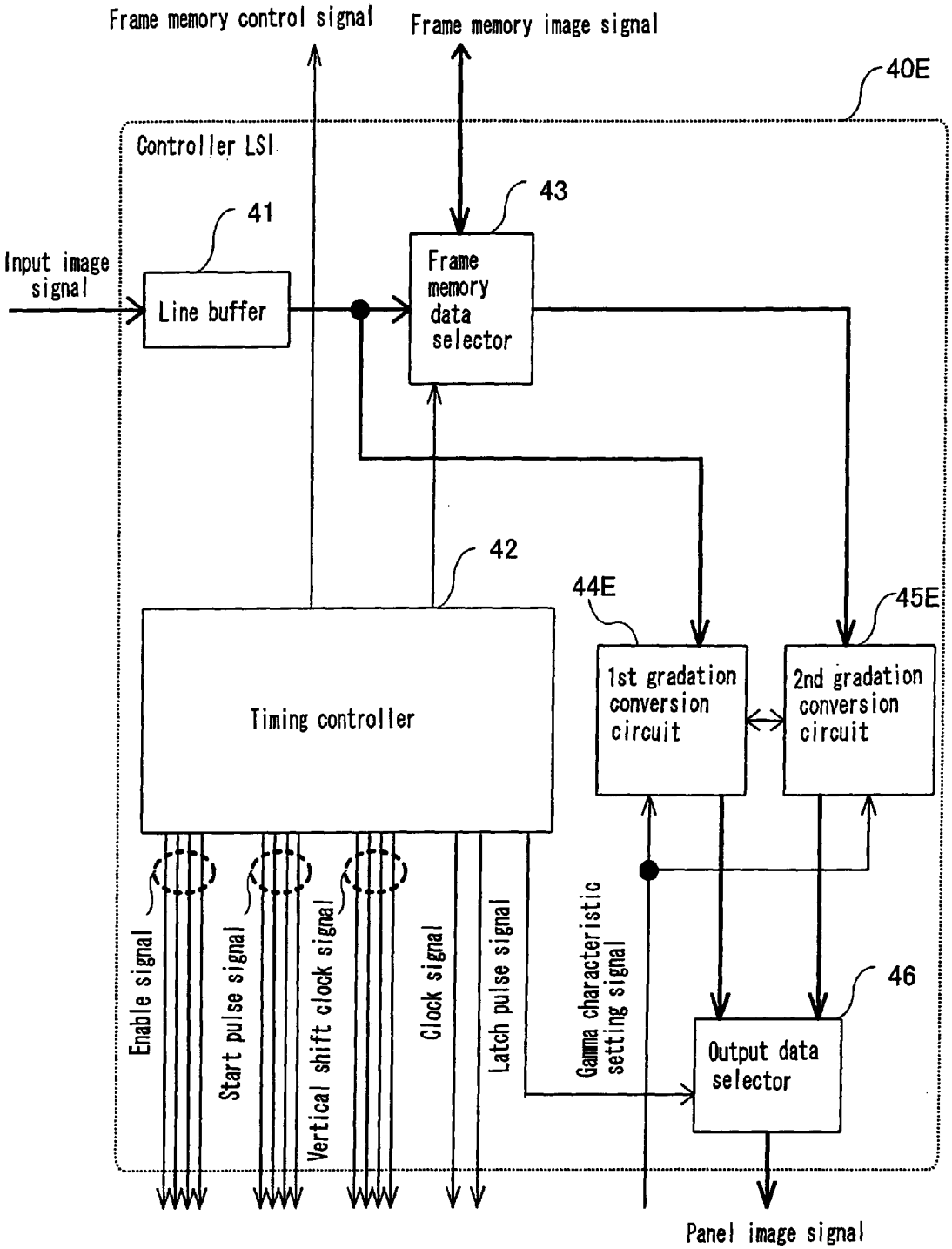
FIG. 61 is a block diagram of an exemplary structure of a controller LSI shown in FIG. 60.

FIG. 61 is a block diagram of a structure of a controller LSI 40E (as the display control section; shown in FIG. 60).

As shown in FIG. 61, the controller LSI 40E includes a line buffer 41 (line data memory section), a timing controller 42 (timing control section), a frame memory data selector 43 (frame memory data selection section), a first gradation conversion circuit 44E (first gradation conversion section) for receiving a gamma luminance characteristic setting signal, a second gradation conversion circuit 45E (second gradation conversion section) for receiving a gamma luminance characteristic setting signal, and an output data selector 46 (output data selection section).

The line buffer 41 receives the input image signal horizontal line by horizontal line, and temporarily stores the input image signal. The line buffer 41 includes a receiving port and a sending port independently, and therefore can receive and send signals simultaneously.

The timing controller 42 controls the frame memory data selector 43 to alternately select data transfer to the frame memory 30 or data read from the frame memory 30. The timing controller 42 also controls the output data selector 46 to alternately select data output from the first gradation conversion circuit 44 or data output from the second gradation conversion circuit 45. Namely, the timing controller 42 selects the first sub frame period or the second sub frame period for the output data selector 46, as described later in detail.

The frame memory data selector 43 is controlled by the timing controller 42 to alternately select data transfer or data read. In data transfer, the frame memory data selector 43 transfers the input image signal stored in the line buffer 41 to the frame memory 30, horizontal line by horizontal line. In data read, the frame memory data selector 43 reads an input image signal which was read one frame period before and has been stored in the frame memory 30, horizontal line by horizontal line, and transfers the read data to the second gradation conversion circuit 45E.

The first gradation conversion circuit 44E converts the gradation level of the input image signal supplied from the line buffer 41 to a gradation level for the first sub frame period in accordance with a look-up table.

The second gradation conversion circuit 45E converts the gradation level of the image signal supplied from the frame data selector 43 to a gradation level for the second sub frame period in accordance with a look-up table.

In Example 9, the first gradation conversion circuit 44 and the second gradation conversion circuit 45 work by look-up tables which store output values for input values. One of the gradation levels is selected by three types of look-up tables which are determined by the gamma value from the gamma luminance characteristic setting switch 21 to determine output values. Alternatively, the output values may be obtained by a calculation circuit by selecting a calculation expression.

The output data selector 46 is controlled by the timing controller 42 to alternately select an image signal which is output from the first gradation conversion circuit 44E, or an image signal which is output from the second gradation conversion circuit 45E, horizontal line by horizontal line. The output data selector 46 outputs the selected image signal as a panel image signal.

An operation of the image display apparatus in Example 9 is substantially the same as that of Example 1 except that the digital input system source drivers 13Da through 13Dd are used instead of the source drivers 13*a* through 13*d*, and will not be described in detail here.

In Example 9, the sub frame period α is assigned to the second sub frame period. The gradation level of the image signal is converted by the second gradation conversion circuit 45E such that: when the gradation level of the input image signal is equal to or less than the threshold level uniquely determined, an image signal of a gradation level which is increased or decreased in accordance with the gradation level of the input image signal is supplied in the sub frame period α; and when the gradation level of the input image signal is greater than the threshold level uniquely determined, an image signal of the maximum gradation level is supplied in the sub frame period α. When the image signal of the maximum gradation level is supplied, the gradation level of the image signal supplied in one of the two sub frame periods is equal to or less than half, preferably equal to or less than 10%, or more preferably equal to or less than 2%, of the gradation level of the image supplied in the other sub frame period.

The sub frame period β is assigned to the first sub frame period. The gradation level of the image signal is converted by the first gradation conversion circuit 44E such that: when the gradation level of the input image signal is equal to or less than the threshold level uniquely determined, an image signal of the minimum gradation level is supplied in the sub frame period β; and when the gradation level of the input image signal is greater than the threshold level uniquely determined, an image signal of the maximum gradation level is supplied in the sub frame period α. When the image signal of the minimum gradation level is supplied, the gradation level of the image signal supplied in one of the two sub frame periods is equal to or less than half, preferably equal to or less than 10%, or more preferably equal to or less than 2%, of the gradation level of the image supplied in the other sub frame period.

Hereinafter, how to allocate the gradation levels to the first sub frame period and the second sub frame period will be described.

In Example 9, 5-bit digital input system source drivers will be used for the sake of explanation, but the number of bits of the source drivers is not specifically limited. In general, 8-bit input system source drivers capable of displaying 256 gradation levels are used.

The luminance level of the display panel 10 (liquid crystal display panel) is determined by the relationship between the output gradation voltage and the voltage-transmittance characteristic (V-T characteristic) of the liquid crystal display panel 10 in accordance with the digital display data which is input to the source drivers 13Da through 13Dd. In Example 9, the source drivers 13Da through 13Dd are of the 5-bit digital input system, and the gradation voltages are set such that the luminance level of the liquid crystal display panel 10, with respect to the input digital data, is as shown in Table 1. In other words, the reference voltages are set such that the gamma luminance characteristic of the source drivers 13Da through 13Dd is 2.2.

TABLE 1

Gamma luminance characteristic of the source driver

| Driver input data (5 bits) | Luminance level of the liquid crystal panel (%) |
|---|---|
| 0 | 0.00 |
| 1 | 3.80 |
| 2 | 4.45 |
| 3 | 5.15 |
| 4 | 7.80 |
| 5 | 8.85 |
| 6 | 10.00 |
| 7 | 11.00 |
| 8 | 13.30 |
| 9 | 14.65 |
| 10 | 17.70 |
| 11 | 20.80 |
| 12 | 26.20 |
| 13 | 31.00 |
| 14 | 34.40 |
| 15 | 39.20 |
| 16 | 44.10 |
| 17 | 48.65 |
| 18 | 53.10 |
| 19 | 57.50 |
| 20 | 62.00 |
| 21 | 66.25 |
| 22 | 70.85 |
| 23 | 75.15 |
| 24 | 79.60 |
| 25 | 84.00 |
| 26 | 88.40 |
| 27 | 93.40 |
| 28 | 97.00 |
| 29 | 98.00 |
| 30 | 99.00 |
| 31 | 100.00 |

In Example 9, the gamma luminance characteristic of the image display apparatus is changed by appropriately combining the gradation levels for the first sub frame period and the second sub frame period using the digital input system source drivers 13Da through 13Dd. A majority of general image signals are output with a gamma value of 2.2 in consideration of the gamma luminance characteristic of CRTs which are mainly used as display devices conventionally. In Example 9, the gamma value (gamma luminance characteristic) is selectable to "2.1", "2.2" or "2.3" by the gamma luminance characteristic setting switch 21. Thus, the optimum gamma luminance characteristic for the screen can be selected, so that the image on the screen is easy to view.

Specifically, one of the three look-up tables (a look-up table A for the gamma luminance characteristic of 2.2, a look-up table B for the gamma luminance characteristic of 2.1, and a look-up table C for the gamma luminance characteristic of 2.3) in each of the first gradation conversion circuit 44E and the second gradation conversion circuit 45E is selected in accordance with the gamma luminance characteristic setting signal which is sent from the gamma luminance characteristic setting switch 21.

Table 2 shows the following correspondence in the look-up table A (gamma luminance characteristic: 2.2): the correspondence between the gradation level of the input image signal, the digital data output to the source drivers 13Da through 13Dd in the first and second sub frame periods, the gradation levels in the first and second sub frame periods, and the time-integrated value of the display luminance during the first and second sub frame periods (perceived brightness).

TABLE 2

Look-up table A (gamma luminance characteristic 2.2)

| Gradation level of the input image signal (%) | Target gradation level of the image display device (%) | Look-up table (output digital data to the source driver) 1st sub frame period | Look-up table (output digital data to the source driver) 2nd sub frame period | Gradation level (%) 1st sub frame period | Gradation level (%) 2nd sub frame period | Time-integrated luminance of one frame period (perceived brightness) | Error (%) |
|---|---|---|---|---|---|---|---|
| 0.00 | 0.00 | 0 | 0 | 0.00 | 0.00 | 0.00 | 0.0 |
| 3.23 | 0.05 | 0 | 2 | 0.00 | 4.45 | 0.05 | 1.5 |
| 6.45 | 0.24 | 0 | 5 | 0.00 | 8.85 | 0.24 | 0.2 |
| 9.68 | 0.59 | 0 | 8 | 0.00 | 13.30 | 0.59 | 0.6 |
| 12.90 | 1.11 | 0 | 10 | 0.00 | 17.70 | 1.11 | 0.2 |
| 16.13 | 1.81 | 5 | 11 | 8.85 | 20.80 | 1.82 | 0.8 |
| 19.35 | 2.70 | 2 | 12 | 4.45 | 26.20 | 2.68 | −0.7 |
| 22.58 | 3.79 | 0 | 13 | 0.00 | 31.00 | 3.80 | 0.4 |
| 25.81 | 5.08 | 5 | 14 | 8.85 | 34.40 | 5.02 | −1.2 |
| 29.03 | 6.58 | 5 | 15 | 8.85 | 39.20 | 6.61 | 0.5 |
| 32.26 | 8.30 | 0 | 16 | 0.00 | 44.10 | 8.26 | −0.5 |
| 35.48 | 10.23 | 0 | 17 | 0.00 | 48.65 | 10.25 | 0.1 |
| 38.71 | 12.39 | 0 | 18 | 0.00 | 53.10 | 12.42 | 0.2 |
| 41.94 | 14.78 | 0 | 19 | 0.00 | 57.50 | 14.80 | 0.1 |
| 45.16 | 17.40 | 0 | 20 | 0.00 | 62.00 | 17.47 | 0.4 |
| 48.39 | 20.25 | 0 | 21 | 0.00 | 66.25 | 20.21 | −0.2 |
| 51.61 | 23.34 | 0 | 22 | 0.00 | 70.85 | 23.43 | 0.4 |
| 54.84 | 26.67 | 0 | 23 | 0.00 | 75.15 | 26.67 | 0.0 |
| 58.06 | 30.24 | 0 | 24 | 0.00 | 79.60 | 30.27 | 0.1 |
| 61.29 | 34.06 | 0 | 25 | 0.00 | 84.00 | 34.07 | 0.0 |
| 64.52 | 38.13 | 0 | 26 | 0.00 | 88.40 | 38.12 | 0.0 |
| 67.74 | 42.45 | 0 | 27 | 0.00 | 93.10 | 42.72 | 0.6 |
| 70.97 | 47.03 | 0 | 28 | 0.00 | 97.00 | 46.76 | −0.6 |
| 74.19 | 51.86 | 12 | 30 | 26.20 | 99.00 | 51.53 | −0.6 |
| 77.42 | 56.95 | 16 | 30 | 44.10 | 99.00 | 57.16 | 0.4 |
| 80.65 | 62.30 | 18 | 31 | 53.10 | 100.00 | 62.42 | 0.2 |
| 83.87 | 67.91 | 21 | 29 | 66.25 | 98.00 | 68.04 | 0.2 |
| 87.10 | 73.79 | 23 | 28 | 75.15 | 97.00 | 73.43 | −0.5 |
| 90.32 | 79.94 | 24 | 31 | 79.60 | 100.00 | 80.27 | 0.4 |
| 93.55 | 86.35 | 26 | 29 | 88.40 | 98.00 | 85.95 | −0.5 |
| 96.77 | 93.04 | 27 | 31 | 93.10 | 100.00 | 92.72 | −0.3 |
| 100.00 | 100.00 | 31 | 31 | 100.00 | 100.00 | 100.00 | 0.0 |

The relationship between the gradation level of the input image signal and the target luminance level of the image display apparatus is represented by the following expression.

$$\text{Target luminance level of the image display apparatus} = (\text{gradation level of the input image signal})^{\gamma} \quad \text{expression (100)}$$

where γ is the gamma luminance characteristic of the image display apparatus (the gamma value set by the switch 21).

The relationship between the gradation levels of the image signals supplied in the first sub frame period and the second sub frame period, and the time-integrated luminance during the first sub frame period and the second sub frame period (perceived brightness) is represented by the following expression.

$$\text{Time-integrated luminance (perceived brightness)} = \{(\text{gradation level in the first sub frame period})^{D\gamma} + (\text{gradation level in the second sub frame period})^{D\gamma}\}/2 \quad \text{expression (101)}$$

where Dγ=2.2 (gamma luminance characteristic of the source drivers).

Figure 62:
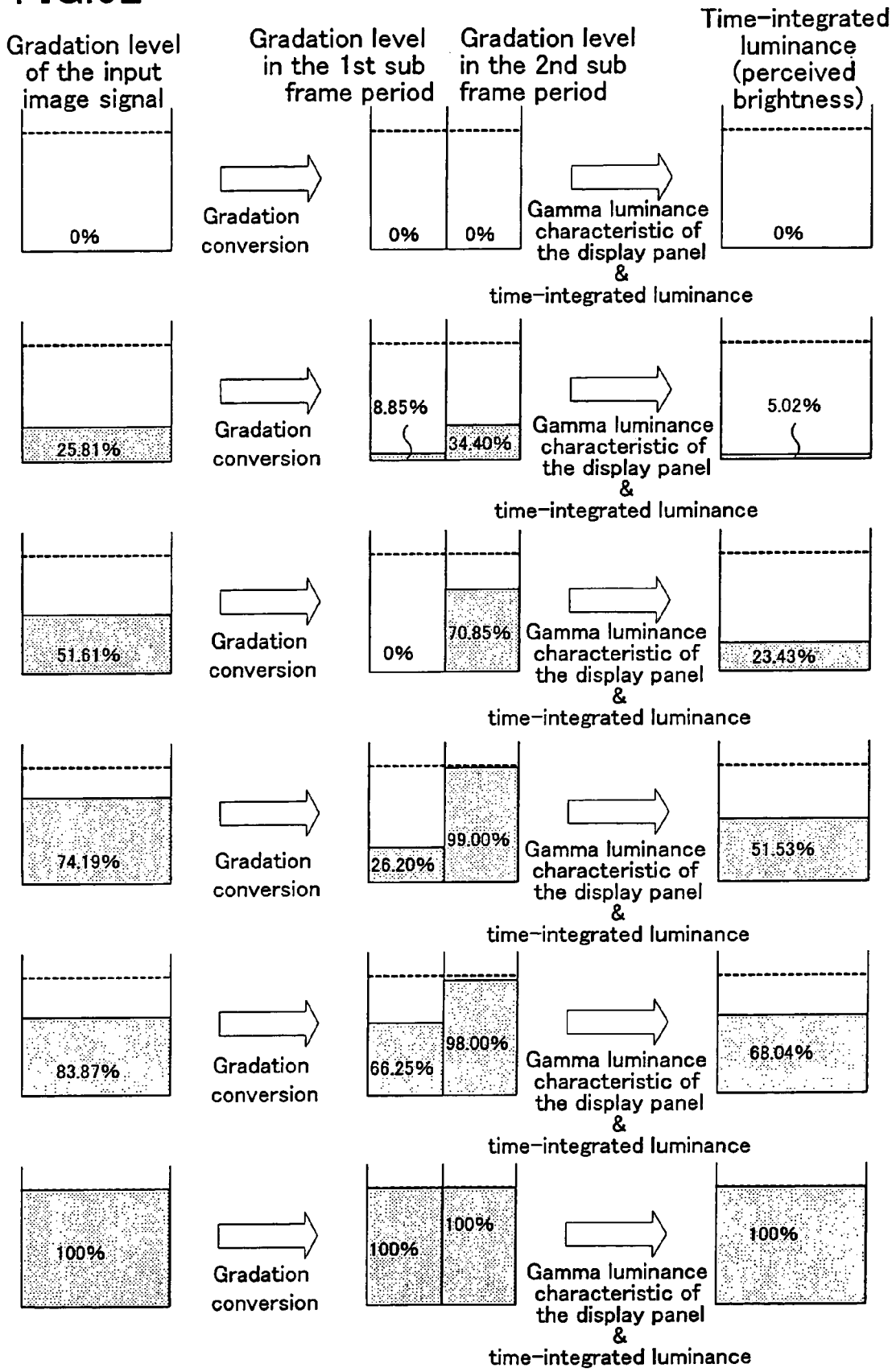
FIG. 62 shows six examples of the relationship between the gradation level of the input image signal, the gradation levels in the first and second sub frame periods, and the perceived brightness, with different target luminance levels.

FIG. 62 shows six examples of the relationship shown in Table 2 with different target luminance levels.

As shown in FIG. 62, when the gradation level of the input image signal is less than 50%, e.g., 25.81, the perceived brightness is determined by the combination of a gradation level which is increased or decreased in accordance with the gradation level of the input image signal (supplied in the second sub frame period) and a gradation level in the vicinity of the minimum gradation level (supplied in the first sub frame period). When the gradation level of the input image signal is 50% or greater, e.g., 74.19% or 83.67%, the perceived brightness is determined by the combination of a gradation level which is increased or decreased in accordance with the gradation level of the input image signal (supplied in the first sub frame period) and a gradation level in the vicinity of the maximum gradation level (supplied in the second sub frame period).

Table 3 shows the above-described correspondence in the look-up table B, and Table 4 shows the above-described correspondence in the look-up table C. In theses cases, the expressions (100) and (101) are obtained. In the look-up table B, γ=2.1. In the look-up table C, γ=2.3.

TABLE 3

Look-up table A (gamma luminance characteristic 2.1)

| Gradation level of the input image signal (%) | Target gradation level of the image display device (%) | Look-up table (output digital data to the source driver) 1st sub frame period | Look-up table (output digital data to the source driver) 2nd sub frame period | Gradation level (%) 1st sub frame period | Gradation level (%) 2nd sub frame period | Time-integrated luminance of one frame period (perceived brightness) | Error (%) |
|---|---|---|---|---|---|---|---|
| 0.00 | 0.00 | 0 | 0 | 0.00 | 0.00 | 0.00 | 0.0 |
| 3.23 | 0.07 | 0 | 3 | 0.00 | 5.15 | 0.07 | −0.7 |
| 6.45 | 0.32 | 0 | 6 | 0.00 | 10.00 | 0.32 | −0.3 |
| 9.68 | 0.74 | 0 | 9 | 0.00 | 14.65 | 0.73 | −1.4 |
| 12.90 | 1.36 | 5 | 10 | 8.85 | 17.70 | 1.35 | −0.6 |
| 16.13 | 2.17 | 8 | 11 | 13.30 | 20.80 | 2.17 | 0.2 |
| 19.35 | 3.18 | 8 | 12 | 13.30 | 26.20 | 3.22 | 1.2 |
| 22.58 | 4.39 | 8 | 13 | 13.30 | 31.00 | 4.39 | 0.0 |
| 25.81 | 5.82 | 10 | 14 | 17.70 | 34.40 | 5.89 | 1.2 |
| 29.03 | 7.45 | 10 | 15 | 17.70 | 39.20 | 7.48 | 0.4 |
| 32.26 | 9.29 | 10 | 16 | 17.70 | 44.10 | 9.36 | 0.8 |
| 35.48 | 11.35 | 10 | 17 | 17.70 | 48.65 | 11.35 | 0.0 |
| 38.71 | 13.63 | 10 | 18 | 17.70 | 53.10 | 13.53 | −0.7 |
| 41.94 | 16.12 | 10 | 19 | 17.70 | 57.50 | 15.91 | −1.3 |
| 45.16 | 18.84 | 10 | 20 | 17.70 | 62.00 | 18.58 | −1.4 |
| 48.39 | 21.77 | 11 | 21 | 20.80 | 66.25 | 21.79 | 0.1 |
| 51.61 | 24.93 | 11 | 22 | 20.80 | 70.85 | 25.01 | 0.3 |
| 54.84 | 28.32 | 11 | 23 | 20.80 | 75.15 | 28.25 | −0.2 |
| 58.06 | 31.93 | 11 | 24 | 20.80 | 79.60 | 31.85 | −0.3 |
| 61.29 | 35.77 | 11 | 25 | 20.80 | 84.00 | 35.65 | −0.3 |
| 64.52 | 39.84 | 11 | 26 | 20.80 | 88.40 | 39.70 | −0.3 |
| 67.74 | 44.14 | 10 | 27 | 17.70 | 93.10 | 43.83 | −0.7 |
| 70.97 | 48.67 | 0 | 30 | 0.00 | 99.00 | 48.91 | 0.5 |
| 74.19 | 53.43 | 15 | 28 | 39.20 | 97.00 | 53.13 | −0.6 |
| 77.42 | 58.42 | 17 | 29 | 48.65 | 98.00 | 58.07 | −0.6 |
| 80.65 | 63.65 | 19 | 30 | 57.50 | 99.00 | 63.71 | 0.1 |
| 83.87 | 69.12 | 21 | 30 | 66.25 | 99.00 | 69.12 | 0.0 |
| 87.10 | 74.82 | 23 | 29 | 75.15 | 98.00 | 74.50 | −0.4 |
| 90.32 | 80.76 | 25 | 28 | 84.00 | 97.00 | 80.83 | 0.1 |
| 93.55 | 86.93 | 26 | 30 | 88.40 | 99.00 | 87.03 | 0.1 |
| 96.77 | 93.35 | 27 | 31 | 93.10 | 100.00 | 92.72 | −0.7 |
| 100.00 | 100.00 | 31 | 31 | 100.00 | 100.00 | 100.00 | 0.0 |

TABLE 4

Look-up table A (gamma luminance characteristic 2.3)

| Gradation level of the input image signal (%) | Target gradation level of the image display device (%) | Look-up table (output digital data to the source driver) 1st sub frame period | Look-up table (output digital data to the source driver) 2nd sub frame period | Gradation level (%) 1st sub frame period | Gradation level (%) 2nd sub frame period | Time-integrated luminance of one frame period (perceived brightness) | Error (%) |
|---|---|---|---|---|---|---|---|
| 0.00 | 0.00 | 0 | 0 | 0.00 | 0.00 | 0.00 | 0.0 |
| 3.23 | 0.04 | 0 | 1 | 0.00 | 3.80 | 0.04 | 1.1 |
| 6.45 | 0.18 | 0 | 4 | 0.00 | 7.80 | 0.18 | −0.2 |
| 9.68 | 0.46 | 3 | 7 | 5.15 | 11.00 | 0.46 | −0.5 |
| 12.90 | 0.90 | 4 | 9 | 7.80 | 14.65 | 0.91 | 1.4 |
| 16.13 | 1.50 | 7 | 10 | 11.00 | 17.70 | 1.50 | −0.5 |
| 19.35 | 2.29 | 9 | 11 | 14.65 | 20.80 | 2.31 | 1.0 |
| 22.58 | 3.26 | 8 | 12 | 13.30 | 26.20 | 3.22 | −1.4 |

TABLE 4-continued

| Look-up table A (gamma luminance characteristic 2.3) | | | | | | | |
|---|---|---|---|---|---|---|---|
| Gradation level of the input image signal (%) | Target gradation level of the image display device (%) | Look-up table (output digital data to the source driver) 1st sub frame period | Look-up table (output digital data to the source driver) 2nd sub frame period | Gradation level (%) 1st sub frame period | Gradation level (%) 2nd sub frame period | Time-integrated luminance of one frame period (perceived brightness) | Error (%) |
| 25.81 | 4.44 | 8 | 13 | 13.30 | 31.00 | 4.39 | −1.0 |
| 29.03 | 5.82 | 10 | 14 | 17.70 | 34.40 | 5.89 | 1.2 |
| 32.26 | 7.41 | 10 | 15 | 17.70 | 39.20 | 7.48 | 0.9 |
| 35.48 | 9.23 | 10 | 16 | 17.70 | 44.10 | 9.36 | 1.5 |
| 38.71 | 11.27 | 10 | 17 | 17.70 | 48.65 | 11.35 | 0.7 |
| 41.94 | 13.55 | 10 | 18 | 17.70 | 53.10 | 13.53 | −0.2 |
| 45.16 | 16.07 | 10 | 19 | 17.70 | 57.50 | 15.91 | −1.0 |
| 48.39 | 18.83 | 11 | 20 | 20.80 | 62.00 | 19.05 | 1.1 |
| 51.61 | 21.84 | 11 | 21 | 20.80 | 66.25 | 21.79 | −0.2 |
| 54.84 | 25.11 | 11 | 22 | 20.80 | 70.85 | 25.01 | −0.4 |
| 58.06 | 28.64 | 11 | 23 | 20.80 | 75.15 | 28.25 | −1.4 |
| 61.29 | 32.43 | 12 | 24 | 26.20 | 79.60 | 32.89 | 1.4 |
| 64.52 | 36.50 | 12 | 25 | 26.20 | 84.00 | 36.70 | 0.6 |
| 67.74 | 40.83 | 12 | 26 | 26.20 | 88.40 | 40.75 | −0.2 |
| 70.97 | 45.44 | 12 | 27 | 26.20 | 93.10 | 45.35 | −0.2 |
| 74.19 | 50.33 | 13 | 28 | 31.00 | 97.00 | 50.56 | 0.5 |
| 77.42 | 55.51 | 16 | 29 | 44.10 | 98.00 | 56.08 | 1.0 |
| 80.65 | 60.97 | 19 | 28 | 57.50 | 97.00 | 61.56 | 1.0 |
| 83.87 | 66.73 | 21 | 28 | 66.25 | 97.00 | 66.97 | 0.4 |
| 87.10 | 72.78 | 23 | 28 | 75.15 | 97.00 | 73.43 | 0.9 |
| 90.32 | 79.13 | 24 | 30 | 79.60 | 99.00 | 79.17 | 0.1 |
| 93.55 | 85.78 | 26 | 29 | 88.40 | 98.00 | 85.95 | 0.2 |
| 96.77 | 92.74 | 27 | 31 | 93.10 | 100.00 | 92.72 | 0.0 |
| 100.00 | 100.00 | 31 | 31 | 100.00 | 100.00 | 100.00 | 0.0 |

The data in the look-up tables used in Example 9 is selected such that the error with respect to the gamma luminance characteristic set for the image display apparatus is within ±1.5%.

Figure 63:
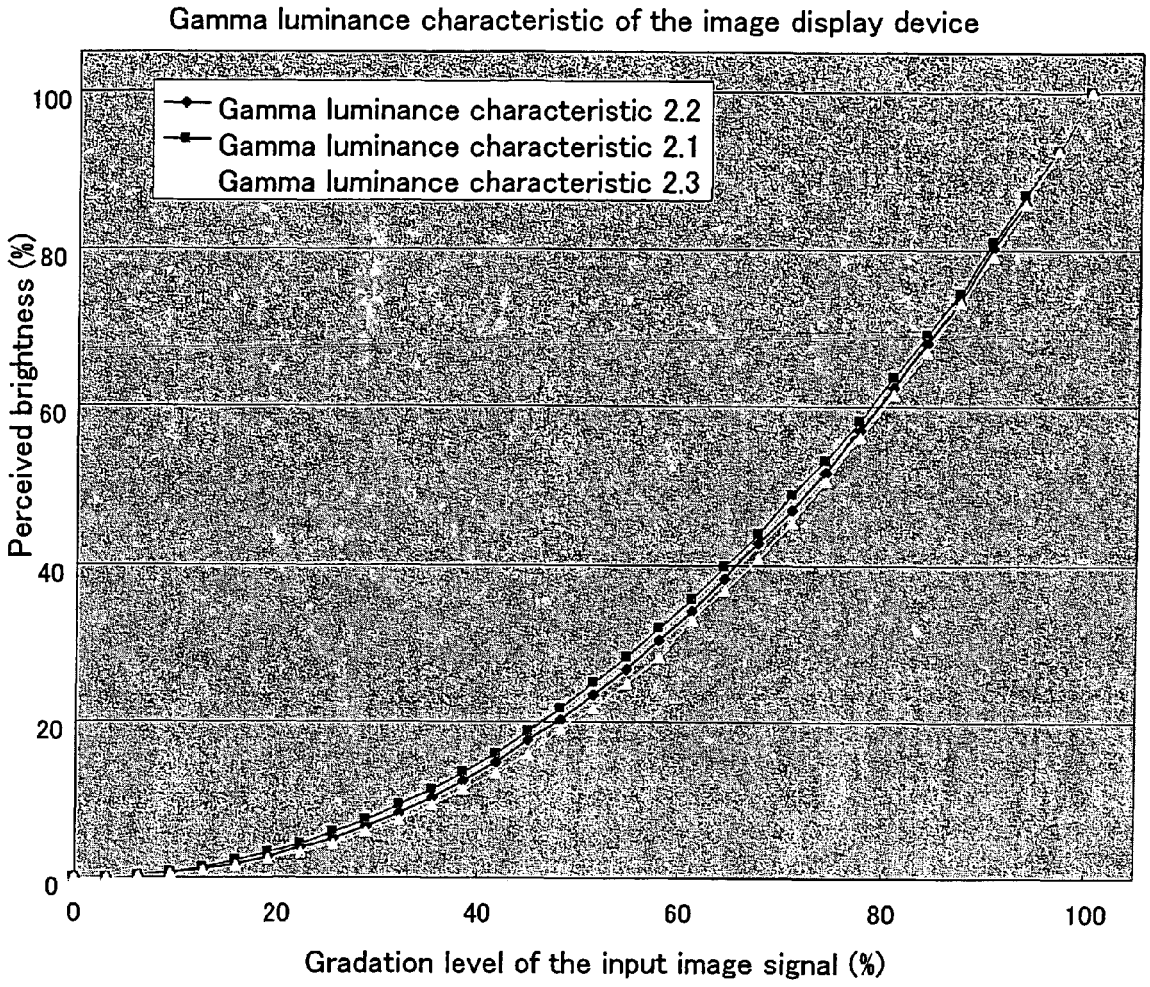
FIG. 63 is a graph illustrating the relationship between the gradation level of the input image signal and the time-integrated luminance during the first and second sub frame periods (perceived brightness) when the look-up tables A through C are used.

FIG. 63 is a graph illustrating the relationship between the gradation level of the input image signal and the time-integrated luminance during the first and second sub frame periods (perceived brightness) when the look-up tables A through C are used.

As described above, in Example 9, the gradation level of the image signal is converted by the first gradation conversion circuit 44E such that: when the gradation level of the input image signal is equal to or less than a threshold level uniquely determined, an image signal of a gradation level, which is increased or decreased in accordance with the gradation level of the input image signal, is supplied; and when the gradation level of the input image signal is greater than the threshold level, an image signal of a gradation level in the vicinity of the maximum gradation level is supplied. The gradation level of the image signal is converted by the second gradation conversion circuit 45E such that: when the gradation level of the input image signal is equal to or less than a threshold level uniquely determined, an image signal of a gradation level in the vicinity of the minimum gradation level is supplied; and when the gradation level of the input image signal is greater than the threshold level, an image signal of a gradation level, which is increased or decreased in accordance with the gradation level of the input image signal, is supplied. With such setting, the gamma luminance characteristic of the image display apparatus can be changed. In other words, the gradation levels in the first and second sub frame periods are appropriately combined, so that the gamma luminance characteristic of the image display apparatus can be changed while alleviating the movement blur to improve the quality of moving images of a hold-type image display apparatus, without reducing the maximum value of the time-integrated luminance in any given one frame period.

In Example 9, the gamma luminance characteristic of the image display apparatus is changed by supplying an image signal of a gradation level which is increased or decreased by the gradation level of the input image signal, and an image signal of a gradation level in the vicinity of the minimum gradation level, respectively to the two sub frame periods, or by supplying an image signal of a gradation level in the vicinity of the maximum gradation level, and an image signal of a gradation level which is increased or decreased by the gradation level of the input image signal, respectively to the two sub frame periods. Thus, the brightness perceived during one frame period is controlled. The image display apparatus in Example 9 is also usable for other purposes, for example, for correcting the temperature of the liquid crystal display panel, or for correcting the gradation level which is necessitated when use of a different liquid crystal material changes the V-T characteristic.

Example 10

In Examples 1 through 9, the image display control section of an image display apparatus is provided by hardware, i.e., a controller LSI. In Example 10, the image display control section of the image display apparatus is provided by software.

Figure 64:
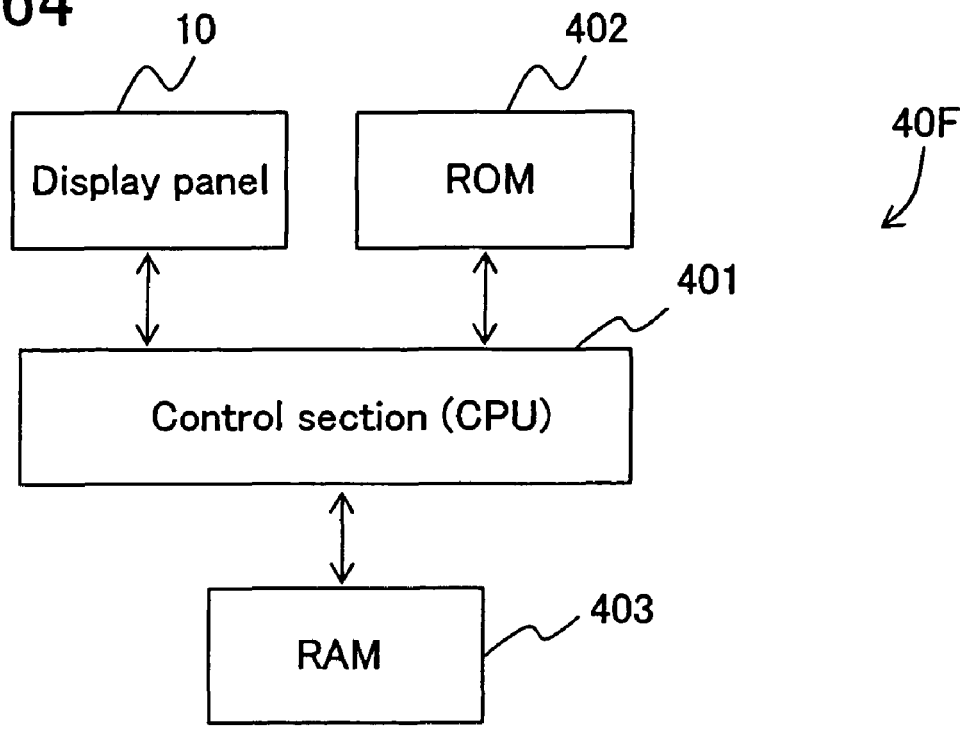
FIG. 64 is a block diagram of a structure of an image display control section provided by a computer in Example 10 according to the present invention.

FIG. 64 is a block diagram of a structure of an image display control section 40F provided by a computer.

As shown in FIG. 64, the image display control section 40F includes a CPU (central processing unit) 401 (control section), a ROM 402 as a computer-readable medium which stores a display control program for executing the image display method described in each of Examples 1 through 9 by a computer and data used for the display control, and a RAM 403 used as a work memory of the CPU 401.

Usable computer-readable mediums include memory devices, for example, various types of IC memories, hard discs (HDs), optical discs (e.g., CDs), and magnetic recording mediums (e.g., FDs). The display control program and data stored in the ROM 402 is transferred to the RAM 403, and executed by the CPU 401.

For displaying an image corresponding to one frame period, the CPU 401 repeats the following processing using the corresponding section, based on the display control program and data according to the present invention.

In a sub frame period which is at the center or which is closest to the center of one frame period in terms of time, an image signal of the maximum gradation level within the range, in which the sum of time-integrated luminance levels in the n sub frame periods does not exceed the luminance level of the input image signal, is supplied to the display panel 10. (The sub frame period which is at the center or which is closest to the center of one frame period in terms of time will be referred to as the "central sub frame period".)

When the sum of time-integrated luminance levels in the central sub frame period does not reach the luminance level of the input image signal, an image signal of the maximum gradation level within the range, in which the sum of time-integrated luminance levels in the n sub frame periods does not exceed the luminance level of the input image signal, is supplied to the display panel 10 in each of the sub frame periods before and after the central sub frame period. (The sub frame period before the central sub frame period will be referred to as the "preceding sub frame period", and the sub frame period after the central sub frame period will be referred to as the "subsequent sub frame period".)

When the sum of time-integrated luminance levels in the central sub frame period, the preceding sub frame period and the subsequent sub frame period still does not reach the luminance level of the input image signal, an image signal of the maximum gradation level within the range, in which the sum of time-integrated luminance levels in the n sub frame periods does not exceed the luminance level of the input image signal, is supplied to the display panel 10 in each of the sub frame period before the preceding sub frame period and the sub frame period after the subsequent sub frame period.

Such an operation is repeated until the sum of time-integrated luminance levels in all the sub frame periods in which the image signals have been supplied reaches the luminance level of the input image signal. When this occurs, an image signal of the minimum gradation level or an image signal of a gradation level less than a prescribed value is supplied to the display panel 10 in the remaining sub frame period(s).

Alternatively, for displaying an image corresponding to one frame period by the sum of time-integrated values of luminance during n sub frame periods, the CPU 401 repeats the following process using the corresponding section, based on the display control program and data according to the present invention.

The n sub frame periods are referred to as the first sub frame period, the second sub frame period, . . . the n'th sub frame period from the sub frame period which is earliest in terms of time or from the sub frame period which is latest in terms of time. Two sub frame periods which are closest to the center in terms of time are referred to as the "m1st sub frame period" and the "m2nd sub frame period". The mist sub frame period is set to n/2, and the m2nd sub frame period is set to n/2+1. n/2-number of threshold levels are provided and referred to as T1, T2, . . . T[n/2] from the smallest threshold level.

When the gradation level of the input image signal is T1 or less, an image signal of a gradation level which is increased or decreased in accordance with the gradation level of the input image signal is supplied to the display panel 10 in each of the mist sub frame period and the m2nd sub frame period, and an image signal of the minimum gradation level or an image signal of a gradation level less than a prescribed value is supplied to the display panel 10 in the other sub frame periods.

When the gradation level of the input image signal is greater than T1 and equal to or less than T2, an image signal of the maximum gradation level or an image signal of a gradation level which is greater than the prescribed value is supplied to the display panel 10 in each of the mist sub frame periods and the m2nd sub frame periods, an image signal of a gradation level which is increased or decreased in accordance with the gradation level of the input image signal is supplied to the display panel 10 in each of the (m1−1)'th sub frame periods and the (m2+1)'th sub frame periods, and an image signal of the minimum gradation level or an image signal of a gradation level less than the prescribed value is supplied to the display panel 10 in the other sub frame periods.

When the gradation level of the input image signal is greater than T2 and equal to or less than T3, an image signal of the maximum gradation level or an image signal of a gradation level greater than the prescribed value is supplied to the display panel 10 in each of the mist sub frame periods, the m2nd sub frame periods, the (m1−1)'th sub frame period and the (m2+1)'th sub frame period, an image signal of a gradation level which is increased or decreased in accordance with the gradation level of the input image signal is supplied to the display panel 10 in each of the (m1−2)'th sub frame periods and the (m2+2)'th sub frame periods, and an image signal of the minimum gradation level or an image signal of a gradation level less than the prescribed value is supplied to the display panel 10 in the other sub frame periods.

In this manner, when the gradation level of the input image signal is greater than Tx−1 (x is an integer of 4 or greater) and equal to or less than Tx, an image signal of the maximum gradation level or an image signal of a gradation level greater than the prescribed value is supplied to the display panel 10 in each of the [m1−(x−2)]'th sub frame periods through the [m2+(x−2)]'th sub frame period, an image signal of a gradation level which is increased or decreased in accordance with the gradation level of the input image signal is supplied in each of the [m1−(x−1)]'th sub frame periods through the [m2+(x−1)]'th sub frame period, and an image signal of the minimum gradation level or an image signal of a gradation level less than the prescribed value is supplied to the display panel 10 in the other sub frame periods.

Alternatively, for displaying an image corresponding to one frame period by the sum of time-integrated values of luminance during two sub frame periods, the CPU 401 repeats the following process using the corresponding section, based on the display control program and data according to the present invention.

One of the two sub frame periods is referred to as the sub frame period α, and the other sub frame period is referred to as the sub frame period β. When the gradation level of the input image signal is equal to or less than the threshold level uniquely determined, an image signal of a gradation level which is increased or decreased in accordance with the gradation level of the input image signal is supplied to the display panel 10 in the sub frame period α, and an image signal of the minimum gradation level or an image signal of a gradation level less than a prescribed value is supplied to the display panel 10 in the sub frame period β.

When the gradation level of the input image signal is greater than the threshold level, an image signal of the maximum gradation level or an image signal of a gradation level greater than the prescribed value is supplied to the display panel in the sub frame period α, and an image signal of a gradation level which is increased or decreased by the gradation level of the input image signal is supplied to the display panel 10 in the sub frame period β.

Alternatively, for displaying an image corresponding to one frame period by the sum of time-integrated values of luminance during two sub frame periods, the CPU 401 repeats the following processing using the corresponding section, based on the display control program and data according to the present invention.

One of the two sub frame periods is referred to as the sub frame period α, and the other sub frame period is referred to as the sub frame period β. Threshold levels T1 and T2 of the gradation level in the two sub frame periods are defined. The threshold level T2 is larger than the threshold level T1.

When the gradation level of the input image signal is the threshold level T1 or less, an image signal of a gradation level which is increased or decreased in accordance with the gradation level of the input image signal is supplied to the display panel 10 in the sub frame period α, and an image signal of the minimum gradation level or an image signal of a gradation level less than a prescribed value is supplied to the display panel 10 in the sub frame period β.

When the gradation level of the input image signal is greater than the threshold level T1 and equal to or less than the threshold level T2, an image signal of a gradation level which is increased or decreased in accordance with the gradation level of the input image signal is supplied to the display panel 10 in the sub frame period α, and an image signal of a gradation level which is increased or decreased in accordance with the gradation level of the input image signal and which is lower than the gradation level supplied in the sub frame period α is supplied to the display panel 10 in the sub frame period β.

When the gradation level of the input image signal is greater than the threshold level T2, an image signal of the maximum gradation level or an image signal of a gradation level greater than the prescribed value is supplied to the display panel 10 in the sub frame period α, and an image signal of a gradation level which is increased or decreased in accordance with the gradation level of the input image signal is supplied to the display panel 10 in the sub frame period β.

Alternatively, for displaying an image corresponding to one frame period by the sum of time-integrated values of luminance during two sub frame periods, the CPU 401 repeats the following process using the corresponding section, based on the display control program and data according to the present invention.

One of the two sub frame periods is referred to as the sub frame period α, and the other sub frame period is referred to as the sub frame period β. Threshold levels T1 and T2 of the gradation level in the two sub frame periods are defined. The threshold level T2 is larger than the threshold level T1. A gradation level L is uniquely to be defined.

When the gradation level of the input image signal is the threshold level T1 or less, an image signal of a gradation level, which is increased or decreased in accordance with the gradation level of the input image signal, is supplied to the display panel 10 in the sub frame period α, and an image signal of the minimum gradation level or an image signal of a gradation level less than a prescribed value is supplied to the display panel 10 in the sub frame period β.

When the gradation level of the input image signal is greater than the threshold level T1 and equal to or less than the threshold level T2, an image signal of the gradation level L is supplied to the display panel 10 in the sub frame period α, and an image signal of a gradation level, which is increased or decreased in accordance with the gradation level of the input image signal, is supplied to the display panel 10 in the sub frame period β.

When the gradation level of the input image signal is greater than the threshold level T2, an image signal of a gradation level which is increased or decreased in accordance with the gradation level of the input image signal is supplied to the display panel 10 in the sub frame period α, and an image signal of the maximum gradation level or an image signal of a gradation level greater than the prescribed value is supplied to the display panel 10 in the sub frame period β.

Alternatively, for displaying an image corresponding to one frame period by the sum of time-integrated values of luminance during two sub frame periods, the CPU 401 repeats the following process using the corresponding section, based on the display control program and data according to the present invention.

One of the two sub frame periods is referred to as the sub frame period α, and the other sub frame period is referred to as the sub frame period β.

Based on two frames of image continuously input, an image in an intermediate state in terms of time is generated through estimation.

When the gradation level of the input image signal is equal to or less than a threshold level uniquely determined, an image signal of a gradation level, which is increased or decreased in accordance with the gradation level of the input image signal, is supplied to the display panel 10 in the sub frame period α. When the gradation level of the input image signal is greater than the threshold level, an image signal of the maximum gradation level or an image signal of a gradation level greater than a prescribed value is supplied to the display panel 10 in the sub frame period α.

When the gradation level of the image signal in the intermediate state is equal to or less than the threshold level, an image signal of the minimum gradation level or an image signal of a gradation level less than the prescribed value is supplied to the display panel 10 in the sub frame period β. When the gradation level of the image signal in the intermediate state is greater than the threshold level, an image signal of a gradation level, which is increased or decreased in accordance with the gradation level of the image signal in the intermediate state, is supplied to the display panel 10 in the sub frame period β.

Alternatively, for displaying an image corresponding to one frame period by the sum of time-integrated values of luminance during two sub frame periods, the CPU 401 repeats the following process using the corresponding section, based on the display control program and data according to the present invention.

One of the two sub frame periods is referred to as the sub frame period α, and the other sub frame period is referred to as the sub frame period β.

When the gradation level of the input image signal is equal to or less than a threshold level uniquely determined, an image signal of a gradation level, which is increased or decreased in accordance with the gradation level of the input image signal, is supplied to the display panel 10 in the sub frame period α. When the gradation level of the input image signal is greater than the threshold level, an image signal of the maximum gradation level or an image signal of a gradation level greater than a prescribed value is supplied to the display panel 10 in the sub frame period α.

When an average value of the gradation level of the image signal in the current frame period and the gradation level of an image signal input one frame before or one frame after is equal to or less than the threshold level, an image signal of the minimum gradation level or an image signal of a gradation level less than the prescribed value is supplied to the display panel 10 in the sub frame period β. When such an average value is greater than the threshold level, an image signal of a gradation level, which is increased or decreased in accordance with the average value, is supplied to the display panel 10 in the sub frame period β.

With the above-described execution, the movement blur of moving images can be suppressed while suppressing the reduction in the maximum luminance or contrast.

Example 11

In Example 11 of the present invention, a liquid crystal TV using the image display apparatus and the image display method described in any of Examples 1 through 10 will be described.

Figure 65:
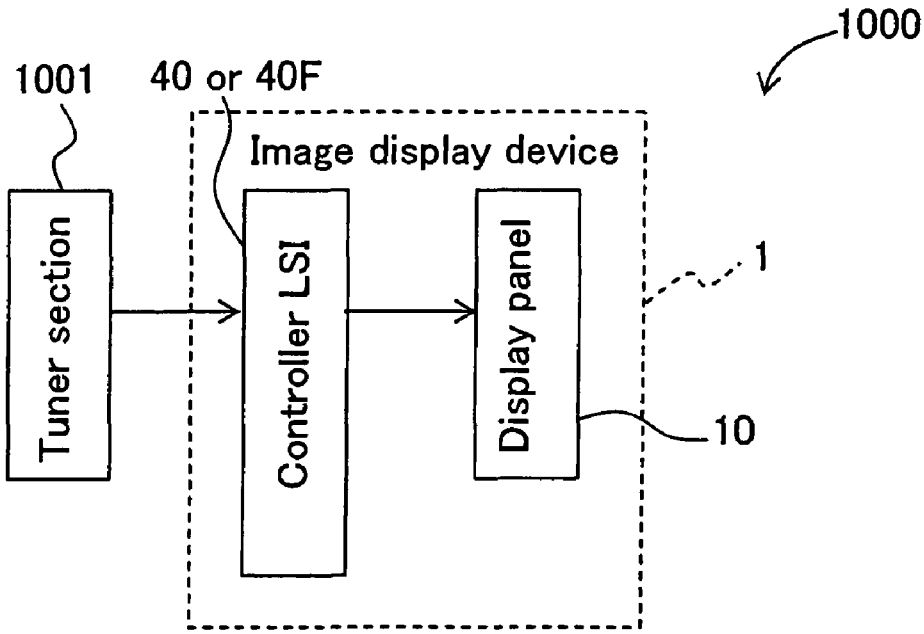
FIG. 65 is a block diagram of a structure of a liquid crystal TV in Example 11, using an image display apparatus according to the present invention.

FIG. 65 is a block diagram of a structure of a liquid crystal TV 1000 in Example 11.

As shown in FIG. 65, the liquid crystal TV 1000 includes an image display apparatus 1 which is described in any of Examples 1 through 10, and a tuner section 1001 for selecting a channel of TV broadcast signal. The TV broadcast signal of the channel selected by the tuner section 1001 is input to the controller LSI 40 of the image display apparatus 1 as an image signal.

With such a structure, the liquid crystal TV 1000 displays high quality images with the movement blur of moving images being suppressed while suppressing the reduction in the maximum luminance or contrast.

Example 12

In Example 12 of the present invention, a liquid crystal monitoring apparatus using the image display apparatus and the image display method described in any of Examples 1 through 10 will be described.

Figure 66:
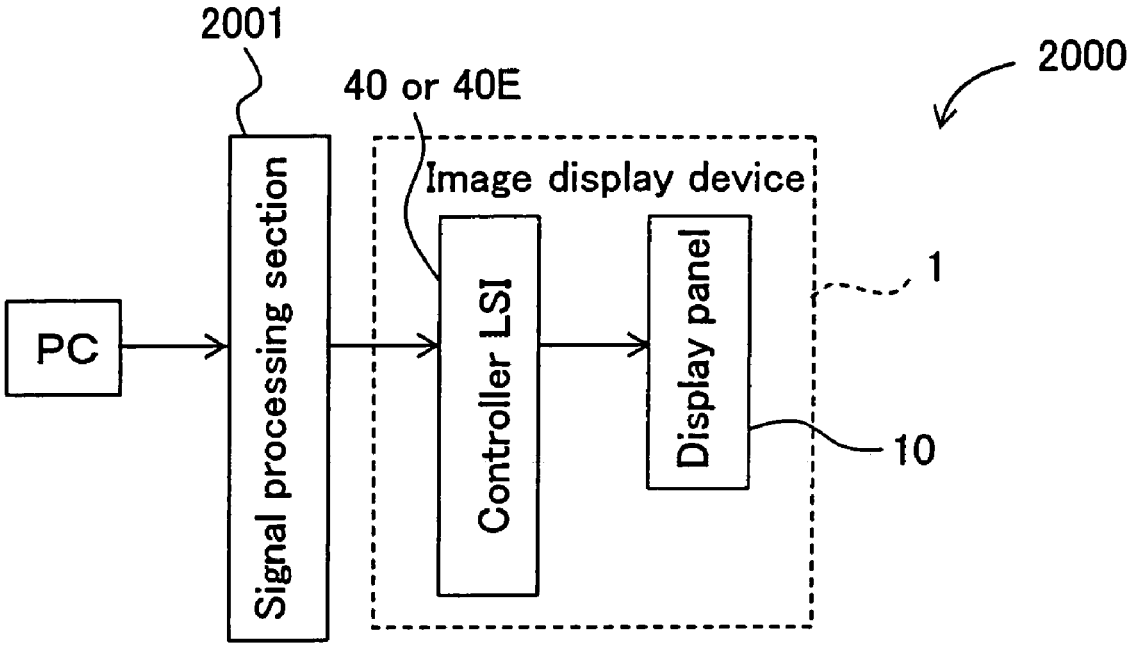
FIG. 66 is a block diagram of a structure of a liquid crystal monitoring apparatus in Example 12, using an image display apparatus according to the present invention.

FIG. 66 is a block diagram of a structure of a liquid crystal monitoring apparatus 2000 in Example 12.

As shown in FIG. 66, the liquid crystal monitoring apparatus 2000 includes an image display apparatus 1 which is described in any of Examples 1 through 10, and a signal processing section 2001 for processing a monitor signal from a personal computer (PC) or other external devices. The monitor signal from the signal processing section 2001 is input to the controller LSI 40 of the image display apparatus 1 as an image signal.

With such a structure, the liquid crystal monitoring apparatus 2000 displays high quality images with the movement blur of moving images being suppressed while suppressing the reduction in the maximum luminance or contrast.

In Example 1, the display control is performed on each of the pixel portions on the screen. Also in Examples 2 through 9, the display control is performed on each of the pixel portions on the screen.

In Examples 1 through 12, in the case where there are three or more sub frame periods, the gradation level allocated to the central sub frame period in one frame period is higher than the gradation levels allocated to the other sub frame periods. The luminance level allocated to the central sub frame period in one frame period is higher than the luminance levels allocated to the other sub frame periods. The center of gravity of the time-integrated luminance during a plurality of sub frame periods moves within one frame period.

In Examples 1 through 12, the display control is performed with one frame period being divided into two or three sub frame periods. The present invention is not limited to this, but is applicable to display control performed with one frame period being divided into a plurality of (integer of 2 or greater) sub frame periods. Hereinafter, various methods for allocating the luminance level assumed for the input image signal to the plurality of sub frame periods will be described. The gradation levels supplied in the sub frame periods are adjusted so as to realize the luminance level assumed for the input image signal.

In the following description, for the sake of clarity, the gradation level of the input image signal is allocated such that the gradation level is gradually increased to a prescribed level. According to the present invention, the allocation is actually performed instantaneously by, for example, calculation or conversion using a look-up table or the like, based on the above manner of allocation in accordance with the gradation level of the input image signal.

FIGS. 67 through 71 are conceptual views illustrating various methods for allocating the luminance level assumed for the input image signal to a plurality of sub frame periods in an image display apparatus according to the present invention. In FIGS. 67 through 71, one frame includes a plurality of sub frame periods. Each strip shape represents a sub frame period. The luminance level is being allocated to the sub frame periods represented with dotted areas, and the luminance level allocated to the sub frame periods represented with hatching has been determined.

Figure 67:
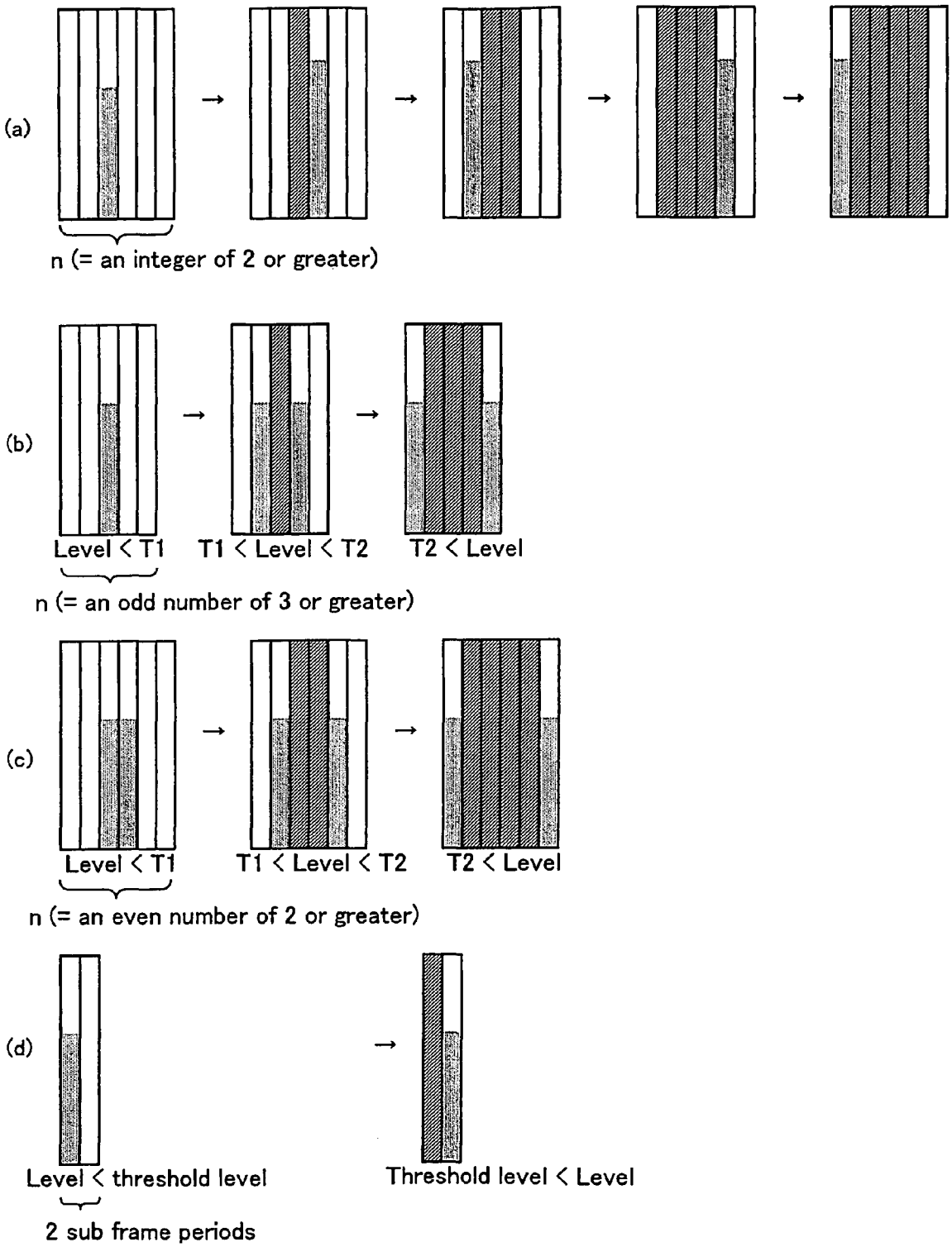
FIGS. 67(*a*) through (*d*), FIGS. 68(*e*) through (*h*), FIGS. 69(*i*) through (*l*), FIGS. 70(*m*) through (*p*), and FIGS. 71(*q*) through (*s*) show conceptual views of sub frame periods, which illustrate exemplary methods for allocating the luminance level assumed for the input image signal to the sub frame periods in an image display apparatus according to the present invention.

In FIG. 67(*a*), one frame is divided into n sub frame periods, where "n" is an integer of 2 or greater. "n" includes odd numbers, but in this example, one frame is divided into 6 sub frame periods. As shown in the leftmost part of FIG. 67(*a*), the luminance level assumed for the input image signal is allocated, starting from the sub frame period which is at the time-wise center, or closest to the time-wise center, of one frame period for image display (as represented by dots). (In this example, the allocation of the luminance level is started from the left one of the two sub frame periods closest to the time-wise center, but the allocation may be started from the right one of the two sub frame periods closest to the time-wise center.) As shown in the second-from-the-left part of FIG. 67(*a*), when the sub frame period is filled with the luminance level (as represented by hatching), the luminance level is allocated to the right one of the two sub frame periods closest to the time-wise center (as represented by dots). As shown in the central part of FIG. 67(*a*), when the sub frame period is filled with the luminance level (as represented by hatching), the luminance level is allocated to the sub frame period which is to the left of the left one of the two sub frame periods closest to the time-wise center (as represented by dots). As shown in the second-from-the-right part of FIG. 67(*a*), when the sub frame period is filled with the luminance level (as represented by hatching), the luminance level is allocated to the sub frame period which is to the right of the right one of the two sub frame periods closest to the time-wise center (as represented by dots). Such an operation is repeated, so as to allocate the luminance level assumed to the input image signal to the sub frame periods. The remaining luminance level is allocated to the remaining sub frame period(s), such that the allocated luminance level is equal to the total luminance level assumed to the input image signal. Thus, the allocation is completed.

In FIG. 67(*b*), one frame is divided into n sub frame periods, where "n" is an odd number of 3 or greater. In this example, one frame is divided into 5 sub frame periods. As shown in the left part of FIG. 67(*b*), the luminance level assumed for the input image signal is allocated, starting from the sub frame period which is at the time-wise center of one frame period (the third from the left in this example) for image display (as represented by dots). A reference value for allocating the gradation level, corresponding to the luminance level assumed for the input image signal, to the sub frame periods is a threshold level (described in more detail below). At this point, the gradation level of the input image signal<the threshold level T1. As shown in the central part of FIG. 67(*b*), when the central sub frame period is filled with the luminance level (as represented by hatching; the threshold level T1), the luminance level is simultaneously allocated to the sub frame period to the right of the central sub frame period and the sub frame period to the left of the central sub frame period (as represented by dots). At this point, the threshold level T1<the gradation level of the input image signal<the threshold level T2. As shown in the right part of FIG. 67(*b*), when these sub frame periods are filled with the luminance level (as represented by hatching; the threshold level T2), the luminance level is allocated to the sub frame period which is to the left of these sub frame periods and the sub frame period which is to the right of these sub frame periods (as represented by dots). At this point, the threshold level T2<the gradation level of the input image signal. Such an operation is repeated. More specifically, the gradation level corresponding to the luminance level allocated until the central sub frame period is filled with the luminance level is the threshold level T1. The gradation level corresponding to the luminance level allocated until the sub frame periods to the left and to the right of the central sub frame period are filled with the luminance level is the threshold level T2. As the number of sub frame periods is increased, the number of the threshold levels is also increased. By providing the threshold levels T1 and T2, determinations regarding the control can be quickly made when allocating the luminance level.

In FIG. 67(*c*), one frame is divided into n sub frame periods, where "n" is an even number of 2 or greater. In this example, one frame is divided into 6 sub frame periods. As shown in the left part of FIG. 67(*c*), the luminance level assumed for the input image signal is allocated, starting simultaneously from two sub frame periods which are at the time-wise center of one frame period (the third and fourth from the left in this example) for image display (as represented by dots). At this point, the gradation level of the input image signal<the threshold level T1. As shown in the central part of FIG. 67(*c*), when these central sub frame periods are filled with the luminance level (as represented by hatching; the threshold level T1), the luminance level is simultaneously allocated to the sub frame periods to the right and to the left of these central sub frame periods (the second and fifth in this example; as represented by dots). At this point, the threshold level T1<the gradation level of the input image signal<the threshold level T2. As shown in the right part of FIG. 67(*c*), when these sub frame periods are filled with the luminance level (as represented by hatching; the threshold level T2), the luminance level is allocated to the sub frame periods which are to the left and to the right of these sub frame periods (the leftmost and rightmost sub frame periods in this example; (as represented by dots). At this point, the threshold level T2<the gradation level of the input image signal. Such an operation is repeated.

In FIG. 67(*d*), one frame is divided into two sub frame periods. A reference value for allocating the gradation level, corresponding to the luminance level assumed for the input image signal, to the sub frame periods is the threshold level T (described in more detail below). As shown in the left part of FIG. 67(*d*), the luminance level assumed for the input image signal is allocated, starting from one of the two sub frame periods (left in this example; as represented by dots). At this point, the gradation level of the input image signal<the threshold level T. As shown in the right part of FIG. 67(*d*), when the left sub frame period is filled with the luminance level (as represented by hatching; the threshold level T), the luminance level is allocated to the right sub frame period (as represented by dots). At this point, the threshold level T<the gradation level of the input image signal. The gradation level corresponding to the luminance level which can be allocated to one of the sub frame periods is the threshold level T.

Figure 68:
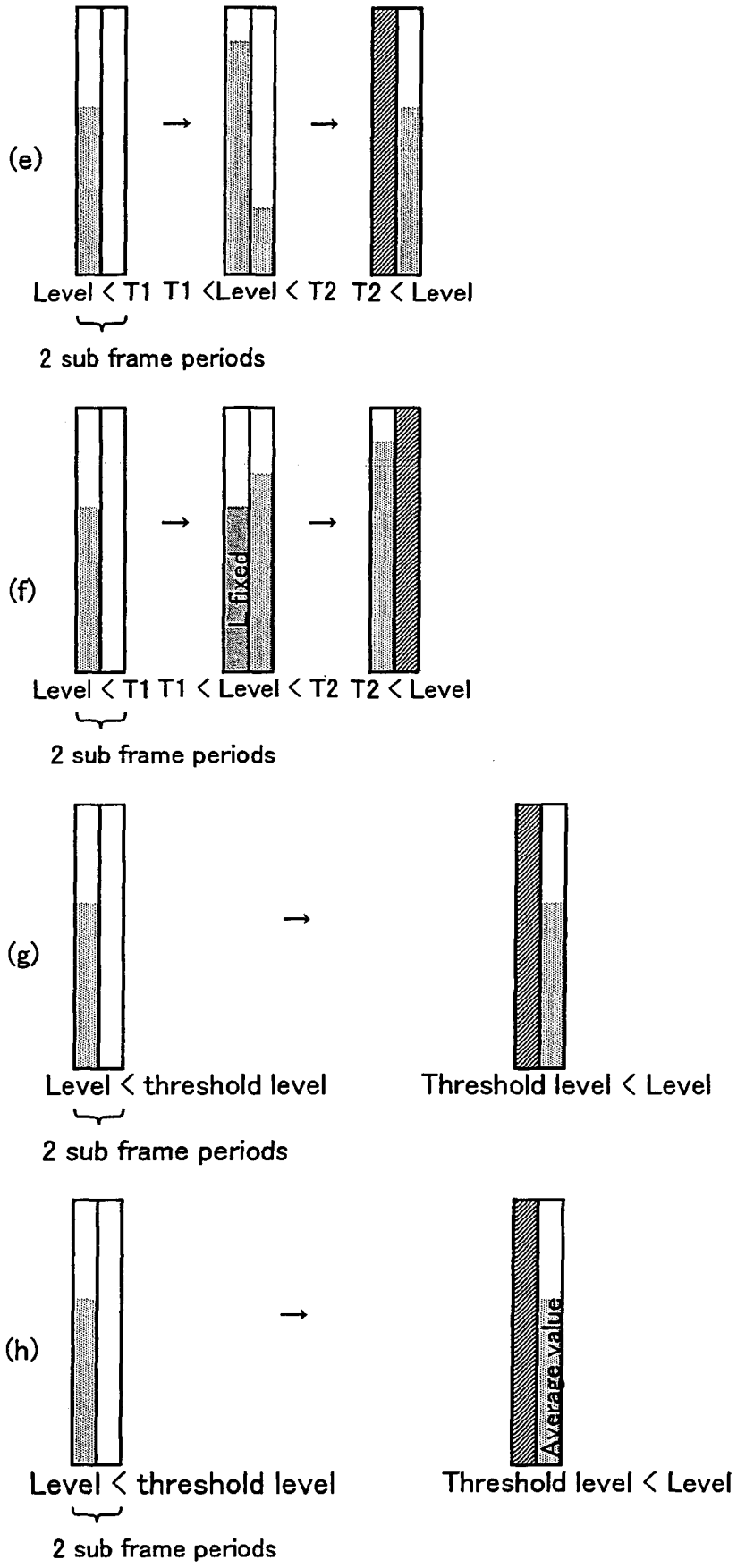

In FIG. 68(*e*), one frame is divided into two sub frame periods. Reference values for allocating the gradation level, corresponding to the luminance level assumed for the input image signal, to the sub frame periods are the threshold levels T1 and T2. As shown in the left part of FIG. 68(*e*), the luminance level assumed for the input image signal is allocated, starting from one of the two sub frame periods (left in this example; as represented by dots). At this point, the gradation level of the input image signal<the threshold level T1. As shown in the central part of FIG. 68(*e*), when the gradation level corresponding to the luminance level assumed for the input image signal reaches the threshold level T1 in the left sub frame period, the luminance level is also allocated to the right sub frame period (as represented by dots) as well as to the left sub frame period. At this point, the threshold level T1<the gradation level of the input image signal<the threshold level T2. As shown in the right part of FIG. 68(*e*), when the gradation level corresponding to the luminance level assumed for the input image signal reaches the threshold level T2 in the left sub frame period, the remaining luminance level is allocated to the right sub frame period (as represented by dots), and the allocation is completed. At this point, the threshold level T2<the gradation level of the input image signal.

In FIG. 68(*f*), one frame is divided into two sub frame periods. Reference values for allocating the gradation level, corresponding to the luminance level assumed for the input image signal, to the sub frame periods are the threshold levels T1 and T2. As shown in the left part of FIG. 68(*f*), the luminance level assumed for the input image signal is allocated, starting from one of the two sub frame periods (left in this example; as represented by dots). At this point, the gradation level of the input image signal<the threshold level T1. As shown in the central part of FIG. 68(*f*), when the gradation level corresponding to the luminance level assumed for the input image signal reaches the threshold level T1 in the left sub frame period, the luminance level allocated to the left sub frame period is temporarily fixed (i.e., the allocation is paused), and the luminance level assumed for the input image signal is allocated to the other sub frame period (right in this example; as represented by dots). At this point, the threshold level T1<the gradation level of the input image signal<the threshold level T2. As shown in the right part of FIG. 68(*f*), when the gradation level corresponding to the luminance level assumed for the input image signal reaches the threshold level T2 in the right sub frame period, the luminance level allocated to the left sub frame period is released from the fixed state, and the remaining luminance level is allocated to the left sub frame period (as represented by dots). Thus, the allocation is completed. At this point, the threshold level T2<the gradation level of the input image signal. In this manner, the center of gravity of luminance is averaged.

In FIG. 68(*g*), one frame is divided into two sub frame periods. A reference value for allocating the gradation level, corresponding to the luminance level assumed for the input image signal, to the sub frame periods is the threshold level T. As shown in the left part of FIG. 68(*g*), the luminance level assumed for the input image signal is allocated, starting from one of the two sub frame periods (left in this example; as represented by dots). At this point, the gradation level of the input image signal<the threshold level T. As shown in the right part of FIG. 68(*g*), when the gradation level corresponding to the luminance level assumed for the input image signal reaches the threshold level T in the left sub frame period, the luminance level to the left sub frame period is made maximum, while a luminance level is allocated to the right sub frame period in consideration of the image state of the next one frame. More specifically, it is checked if there is a difference between the image currently input and the image which is to be input next (i.e., the movement). When there is a difference, the remaining luminance level is allocated to the right sub frame period, such that the luminance level of the right sub frame period is the luminance level assumed for an input image signal in an intermediate state in terms of time between the image currently input and the image which is to be input next (i.e., the image between the two images is estimated). Then, the left sub frame period is filled with the luminance level (the threshold level T). At this point, the threshold level T<the gradation level of the input image signal. In this manner, the generation of pseudo profiles is suppressed.

In FIG. 68(*h*), one frame is divided into two sub frame periods. A reference value for allocating the gradation level, corresponding to the luminance level assumed for the input image signal, to the sub frame periods is the threshold level T. As shown in the left part of FIG. 68(*h*), the luminance level assumed for the input image signal is allocated, starting from one of the two sub frame periods (left in this example; as represented by dots). At this point, the gradation level of the input image signal<the threshold level T. As shown in the right part of FIG. 68(*h*), when the gradation level corresponding to the luminance level assumed for the input image signal reaches the threshold level T in the left sub frame period, the luminance level allocated to the left sub frame period is made maximum. Concurrently, an average value of the image currently input and the image which is to be input next is calculated, and the remaining luminance level assumed for an input image signal of the average value is allocated to the other sub frame period (right in this example). Then, the left sub frame period is filled with the luminance level (the threshold level T). At this point, the threshold level T<the gradation level of the input image signal.

Figure 69:
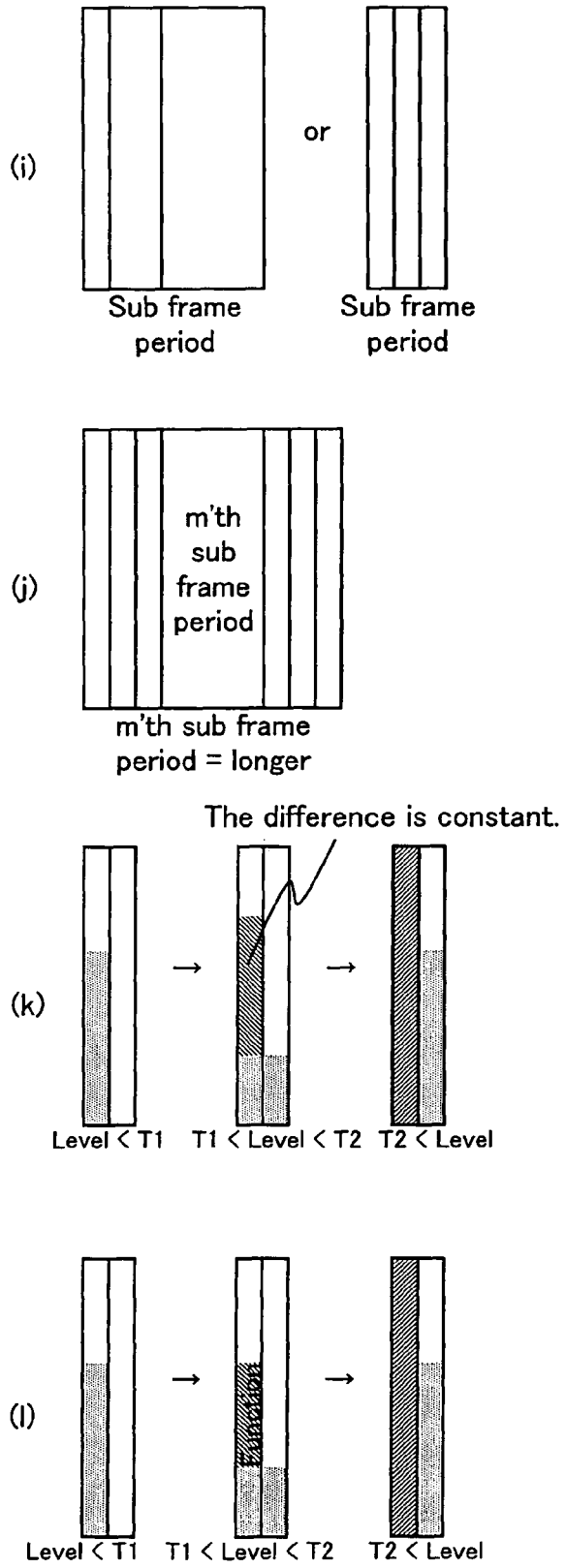

FIG. 69(*i*) show the case where the sub frame periods have different lengths. FIG. 69(*j*) shows the case where the sub frame periods have the same length. As the length of a sub frame period is shorter, a higher impulse effect is obtained. When the sub frame period is longer, the center of gravity of luminance tends to be closer to the longer sub frame period and does not move easily. Owing to such characteristics, the effect provided by the center of gravity of luminance and the impulse effect can be changed by, for example, increasing or decreasing a sub frame period at a prescribed position (e.g., the sub frame period at the time-wise center of one frame period). FIG. 69(*i*) is applicable to FIGS. 67(*a*) through 68(*h*). FIG. 69(*j*) is applicable to FIG. 67(*b*).

In FIG. 69(*k*), the method of allocation is substantially the same as that of FIG. 68(*e*) except for the following. In addition to the operation in FIG. 68(*e*), the luminance level is allocated such that the difference between the gradation levels or luminance levels allocated to the left sub frame period and the gradation level or luminance level allocated to the right sub frame period is constant. This will described below specifically.

One frame is divided into two sub frame periods. Reference values for allocating the gradation level, corresponding to the luminance level assumed for the input image signal, to the sub frame periods are the threshold levels T1 and T2. As shown in the left part of FIG. 69(*k*), the luminance level assumed for the input image signal is allocated, starting from one of the two sub frame periods (left in this example; as represented by dots). At this point, the gradation level of the input image signal<the threshold level T1. As shown in the central part of FIG. 69(*k*), when the gradation level corresponding to the luminance level assumed for the input image signal reaches the threshold level T1 in the left sub frame period, the luminance level is allocated also to the right sub frame period (as represented by dots). In more detail, the luminance level is allocated simultaneously to the left sub frame period and the right sub frame period at the same speed, such that the difference between the gradation levels or the luminance levels allocated to the left sub frame period and the right sub frame period is constant. At this point, the threshold level T1<the gradation level of the input image signal<the threshold level T2. As shown in the right part of FIG. 69(*k*), when the gradation level corresponding to the luminance level assumed for the input image signal reaches the threshold level T2 in the left sub frame period, the remaining luminance level is allocated to the right sub frame period (as represented by dots), and the allocation is completed. At this point, the threshold level T2<the gradation level of the input image signal.

In FIG. 69(*l*), the method of allocation is substantially the same as that of FIG. 69(*k*) except for the following. The luminance level is allocated to the left sub frame period and the right sub frame period, such that the difference between the gradation level or luminance level allocated to the left sub frame period and the gradation level or luminance level allocated to the right sub frame period is in accordance with a prescribed function. The function encompasses the constant value as the difference in the case of FIG. 69(*k*), and also encompasses a value obtained by multiplying the constant by a prescribed coefficient which defines a manner of allocation of the luminance level. FIG. 69(*l*) is applicable to FIG. 68(*e*) and FIG. 68(*f*).

Figure 70:
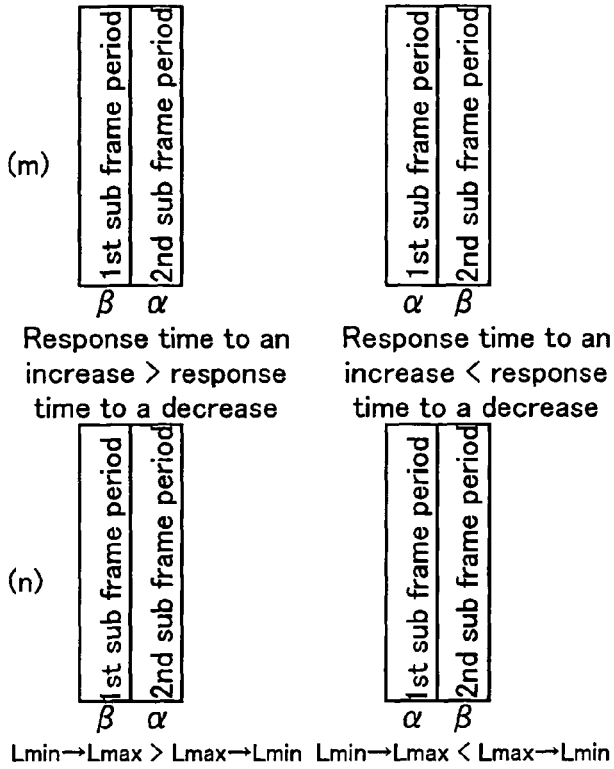
Figure 70:
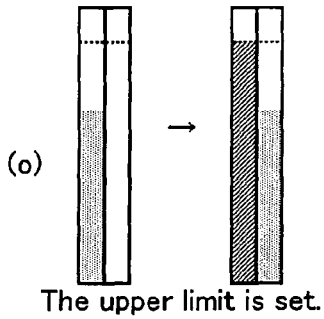
Figure 70:
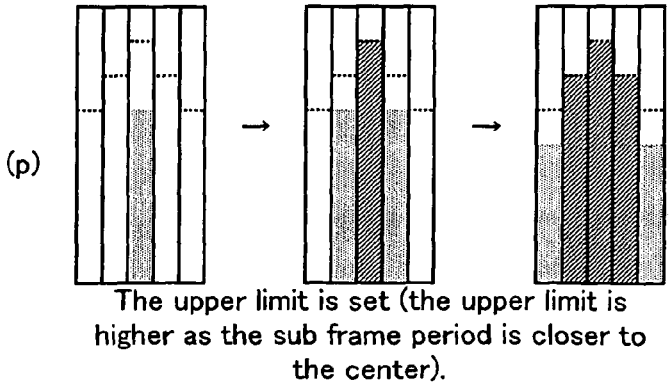

FIG. 70(*m*) is regarding the response speed of a liquid crystal material. In the case where the response time of the liquid crystal material to an increase in luminance is different from the response time of the liquid crystal material to a decrease in luminance, it is checked whether the allocation should start from the first sub frame period or from the second sub frame period in order to provide less harm. In this example, the allocation of the luminance level is started from the second sub frame period when the response time of the liquid crystal material to an increase in luminance>the response time of the liquid crystal material to a decrease in luminance. The allocation of the luminance level is started from the first sub frame period when the response time of the liquid crystal material to an increase in luminance<the response time of the liquid crystal material to a decrease in luminance. FIG. 70(*m*) is applicable to FIGS. 67(*d*) through 68(*h*).

Here, FIG. 70(*m*) is applied to FIG. 67(*d*). When the liquid crystal material to an increase in luminance>the response time of the liquid crystal material to a decrease in luminance, the luminance level assumed for the input image signal is allocated, starting from the second (right) sub frame period among the two sub frame periods (as represented by dots). At this point, the gradation level of the input image signal<the threshold level T. When the second sub frame period is filled with the luminance level, the luminance level is allocated to the first (left) sub frame period (as represented by dots). At this point, the threshold level T<the gradation level of the input image signal. When the liquid crystal material to an increase in luminance<the response time of the liquid crystal material to a decrease in luminance, the luminance level assumed for the input image signal is allocated, starting from the first (left) sub frame period among the two sub frame periods (as represented by dots). At this point, the gradation level of the input image signal<the threshold level T. When the first sub frame period is filled with the luminance level, the luminance level is allocated to the second (right) sub frame period (as represented by dots). At this point, the threshold level T<the gradation level of the input image signal.

FIG. 70(*n*) is the response speed of a display element. The maximum luminance level of the display element is Lmax, and the minimum luminance level of the display element is Lmin. In the case where the response time of the display element to a luminance switch from Lmax to Lmin is different from the response time of the display element to a luminance switch from Lmin to Lmax, it is checked whether the allocation should start from the first sub frame period or from the second sub frame period in order to provide less harm. In this example, the allocation of the luminance level is started from the second sub frame period when the response time of the display element to a luminance switch from Lmin to Lmax (the luminance is increased)>the response time of the display element to a luminance switch from Lmax to Lmin (the luminance is decreased). The allocation of the luminance level is started from the first sub frame period when the response time of the display element to a luminance switch from Lmin to Lmax (the luminance is increased)<the response time of the display element to a luminance switch from Lmax to Lmin (the luminance is decreased). FIG. 70(*n*) is applicable to FIGS. 67(*d*) through 68(*h*).

In FIG. 70(*o*), the upper limit L for the gradation level corresponding to the luminance level to be allocated to the sub frame periods is set. FIG. 70(*o*) is applicable to FIGS. 67(*a*) through 68(*h*).

For example, as in the case of FIG. 67(*d*), one frame is divided into two sub frame periods. A reference value for allocating the gradation level, corresponding to the luminance level assumed for the input image signal, to the sub frame periods is the threshold level T. The luminance level assumed for the input image signal is allocated, starting from one of the two sub frame periods (as represented by dots). At this point, the gradation level of the input image signal<the threshold level T. When the gradation level corresponding to the luminance level assumed for the input image signal reaches the upper limit L (as represented by hatching; the threshold level T), the luminance level is allocated to the other sub frame period (as represented by dots). At this point, the threshold level T<the gradation level of the input image signal.

In FIG. 70(*p*), the upper limits L1, L2 and L3 for the gradation level corresponding to the luminance level to be allocated to the sub frame periods are set. The upper limits L1, L2 and L3 are made higher as the sub frame period is closer to the time-wise center of one frame period. FIG. 70(*p*) is applicable to FIGS. 67(*a*) through 67(*a*).

For example, as in the case of FIG. 67(*b*), one frame is divided into n sub frame periods, where "n" is an odd number of 3 or greater. In this example, one frame is divided into 5 sub frame periods. The luminance level assumed for the input image signal is allocated, starting from the sub frame period which is at the time-wise center of one frame period (the third from the left in this example) for image display (as represented by dots). At this point, the gradation level of the input image signal<the threshold level T1. When the gradation level corresponding the luminance level in the central sub frame period reaches the highest upper limit L1 (as represented by hatching; the threshold level T1), the luminance level is simultaneously allocated to the sub frame period to the right of the central sub frame period and the sub frame period to the left of the central sub frame period (as represented by dots). At this point, the threshold level T1<the gradation level of the input image signal<the threshold level T2. When the gradation level corresponding to the luminance level in these sub frame periods reaches the second highest upper limit L2 (as represented by hatching; the threshold level T2), the luminance level is allocated to the sub frame period which is to the left of these sub frame periods and the sub frame period which is to the right of these sub frame periods (as represented by dots), until the gradation level corresponding to the luminance level in these sub frame periods reaches the lowest upper limit L3. At this point, the threshold level T2<the gradation level of the input image signal. The upper limit L3<the upper limit L2<the upper limit L1.

In FIG. 71(*q*), the upper limits L1 and L2 for the gradation level corresponding to the luminance level to be allocated to the sub frame periods are set, such that the upper limit L1 is higher than the upper limit L2. FIG. 71(*q*) is applicable to FIGS. 67(*d*) through 68(*h*).

For example, as in the case of FIG. 67(*d*), one frame is divided into two sub frame periods. A reference value for allocating the gradation level, corresponding to the luminance level assumed for the input image signal, to the sub frame periods is the threshold level T. The luminance level assumed for the input image signal is allocated, starting from one of the two sub frame periods (as represented by dots). At this point, the gradation level of the input image signal<the threshold level T. When the gradation level corresponding to the luminance level reaches the higher upper limit L1 (as represented by hatching; the threshold level T), the luminance level is allocated to the right sub frame period until the luminance level reaches the lower upper limit L2 (as represented by dots). At this point, the threshold level T<the gradation level of the input image signal. The lower upper limit L2>the higher upper limit L1.

By providing the upper limits L as in FIGS. 70(*o*) through 71(*q*), even when the gradation level of the input image signal is maximum, the luminance level in all the sub frame periods does not become 100%. Thus, the impulse effect can be provided as by the minimum (luminance) insertion system. In the case where the upper limit is higher as the sub frame period is closer to the time-wise center, the center of gravity of luminance is located at the center.

In FIG. 71(*r*), the method of allocation is substantially the same as that of FIG. 67(*a*) except for the following. The luminance level in each sub frame period is set such that the relationship between the luminance level assumed for the input image signal and the time-integrated luminance exhibits an appropriate gamma luminance characteristic.

More specifically, the luminance level to be allocated to each sub frame period is determined, such that: the number of sub frame periods to which the luminance level is allocated is increased or decreased in accordance with the gradation level of the input image signal, whereas the time-integrated luminance in one frame period always exhibits an appropriate gamma luminance characteristic with respect to the gradation level of the input image signal. Then, the gradation level which realizes such a luminance level is set.

In FIG. 71(*s*), in addition to the operation of FIG. 71(*r*), the threshold level of the gradation level, which acts as reference to the allocation of luminance level to each sub frame period is set, such that the time-integrated luminance in one frame period always exhibits an appropriate gamma luminance characteristic with respect to the gradation level of the input image signal.

According to the present invention, the following effects are provided in, for example, the field of an image display apparatus using a hold-type image display device such as a liquid crystal display device or an EL display device: the reduction in the maximum luminance and contrast is suppressed; the deterioration in quality caused by the time-wise center of gravity of the display luminance being different in accordance with the gradation level of an input image signal is minimized; and minimizing the deterioration of quality of moving images represented by afterimage and movement blur, while maintaining the compatibility in terms of gradation representation with an image signal which is generated so as to be output to image display devices having a general gamma luminance characteristic.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An image display apparatus, for performing one frame of image display by a sum of time-integrated values of luminance displayed in an image display section in n sub-frame periods (where n is an odd number of 3 or greater), wherein the image display section can arbitrarily control display luminance without changing the lengths of the n sub-frame periods, the image display apparatus comprising:

a display control section for performing the n sub-frame periods of image display control on the image display section in each one-frame period, wherein:

the sub-frame periods are referred to as a first sub-frame period, a second sub-frame period, the n'th sub-frame period from the sub-frame period which is earliest in terms of time or from the sub-frame period which is latest in terms of time, and the sub-frame period which is at a time-wise center of one frame period for image display is referred to as the m'th sub-frame period, where m=(n+1)/2;

(n+1)/2-number of threshold levels are provided for the gradation level of an input image signal, and the threshold levels are referred to as T1, T2, T[(n+1)/2] from the smallest threshold level;

when the gradation level of the input image signal is equal to or less than T1, the display control section supplies, to the image display section, an image signal of a gradation level which is increased or decreased in accordance with the gradation level of the input image signal in the m'th sub-frame period, and an image signal of a relatively smallest gradation level or an image signal lower than a prescribed value in the other sub-frame periods;

when the gradation level of the input image signal is greater than T1 and equal to or less than T2, the display control section supplies, to the image display section, an image signal of a relatively largest gradation level or an image signal of a gradation level greater than the prescribed value in the m'th sub-frame period, an image signal of a gradation level which is increased or decreased in accordance with the gradation level of the input image signal in each of the (m−1)'th sub-frame periods and the (m+1)'th sub-frame periods, and an image signal of the relatively smallest gradation level or an image signal of a gradation level lower then the prescribed value in the other sub-frame periods;

when the gradation level of the input image signal is greater than T2 and equal to or less than T3, the display control section supplies, to the image display section, an image signal of the relatively largest gradation level or an image signal of a gradation level greater than the prescribed value in each of the m'th sub-frame periods, the (m−1)'th sub-frame periods and the (m+1)'th sub-frame periods, an image signal of a gradation level which is increased or decreased in accordance with the gradation level of the input image signal in each of the (m−2)'th sub-frame periods and the (m+2)'th sub-frame periods, and an image signal of the relatively smallest gradation level or an image signal of a gradation level lower than the prescribed value in the other sub-frame periods; and when the gradation level of the input image signal is greater than Tx−1 (x is an integer of 4 or greater) and equal to or less than Tx, the display control section supplies, to the image display section, an image signal of the relatively largest gradation level or an image of a gradation level greater than the prescribed value in each of the [m−(x−2)]'th sub-frame periods through the [m+(x−2)]'th sub-frame period, an image signal of a gradation level which is increased or decreased in accordance with the gradation level of the input image signal in each of the [m−(x−1)]'th sub-frame periods through the [m+(x−1)]'th sub-frame period, and an image signal of the relatively smallest gradation level or an image signal of a gradation level lower than the prescribed value in the other sub-frame periods;

when the gradation of the input image signal is relatively smallest, the display control section supplies a relatively smallest gradation level to all the sub-frame periods; and the display control section is configured to obtain a time-integrated value of luminance of the frame representing a prescribed luminance characteristic by determining the gradation level of each of sub-frames and supplying the gradation level of each of the sub-frame periods such that the display luminance of each of the sub-frame periods is variably controlled to be variable between zero and a maximum luminance value, including values therebetween, wherein when n is 3, the display control section includes, a timing control section, a line data memory section for receiving and temporarily storing one horizontal line of image signal, a frame memory data selection section, controlled by the timing control section, to select (i) transferring data from the line data memory section to a frame data memory section, or (ii) outputting data which was input ¼ frame before and is read from the frame data memory section and outputting data which was input ¾ frame before and is read from the frame data memory section, a gradation conversion source selection section, controlled by the timing control section, to select (i) outputting the data from the line data memory section, or (ii) outputting the data which was input ¾ frame before and is supplied from the frame memory data selection section, a first gradation conversion section for converting the gradation level of the image signal from the frame memory data selection section to the relatively largest level or a gradation level greater than a prescribed value or to a gradation level which is increased or decreased by the gradation level of the input image signal, a second gradation conversion section for converting the gradation level of the image signal from the gradation conversion source selection section to the relatively smallest level or a gradation level lower than the prescribed value or to a gradation level which is increased or decreased by the gradation level of the input image signal, and an output data selection section, controlled by the timing control section, for selecting the image signal from the first gradation conversion section or the image signal from the second gradation conversion section, and supplying the selected image signal to the image display section.

* * * * *